US011102582B2

(12) United States Patent
Palmer et al.

(10) Patent No.: US 11,102,582 B2
(45) Date of Patent: Aug. 24, 2021

(54) AUDIO TRANSDUCERS AND DEVICES INCORPORATING THE SAME

(71) Applicant: Wing Acoustics Limited, Auckland (NZ)

(72) Inventors: David John Palmer, Auckland (NZ); Michael Ian Palmer, Auckland (NZ)

(73) Assignee: WING ACOUSTICS LIMITED, Auckland (NZ)

( * ) Notice: Subject to any disclaimer, the term of this patent is extended or adjusted under 35 U.S.C. 154(b) by 0 days.

(21) Appl. No.: 16/265,096

(22) Filed: Feb. 1, 2019

(65) Prior Publication Data

US 2019/0166430 A1 May 30, 2019

Related U.S. Application Data

(63) Continuation of application No. 15/707,164, filed on Sep. 18, 2017, now Pat. No. 10,244,325, which is a (Continued)

(30) Foreign Application Priority Data

Sep. 14, 2015 (NZ) ..... 712255
Sep. 14, 2015 (NZ) ..... 712256

(51) Int. Cl.
*H04R 7/04* (2006.01)
*H04R 7/24* (2006.01)

(Continued)

(52) U.S. Cl.
CPC ..... *H04R 7/24* (2013.01); *H04R 9/025* (2013.01); *H04R 9/06* (2013.01); *H04R 31/003* (2013.01);

(Continued)

(58) Field of Classification Search
CPC .. H04R 2440/00–07; H04R 1/08; H04R 9/08; H04R 11/04; H04R 17/02;

(Continued)

(56) References Cited

U.S. PATENT DOCUMENTS 1,035,577 A 8/1912 Grace
1,536,116 A 5/1925 Martin (Continued)

FOREIGN PATENT DOCUMENTS

CA 2 600 015 A1 9/2006
DE 3378456 12/1988

(Continued)

OTHER PUBLICATIONS

International Search Report and Written Opinion for Application No. PCT/IB2017/051519 dated Jun. 21, 2017, 20 pages.

(Continued)

*Primary Examiner* — Suhan Ni
(74) *Attorney, Agent, or Firm* — Alston & Bird LLP

(57) ABSTRACT

The invention relates to audio transducers, such as loudspeaker, microphones and the like, and includes improvements in or relating to hinge systems for rotational action audio transducers. The hinge systems of the invention being configured to operatively support a diaphragm in use, and comprising a hinge assembly having one or more hinge joints, wherein each hinge joint comprises a hinge element and a contact member. The contact member comprises a contact surface and the configuration is such that during operation each hinge joint is configured to allow the hinge element to move relative to the associated contact member, while maintaining a substantially consistent physical contact with the contact surface. The hinge assembly biases the hinge element towards the contact surface. Preferably the hinge assembly is configured to apply a biasing force to the (Continued)

hinge element of each joint toward the associated contact surface, compliantly. Various applications and implementations are described and envisaged for the audio transducer embodiments including, for example, personal audio devices such as headphones, earphones and the like.

36 Claims, 60 Drawing Sheets

Related U.S. Application Data continuation of application No. 15/265,442, filed on Sep. 14, 2016, now Pat. No. 9,800,980.

(51) Int. Cl.

| | |
|---|---|
| ***H04R 9/02*** | (2006.01) |
| ***H04R 9/06*** | (2006.01) |
| ***H04R 31/00*** | (2006.01) |
| *H04R 1/10* | (2006.01) |
| *H04R 15/00* | (2006.01) |
| *H04R 17/00* | (2006.01) |
| *H04R 19/01* | (2006.01) |

(52) U.S. Cl.
CPC ..... *H04R 1/1008* (2013.01); *H04R 1/1075* (2013.01); *H04R 15/00* (2013.01); *H04R 17/00* (2013.01); *H04R 19/013* (2013.01); *H04R 2307/023* (2013.01); *H04R 2307/027* (2013.01)

(58) Field of Classification Search
CPC ..... H04R 21/02; H04R 9/025; H04R 9/027; H04R 7/04
USPC ..... 381/152, 170–173, 178, 418–419, 431
See application file for complete search history.

(56) References Cited

U.S. PATENT DOCUMENTS 1,562,165 A 11/1925 Harrison
1,579,864 A 4/1926 Hobart, Jr.
1,614,327 A 1/1927 Thomas
1,633,170 A 6/1927 Fischer
1,683,946 A 9/1928 Baldwin
1,693,223 A 11/1928 Danziger et al.
1,786,465 A 12/1930 Wagenen
1,821,547 A 9/1931 Hartley
2,035,104 A 3/1936 Thomas
2,049,784 A 8/1936 Thomas
2,075,774 A 3/1937 Allen
2,077,170 A 4/1937 Harrison
2,078,469 A 4/1937 Thomas
2,085,198 A 6/1937 Lindsay
2,239,837 A 4/1941 Bottorff
2,278,966 A 4/1942 Williams
2,304,022 A 12/1942 Sanders, Jr.
3,578,921 A 5/1971 Knauert
3,761,956 A 9/1973 Takahashi et al.
4,182,937 A 1/1980 Greenwood
4,239,090 A 12/1980 Dahlquist
4,313,040 A * 1/1982 Tsukamoto ..... H04R 7/10 381/425
4,385,210 A 5/1983 Marquiss
4,426,552 A 1/1984 Cowans et al.
4,430,529 A 2/1984 Nakagawa et al.
4,593,160 A 6/1986 Nakamura
4,628,907 A 12/1986 Epley
4,763,358 A 8/1988 Danley
5,140,641 A 8/1992 Danley et al.
5,191,618 A 3/1993 Hisey
5,255,328 A 10/1993 Akiniwa et al.
5,313,127 A 5/1994 Danley et al.
5,317,642 A 5/1994 Danley et al.
5,633,552 A 5/1997 Lee et al.
5,660,397 A 8/1997 Holtkamp
5,694,476 A 12/1997 Klippel
5,704,613 A 1/1998 Holtkamp
5,802,189 A 9/1998 Blodget
5,825,901 A 10/1998 Hisey
5,848,173 A 12/1998 Sato et al.
5,872,853 A 2/1999 Marquiss
6,097,829 A 8/2000 Guenther et al.
6,151,402 A 11/2000 Azima et al.
6,160,898 A 12/2000 Bachmann et al.
6,192,136 B1 2/2001 Azima et al.
6,347,149 B1 2/2002 Bachmann et al.
6,384,550 B1 5/2002 Miyakawa et al.
6,466,682 B2 10/2002 An
6,560,348 B1 5/2003 Bachmann et al.
6,567,525 B1 5/2003 Sapiejewski
6,748,090 B1 6/2004 Bachmann et al.
6,985,596 B2 1/2006 Bank et al.
7,088,839 B2 8/2006 Geschiere et al.
7,206,428 B2 4/2007 Geschiere et al.
7,302,068 B2 * 11/2007 Longbottom ..... H04R 17/00 381/152
7,369,674 B2 5/2008 Miura
7,403,632 B2 7/2008 Goldberg
7,471,805 B2 12/2008 Goldberg
7,729,504 B2 6/2010 Tsuda et al.
7,747,035 B1 6/2010 Heavner
7,860,265 B2 12/2010 Gaudreault
8,014,556 B2 9/2011 Goldberg
8,023,668 B2 9/2011 Pfaffinger
8,064,630 B2 11/2011 Goldberg
8,073,162 B2 * 12/2011 Ando ..... H04R 1/403 381/152
8,073,181 B2 12/2011 Bakalos et al.
8,073,187 B2 12/2011 Hashimoto et al.
8,085,955 B2 12/2011 Henry
8,116,508 B2 2/2012 Xu et al.
8,131,005 B2 3/2012 Lemarquand et al.
8,139,813 B2 3/2012 Kobayashi et al.
8,144,380 B2 3/2012 Takeuchi
8,280,096 B2 10/2012 Milot
8,295,536 B2 10/2012 Carlmark et al.
8,295,537 B2 10/2012 Carlmark et al.
8,457,344 B2 6/2013 Kobayashi et al.
8,659,211 B1 2/2014 Butler et al.
8,705,774 B2 4/2014 Jilani et al.
8,965,024 B2 2/2015 Graham
9,247,365 B1 1/2016 Ellis et al.
10,244,325 B2 3/2019 Palmer et al.
2002/0122560 A1 9/2002 An
2002/0146141 A1 10/2002 Geschiere et al.
2004/0062404 A1 4/2004 Negishi et al.
2004/0202338 A1 10/2004 Longbotttom et al.
2005/0180592 A1 8/2005 Miura
2005/0269906 A1 12/2005 Allan et al.
2006/0028751 A1 2/2006 Takeuchi
2006/0198541 A1 * 9/2006 Henry ..... H04R 9/02 381/152
2006/0239488 A1 10/2006 Geschiere et al.
2007/0258617 A1 11/2007 Henry
2007/0263886 A1 11/2007 Starnes et al.
2008/0025533 A1 1/2008 Livingstone et al.
2008/0069385 A1 3/2008 Revit
2008/0232636 A1 9/2008 Thurber et al.
2008/0247595 A1 10/2008 Henry
2009/0028374 A1 1/2009 Hashimoto et al.
2009/0034780 A1 * 2/2009 Gaudreault ..... H04R 9/063 381/424
2009/0226028 A1 9/2009 Suganuma
2011/0069859 A1 3/2011 Kobayashi et al.
2011/0243365 A1 10/2011 Carlmark et al.
2011/0243366 A1 10/2011 Carlmark et al.
2011/0261979 A1 10/2011 Yang et al.
2011/0299716 A1 12/2011 Reckert
2012/0033818 A1 2/2012 De Poortere
2012/0045073 A1 2/2012 Kobayashi et al.
2012/0257778 A1 10/2012 Hall et al.
2014/0003624 A1 1/2014 Stromback

(56) References Cited

U.S. PATENT DOCUMENTS

| | | | | |
|---|---|---|---|---|
| 2014/0049983 | A1* | 2/2014 | Nichol | G02B 6/0028 362/610 |
| 2014/0140559 | A1 | 5/2014 | Graham | |
| 2014/0254805 | A1 | 9/2014 | Su et al. | |
| 2014/0321668 | A1 | 10/2014 | Kimura et al. | |
| 2014/0369519 | A1 | 12/2014 | Leschka et al. | |
| 2015/0281830 | A1 | 10/2015 | Gauger, Jr. et al. | |
| 2016/0337747 | A1 | 11/2016 | Litovsky et al. | |
| 2016/0373858 | A1 | 12/2016 | Lawrence et al. | |
| 2017/0078798 | A1 | 3/2017 | Palmer et al. | |
| 2018/0014115 | A1 | 1/2018 | Crosby et al. | |

FOREIGN PATENT DOCUMENTS

| | | | |
|---|---|---|---|
| DE | 3908402 | A1 | 9/1990 |
| EP | 0 114 910 | A1 | 8/1984 |
| EP | 0 114 910 | B1 | 11/1988 |
| EP | 0 609 873 | A2 | 8/1994 |
| EP | 0 609 873 | A3 | 8/1994 |
| EP | 0 701 386 | A2 | 3/1996 |
| EP | 0 720 810 | A1 | 7/1996 |
| EP | 0 735 795 | A2 | 10/1996 |
| EP | 1 248 496 | A2 | 10/2002 |
| EP | 0 735 795 | A3 | 7/2003 |
| EP | 1 248 496 | A3 | 11/2005 |
| EP | 1 752 016 | A1 | 2/2007 |
| EP | 1 854 332 | A2 | 11/2007 |
| EP | 1 940 199 | A1 | 7/2008 |
| EP | 2 023 657 | A2 | 2/2009 |
| EP | 1 752 016 | B1 | 2/2010 |
| EP | 2 124 480 | B1 | 3/2012 |
| EP | 2 023 657 | A3 | 6/2013 |
| GB | 325543 | A | 2/1930 |
| JP | S 54-103340 | A | 8/1979 |
| JP | S54147028 | A | 11/1979 |
| JP | S5553996 | A | 4/1980 |
| JP | S5555696 | A | 4/1980 |
| JP | S 56-131298 | A | 10/1981 |
| JP | S 58-151200 | A | 9/1983 |
| JP | S59161996 | A | 9/1984 |
| JP | S59191998 | A | 10/1984 |
| JP | S60259086 | A | 12/1985 |
| JP | S60259087 | A | 12/1985 |
| JP | S60259089 | A | 12/1985 |
| JP | S60259090 | A | 12/1985 |
| JP | S60259095 | A | 12/1985 |
| JP | S619098 | A | 1/1986 |
| JP | S61103393 | A | 5/1986 |
| JP | S 61-157000 | A | 7/1986 |
| JP | S61144200 | A | 7/1986 |
| JP | S 61-214897 | A | 9/1986 |
| JP | S6253099 | A | 3/1987 |
| JP | 64-29098 | A | 1/1989 |
| JP | H01264098 | A | 10/1989 |
| JP | H04357799 | A | 12/1992 |
| JP | H 05-236595 | A | 9/1993 |
| JP | H06217390 | A | 8/1994 |
| JP | 62-53099 | A | 9/1994 |
| JP | H09084179 | A | 3/1997 |
| JP | H09084181 | A | 3/1997 |
| JP | H09084182 | A | 3/1997 |
| JP | H09084186 | A | 3/1997 |
| JP | H0998496 | A | 4/1997 |
| JP | H09098497 | A | 4/1997 |
| JP | H09233582 | A | 9/1997 |
| JP | H09275289 | A | 10/1997 |
| JP | H10066194 | A | 3/1998 |
| JP | H 11-355876 | A | 12/1999 |
| JP | H11355876 | A | 12/1999 |
| JP | 2002-354853 | A | 12/2002 |
| JP | 2004-200745 | A | 7/2004 |
| JP | 2004-274206 | A | 9/2004 |
| JP | 2005-260510 | A | 9/2005 |
| JP | 2005-311951 | A | 11/2005 |
| JP | 2005-328209 | A | 11/2005 |
| JP | 2006-013671 | A | 1/2006 |
| JP | 38-63884 | B2 | 12/2006 |
| JP | 2008-532422 | A | 8/2008 |
| JP | 2009-098496 | A | 5/2009 |
| JP | 2009-219067 | A | 9/2009 |
| JP | 2010-050764 | A | 3/2010 |
| JP | 2010-263362 | A | 11/2010 |
| JP | 2010-263363 | A | 11/2010 |
| JP | 2011-228863 | A | 11/2011 |
| JP | 2013-090309 | A | 5/2013 |
| JP | 2013-232872 | A | 11/2013 |
| WO | WO 1994/019914 | A1 | 9/1994 |
| WO | WO 2003/001841 | A2 | 1/2003 |
| WO | WO 2004/030407 | A2 | 4/2004 |
| WO | WO 2005/104614 | A1 | 11/2005 |
| WO | WO 2005/104617 | A1 | 11/2005 |
| WO | WO 2006/069056 | A2 | 6/2006 |
| WO | WO 2006/093876 | A2 | 9/2006 |
| WO | WO 2007/034781 | A1 | 3/2007 |
| WO | WO 2011/123265 | A1 | 10/2011 |
| WO | WO 2011/123266 | A1 | 10/2011 |
| WO | WO 2011/123266 | A9 | 3/2013 |
| WO | WO 2014/041613 | A1 | 3/2014 |
| WO | WO 2015/128237 | A1 | 9/2015 |
| WO | WO 2017/046716 | A1 | 3/2017 |
| WO | WO 2018/167538 | A1 | 9/2018 |

OTHER PUBLICATIONS

Borwick, J., Loudspeaker and Headphone Handbook, 3rd Revised Edition (Mar. 27, 2001), 733 pages.

Gerog Neumann GmbH, The Dummy Head-Theory and Practice, Brochure, Berlin, 28 pages (undated).

Hammershoi, D. et al., Determination of Noise Emission From Sound Sources Close to the Ears, Acta Acustica, vol. 94, No. 1 (Jan. 2008) 114-129.

Olive, S. E. et al., Factors That Influence Listeners' Preferred Base and Treble Balance in Headphones, AES Convention Paper 9382 Presented at the 139th Convention (Oct.-Nov. 2015) 12 pages.

International Search Report and Written Opinion for Application No. PCT/IB2018/051881 dated Jul. 3, 2018, 11 pages.

Extended European Search Report for European Application No. 16845811.5 dated Apr. 5, 2019.

Fern Acoustics [online][retrieved Jan. 29, 2018]. Retrieved from the Internet: <URL: http://www.fertinacoustics.com/en_tecnology.html>. 3 pages.

International Search Report and Written Opinion for Application No. PCT/IB2016/055472 dated Jan. 3, 2017.

* cited by examiner

SECTION B-B

AUDIO TRANSDUCERS AND DEVICES INCORPORATING THE SAME

CROSS-REFERENCE TO RELATED APPLICATIONS

This application is a continuation of U.S. patent application Ser. No. 15/707,164, filed on Sep. 18, 2017, which is a continuation of U.S. patent application Ser. No. 15/265,442, filed on Sep. 14, 2016, which claims priority to New Zealand Patent Application Serial Nos. 712255 and 712256, both filed on Sep. 14, 2015, the contents of each of which are incorporated by reference herein in their entirety.

FIELD OF THE INVENTION

The present invention relates to audio transducer technologies, and in particular to hinge systems for audio transducers and to audio transducer and audio devices incorporating the same.

BACKGROUND TO THE INVENTION

Loudspeaker drivers are a type of audio transducer that generate sound by oscillating a diaphragm using an actuating mechanism that may be electromagnetic, electrostatic, piezoelectric or any other suitable moveable assembly known in the art. The driver is generally contained within a housing. In conventional drivers, the diaphragm is a flexible membrane component coupled to a rigid housing. Loudspeaker drivers therefore form resonant systems where the diaphragm is susceptible to unwanted mechanical resonance (also known as diaphragm breakup) at certain frequencies during operation. This affects the driver performance.

An example of a conventional loudspeaker driver is shown in FIGS. 15A and 15B. The driver comprises a diaphragm assembly mounted by a diaphragm suspension system to a transducer base structure. The transducer base structure comprises a basket J113, magnet J116, top pole piece J118, and T-yoke J117. The diaphragm assembly comprises a thin-membrane diaphragm, a coil former J114 and a coil winding J115. The diaphragm comprises of cone J101 and cap J120. The diaphragm suspension system comprises of a flexible rubber surround J105 and a spider J119. The transducing mechanism comprises a force generation component being the coil winding held within a magnetic circuit. The transducing mechanism also comprises the magnet J116, top pole piece J118, and T-yoke J117 that directs the magnetic circuit through the coil. When an electrical audio signal is applied to the coil, a force is generated in the coil, and a reaction force, is applied to the base structure.

The driver is mounted to a housing J102 via a mounting system consisting of multiple washers J111 and bushes J107 made of flexible natural rubber. Multiple steel bolts J106, nuts J109 and washers J108 are used to fasten the driver. There is a separation J112 between the basket J113 and the housing J102 and the configuration is such that the mounting system is the only connection between the housing J102 and the driver. In this example, the diaphragm moves in a substantially linear manner, back and forth in the direction of the axis of the cone shaped diaphragm, and without significant rotational component.

As mentioned, the flexible diaphragm coupled to the rigid housing J102, via the suspension and mounting system, forms a resonant system, where the diaphragm is susceptible to unwanted resonances over the driver's frequency range of operation. Also, other parts of the driver including the diaphragm suspension and mounting systems and even the housing can suffer from mechanical resonances which can detrimentally affect the sound quality of the driver. Prior art driver systems have thus attempted to minimize the effects of mechanical resonance by employing one or more damping techniques within the driver system. Such techniques comprise for example impedance matching of the diaphragm to a rubber diaphragm surround and/or modifying diaphragm design, including diaphragm shape, material and/or construction.

Many microphones have the same basic construction as loudspeakers. They operate in reverse transducing sound waves into an electrical signal. To do this, microphones use sound pressure in the air to move a diaphragm, and convert that motion into an electrical audio signal. Microphones therefore have similar constructions to loudspeaker drivers and suffer some equivalent design issues including mechanical resonances of the diaphragm, diaphragm surround and other parts of the transducer and even the housing within which the transducer is mounted. These resonances can detrimentally affect the transducing quality.

Passive radiators also have the same basic construction as loudspeakers, except they do not have a transducing mechanism. They therefore suffer from some equivalent design issues creating mechanical resonances which can all detrimentally affect operation.

Over many decades a tremendous amount of research has been conducted into ways of minimising the effect of diaphragm and diaphragm suspension breakup resonance modes in conventional cone and dome-diaphragm loudspeaker drivers. Comparatively little equivalent research appears to have been conducted into improvement and optimisation of breakup performance, diaphragm excursion and fundamental diaphragm resonance frequency in rotational action loudspeaker diaphragms and diaphragm suspensions.

The conventional diaphragm suspension system consisting of both a standard flexible rubber type surround and a flexible spider suspension, limits diaphragm excursion, increases the diaphragm fundamental resonance frequency and introduces resonance. The soft materials used and the range of motion that they are used in is typically non-linear, with respect to Hooke's law, leading to inaccuracies in transducing an audio signal.

Rotational-action diaphragm loudspeakers have not been notable for providing clean performance in terms of energy storage as measured by a waterfall/CSD plot, nor have they been notable for providing audiophile sound quality, particularly in the mid-range and treble frequency bands.

The base structures of these drivers and conventional loudspeaker drivers are often prone to adverse resonance modes within their frequency range of operation, and these modes can be excited by the driver motor and amplified by the diaphragm, especially if the diaphragm suspension system incorporates some rigidity.

It is an object of the present invention to provide improvements in or relating to hinge systems associated with audio transducers which work in some way towards addressing some of the resonance issues mentioned above or to at least provide the public with a useful choice.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

In another aspect, the present invention may broadly be said to consist of an audio transducer comprising:

- a diaphragm having a diaphragm body that remains substantially rigid during operation;
- a hinge system configured to operatively support the diaphragm in use, and comprising a hinge assembly having one or more hinge joints, wherein each hinge joint comprises a hinge element and a contact member, the contact member having a contact surface; and
- wherein, during operation each hinge joint is configured to allow the hinge element to move relative to the associated contact member while maintaining a substantially consistent physical contact with the contact surface, and the hinge assembly biases the hinge element towards the contact surface.

Preferably the audio transducer further comprises a transducer base structure and the hinge assembly rotatably couples the diaphragm to the transducer base structure to enable the diaphragm to rotate during operation about an axis of rotation or approximately axis of rotation of the hinge assembly. Preferably the diaphragm oscillates about the axis of rotation during operation.

Preferably the substantially consistent physical contact comprises a substantially consistent force.

Preferably the hinge assembly is configured to apply a biasing force to the hinge element of each joint toward the associated contact surface, compliantly.

Preferably the diaphragm has a substantially rigid diaphragm body.

Preferably, hinge assembly further comprises a biasing mechanism and wherein the hinge element is biased towards the contact surface by a biasing mechanism.

In one form, the biasing mechanism applies a biasing force in a direction with an angle of less than 25 degrees, or less than 10 degrees, or less than 5 degrees to an axis perpendicular to the contact surface in the region of contact between each hinge element and the associated contact member during operation.

Preferably, the biasing mechanism applies a biasing force in a direction substantially perpendicular to the contact surface at the region of contact between each hinge element and the associated contact member during operation.

Preferably the biasing mechanism is substantially compliant. Preferably the biasing mechanism is substantially compliant in a direction substantially perpendicular to the contact surface at the region of contact between each hinge element and the associated contact member during operation.

Preferably the biasing mechanism is substantially compliant. Preferably the biasing mechanism is substantially compliant in terms of that it applies a biasing force as opposed to a biasing displacement, in a direction substantially perpendicular to the contact surface at the region of contact between each hinge element and the associated contact member during operation.

Preferably the biasing mechanism is substantially compliant. Preferably the biasing mechanism is substantially compliant in terms of that the biasing force does not change greatly if, in use, the hinge element shifts slightly in a direction substantially perpendicular to the contact surface at the region of contact between each hinge element and the associated contact member during operation.

Preferably the contact between the hinge element and the contact member substantially rigidly restrains the hinge element against translational movements relative to the contact member in a direction perpendicular to the contact surface at the region of contact during operation.

In one embodiment the biasing mechanism is separate to the structure that rigidly restrains the hinge element against translational movements relative to the contact member in a direction perpendicular to the contact surface at the region of contact between each hinge element and the associated contact member.

In one embodiment the diaphragm comprises the biasing mechanism.

Preferably when additional forces are applied to the hinge element and the vector representing the net force passes through the location of the hinge elements physical contact with the contact surface, and when the net force is small compared to the biasing force, the consistent physical contact between the hinge element and the contact member rigidly restrains the contacting part of the hinge element against translational movements relative to the transducer base structure, where the hinge element contacts the contact member, in a direction perpendicular to the contact surface at the point of contact.

Preferably when additional forces are applied to the hinge element and the vector representing the net force passes through the location of the hinge elements physical contact with the contact surface, and when the net force is small compared to the biasing force, the consistent physical contact between the hinge element and the contact member effectively rigidly restrains the contacting part of the hinge element against all translational movements relative to the transducer base structure at the point of contact.

Preferably the biasing mechanism is sufficiently compliant such that:

- when the diaphragm is at a neutral position during operation; and
- an additional force is applied to the hinge element from the contact member, in a direction through the a region of contact of the hinge element with the contact surface that is perpendicular to the contact surface; and the additional force is relatively small compared to the biasing force so that no separation between the hinge element and contact member occurs;

- the resulting change in a reaction force exerted by the contact member on the hinge element is larger than the resulting change in the force exerted by the biasing mechanism.

Preferably the resulting change is at least four times larger, more preferably at least 8 times larger and most preferably at least 20 times larger.

Preferably the biasing structure compliance excludes compliance associated with and in the region of contact between non-joined components within the biasing mechanism, compared to the contact member.

Preferably the diaphragm body maintains a substantially rigid form over the FRO of the transducer, during operation.

Preferably the diaphragm is rigidly connected with the hinge assembly.

Preferably the diaphragm maintains a substantially rigid form over the FRO of the transducer, during operation.

In some embodiments the diaphragm comprises a single diaphragm body. In alternative embodiments the diaphragm comprises a plurality of diaphragm bodies.

Preferably the contact between the hinge element and the contact member rigidly restrains the hinge element against all translational movements relative to the contact member.

Preferably the axis of rotation coincides with the contact region between the hinge element and the contact surface of each hinge joint.

In one configuration one or more components of the hinge assembly is rigidly connected to the transducer base structure.

Preferably the hinge element is rigidly connected as part of the diaphragm.

Preferably, the contact member is rigidly connected as part of the transducer base structure.

Preferably one of either the hinge element and the contact member is rigidly connected as part of the diaphragm and the other is rigidly connected as part of the transducer base structure.

Preferably, in a region of contact between each hinge element and the associated contact surface, one of the hinge element and the contact member is effectively rigidly connected to the diaphragm, and the other is effectively rigidly connected to the transducer base structure.

In one embodiment the substantially consistent physical contact comprises a substantially consistent force and in a region of contact between each hinge element and the associated contact surface, one of the hinge element and the contact member is effectively rigidly connected to the diaphragm, and the other is effectively rigidly connected to the transducer base structure. Preferably the hinge assembly is configured to apply a biasing force to the hinge element of each joint toward the associated contact surface, compliantly. Preferably the hinge assembly is configured to apply a biasing force to the hinge element of each joint toward the associated contact surface, compliantly.

Preferably the diaphragm body comprises a maximum thickness that is greater than 15% of a length from the axis of rotation to an opposing, most distal, terminal end of the diaphragm, or more preferably greater than 20%.

Preferably the diaphragm body is in close proximity to or in contact with the contact surface.

Preferably the distance from the diaphragm body to the contact surface is less than half a total distance from the axis of rotation to a furthest periphery of the diaphragm body, or more preferably less than ¼ of the total distance, or more preferably less than ⅛ the total distance, or most preferably less than 1/16 of the total distance.

Preferably at all times during normal operation a region of the contact member of each hinge joint that is in close proximity to the contact surface is effectively rigidly connected to the transducer base structure.

Preferably at all times during normal operation a region of contact between the contact surface and the hinge element of each hinge joint is effectively substantially immobile relative to both the diaphragm and the transducer base structure in terms of translational displacements.

Preferably one of the diaphragm and transducer base structure is effectively rigidly connected to at least a part of the hinge element of each hinge joint in the immediate vicinity of the contact region, and the other of the diaphragm and transducer base structure is effectively rigidly connected to at least a part of the contact member of each hinge joint in the immediate vicinity of the contact region.

Preferably whichever of the contact member or hinge element of each hinge joint that comprises a smaller contact surface radius, in cross-sectional profile in a plane perpendicular to the axis of rotation, is less than 30%, more preferably less than 20%, and most preferably less than 10% of a greatest length from the contact region, in a direction perpendicular to the axis of rotation, across all components effectively rigidly connected to a localised part of the component which is immediately adjacent to the contact region.

Preferably whichever of the contact member or hinge element of each hinge joint that comprises a smaller contact surface radius, in cross-sectional profile in a plane perpendicular to the axis of rotation, is less than 30%, more preferably less than 20%, and most preferably less than 10% of a distance, in a direction perpendicular to the axis of rotation, across the smaller out of:

The maximum dimension across all components effectively rigidly connected to the part of the contact member immediately adjacent to the point of contact with the hinge assembly, and:

The maximum dimension across all components effectively rigidly connected to the part of the hinge element immediately adjacent to the point of contact with the contact member.

Preferably the hinge element of each hinge joint comprises a radius at the contact surface that is less than 30%, more preferably less than 20%, and most preferably less than 10% of: a length from the contact region, in a direction perpendicular to the axis of rotation to a terminal end of the diaphragm, and/or a length of the diaphragm body. Alternatively the contact member of each hinge joint comprises a radius at the contact surface that is less than 30%, more preferably less than 20%, and most preferably less than 10% of: a length from the contact region, in a direction perpendicular to the axis of rotation to a terminal end of the transducer base structure, and/or a length of the transducer base structure.

In some configurations, the hinge assembly comprises a single hinge joint to rotatably couple the diaphragm to the transducer base structure. In some configurations, the hinge assembly comprises multiple hinge joints, for example two hinge joints located at either side of the diaphragm.

Preferably, the hinge element is embedded in or attached to an end surface of the diaphragm, the hinge element is arranged to rotate or roll on the contact surface while maintaining a consistent physical contact with the contact surface to thereby enable the movement of the diaphragm.

Preferably the hinge joint is configured to allow the hinge element to move in a substantially rotational manner relative to the contact member.

Preferably the hinge element is configured to roll against the contact member with insignificant sliding during operation.

Preferably the hinge element is configured to roll against the contact member with no sliding during operation.

Alternatively the hinge element is configured to rub or twist on the contact surface during operation.

Preferably the hinge assembly is configured such that contact between the hinge element and the contact member rigidly restrains some point in the hinge element, that is located at or else in close proximity to the region of contact, against all translational movements relative to the contact member.

Preferably one of the hinge element or the contact member comprises a convexly curved contact surface, in at least a cross-sectional profile along a plane perpendicular to the axis of rotation, at the region of contact.

Preferably the other of the hinge element or the contact member comprises a concavely curved contact surface, in at least a cross-sectional profile along a plane perpendicular to the axis of rotation, at the region of contact.

Preferably one of the hinge element or the contact member comprises a contact surface having one or more raised portions or projections configured to prevent the other of the hinge element or contact member from moving beyond the raised portion or projection when an external force is exhibited or applied to the audio transducer.

In one form the hinge element comprises the convexly curved contact surface, and the contact member comprises the concavely curved contact surface. In an alternative form the hinge element comprises the concavely curved contact surface, and the contact member comprises the convexly curved contact surface.

In one form, the hinge element comprises at least in part a concave or a convex cross-sectional profile, when viewed in a plane perpendicular to the axis of rotation, where it makes the physical contact with the contact surface.

In one form, the hinge element comprises at least in part a convex cross-sectional profile, when viewed in a plane perpendicular to the axis of rotation, and the contact surface profile is substantially flat in the same plane, or vice versa.

In another form, the hinge element comprises at least in part a concave cross-sectional profile, when viewed in a plane perpendicular to the axis of rotation and the contact surface comprises a convex cross-sectional profile in a plane perpendicular to the axis of rotation where the physical contact is made, wherein the hinge element and the contact surface are arranged to rock or roll relative to each other along the concave and the convex surfaces in use.

In another form, the hinge element comprises at least in part a convex cross-sectional profile, when viewed in a plane perpendicular to the axis of rotation and the contact surface comprises a convex cross-sectional profile in a plane perpendicular to the axis of rotation, to allow the hinge element and the contact surface to rock or roll relative to each other in use along the surfaces.

In another form a first element of the hinge element or the contact member comprises a convexly curved contact in at least across-sectional profile along a plane perpendicular to the axis of rotation, and the other second element of the hinge element and the contact member, comprises a contact surface having a central region that is substantially planar, or that comprises a substantially large radius, and is sufficiently wide such that the first element is centrally located and does not move substantially beyond the substantially planar central region during normal operation, and has, when viewed in cross-sectional profile in a plane perpendicular to the axis of rotation, one or more raised portions configured to re-centralise the first element towards the substantially central region when an external force is exhibited.

The raised portions may be raised edge portions.

Alternatively the central region is concave to gradually recentralize the first element during normal operation or when an external force is exhibited.

Preferably the first element is the hinge element and the second element is the contact member.

Preferably whichever out of the hinge element and the contact surface that comprises a convexly curved contact surface with a relatively smaller radius of curvature in a cross-sectional profile along a plane perpendicular to the axis of rotation, has a radius r in metres satisfying the relationship:

$$r > \frac{E \cdot l}{1000{,}000{,}000} \times (2\pi f)^2;$$

and/or has a radius r in metres satisfying the relationship:

$$r < \frac{E \cdot l}{1000{,}000{,}000} \times (2\pi f)^2$$

where l is the distance in metres from the axis of rotation of the hinge element relative to the contact member to the most distal part of the diaphragm, f is the fundamental resonance frequency of the diaphragm in Hz, and E is preferably in the range of 50-140, for example E is 140, more preferably is 100, more preferably again is 70, even more preferably is 50, and most preferably is 40.

In one form, the biasing mechanism uses a magnetic mechanism or structure to bias or urge the hinge element towards the contact surface of the contact member.

Preferably the hinge element comprises, or consists of, a magnetic element or body.

Preferably the magnetic element or body is incorporated in the diaphragm.

Preferably the magnetic element or body is a ferromagnetic steel shaft coupled to or otherwise incorporated within the diaphragm at an end surface of the diaphragm body.

Preferably, the shaft has a substantially cylindrical profile.

Preferably, the approximately cylindrical profile of the shaft has a diameter of approximately between 1-10 mm.

In one form, the portion of the shaft that makes the physical contact with the contact surface comprises a convex profile with a radius of approximately between 0.05 mm and 0.15 mm.

In some embodiments, the biasing mechanism may comprise a first magnetic element that contacts or is rigidly connected to the hinge element, and also a second magnetic element, wherein the magnetic forces between the first and the second magnetic elements biases or urges the hinge element towards the contact surface so as to maintain the consistent physical contact between the hinge element and the contact surface in use.

The first magnetic element may be a ferromagnetic fluid.

The first magnetic element may be a ferromagnetic fluid located near an end of the diaphragm body.

The second magnetic element may be a permanent magnet or an electromagnet.

Alternatively the second magnetic element may be a ferromagnetic steel part that is coupled to or embedded in the contact surface of the contact member.

Preferably, the contact member is located between the first and the second magnetic elements.

In some embodiments, the biasing mechanism comprises a mechanical mechanism to bias or urge the hinge element towards the contact surface of the contact member.

In one form, the biasing mechanism comprises a resilient element or member which biases or urges the hinge element towards the contact surface.

Preferably the resilient element is a steel flat spring.

Alternatively or in addition the biasing mechanism may comprise rubber bands in tension, rubber blocks in compression, and ferromagnetic-fluid attracted by a magnet.

Preferably the hinge joint also comprises a fixing structure for locating the hinge element at a desired operative and physical location relative to the contact member.

In one form, the fixing structure is a mechanical fixing assembly which comprises fixing members such as pins coupled to each end of the hinge element, and one or more strings which each have one end coupled to a fixing member, and then another end coupled to the contact member, wherein the intermediate portion of the string is arranged to curve around a cross section of the hinge element to thereby maintain the hinge element at the desired operative and physical location relative to the contact member.

In one form, the fixing structure is a mechanical fixing assembly which comprises one or more thin, flexible elements having one end fixed, either directly or indirectly, to an end of the hinge element, and then another end coupled to the contact member, wherein the intermediate portion of the string is arranged to curve around a cross section of the hinge element or a component rigidly attached to the hinge element to thereby maintain the hinge element at the desired operative and physical location relative to the contact member.

Preferably the thin flexible element is string, most preferably multi-strand string.

Preferably the thin, flexible element exhibits low creep.

Preferably the thin, flexible element exhibits high resistance to abrasion.

Preferably the thin, flexible element is an aromatic polyester fibre such as Vectran™ fibre.

In one form, the fixing structure is a mechanical fixing assembly which comprises one or more strings having one end fixed, either directly or indirectly, to an end of the hinge element, and then another end coupled to the contact member, wherein the intermediate portion of the string is arranged to curve around a cross section of whichever component out of the hinge element and the contact member is the more convex in side profile at the location at which they are in contact, to thereby maintain the hinge element at the desired operative and physical location relative to the contact member.

Preferably the radius about which the string is curved has substantially the same side profile as the contacting surface of the same component.

Preferably the radius about which the string is curved has a radius which is fractionally smaller at all locations compared to the side profile of the contacting surface of the same component, by half the thickness of the string at the same location.

In one form, the fixing structure is a mechanical fixing assembly which comprises a flexible element which connects one end to the hinge element and another end to the contact member, is located close to and parallel to the axis of rotation of the hinge element with respect to the contact member, is sufficiently thin-walled in order that it is resilient in terms of twisting along the length, and is sufficiently wide in the direction perpendicular to the hinge axis and parallel to the contact surface such that it is relatively non-compliant in terms of translation of one end in the same direction and thereby restricts the hinge element from sliding against the contact surface in the same direction.

Preferably the thin, flexible element is a flat spring.

Preferably the thin, flexible element is a thin, solid strip, for example metal shim.

Preferably the flexible element is made from a material that is resistant to fatigue and creep, for example steel or titanium.

Preferably, the hinge assembly biases the hinge element towards the contact surface of the contact member using a biasing force that remains substantially constant in use.

Preferably, the hinge assembly biases the hinge element towards the contact surface of the contact member using a biasing force that is greater than the force of gravity acting on the diaphragm, or more preferably greater than 1.5 times the force of gravity acting on the diaphragm.

Preferably the biasing force is substantially large relative to the maximum excitation force of the diaphragm.

Preferably the biasing force is greater than 1.5, or more preferably greater than 2.5, or even more preferably greater than 4 times the maximum excitation force experienced during normal operation of the transducer.

Preferably the hinge assembly biases the hinge element towards the contact surface of the contact member using a biasing force that is sufficiently large such that substantially non-sliding contact is maintained between the hinge element and the contact surface when the maximum excitation is applied to the diaphragm during normal operation of the transducer.

Preferably the biasing force in a particular hinge joint is greater than 3 or 6 or 10 times greater than the component of reaction force acting in a direction such as to cause slippage between the hinge element and the contact surface when the maximum excitation is applied to the diaphragm during normal operation of the transducer.

Preferably at least 30%, or more preferably at least 50%, or most preferably at least 70% of contacting force between the hinge element and the contact member is provided by the biasing mechanism.

Preferably the biasing mechanism is sufficiently compliant such that the biasing force it applies does not vary by more than 200%, or more preferably 150% or more preferably 100 of the average force when the transducer is at rest, when the diaphragm traverses its full range of excursion during normal operation.

Preferably the biasing structure is sufficiently compliant such that the hinge joint is significantly asymmetrical in terms of that the biasing mechanism applying the biasing force to the hinge element in one direction is applied compliantly relative to the resulting reaction force.

Preferably said reaction force is applied in the form of a substantially constant displacement.

Preferably said reaction force is provided by parts of the contact member connecting the contact surface to the main body of the contact member which are comparatively non-compliant.

Preferably the hinge element is rigidly connected to the diaphragm body, and the region of the hinge element immediately local to the contact surface, and connections between this region and the rest of the diaphragm, are non-compliant relative to the biasing mechanism.

In some embodiments the overall stiffness k (where "k" is as defined under Hook's law) of the biasing mechanism acting on the hinge element, the rotational inertia of about its axis of rotation of the part of the diaphragm supported via said contacting surfaces, and the fundamental resonance frequency of the diaphragm in Hz (f) satisfy the relationship:

$$k<C\times 10{,}000\times(2\pi f)^2\times I$$

where C is a constant preferably given by 200, or more preferably by 130, or more preferably given by 100, or more preferably given by 60, or more preferably given by 40, or more preferably given by 20, or most preferably given by 10.

In some embodiments the biasing mechanism is sufficiently compliant such that, when the diaphragm is at its equilibrium displacement during normal operation, if two small equal and opposite forces are applied perpendicular to a pair of contacting surfaces, one force to each surface, in directions such as to separate them, the relationship between a small (preferably infinitesimal) increase in force in Newtons (dF), above and beyond the force required to just achieve initial separation, the resulting change in separation at the surfaces in meters (dx) resulting from deformation of the rest of the driver, excluding compliance associated with and in the localised region of contact between non-joined components, the rotational inertia about its axis of rotation of the part of the diaphragm supported via said contacting surfaces ($I_s$), and the fundamental resonance frequency of the diaphragm in Hz (f) satisfy the relationship:

$$\frac{dF}{dx} < C \times 10{,}000 \times (2\pi f)^2 \times I_s$$

where C is a constant preferably given by 200, or more preferably by 130, or more preferably given by 100, or more preferably given by 60, or more preferably given by 40, or more preferably given by 20, or most preferably given by 10.

Preferably part of the biasing mechanism is rigidly connected to the transducer base mechanism.

Alternatively, or in addition the diaphragm comprises the biasing mechanism.

In some embodiments the average ($\Sigma F_n/n$) of all the forces in Newtons ($F_n$) biasing each hinge element towards its associated contact surface within the number n of hinge joints of this type within the hinge assembly consistently satisfies the following relationship while constant excitation force is applied such as to displace the diaphragm to any position within its normal range of movement:

$$\frac{\sum F_n}{n} > D \times \frac{1}{n} \times (2\pi f)^2 \times I$$

where D is a constant preferably equal to 5, or more preferably equal to 15, or more preferably equal to 30, or more preferably equal to 40.

In some embodiments the biasing mechanism applies an average ($\Sigma F_n/n$) of all the forces in Newtons ($F_n$) biasing each hinge element towards its associated contact surface within the number n of hinge joints of this type within the hinge assembly consistently satisfies the following relationship when constant excitation force is applied such as to displace the diaphragm to any position within its normal range of movement:

$$\frac{\sum F_n}{n} < D \times \frac{1}{n} \times (2\pi f)^2 \times I$$

where D is a constant preferably equal to 200, or more preferably equal to 150, or more preferably equal to 100, or most preferably equal to 80.

In some embodiments the biasing mechanism applies a net force F biasing a hinge element to a contact member that satisfies the relationship:

$$F > D \times (2\pi f_l)^2 \times I_s$$

where $I_s$ (in kg·m$^2$) is the rotational inertia, about the axis of rotation, of the part of the diaphragm that is supported by the hinge element, $f_l$ (in Hz), is the lower limit of the FRO, and D is a constant preferably equal to 5, or more preferably equal to 15, or more preferably equal to 30, or more preferably equal to 40, or more preferably equal to 50, or more preferably equal to 60, or most preferably equal to 70.

Preferably this relationship is satisfied consistently, at all angles of rotation of the hinge element relative to the contact member during the course of normal operation.

Preferably, the hinge assembly further comprises a restoring mechanism to restore the diaphragm to a desired neutral rotational position when no excitation force is applied to the diaphragm.

In one form, the restoring mechanism comprises a torsion bar attached to an end of the diaphragm body. In this configuration, the torsion bar comprises a middle section that flexes in torsion, and end sections that are coupled to the diaphragm and to the transducer base structure.

Preferably at least one end of the sections provides translational compliance in the direction of the primary axis of the torsion bar.

Preferably one, or more preferably both, of the end sections incorporates rotational flexibility, in directions perpendicular to the length of the middle section.

Preferably the translational and rotational flexibility is provided by one or more substantially planar and thin walls at one or both ends of the torsion bar, the plane of which is/are oriented substantially perpendicular to the primary axis of the torsion bar.

Preferably both end sections are relatively non-compliant in terms of translations in directions perpendicular to the primary axis of the torsion bar.

In some embodiments the audio transducer further comprises an excitation mechanism including a coil and conducting wires connecting to the coil, wherein the conducting wires are attached to the surface of the middle section of the torsion bar.

Preferably the wires are attached close to an axis running parallel to the torsion bar and about which the torsion bar rotates during normal operation of the transducer.

In another form the restoring mechanism comprises a compliant element such as silicon or rubber, located close to the axis of rotation.

Preferably the compliant element comprises a narrow middle section and end sections having increased area to facilitate secure connections.

In another form part or all of the restoring force is provided within the hinge joint through the geometry of the contacting surfaces and through the location, direction and strength of the biasing force is applied by the biasing structure.

In another form some part of the centering force is provided by magnetic elements.

In one form, one or more components of the hinge assembly are made from a material having a Young's modulus higher than 6 GPa, or more preferably higher than 10 GPa.

In another aspect, the present invention may broadly be said to consists of an audio transducer comprising:

- a diaphragm having a diaphragm body that remains substantially rigid during operation;
- a hinge system configured to operatively support the diaphragm in use, and comprising a hinge assembly having one or more hinge joints, wherein each hinge joint comprises a hinge element and a contact member, the contact member having a contact surface;

wherein, during operation each hinge joint is configured to allow the hinge element to move relative to the associated contact member while maintaining a substantially consistent physical contact with the contact surface, and the hinge assembly biases the hinge element towards the contact surface; and

- wherein at least parts of both the hinge element and the contact member in the immediate region of the contact surface are made from a rigid material.

In one embodiment the substantially consistent physical contact comprises a substantially consistent force and in a region of contact between each hinge element and the associated contact surface, one of the hinge element and the contact member is effectively rigidly connected to the diaphragm, and the other is effectively rigidly connected to the transducer base structure. Preferably the hinge assembly is configured to apply a biasing force to the hinge element of each joint toward the associated contact surface, compliantly. Preferably the hinge assembly is configured to apply a biasing force to the hinge element of each joint toward the associated contact surface, compliantly.

Preferably in either the thirty seventh or thirty eighth aspect the parts of both the hinge element and the contact member in the immediate region of the contact surface are made from a material having a Young's modulus higher than 6 GPa, more preferably higher than 10 GPa.

Preferably there is at least one pathway connecting the diaphragm body to the base structure comprised of substantially rigid components and whereby, in the immediate vicinity of places where one rigid component contacts another without being rigidly connected, all materials have a Young's modulus higher than 6 GPa, or even more preferably higher than 10 GPa.

More preferably, the hinge element and the contact member are made from a material having a Young's modulus higher than 6 GPa, or even more preferably higher than 10 GPa for example but not limited to aluminum, steel, titanium, tungsten, ceramic and so on.

Preferably the hinge element and/or the contact surface comprises a thin coating, for example a ceramic coating or an anodized coating.

Preferably either or both of the surface of the hinge element at the location of contact and the contact surface comprise a non-metallic material.

Preferably both the hinge element at the location of contact and the contact surface comprise non-metallic materials.

Preferably both the hinge element at the location of contact and the contact surface comprise corrosion-resistant materials.

Preferably both the hinge element at the location of contact and the contact surface comprise materials resistant to fretting-related corrosion.

Preferably the hinge element rolls against the contact surface about an axis that is substantially collinear with an axis of rotation of the diaphragm.

Preferably the hinge assembly is configured to facilitate single degree of freedom motion of the diaphragm.

In one configuration the hinge assembly rigidly restrains the diaphragm against translation in at least 2 directions/along at least two substantially orthogonal axes.

In one configuration the hinge assembly enables diaphragm motion consisting of a combination of translational and rotational movements.

In a preferred configuration the hinge assembly enables diaphragm motion that is substantially rotational about a single axis.

Preferably the wall thickness of the hinge element is thicker than $1/8^{th}$ of, or ¼ of, or ½ of or most preferably thicker than the radius of the contacting surface that is more convex in side profile out of that of the hinge element and the contact member, at the location of contact.

Preferably the wall thickness of the contact member is thicker than $1/8^{th}$ of, or ¼ of, or ½ of or most preferably thicker than the radius of the contacting surface that is more convex in side profile out of that of the hinge element and the contact member, at the location of contact.

Preferably there is at least one substantially non-compliant pathway by which translational loadings may pass from the diaphragm through to the transducer base structure via the hinge joint.

Preferably the diaphragm incorporates and is rigidly coupled to a force transferring component of a transducing mechanism that transduces electricity and movement.

In another aspect, the present invention may broadly be said to consist of an audio transducer comprising:

- a diaphragm having a diaphragm body that remains substantially rigid during operation;
- a transducing mechanism that transduces electricity and/or movement having a force transferring component, wherein the diaphragm incorporates and is rigidly coupled to the force transferring component;
- a hinge system configured to operatively support the diaphragm in use, and comprising a hinge assembly having one or more hinge joints, wherein each hinge joint comprises a hinge element and a contact member, the contact member having a contact surface; and wherein, during operation each hinge joint is configured to allow the hinge element to move relative to the associated contact member while maintaining a substantially consistent physical contact with the contact surface, and the hinge assembly biases the hinge element towards the contact surface.

In one embodiment the substantially consistent physical contact comprises a substantially consistent force and in a region of contact between each hinge element and the associated contact surface, one of the hinge element and the contact member is effectively rigidly connected to the diaphragm, and the other is effectively rigidly connected to the transducer base structure. Preferably the hinge assembly is configured to apply a biasing force to the hinge element of each joint toward the associated contact surface, compliantly. Preferably the hinge assembly is configured to apply a biasing force to the hinge element of each joint toward the associated contact surface, compliantly.

In another aspect, the present invention may broadly be said to consists of an audio transducer comprising:

- a diaphragm having a diaphragm body that remains substantially rigid during operation and that comprises a maximum thickness that is greater than approximately 11% of a maximum length of the diaphragm body;
- a hinge system configured to operatively support the diaphragm in use, and comprising a hinge assembly having one or more hinge joints, wherein each hinge joint comprises a hinge element and a contact member, the contact member having a contact surface; and wherein, during operation each hinge joint is configured to allow the hinge element to move relative to the associated contact member while maintaining a substantially consistent physical contact with the contact surface, and the hinge assembly biases the hinge element towards the contact surface.

In any one of the above aspects relating to an audio transducer including a hinge system, in one form, the hinge assembly comprises a pair of hinge joints located on either side of a width of the diaphragm.

Alternatively the hinge assembly comprises more than 2 hinge joints with at least a pair of hinge joints located on either side of the width of the diaphragm.

In one form, multiple hinge assemblies are configured to operatively support the diaphragm during operation.

Preferably the audio transducer further comprises a diaphragm suspension having at least one hinge assembly, the diaphragm suspension being configured to operatively support the diaphragm during operation.

Preferably the diaphragm suspension consists of a single hinge assembly to enable the movement of the diaphragm assembly.

Alternatively the diaphragm suspension comprises two or more hinge assemblies. #409 In one form, the diaphragm suspension comprises a four-bar linkage and a hinge assembly is located at each corner of the four-bar linkage.

Preferably each diaphragm is connected to no more than two hinge joints each having significantly different axes of rotation.

In one configuration the hinge element is biased or urged towards the contact surface by magnetic forces.

In one configuration, the hinge element is a ferromagnetic steel shaft attached to or embedded in or along an end surface of the diaphragm body. The hinge joint comprises a magnet which attracts the hinge element towards the contact surface.

In one configuration the hinge element is biased or urged towards the contact surface by a mechanical biasing mechanism.

In one form configuration, the hinge element is a diaphragm base frame attached to or embedded in or along an end surface of the diaphragm body.

The mechanical biasing structure may comprises a pretensioned spring member.

Preferably the biasing force applied to the hinge element, is applied at an edge that is approximately co-linear with the axis of rotation of the diaphragm relative to the contact surface.

Preferably the biasing force applied between the hinge element and the contact surface is applied at an edge that is substantially parallel to the axis of rotation and substantially co-linear to a line axis passing close to the centre of the contact radius of the contacting surface side that is the more convex, when viewed in cross-sectional profile in a plane perpendicular to the axis of rotation, out of the contacting surface of the hinge element and the contacting surface of the contact surface.

Preferably the biasing force applied between the hinge element and the contact surface is applied at an edge that is co-linear to a line that is parallel to the axis of rotation and passes through the centre of the contact radius of the contacting surface side that is the more convex, when viewed in cross-sectional profile in a plane perpendicular to the axis of rotation, out of the contacting surface of the hinge element and the contacting surface of the contact surface.

Preferably the biasing force applied to the hinge element is applied at a location that lies, approximately, on the axis of rotation of the diaphragm relative to the contact surface.

Preferably the biasing force is applied at an axis that is approximately parallel to the axis of rotation and passes approximately through the centre of the radius of the surface side that is the more convex, when viewed in cross-sectional profile in a plane perpendicular to the axis of rotation, out of the hinge element and the contact surface.

Preferably the biasing force is applied close to this location throughout the full range of diaphragm excursion.

Preferably at all times during normal operation the location and direction of the biasing force is such that it passes through a hypothetical line oriented parallel to the axis of rotation and passing through the point of contact between the hinge element and the contact member.

In another aspect the invention may broadly be said to consist of an audio transducer as per any one of the above aspects that includes a hinge system, and further comprising:

a housing comprising an enclosure or baffle for accommodating the diaphragm therein or therebetween; and wherein the diaphragm comprises an outer periphery having one or more peripheral regions that are free from physical connection with the housing.

Preferably the outer periphery is significantly free from physical connection such that the one or more peripheral regions constitute at least 20%, or more preferably at least 30% of a length or perimeter of the periphery. More preferably the outer periphery is substantially free from physical connection such that the one or more peripheral regions constitute at least 50%, or more preferably at least 80% of a length or perimeter of the periphery. Most preferably the outer periphery is approximately entirely free from physical connection such that the one or more peripheral regions constitute at approximately an entire length or perimeter of the periphery.

In some embodiments the transducer contains ferromagnetic fluid between the one or more peripheral regions of the diaphragm and the interior of the housing. Preferably the ferromagnetic fluid provides significant support to the diaphragm in direction of the coronal plane of the diaphragm.

Preferably the diaphragm comprises normal stress reinforcement coupled to the body, the normal stress reinforcement being coupled adjacent at least one of said major faces for resisting compression-tension stresses experienced at or adjacent the face of the body during operation In another aspect the invention may broadly be said to consist of an audio transducer as per any one of the above aspects that includes a hinge system, and wherein the diaphragm comprises:

a diaphragm body having one or more major faces, normal stress reinforcement coupled to the body, the normal stress reinforcement being coupled adjacent at least one of said major faces for resisting compression-tension stresses experienced at or adjacent the face of the body during operation, and at least one inner reinforcement member embedded within the body and oriented at an angle relative to at least one of said major faces for resisting and/or substantially mitigating shear deformation experienced by the body during operation.

Preferably in either one of the above two aspects a distribution of mass of associated with the diaphragm body or a distribution of mass associated with the normal stress reinforcement, or both, is such that the diaphragm comprises a relatively lower mass at one or more low mass regions of the diaphragm relative to the mass at one or more relatively high mass regions of the diaphragm.

Preferably the diaphragm body comprises a relatively lower mass at one or more regions distal from a centre of mass location of the diaphragm. Preferably the thickness of the diaphragm reduces toward a periphery distal from the centre of mass.

Alternatively or in addition a distribution of mass of the normal stress reinforcement is such that a relatively lower amount of mass is at one or more peripheral edge regions of the associated major face distal from an assembled centre of mass location the diaphragm.

In another aspect the invention may broadly be said to consist of an audio device incorporating any one of the above aspects including a hinge system, and further comprising a decoupling mounting system located between the diaphragm of the audio transducer and at least one other part of the audio device for at least partially alleviating mechanical transmission of vibration between the diaphragm and the at least one other part of the audio device, the decoupling mounting system flexibly mounting a first component to a second component of the audio device.

Preferably the at least one other part of the audio device is not another part of the diaphragm of an audio transducer of the device. Preferably the decoupling mounting system is coupled between the transducer base structure and one other part. Preferably the one other part is the transducer housing.

In another aspect the invention may consist of an audio device comprising two or more electro-acoustic loudspeakers incorporating any one or more of the audio transducers of the above aspects and providing two or more different audio channels through capable of reproduction of independent audio signals. Preferably the audio device is personal audio device adapted for audio use within approximately 10 cm of the user's ear.

In another aspect the invention may be said to consist of a personal audio device incorporating any combination of one or more of the audio transducers and its related features, configurations and embodiments of any one of the previous audio transducer aspects.

In another aspect the invention may be said to consist of a personal audio device comprising a pair of interface devices configured to be worn by a user at or proximal to each ear, wherein each interface device comprises any combination of one or more of the audio transducers and its related features, configurations and embodiments of any one of the previous audio transducer aspects.

In another aspect the invention may be said to consist of a headphone apparatus comprising a pair of headphone interface devices configured to be worn on or about each ear, wherein each interface device comprises any combination of one or more of the audio transducers and its related features, configurations and embodiments of any one of the previous audio transducer aspects.

In another aspect the invention may be said to consist of an earphone apparatus comprising a pair of earphone interfaces configured to be worn within an ear canal or concha of a user's ear, wherein each earphone interface comprises any combination of one or more of the audio transducers and its related features, configurations and embodiments of any one of the previous audio transducer aspects.

In another aspect the invention may be said to consist of an audio transducer of any one of the above aspects and related features, configurations and embodiments, wherein the audio transducer is an acoustoelectric transducer.

Any one or more of the above embodiments or preferred features can be combined with any one or more of the above aspects.

Other aspects, embodiments, features and advantages of this invention will become apparent from the detailed description and from the accompanying drawings, which illustrate by way of example, principles of this invention.

Definitions

The phrase "audio transducer" as used in this specification and claims is intended to encompass an electroacoustic transducer, such as a loudspeaker, or an acoustoelectric transducer such as a microphone. Although a passive radiator is not technically a transducer, for the purposes of this specification the term "audio transducer" is also intended to include within its definition passive radiators.

The phrase "force transferring component" as used in this specification and claims means a member of an associated transducing mechanism within which:

a) a force is generated which drives a diaphragm of the transducing mechanism, when the transducing mechanism is configured to convert electrical energy to sound energy; or b) physical movement of the member results in a change in force applied by the force transferring component to the diaphragm, in the case that the transducing mechanism is configured to convert sound energy to electrical energy.

The phrase "personal audio" as used in this specification and claims in relation to a transducer or a device means a loudspeaker transducer or device operable for audio reproduction and intended and/or dedicated for utilisation within close proximity to a user's ear or head during audio reproduction, such as within approximately 10 cm the user's ear or head. Examples of personal audio transducers or devices include headphones, earphones, hearing aids, mobile phones and the like.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Number Ranges

It is intended that reference to a range of numbers disclosed herein (for example, 1 to 10) also incorporates reference to all rational or irrational numbers within that range (for example, 1, 1.1, 2, 3, 3.9, 4, 5, 6, 6.5, 7, 8, 9 and 10) and also any range of rational or irrational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

Frequency Range of Operation

The phrase "frequency range of operation" (herein also referred to as FRO) as used in this specification and claims in relation to a given audio transducer is intended to mean the audio-related FRO of the transducer as would be determined by persons knowledgeable and/or skilled in the art of acoustic engineering, and optionally includes any application of external hardware or software filtering. The FRO is hence the range of operation that is determined by the construction of the transducer.

As will be appreciated by those knowledgeable and/or skilled in the relevant art, the FRO of a transducer may be determined in accordance with one or more of the following interpretations:

1. In the context of a complete speaker system or audio reproduction system or personal audio device such as a headphone, earphone or hearing aid etc., the FRO is the frequency range, within the audible bandwidth of 20 Hz to 20 kHz, over which the Sound Pressure Level (SPL) is either greater than, or else is within 9 dB below (excluding any narrow bands where the response drops below 9 dB), the average SPL produced by the entire system over the frequency band 500 Hz-2000 Hz (average calculated using log-scale weightings in both SPL (i.e. dB) and frequency domain), in the case that the device is designed for accurate audio reproduction, or in other cases, such as that the device is designed for another purpose such as hearing enhancement or noise cancellation, the FRO will be as determined by person(s) knowledgeable in the art. If the speaker system etc. is a typical personal audio device then the SPL is to be measured relative to the 'Diffuse Field' target reference of Hammershoi and Moller, for example.

2. In the context of a loudspeaker driver operationally installed as part of a speaker system or audio reproduction system, the FRO is the frequency range over which the sound that the transducer produces contributes, either directly or indirectly via a port or passive radiator etc., significantly to the overall SPL of audio reproduction of the speaker or audio reproduction system within said systems FRO;
3. In the context of a passive radiator operationally installed as part of a speaker system or audio reproduction system, the FRO is the frequency range over which the sound that the passive radiator produces contributes significantly to the overall Sound Pressure Level (SPL) of audio reproduction of the speaker or audio reproduction system, within said systems FRO;
4. In the context of a microphone, the FRO is the frequency range over which the transducer contributes, either directly or indirectly, significantly to the overall level of audio recording, within the bandwidth being recorded by the overall (mono-channel) recording device of which the transducer is a component, as measured with any active and/or passive crossover filtering, that either occurs in real time or else would be intended to occur post-recording, that alters the amount of sound produced by one or more transducers in the system; or
5. In the case that the associated transducer is not operationally installed as part of a speaker system or audio reproduction system or microphone, the FRO is the bandwidth over which the transducer is considered to be suitable for proper operation as judged by those knowledgeable and/or skilled in the relevant art.

In the context of a mobile phone transducer intended for voice reproduction with the transducer located within approximately 5-10 cm of a user's ear, the FRO is considered to be the audio bandwidth normally applied in this voice reproduction scenario.

For the above set of included interpretations of the phrase FRO, the frequency range referred to in each interpretation is to be determined or measured using a typical industry-accepted method of measuring the related category of speaker or microphone system. As an example, for a typical industry-accepted method of measuring the SPL produced by a typical home audio floor standing loudspeaker system: measurement occurs on the tweeter-axis, and anechoic frequency response is measured with a 2.83 VRMS excitation signal at a distance determined by proper summing of all drivers and any resonators in the system. This distance is determined by successively conducting the windowed measurement described below starting at 3 times the largest dimension of the source and decreasing the measurement distance in steps until one step before response deviations are apparent.

The lower limit of the FRO of a particular driver in the system is either the −6 dB high-pass roll-off frequency produced by a high-pass active and/or passive crossover and/or by any applicable pre-filtering of the source signal and/or by the low frequency roll-off characteristics of the combination of the driver and/or any associated resonator (e.g. port or passive radiator etc., said resonator being associated with said driver), or else is the lower limit of the FRO of the system, whichever is the higher frequency of the two.

Typically the upper limit of the FRO of a particular driver in the system is either the −6 dB low-pass roll-off frequency produced by a low-pass active and/or passive crossover and/or other filtering and/or by any applicable pre-filtering of the source signal and/or by the high frequency roll-off characteristics of the combination of the driver, or else is the upper limit of the FRO of the system, whichever is the lower frequency of the two.

A typical headphone measurement set-up would include the use of a standard head acoustics simulator.

The invention consists in the foregoing and also envisages constructions of which the following gives examples only. Further aspects and advantages of the present invention will become apparent from the ensuing description.

BRIEF DESCRIPTION OF THE DRAWINGS

Preferred embodiments of the invention will be described by way of example only and with reference to the drawings, in which:

FIGS. 1A-F show an embodiment A hinge-action transducer with a composite diaphragm of low rotational inertia, hinged using contact surfaces that roll against each other, a biasing force applied using magnetism, a fixing structure consisting of string used to help locate the diaphragm within the transducer base structure, and also a torsion bar to help locate and centre the diaphragm, with:

FIG. 1A being a 3D isometric view of the embodiment A transducer,

FIG. 1B being a plan view of the embodiment A transducer,

FIG. 1C being a side elevation view of the embodiment A transducer,

FIG. 1D being a front (tip of diaphragm) elevation view of the embodiment A transducer, FIG. 1E being a cross-sectional view (section A-A of FIG. 1B) of the embodiment "A" transducer, FIG. 1F being a detail view of the hinging mechanism shown in FIG. 1E of the embodiment A transducer;

FIGS. 2A-G show the diaphragm of the embodiment A driver illustrated in FIGS. 1A-F with:

FIG. 2A being a 3D isometric view of the diaphragm,

FIG. 2B being a detail view of the struts shown in FIG. 2A of the diaphragm, FIG. 2C being a top (tip of diaphragm) elevation view, FIG. 2D being a front view of the diaphragm, FIG. 2E being a bottom (coil) elevation view of the diaphragm, FIG. 2F being a side elevation view of the diaphragm, FIG. 2G being an exploded 3D isometric view of the diaphragm, FIG. 2H being a 3D isometric view of the diaphragm without the diaphragm base frame from the back, FIG. 2I being a 3D isometric view of the diaphragm without the diaphragm base frame from the front;

FIGS. 3A-3J show the hinge assembly of the embodiment A driver illustrated in FIGS. 1A-F with:

FIG. 3A being a 3D isometric view of the hinge assembly,

FIG. 3B being a top view of the hinge assembly,

FIG. 3C being a front view of the hinge assembly,

FIG. 3D being a side elevation view of the hinge assembly,

FIG. 3E being a bottom view of the hinge assembly,

FIG. 3F being a detail view of the hinge assembly (detail A of FIG. 3C),

FIG. 3G being a cross-sectional view of the hinge assembly (section A of FIG. 3F), FIG. 3H being a cross-sectional view of the hinge assembly (section B of FIG. 3F), FIG. 3I being a cross-sectional view of the hinge assembly (section C of FIG. 3F), FIG. 3J being a detail view of the hinge joint of FIG. 3G;

FIGS. 4A-D show the torsion bar component of the embodiment A driver illustrated in FIGS. 1A-F with:

FIG. 4A being a 3D isometric view of the torsion bar,

FIG. 4B being a front view of the torsion bar,

FIG. 4C being a side elevation view of the torsion bar,

FIG. 4D being a cross-sectional and enlarged view of the torsion bar (section A-A of FIG. 4B);

FIGS. 5A-M show an embodiment E, hinge-action loudspeaker driver of the invention with a composite diaphragm of low rotational inertia, hinged using contact surfaces that roll against each other, a biasing force applied using flat springs, with:

FIG. 5A being a 3D isometric view of the embodiment E driver,

FIG. 5B being a top view of the embodiment E driver,

FIG. 5C being a side elevation view of the embodiment E driver,

FIG. 5D being a front view of the embodiment E driver,

FIG. 5E being a detail view of FIG. 5C,

FIG. 5F being a cross-sectional view (section A-A of FIG. 5D),

FIG. 5G being a detail view of the contact point in FIG. 5F,

FIG. 5H being a detail view of the coil winding in FIG. 5F,

FIG. 5I being a cross-sectional view (section B-B of FIG. 5C),

FIG. 5J being a detail view of FIG. 5H,

FIG. 5K being a detail view of the detail view FIG. 5J,

FIG. 5L being a 3D isometric, exploded view of the embodiment E driver,

FIG. 5M being a detail view of FIG. 5L;

FIGS. 6A-H show the embodiment E driver, illustrated in FIGS. 5A-M rigidly attached to a baffle, with:

FIG. 6A being a 3D isometric view,

FIG. 6B being a top view,

FIG. 6C being a side elevation view,

FIG. 6D being a front view,

FIG. 6E being a cross-sectional view (section A-A of FIG. 6B),

FIG. 6F being a detail view of FIG. 6E,

FIG. 6G being a cross-sectional view (section B-B of FIG. 6E),

FIG. 6H being a 3D isometric, exploded view;

FIGS. 8A-C show the diaphragm assembly E101 of the embodiment E driver illustrated in FIGS. 5A-M, with:

FIG. 8A being a 3D isometric view of the diaphragm assembly,

FIG. 8B being a top view of the diaphragm assembly,

FIG. 8C being a side elevation view of the diaphragm assembly;

FIGS. 13A-D show schematic side views of four variations of a basic hinge joint which could be used in a contact hinge assembly, with:

FIG. 13A showing a convexly curved hinge element and flat contact member,

FIG. 13B showing a flat hinge element and convexly curved contact member,

FIG. 13C showing a convexly curved hinge element and a convexly curved contact member, FIG. 13D showing a convexly curved hinge element and a concavely curved contact member;

FIGS. 15A-B show a prior art cone loudspeaker driver that is semi-decoupled to a baffle, with:

FIG. 15A being a front view,

FIG. 15B being a cross-sectional view (section A-A of FIG. 15A);

FIGS. 16A-O show an embodiment K, hinge-action loudspeaker driver with a composite diaphragm of low rotational inertia, hinged using contact surfaces that roll against each other and a biasing force applied using a flat spring, with:

FIG. 16A being a 3D isometric view of the embodiment K driver,

FIGS. 18A-H shows the right side ear cup of the pair of headphones shown in FIG. 17, incorporating the hinge-action loudspeaker driver of embodiment K, with:

FIG. 18A being a 3D isometric view, showing the padded side of the cup,

FIG. 18B being a 3D isometric view, showing the outward facing, back side of the cup, FIG. 18C being a back side elevation view of the cup, FIG. 18D being a cross-sectional view (section D-D of FIG. 18C), FIG. 18E being a cross-sectional view (section E-E of FIG. 18D), FIG. 18F being a detail view of the decoupling mount shown in FIG. 18E;

FIG. 18G being a cross-sectional view (section F-F of FIG. 18D),

FIG. 18H being an exploded 3D isometric view;

FIGS. 20A-D shows the force transmitting component of the embodiment K driver shown in FIGS. 16A-O, with:

FIG. 20A being a 3D isometric view,

FIG. 20B being a side elevation view,

FIG. 20C being a back side elevation view,

FIG. 20D being a top view;

FIGS. 21A-H show an embodiment S, hinge-action loudspeaker transducer with a composite diaphragm of low rotational inertia, hinged using a pair of modified ball bearing races, that have the balls biased with the contact surfaces that they roll against, with:

FIG. 21A being a 3D isometric view of the embodiment S transducer,

FIG. 21B being a front (tip of diaphragm) elevation view of the embodiment S transducer, FIG. 21C being a plan view of the embodiment S transducer, FIG. 21D being a cross-sectional view (section A-A of FIG. 21C), FIG. 21E being a cross-sectional view (section C-C of FIG. 21C), FIG. 21F being a detail view of the hinging assembly shown in FIG. 21E, FIG. 21G being a cross-sectional view (section B-B of FIG. 21C), FIG. 21H being a detail view of the hinging assembly shown in FIG. 21G;

FIGS. 22A-E shows the diaphragm assembly of the embodiment S, hinge-action loudspeaker transducer shown in FIGS. 21A-H, with:

FIG. 22A being a 3D isometric view of the diaphragm assembly,

FIG. 22B being a front (tip of diaphragm) elevation view of the diaphragm assembly, FIG. 22C being a plan view of the diaphragm assembly, FIG. 22D being a side elevation view of the diaphragm assembly, FIG. 22E being an exploded 3D isometric view of the diaphragm assembly;

FIGS. 23A-E shows the transducer base structure assembly of the embodiment S, hinge-action loudspeaker transducer shown in FIGS. 21A-H, with:

FIG. 23A being a 3D isometric view of the transducer base structure assembly, FIG. 23B being a front elevation view of the transducer base structure assembly, FIG. 23C being a plan view of the transducer base structure assembly, FIG. 23D being a side elevation view of the transducer base structure assembly, FIG. 23E being an exploded 3D isometric view of the transducer base structure assembly;

FIGS. 24A-I show an embodiment T, hinge-action loudspeaker transducer with a composite diaphragm of low rotational inertia, hinged using a pair of modified ball bearing races, that have the balls biased with the contact surfaces that they roll against, with:

FIG. 24A being a 3D isometric view of the embodiment T transducer,

FIG. 24B being a front (tip of diaphragm) elevation view of the embodiment T transducer, FIG. 24C being a plan view of the embodiment T transducer, FIG. 24D being a cross-sectional view (section A-A of FIG. 24C, FIG. 24E being a cross-sectional view (section C-C of FIG. 24C), FIG. 24F being a partial cross-sectional view (section B-B of FIG. 24C), FIG. 24G being a detail view of the hinging assembly shown in FIG. 24G, FIG. 24H being a detail view of a biasing spring shown in FIG. 24G, FIG. 24I being a detail view of a bearing race;

FIGS. 25A-E show the diaphragm assembly of the embodiment T, hinge-action loudspeaker transducer shown in FIGS. 24A-H, with:

FIG. 25A being a 3D isometric view of the diaphragm assembly,

FIG. 25B being a front (tip of diaphragm) elevation view of the diaphragm assembly, FIG. 25C being a plan view of the diaphragm assembly, FIG. 25D being a side elevation view of the diaphragm assembly, FIG. 25E being an exploded 3D isometric view of the diaphragm assembly;

FIGS. 26A-E show the transducer base structure assembly of the embodiment T, hinge-action loudspeaker transducer shown in FIGS. 24A-H, with:

FIG. 26A being a 3D isometric view of the transducer base structure assembly, FIG. 26B being a front elevation view of the transducer base structure assembly, FIG. 26C being a plan view of the transducer base structure assembly, FIG. 26D being a side elevation view of the transducer base structure assembly, FIG. 26E being an exploded 3D isometric view of the transducer base structure assembly;

FIGS. 27A and 27B show one of the pair of ball bearing races of the hinge system used in the embodiment T transducer shown in FIGS. 24A-H, with:

FIG. 27A being a 3D isometric view of the ball bearing race,

FIG. 27B being an exploded 3D isometric view of the ball bearing race;

FIGS. 28A-E show a prior art bearing assembly incorporating preload, with:

FIG. 28A being a side elevation view of the bearing assembly,

FIG. 28B being a front elevation view of the bearing assembly,

FIG. 28C being a 3D isometric view of the bearing assembly,

FIG. 28D being a cross-sectional view (section A-A of FIG. 28A),

FIG. 28E being a close-up view of a ball bearing race section shown in FIG. 28D;

FIGS. 29A-D show a bearing race of the bearing assembly shown in FIGS. 28A-E, with:

FIG. 29A being a 3D isometric view of the bearing race,

FIG. 29B being a front elevation view of the bearing race,

FIG. 29C being a cross-sectional view (section E-E of FIG. 29B),

FIG. 29D being an exploded 3D isometric view of the bearing race; and

FIGS. 30A-D show embodiment Z, a computer speaker standing on a floor, incorporating two drivers, a treble hinge action transducer and a mid-bass hinge action transducer, both similar to the embodiment K transducer shown in FIGS. 16A-O, and decoupled from an enclosure in a similar way to the decoupling system shown in FIGS. 18A-H, with:

FIG. 30A being a front view of the speaker,

FIG. 30B being a side elevation view of the speaker,

FIG. 30C being a 3D isometric view of the speaker,

FIG. 30D being a detailed view of FIG. 30C.

DETAILED DESCRIPTION OF PREFERRED EMBODIMENTS

Figure 1A:
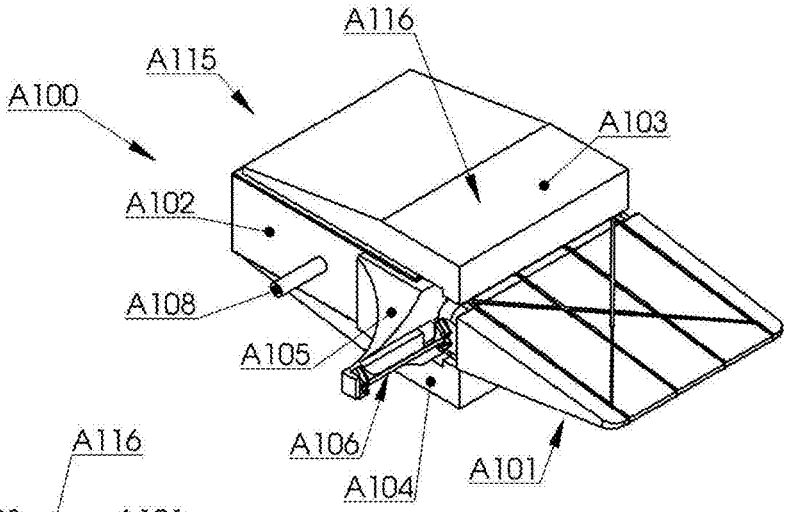
Figure 1B:
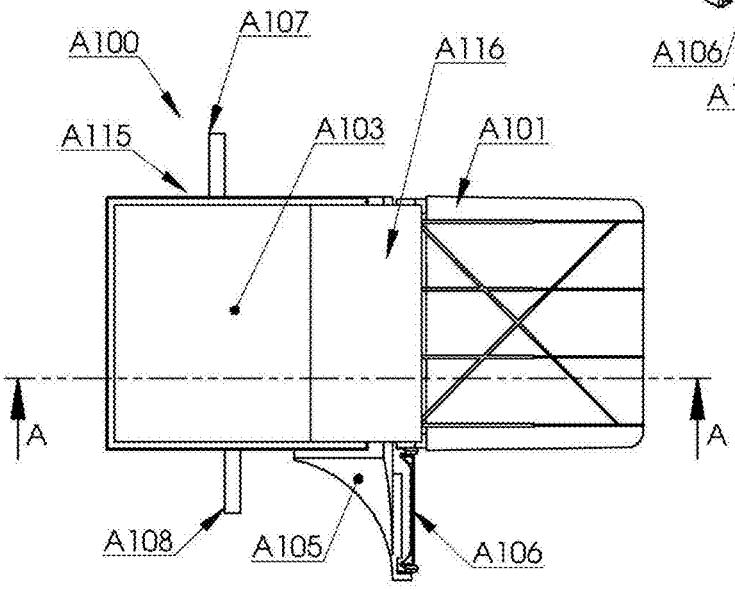
Figure 1C:
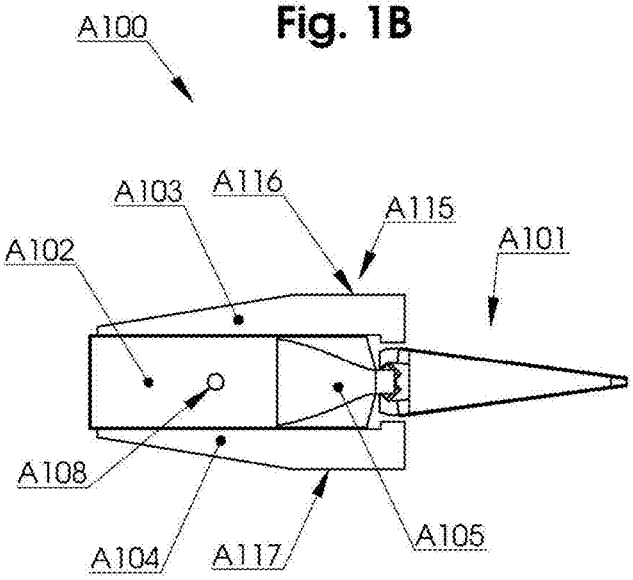
Figure 1D:
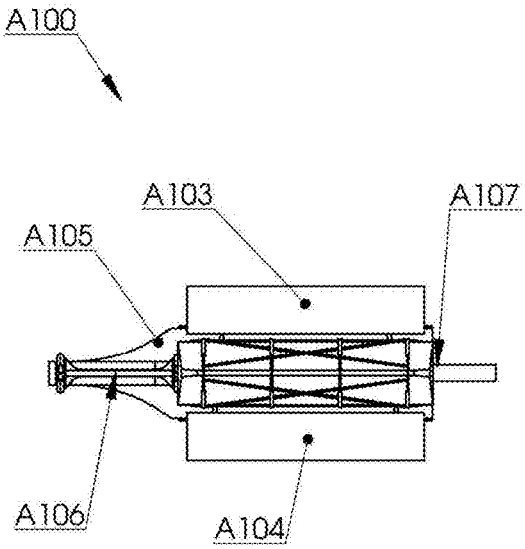

Various embodiments or configurations of audio transducers or related structures, mechanisms, devices, assemblies or systems will now be described in detail. These will be described with reference to the figures. The audio transducer embodiments shown in the drawings are referred to as embodiments A, E, K, S, T and Z for the sake of clarity.

Embodiments or configurations of audio transducers or related structures, mechanisms, devices, assemblies or systems of the invention will be described in some cases with reference to an electroacoustic transducer, such as a loudspeaker driver. Unless otherwise stated, the audio transducers or related structures, mechanisms, devices, assemblies or systems may otherwise be implemented as or in an acoustoelectric transducer, such as a microphone. As such, the term audio transducer as used in this specification, and unless otherwise stated, is intended to include both loudspeaker and microphone implementations.

The embodiments or configurations of audio transducers or related structures, mechanisms, devices, assemblies or systems described herein are designed to address one or more types of unwanted resonances associated with audio transducer systems.

In each of the audio transducer embodiments herein described the audio transducer comprises a diaphragm assembly that is movably coupled relative to a base, such as a transducer base structure and/or part of a housing, support or baffle. The base has a relatively higher mass than the diaphragm assembly. A transducing mechanism associated with the diaphragm assembly moves the diaphragm assembly in response to electrical energy, in the case of an electroacoustic transducer. It will be appreciated that an alternative transducing mechanism may be implemented that otherwise transduces movement of the diaphragm assembly into electrical energy. In this specification, a transducing mechanism may also be referred to as an excitation mechanism.

In the embodiments of this invention, an electromagnetic transducing mechanism is used. An electromagnetic transducing mechanism typically comprises a magnetic structure configured to generate a magnetic field, and at least one electrical coil configured to locate within the magnetic field and move in response to received electrical signals. As the electromagnetic transducing mechanism does not require coupling between the magnetic structure and the electrical coil, generally one part of the mechanism will be coupled to the transducer base structure, and the other part of the mechanism will be coupled to the diaphragm assembly. In the preferred configurations described herein, the heavier magnetic structure forms part of the transducer base structure and the relatively lighter coil or coils form part of the diaphragm assembly. It will be appreciated that alternative transducing mechanisms, including for example piezoelectric, electrostatic or any other suitable mechanism known in the art, may otherwise be incorporated in each of the described embodiments without departing from the scope of the invention.

The diaphragm assembly is moveably coupled relative to the base via a diaphragm suspension mounting system. In particular, rotational action audio transducers in which the diaphragm rotatably oscillates relative to the base are described herein. Examples of rotational action audio transducers are shown in the audio transducers of embodiments A, E, K, S, and T. In rotational action audio transducers, the suspension mounting system comprises a hinge system configured to rotatably couple the diaphragm assembly to the base.

The audio transducer may be accommodated with a housing or surround to form an audio transducer assembly, which may also form an audio device or part of an audio device, such as part of an earphone or headphone device which may comprise multiple audio transducer assemblies for example. In some embodiments, the transducer base structure may form part of the housing or surround of an audio transducer assembly. The audio transducer, or at least the diaphragm assembly, is mounted to the housing or surround via a mounting system. A type of mounting system that is configured to decouple the audio transducer from the housing or surround to at least mitigate transmission of mechanical vibrations from the audio transducer to the housing (and vice versa) due to unwanted resonances during operation, for example, will be described with reference to some of the embodiments, and hereinafter referred to as a decoupling mounting system.

The following description has been divided into multiple sections to describe various structures, mechanisms, devices, assemblies or systems relating to audio transducers, and also to describe the various audio transducer embodiments incorporating these structures, mechanisms, devices, assemblies or systems. In particular, the description includes the following major sections:

Overview of audio transducer embodiments;

Diaphragm suspension systems and rotational action audio transducers incorporating the same; and Preferred Transducer Base Structure Design.

Although various structures, assemblies, mechanisms, devices or systems described under these sections are described in association with some of the audio transducer embodiments of this invention, it will be appreciated that these structures, assemblies, mechanisms, devices or systems may alternatively be incorporated in any other suitable audio transducer assembly without departing from the scope of the invention. Furthermore, the audio transducer embodiments of the invention incorporate certain combinations of one or more of various structures, assemblies, mechanisms, devices or systems as will be described. But, it will be appreciated that a person skilled in the art may alternatively construct an audio transducer incorporating any other combination of one or more of the various structures, assemblies, mechanisms, devices or systems described under these embodiments without departing from the scope of the invention.

The following description also includes a section for describing the various suitable audio transducer applications in which the audio transducer embodiments of the invention may be incorporated, or within which an audio transducer including any combination of the various structure, assemblies, mechanisms, devices or systems relating to audio transducers may be incorporated. Audio device embodiments, including personal audio devices such as headphones or earphones, incorporating such transducers will therefore also be described with reference to the drawings.

Methods of construction of audio transducers, audio devices or any of the various structures, assemblies, mechanisms, devices or systems have been described for some but not all embodiments for the sake of conciseness. Methods of construction associated with each of the described embodiments and/or the related structures, assemblies, mechanism, devices or systems that are apparent to those skilled in the relevant art from the following description are therefore also intended to be covered within the scope of this invention. Furthermore, the invention is also intended to cover methods of transducing audio signals using the principles and/or features of the audio transducers and related structures, assemblies, mechanism, devices or systems described herein.

A brief overview of some of the audio transducer embodiments is given first.

1. Overview of Audio Transducer Embodiments

1.1 Embodiment A Audio Transducer

FIGS. 1A-F, 2A-I, 3A-J and 4A-D show an embodiment A audio transducer of the invention. The audio transducer is a rotational action audio transducer that comprises a diaphragm assembly A101 rotatably coupled to a transducer base structure A115 via a diaphragm suspension system. The diaphragm assembly comprises a substantially rigid diaphragm structure A1300. The features of this diaphragm structure are described in detail under section 2.2.2 of this specification. The transducer base structure comprises a substantially rigid and compact geometry designed in accordance with the preferred design described under section 3 of this specification. A detailed description of the transducer base structure is also provided in section 3 of this specification.

As noted, the diaphragm assembly A101 is rotatably coupled to the transducer base structure A115 via a diaphragm suspension system. In this embodiment, a contact hinge system is used to rotatably couple the diaphragm assembly to the transducer base structure. This is shown in detail in FIGS. 2A-I, 3A-J and 4A-D. The features of the contact hinge system relating to this embodiment are described in detail in section 2.2.2 of this specification. In alternative configurations of this embodiment, an alternative contact hinge system may be incorporated in the audio transducer. For example, the audio transducer may comprises: a contact hinge system as designed in accordance with the principles set out in section 2.2.1; a contact hinge system as described under sections 2.2.3b in relation to embodiment S; a contact hinge system as described under section 2.2.3c in relation to embodiment T; a contact hinge system as described under section 2.2.4 in relation to embodiment K; or a contact hinge system as described under section 2.2.5 in relation to embodiment E.

The audio transducer of this embodiment comprises an electromagnetic excitation/transducing mechanism comprising a permanent magnet with inner and outer pole pieces that generate a magnetic field, and one or more force transferring or generation components, in the form of one or more coils that are operatively connected with the magnetic field. This is described in detail under section 2.2.2 of this specification. In alternative configurations of this embodiment, the transducing mechanism may be substituted by any other suitable mechanism known in the art, including for example a piezoelectric, electrostatic, or magnetostrictive transducing mechanism as outlined under section 4 of this specification.

The audio transducer of embodiment A is described in relation to an electroacoustic transducer, such as a speaker. Some possible applications of the audio transducer are outlined in section 5 of this specification.

It will be appreciated that the embodiment A audio transducer may in some configuration be otherwise implemented as an acoustoelectric transducer, such as a microphone as explained in detail under section 5 of this specification.

1.4 Embodiment E Audio Transducer

FIGS. 4A-M, 6A-H, 7 and 8A-C show an embodiment E audio transducer of the invention. The audio transducer is a rotational action audio transducer that comprises a diaphragm assembly E101 rotatably coupled to a transducer base structure E118*a* via a diaphragm suspension system. The diaphragm assembly comprises a substantially rigid diaphragm structure. The features of this diaphragm structure are described in detail under section 2.2.5 of this specification. The transducer base structure comprises a substantially rigid and compact geometry designed in accordance with the preferred design described under section 3 of this specification. A detailed description of the transducer base structure is also provided in section 2.2.5 of this specification.

As noted, the diaphragm assembly E101 is rotatably coupled to the transducer base structure E118*a* via a diaphragm suspension system. In this embodiment, a contact hinge system is used to rotatably couple the diaphragm assembly to the transducer base structure. This is shown in detail in FIGS. 5B-5J and 7. The features of the contact hinge system relating to this embodiment are described in detail in section 2.2.5 of this specification. In alternative configurations of this embodiment, an alternative contact hinge system may be incorporated in the audio transducer. For example, the audio transducer may comprises: a contact hinge system as designed in accordance with the principles set out in section 2.2.1; a contact hinge system as described under section 2.2.2 in relation to embodiment A; a contact hinge system as described under sections 2.2.3b in relation to embodiment S; a contact hinge system as described under section 2.2.3c in relation to embodiment T; or a contact hinge system as described under section 2.2.4 in relation to embodiment K.

Figure 8A:
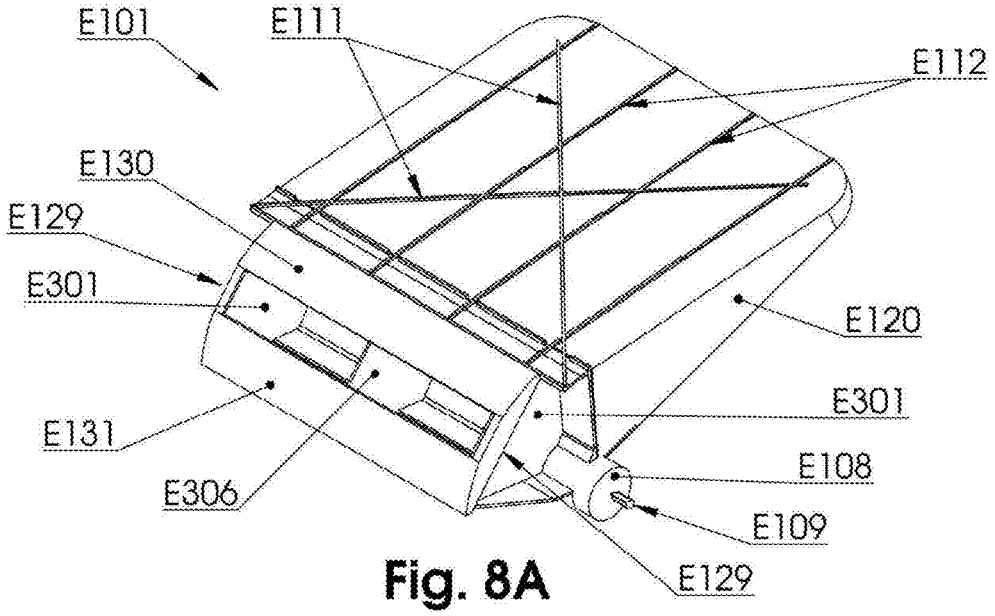
Figure 8B:
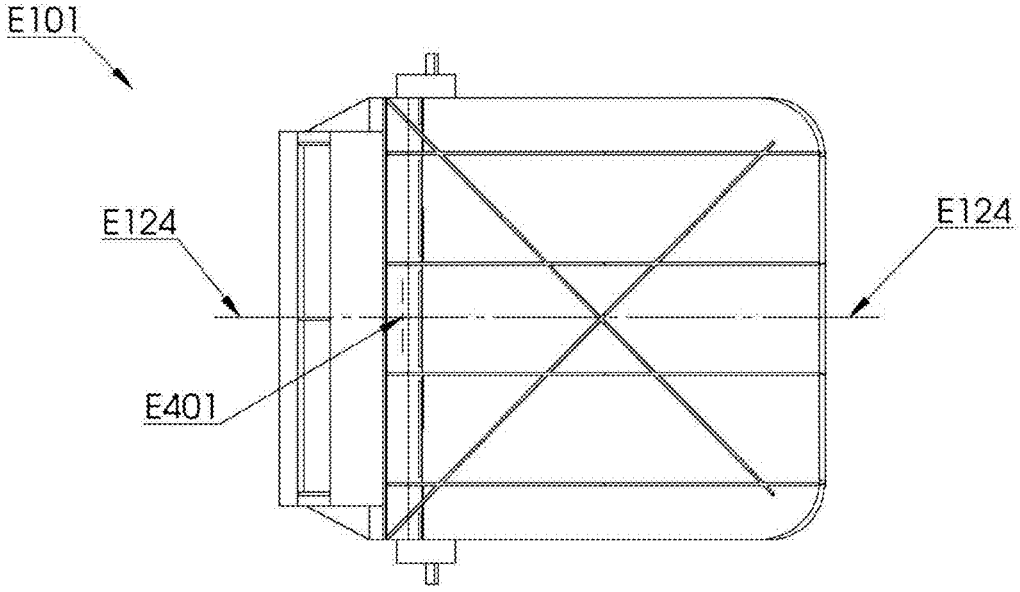
Figure 8C:
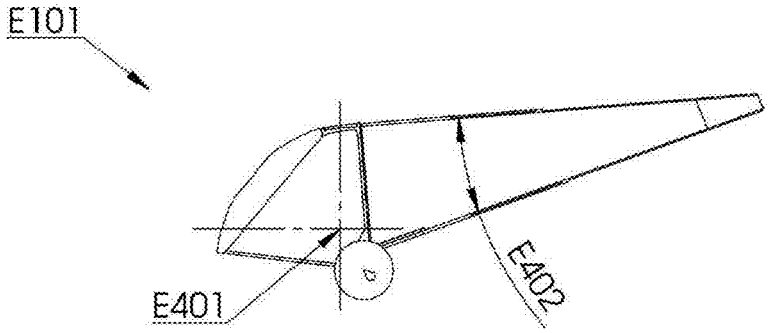

As shown in FIGS. 8A-C, the audio transducer of embodiment E may comprise a diaphragm housing E201 configured to accommodate at least the diaphragm assembly. The diaphragm housing is rigidly coupled and extends from the transducer base structure to house the adjacent diaphragm assembly. The housing in combination with the transducer base structure forms a transducer base assembly. The diaphragm assembly housing is described in detail under section 2.2.2 of this specification. In situ the diaphragm assembly accommodated within the housing comprises an outer periphery that is substantially free from physical connection with an interior of the housing. Air gaps E205 and E206 separate the diaphragm periphery from the housing.

The audio transducer of this embodiment comprises an electromagnetic excitation/transducing mechanism comprising a permanent magnet with inner and outer pole pieces that generate a magnetic field, and one or more force transferring or generation components, in the form of one or more coils that are operatively connected with the magnetic field. This is described in detail under section 2.2.5 of this specification. In alternative configurations of this embodiment, the transducing mechanism may be substituted by any other suitable mechanism known in the art, including for example a piezoelectric, electrostatic, or magnetostrictive transducing mechanism as outlined under section 4 of this specification.

The audio transducer of embodiment E is described in relation to an electroacoustic transducer, such as a speaker. Some possible applications of the audio transducer are outlined in section 5 of this specification.

It will be appreciated that the embodiment E audio transducer may in some configuration be otherwise implemented as an acoustoelectric transducer, such as a microphone as explained in detail under section 5 of this specification.

1.6 Embodiment K Audio Transducer and Personal Audio Device

FIGS. 16A-O, 17, 18A-H, 19 and 20A-D show an embodiment K audio device having an embodiment K audio transducer of the invention. The audio transducer of embodiment K is a rotational action audio transducer that comprises a diaphragm assembly K101 rotatably coupled to a transducer base structure K118 via a diaphragm suspension system. The diaphragm assembly comprises a substantially rigid diaphragm structure. The features of this diaphragm structure are described in detail under section 2.2.4 of this specification. The transducer base structure comprises a substantially rigid and compact geometry designed in accordance with the preferred design described under section 3 of this specification. A detailed description of the transducer base structure is also provided in section 2.2.4 of this specification.

As noted, the diaphragm assembly K101 is rotatably coupled to the transducer base structure K118 via a diaphragm suspension system. In this embodiment, a contact hinge system is used to rotatably couple the diaphragm assembly to the transducer base structure. This is shown in detail in FIGS. 16H-M. The features of the contact hinge system relating to this embodiment are described in detail in section 2.2.4 of this specification. In alternative configurations of this embodiment, an alternative contact hinge system may be incorporated in the audio transducer. For example, the audio transducer may comprises: a contact hinge system as designed in accordance with the principles set out in section 2.2.1; a contact hinge system as described under section 2.2.2 in relation to embodiment A; a contact hinge system as described under sections 2.2.3b in relation to embodiment S; a contact hinge system as described under section 3.2.3c in relation to embodiment T; or a contact hinge system as described under section 2.2.5 in relation to embodiment E.

As shown in FIGS. 18A-H and 19, the audio transducer of embodiment K is preferably housed within a surround K301 of the device configured to accommodate the transducer. The housing may be of any type necessary to construct a particular audio device depending on the application. In the preferred implementation of this embodiment, the audio transducer is housed within a personal audio device, and in particular with a headphone cup of a headphone device. The headphone cup may also comprise any form of fluid passage configured to provide a restrictive gases flow path from the first cavity to another volume of air during operation, to help dampen resonances and/or moderate base boost. This implementation is described in further detail in section 2.2.5 of this specification. Also, as further described in detail under section 2.2.5 of this specification, in situ the diaphragm assembly accommodated within the housing comprises an outer periphery that is substantially free from physical connection with an interior of the housing. In alternative configurations of this embodiment, however, the diaphragm assembly may not have an outer periphery that is substantially free from physical connection with the associated housing in situ.

The audio transducer of this embodiment comprises an electromagnetic excitation/transducing mechanism comprising a permanent magnet with inner and outer pole pieces that generate a magnetic field, and one or more force transferring or generation components, in the form of one or more coils that are operatively connected with the magnetic field. This is described in detail under section 2.2.5 of this specification. In alternative configurations of this embodiment, the transducing mechanism may be substituted by any other suitable mechanism known in the art, including for example a piezoelectric, electrostatic, or magnetostrictive transducing mechanism as outlined under section 4 of this specification.

The audio transducer of embodiment K is described in relation to an electroacoustic transducer, such as a speaker. Some possible applications of the audio transducer are outlined in section 5 of this specification.

It will be appreciated that the embodiment K audio transducer may in some configuration be otherwise implemented as an acoustoelectric transducer, such as a microphone as explained in detail under section 5 of this specification.

1.7 Embodiment S Audio Transducer

FIGS. 21A-H, 22A-E and 23A-E show an embodiment S audio transducer of the invention. The audio transducer is a rotational action audio transducer that comprises a diaphragm assembly S102 rotatably coupled to a transducer base structure S101 via a diaphragm suspension system. The diaphragm assembly comprises a substantially rigid diaphragm structure. The features of this diaphragm structure are described in detail under section 2.2.3b of this specification. The transducer base structure comprises a substantially rigid and compact geometry designed in accordance with the preferred design described under section 3 of this specification.

As noted, the diaphragm assembly S102 is rotatably coupled to the transducer base structure S101 via a diaphragm suspension system. In this embodiment, a contact hinge system is used to rotatably couple the diaphragm assembly to the transducer base structure and is constructed in accordance with the principles set out in section 2.2.1. This is shown in detail in FIGS. 21A-H and 22A-E. The features of the contact hinge system relating to this embodiment are described in detail in section 2.2.3b of this specification. This embodiment shows an alternative contact hinge system which may be incorporated in any rotational action audio transducer embodiment of the invention, including for example embodiments A, E, K and T.

1.8 Embodiment T Audio Transducer

FIGS. 24A-H, 25A-E, 26A-E and 27A-B show an embodiment T audio transducer of the invention. The audio transducer is a rotational action audio transducer that comprises a diaphragm assembly T102 rotatably coupled to a transducer base structure T101 via a diaphragm suspension system. The diaphragm assembly comprises a substantially rigid diaphragm structure. The features of this diaphragm structure are described in detail under section 2.2.3c of this specification. The transducer base structure comprises a substantially rigid and compact geometry designed in accordance with the preferred design described under section 3 of this specification.

As noted, the diaphragm assembly T102 is rotatably coupled to the transducer base structure T101 via a diaphragm suspension system. In this embodiment, a contact hinge system is used to rotatably couple the diaphragm assembly to the transducer base structure and is constructed in accordance with the principles set out in section 2.2.1. This is shown in detail in FIGS. 24A-H, 25A-E and 27A-B. The features of the contact hinge system relating to this embodiment are described in detail in section 2.2.3c of this specification. This embodiment shows an alternative contact hinge system which may be incorporated in any rotational action audio transducer embodiment of the invention, including for example embodiments A, E, K and S.

2. Hinge Systems and Audio Transducers Incorporating the Same

2.1 Introduction

2.1.1 Overview

Diaphragm suspension systems movably couple a diaphragm structure or assembly of an audio transducer to a relatively stationary structure, such as a transducer base structure, to allow the diaphragm structure or assembly to move relative to the stationary structure and generate or transduce sound. The following description relates to rotational action audio transducers, in which a diaphragm structure is configured to rotate relative to a base structure to generate and/or transduce sound. In such audio transducers, a hinge system is required for rotatably coupling the diaphragm structure to the base structure. To minimise the generation of unwanted resonance, it is preferable that the hinge system constrains movement to a single degree of movement, i.e. rotation about a single axis with minimal to zero translational or other rotational movement throughout the frequency range of operation of the audio transducer. Hinge systems of the invention have been developed that enable a diaphragm assembly to move in a substantially single degree of freedom relative to a transducer base structure and/or other stationary parts of the audio transducer. These hinge systems permit a single movement action while also providing high rigidity in terms of all other movements of the diaphragm assembly.

As will be shown in the various embodiments described below, the hinge system may comprise a system of two or more interoperable sub-systems, an assembly of two or more interoperable components or structures, a structure having two or more interoperable components, or it may even comprise a single component or device. The term system, used in this context, is therefore not intended to be limited to multiple interoperable parts or systems.

In each of the audio transducer embodiments described in this section, the hinge system is coupled between the transducer base structure of the audio transducer and to the diaphragm. The hinge system may form part of one or both of the transducer base structure and the hinge system. It may be formed separately from one or both of these components of the audio transducer, or otherwise may comprise one or more parts that are formed integrally with one or both of these components. Modifications to the audio transducer embodiments described below in accordance with these possible variations are therefore envisaged and not intended to be excluded from the scope of the invention.

In the embodiments, the diaphragm assembly incorporates, a force generation component of a transducing mechanism that transduces electricity or movement, and that is rigidly coupled to the diaphragm structure. As the mass of the force generation component is generally high relative to the diaphragm structure, often in the same order of magnitude as the mass of the other parts of the diaphragm assembly, a rigid coupling between the diaphragm structure and the force generation component is preferable in order to prevent resonance modes consisting of the mass of one moving in opposition to the mass of the other.

The transducer base structure may be integrally formed with part of the hinge system, or otherwise rigidly connected to the hinge system by a suitable mechanism, such as using an adhesive agent such as epoxy resin, or by welding, by clamping using fasteners, or by any number of other methods known in the art for achieving a substantially rigid connection between two components/assemblies.

In the preferred configurations of the hinge system, the assembly is connected at at least two substantially widely spaced locations on the diaphragm assembly, relative to the width of the diaphragm body. Likewise, the hinge system is preferably be connected at at least two substantially widely spaced locations on the transducer base structure, relative to the width of the diaphragm body. The connections at these locations may be separate or part of the same coupling.

Suitably wide spacing between connections from the transducer base structure to the diaphragm assembly means that the hinge system or combination of hinge systems are able to effectively resist a range of unwanted diaphragm/transducer base structure resonance modes.

It is also preferable that the connections from the transducer base structure to the hinge system, and from the hinge system to the diaphragm assembly, provide rigidity in terms of translational compliance. When such hinge joint connections are used at a suitably wide spacing the resulting hinge mechanism is able to provide suitable rigidity to the diaphragm assembly such that breakup modes may potentially be pushed to high frequencies and potentially beyond the FRO.

2.1.2 Advantages

Preferred hinge system configurations of the invention, to be fully described in this specification, have potential advantages over conventional diaphragm suspension systems. For example, soft flexible suspension parts used in conventional diaphragm suspension systems, as in the surround J105 and the spider J119, shown in FIGS. 15A and 15B, may be susceptible to mechanical resonances during operation. Further, such suspensions do not sufficiently resist translation of the diaphragm J101 along axes other than the primary axis of movement, and hence can further promote unwanted resonances.

The hinge systems of the invention facilitate a substantially compliant fundamental rotational motion while also providing substantial rigidity in other rotational and translational directions. As such, they can be configured to operatively support a diaphragm in a substantially single degree of freedom mode of operation over a wide bandwidth of the FRO. As the fundamental rotational mode is very compliant, a low fundamental frequency (Wn) of the transducer is facilitated, aiding the high-fidelity reproduction of bass frequencies, and only minimally adversely affecting the high frequency performance.

Yet another potential advantage is that the hinge components themselves are able to be designed (as detailed in this specification) so as not to have their own internal adverse resonances within the audio transducer's FRO.

2.1.3 Preferred Simple Rotational Mechanism Concept

Figure 14A:
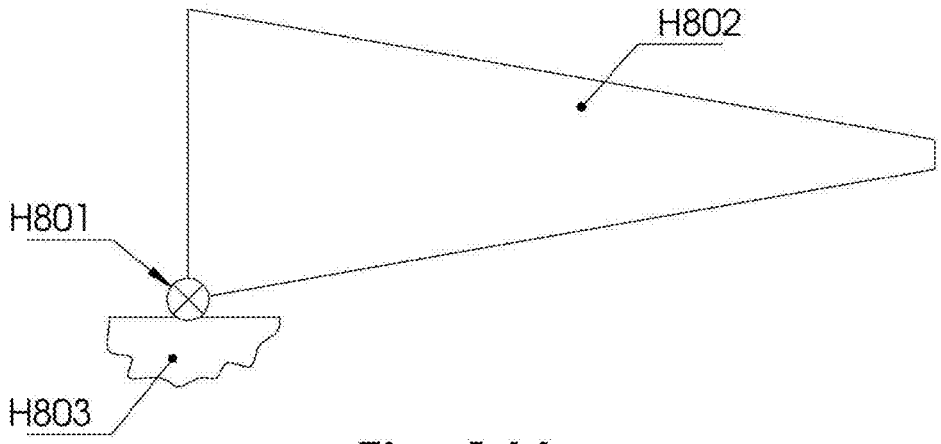
FIG. 14A shows a side view illustration of the concept of a simple rotational diaphragm connected to a transducer base structure.

A simple form of audio transducer diaphragm suspension system for a rotational action audio transducer is a mechanism that limits the motion of the diaphragm assembly to substantially rotational motion about a transducer base structure. FIG. 14A is a schematic that symbolises a diaphragm assembly H802 connected to part of a transducer base structure H803 by a hinge system H801. In this schematic, the diaphragm assembly H802 is illustrated in the shape of a wedge, however it will be appreciated that a range of alternative shapes and hinge locations may be implemented and the configuration shown is to aid description and not intended to be limiting unless otherwise stated. There is an approximate axis of rotation, or hinging axis, of the diaphragm assembly H802 with respect to the transducer base structure H803. This configuration is preferable to the four-bar linkage configurations described later in this document with reference to FIGS. 14B-C. In the preferred form hinge system of the invention, the hinge system is configured to constrain movement of the associated diaphragm assembly to a single degree of motion (preferably pivotal motion about a single axis of rotation) within the desired FRO, as allowing other modes of operation that store and release energy can add distortion to the audio being transduced.

2.1.4 the Four-Bar Linkage Concept

Figure 14B:
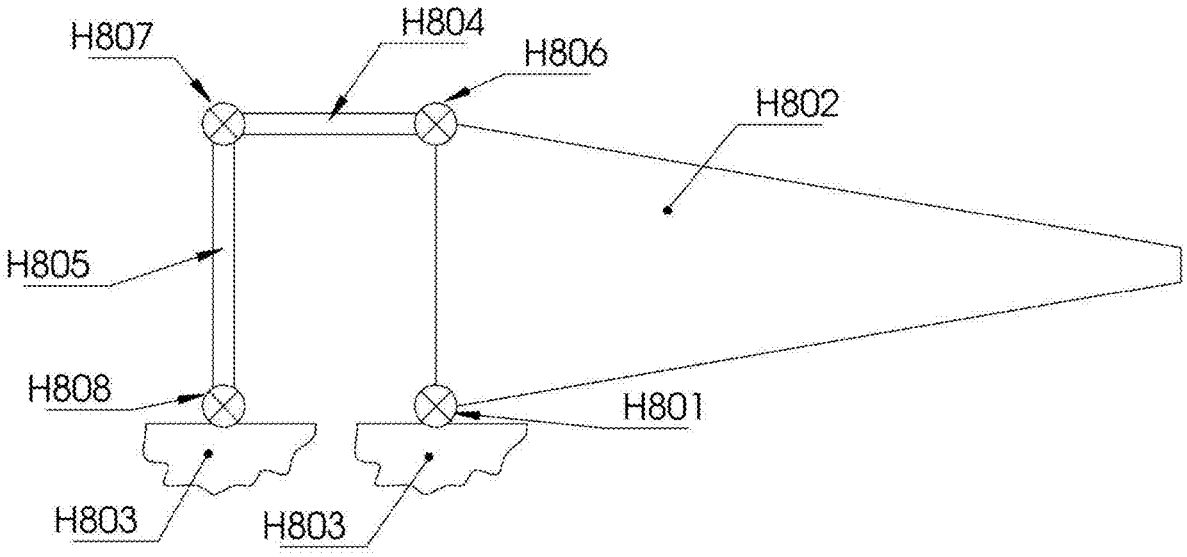
FIG. 14B shows a side view illustration of the concept of a simple rotational diaphragm connected to a transducer base structure and including a four-bar linkage mechanism.

An example of a single degree of freedom type of audio transducer diaphragm suspension comprises a four-bar linkage mechanism, with a hinge system located at each corner of the four-bar linkage. An example of such a concept is shown in the schematic of FIG. 14B, whereby the diaphragm assembly H802 is connected to part of a transducer base structure H803 by hinge system H801 (as per the concept illustrated in FIG. 14A). In addition, hinge systems H806, H807 and H808, are connected by bars H804 and H805. Hinge system H806 is linked to the diaphragm assembly H802 and bar H805 links the preceding hinge systems H807 and H806 to the transducer base structure via hinge system H808. The bars are shaped as long and slender beams in the figure to represent a linkage member however these members may be of any form of shape or size and the invention is not intended to be limited to any particular shape or size unless stated otherwise. In this concept, parts of a transducing mechanism could be attached to bars H804 or H805 (or even the diaphragm H802).

Figure 14C:
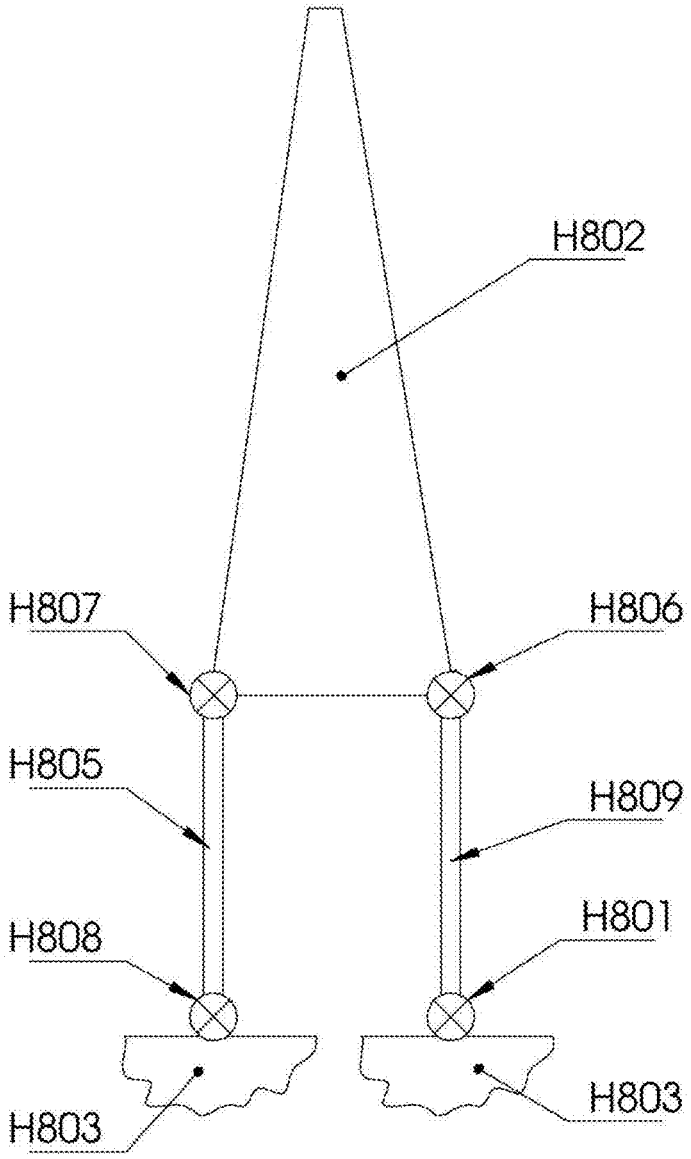
FIG. 14C shows a side view illustration of the concept of a simple diaphragm suspension mechanism including a four-bar linkage mechanism.

FIG. 14C illustrates another example of a diaphragm suspension system utilising a four-bar linkage mechanism with multiple hinge systems. This concept is similar to the version illustrated in FIG. 14B, however the diaphragm is connected between hinging mechanisms H806 and H807 (instead of bar H804) and a bar H809 links hinge systems H806 and H801 (instead of the diaphragm). As the bars H805 and H809 are of equal length (in this example) this mechanism translates the diaphragm substantially compared to the rotational component of motion (relative to the transducer base structure). This mechanism confines the motion of the diaphragm such that it always points in the same direction, yet the tip of the diaphragm still scribes a significant arc (relative to the base structure).

Many variations on this action can be made by varying the length of the bars and the distances between the hinge systems.

The purpose of the four bar linkage is to provide a mechanism that limits the motion of the diaphragm to a single degree of freedom. By using hinge joints described herein, each providing high compliance in all directions except their designed rotational direction, the overall four bar linkage mechanism confines the diaphragm to single mode of motion and restricts undesired motion that may distort the sound that the diaphragm produces.

An advantage of using mechanisms, such as are shown in FIGS. 14A, 14B and 14C, is that a force generation component can be positioned in a location where the distance it moves is not necessarily the same as the diaphragm. A piezo transducer, for example (which in general is optimised for maximum operating efficiency without much distance travel) could be located closer to the diaphragm axis of rotation, or located connecting one bar to another bar etc., depending on the optimum travel required for that transducing mechanism.

Other configurations of multiple hinge systems can be configured to operatively support the diaphragm in use.

2.2 Contact Hinge System

The rigid load-bearing elements and rotational symmetry exhibited by bearing race based hinge systems, such as that of the Phoenix Gold Cyclone loudspeaker, means that in certain cases, and unlike the majority of other previous diaphragm suspension designs, low compliance may be provided in along all three orthogonal translational axes. The problems with an entirely rigid hinge of this type where there is almost zero compliance along all three orthogonal translational axes, is that the hinge becomes susceptible to malfunction, for instance due to manufacturing variances (e.g. bumps on the bearing ball) or when dust or other foreign matter is introduced into the hinge for example.

Hinge system configurations for an audio transducer that have been designed to address some of the shortcomings mentioned above will now be described in detail with reference to some examples. The following configurations comprise a diaphragm assembly suspension hinge system incorporating at least one hinge element that rolls or pivots rigidly against an associated contact member and which is held firmly in place by a biasing mechanism such that the biasing mechanism is capable of applying a reasonably constant force to the contact join. The biasing mechanism is preferably substantially compliant along at least one translational axis or in at least one direction. The compliance of the biasing mechanism is preferably substantially consistent, able to be repeatedly manufactured, and/or not susceptible to environmental or operational variances. Such a hinge system will hereinafter be referred to as contact hinge system.

As will be shown in the various embodiments described below, the biasing mechanism may comprise two or more interoperable systems, an assembly of two or more interoperable components or structures, a structure having two or more interoperable components, or it may even comprise a single component or device. The term mechanism, used in this context, is therefore not intended to be limited to multiple interoperable parts or systems.

2.2.1 Contact Hinge System—Design Considerations and Principles

Figure 13A:
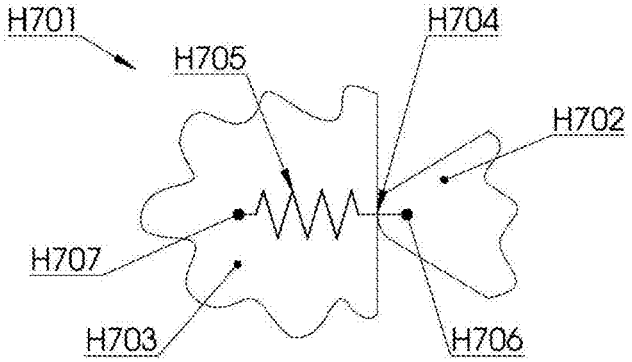
Figure 13B:
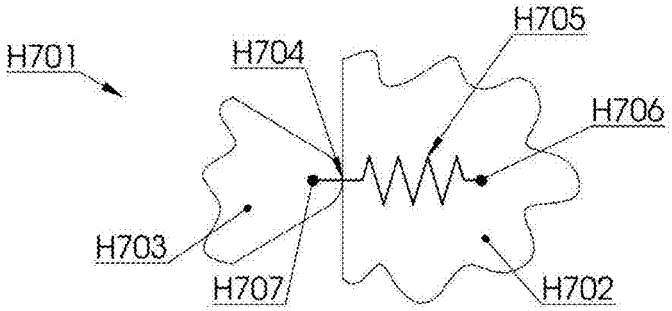
Figure 13C:
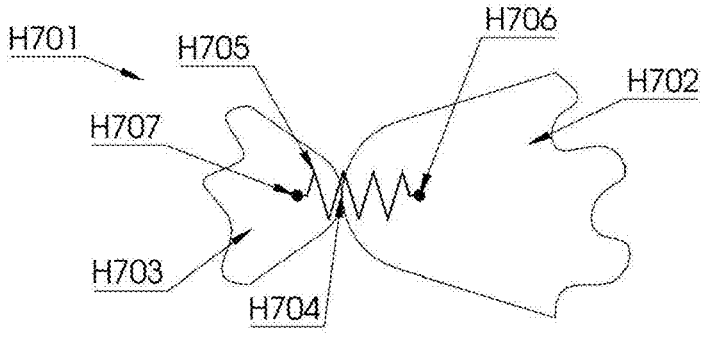

Referring to FIGS. 13A-C concepts and principles for designing a contact hinge system for a rotational action audio transducer (having a diaphragm assembly rotatably coupled to a transducer base structure via the hinge system) in accordance with the invention will now be described. This will be followed by a description of exemplary hinge system embodiments that are designed in accordance with these concepts/principles.

Examples of basic hinge joints H701 of a contact hinge system of the invention is schematically depicted in FIGS. 13A to 13D.

A contact hinge joint comprises two components configured to contact each other in a manner that allows one to rotate relative to the other, for example allowing motions such as rocking, rolling, and twisting. Preferably, the hinge joint of the hinge system substantially defines the axis of rotation of the diaphragm assembly relative to the transducer base structure.

FIG. 13A shows a hinge joint H701 whereby a first component, herein referred to as a hinge element H702, contacts a second component, herein referred to as a contact member H703, at a contact point/region H704. At the contact point/region H704, the hinge element H702 has a substantially convexly curved surface and the contact member H703 has a substantially planar surface. It will be appreciated that in this specification, reference to a convexly curved or concavely curved surface or member, is intended to mean a convex or concave curve across at least a cross-sectional plane that is substantially perpendicular to the axis of rotation.

FIGS. 13A-D show a biasing mechanism H705 symbolised as a coil spring in tension that applies a force to the hinge element H702 at location H706 and an opposing force to the contact member H703 at location H707 such that the hinge element and the contact member are held together in a compliant manner. Although a spring symbol is used, the biasing mechanism may take the form of structures or systems other than a spring, examples of which are described herein. Although the spring symbol depicts a separate structure to the hinge element and the contact member, the biasing mechanism may comprise or incorporate either or both of the hinge element and the contact member, and in fact may not be separate at all. Examples of such biasing mechanism configurations are also described herein.

FIG. 13B shows a hinge joint H701 whereby the hinge element H702 contacts the contact member H703 at a contact point/region H704. At the contact point/region H704 the hinge element H702 has a substantially planar surface and the contact member H702 has a convexly curved surface.

FIG. 13C shows a hinge joint H701 whereby the hinge element H702 contacts the contact member H703 at a contact point/region H704. At the contact point/region H704, the hinge element H702 has a convexly curved surface and the contact member H703 also has a convexly curved surface. The hinge element H702 comprises a surface of relatively larger radius (or is relatively more planar) than the surface of the contact member H703.

Figure 13D:
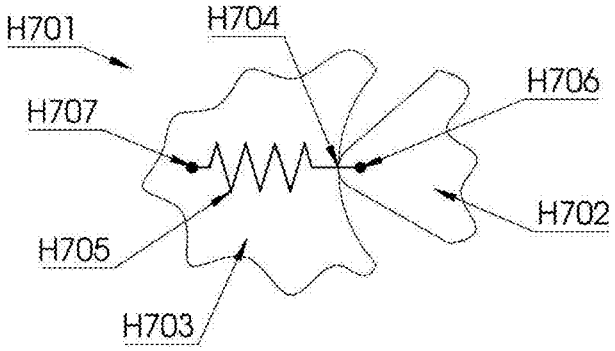

FIG. 13D shows a hinge joint H701 whereby the hinge element H702 contacts the contact member H703 at a contact point/region H704. At the contact point/region H704, the hinge element H702 has a convexly curved surface and the contact member has a concavely curved surface H703.

These are four examples of contact hinge joints. It will be appreciated that other configurations are possible, for example the hinge element may be concavely curved at the contact point/region and the contact member may be convexly curved at this same point/region. In some cases where two surfaces are convexly curved, one surface may have a relatively larger radius than the other as in FIG. 13C and this may be either the hinge element or the contact member surface, or in other cases the two surfaces may have radii that are substantially the same. The cross-sectional profile, viewed in a plane perpendicular to the axis of rotation of either component does not necessarily have a constant radius. Other profiles shapes could be used, such as a parabolic curve.

2.2.1a Curvature Radius at the Contact Point/Region

In accordance with the above examples, one of the hinge element H702 or contact member H703 will have a convexly curved surface of relatively smaller radius/sharper curvature than the other surface, or at least of equal radius, when viewed in cross-sectional profile in a plane perpendicular to the axis of rotation. This curved surface of relatively smaller or at least equal radius, preferably comprises a radius that is sufficiently small so as to provide sufficiently low resistance to rolling over the opposing surface during operation.

This is so that hinge joint enables:

- a fundamental frequency (Wn) of operation of the audio transducer that is relatively low,
- a level of noise generation that is relatively low, and/or
- hinge performance that is sufficiently consistent in cases where the contacting surfaces have discontinuities due to manufacturing variances and/or the introduction of foreign matter such as dust between the surfaces.

This radius is preferably also not too small and overly sharp because a significantly reduced rolling area at the contact point/region contact may be prone to localized deformation and undue compliance. There is a therefore a compromise that needs to be considered in establishing the required/desired curvature radius for the convex contact surface.

Furthermore, when designing the required curvature radius for the more convexly curved surface the following factors can be taken into consideration:

For diaphragms assemblies/structures that are relatively longer or larger, the radius of curvature of the convexly curved surface can generally be made relatively larger, and for relatively shorter or smaller diaphragm assemblies/structures the curvature radius can be made relatively smaller; and/or For audio transducers that do not require a relatively low fundamental frequency of operation (such as a dedicated treble driver for example) a relatively larger curvature radius (larger rolling area) at the contact surface may be used, and for audio transducer that require a relatively low fundamental frequency a relatively smaller curvature radius (smaller rolling area) may be used.

For example, when determining the curvature radius, preferably the contact surface of the hinge element or the contact member, whichever one has a convexly curved surface that is relatively less planar/relatively smaller radius of curvature, (when viewed in cross-sectional profile in a plane perpendicular to the axis of rotation), has curvature radius r in meters satisfying the relationship:

$$r > \frac{E \cdot l}{1000{,}000{,}000} \times (2\pi f)^2$$

where l is the distance in meters from the axis of rotation of the hinge element to the most distal edge of the diaphragm structure (relative to the contact member), f is the fundamental resonance frequency of the diaphragm in Hz, and E is a constant that is preferably approximately between 3-30, such as for example 3, more preferably 6, more preferably 12, even more preferably 20, and most preferably 30.

Alternatively or in addition, when determining the curvature radius, preferably the contact surface of the hinge element or the contact member, whichever one has a convexly curved surface that is relatively less planar/relatively smaller radius of curvature, when viewed in cross-sectional profile in a plane perpendicular to the axis of rotation, has a curvature radius r in meters satisfying the relationship:

$$r < \frac{E \cdot l}{1000{,}000{,}000} \times (2\pi f)^2$$

where l is the distance in meters from the axis of rotation of the hinge element to the most distal edge of the diaphragm structure relative to the contact member, f is the fundamental resonance frequency of the diaphragm in Hz, and E is a constant in the range of approximately 140-50, such as 140, more preferably 100, more preferably again 70, even more preferably 50, and most preferably 40.

2.2.1b Rolling Resistance

The rolling resistance of the hinge element and the contact member should preferably be low compared to the inertia of the diaphragm assembly, in order to reduce the fundamental resonance frequency of the diaphragm. Preferably, the surfaces of the hinge element and contact member that roll against each other during normal operation are substantially smooth, allowing a free and smooth operation.

Rolling resistance can be reduced by reducing the curvature radius at a rolling contact surface. Preferably, whichever is the smaller curvature radius, when viewed in cross-sectional profile in a plane perpendicular to the axis of rotation, out of that of the contacting surface of the hinge element and that of the contact member, has a curvature radius that is less than approximately 30%, more preferably still less than approximately 20%, and most preferably less than approximately 10% of the greatest distance, in a direction perpendicular to the axis of rotation, across all components effectively rigidly connected to the localised part of the same component that is immediately adjacent to the contact location. For example in the case of embodiment A audio transducer shown in FIGS. 1A-F to 4A-D, the rigid diaphragm assembly A101 has a maximum length in a direction perpendicular to the axis of rotation A114 equal to the diaphragm body length A211. The radius of curvature of the shaft A111 at the location of contact A112 with the planar surface of the contact bar A105 of the transducer base structure A114 is approximately less than 10% of the diaphragm body length A211.

Alternatively or in addition whichever one of the contacting surface of the hinge element and the contact surface of the contact member that has the smaller curvature radius, when viewed in cross-sectional profile in a plane perpendicular to the axis of rotation, also has a radius that is less than 30%, more preferably less than 20%, and most preferably less than 10% of the distance, in a direction perpendicular to the axis of rotation, across the smaller out of:

1) The maximum dimension across all components effectively rigidly connected to parts of the contact surface in the immediate vicinity of the contact location with the hinge element, or
2) The maximum dimension across all components effectively rigidly connected to parts of the hinge element in the immediate vicinity of the contact location with the contact surface.

As diaphragm inertia generally increases with increasing diaphragm length, it is preferable that whichever of the contacting surface of the hinge element and the contact surface of the contact member that has the smaller curvature radius, when viewed in cross-sectional profile in a plane perpendicular to the axis of rotation, also has a radius that is relatively small compared to the length of the diaphragm, as measured from the axis of rotation of the two parts to the furthest periphery of the diaphragm. Preferably, this radius should be less than 5% of the diaphragm length.

2.2.1c Contact Points and Contact Lines

FIGS. 13A to 13D all show a side view of a contact hinge system hinge joint. In some forms, the contact member and hinge element are substantially longitudinal and may have a longitudinal profile, in the direction of the axis of rotation, whereby the contacting surfaces of these parts have the same cross-section along the length of the part. In this form a contact line exists between the hinge element H702 and the contact member H703. A contact line can be considered to be a series of contact points, so in this case the contact point H704 indicated in FIG. 13A would be part of this contact line. This configuration means that the hinge element H702 is confined to an approximate axis of rotation relative to the contact member H703. If a hinge system uses a hinge joint as explained above that has a line of contact, then it is preferable that any additional hinge joint, used as part of the same hinging mechanism/assembly, has a contact point or line of contact, that remain(s) substantially collinear to the line of contact of the first hinge joint in order to help ensure that the mechanism works freely and without constraint.

In another form, the hinge joint H701 might only contact at a single point. For example, if, in the case of hinge joint shown in FIG. 13A, the hinge element H702 had a spherical surface at the contact point H704, then there would not be a contact line, just a contact point.

2.2.1d Biasing Mechanism

In order for the basic hinge joint H701 to operate as desired, the hinge element preferably remains in direct and substantially consistent contact with the contact member. To achieve this, the hinge joint H701 may be supported by a biasing mechanism H705 which applies a sufficiently large and consistent force that, either directly or indirectly, holds the hinge element H702 against the contact member H703 during the course of normal operation, or in other words maintains frictional engagement between the contact surfaces. In addition, the biasing mechanism H705 is preferably compliant in a direction substantially perpendicular to the tangential plane of the contact surface of the convexly curved surface of smaller radius to enable efficient pivotal movement of the hinge as will be described.

Examples of this component will be described later in this document with reference to embodiments.

Biasing Force

The biasing mechanism H705 applies a significant and consistent force which, either directly or indirectly, holds the hinge element H702 against the contact member H703 during the course of normal operation.

Preferably the biasing mechanism is configured to apply a sufficient biasing force to each hinge element such that when additional forces are applied to the hinge element, and the vector representing the net force passes through the region of contact of the hinge element with the contact surface and is relatively small compared to the biasing force, the substantially consistent physical contact between the hinge element and the associated contact member rigidly restrains the hinge element at the contact region against translational movements relative to the contact surface in a direction perpendicular to the contact surface at the contact region.

The contact between the hinge element H702 and the contact member H703, facilitated by the biasing mechanism H705, results in friction, preferably non-slipping static friction, which causes the hinge element to be rigidly restrained against translational displacements relative to the contact member at the point of contact.

For a hinge system that comprises several hinge joints, it is possible that a single biasing mechanism can be used to apply the force required to hold the hinge elements against their respective contact members within multiple hinge joints. For example, a single spring connected between a diaphragm assembly and a transducer base structure could apply a force at the middle of the base of a diaphragm assembly, holding it towards the transducer base structure and producing a reaction force within hinge joints located towards each side of the diaphragm.

Preferably a substantial amount of the contacting force between the hinge element and the contact member is provided by the biasing mechanism. The biasing mechanism is therefore a physical component, structure, system or assembly, rather than an external means of biasing such as gravity, or loads applied by the force generation component during the course of operation for example. Gravity is, in general, too weak to effectively bias together the components of a contact hinge joint for example. If the force used is too weak then components run the risk of slipping unpredictably or rattling.

Slippage can create disproportionately loud distortion since such movement may be mechanically amplified via the lightweight diaphragm, hence it is highly desirable if slippage events do not occur during normal operation, or that if they do occur they are infrequent.

Additionally, and as mentioned above, translational compliance at a pivot, or at a rolling joint interface, may reduce with increasing contact force, meaning that increased contact force may result in a reduction in diaphragm resonances.

Preferably the net force applied by all biasing mechanisms is greater than the force of gravity acting on the diaphragm assembly and/or is greater than the weight of the diaphragm assembly.

The net force applied by all biasing mechanisms is therefore preferably greater than the force of gravity acting on the diaphragm assembly and/or greater than the weight of the diaphragm assembly, or more preferably greater than approximately 1.5 times the force of gravity and/or more preferably greater than approximately 15 times the weight of the diaphragm assembly. This is especially preferable in applications where the transducer may be operated at different angles of orientation, such as in headphones and earphones, as it is important that the transducer continues to function properly if the force of gravity acts in the opposite direction to that of the force applied by the biasing mechanism. Preferably the biasing force is substantially large relative to the maximum excitation force of the diaphragm assembly. Preferably the biasing force is greater than 1.5, or more preferably greater than 2.5, or even more preferably greater than 4 times the maximum excitation force experienced during normal operation of the transducer.

It is also preferable that the biasing force is larger for a diaphragm assembly with greater inertia, and also larger for a diaphragm assembly that operates at higher frequencies.

In order that the biasing force is sufficient to minimize diaphragm resonances, preferably the average ($\Sigma F_n/n$) of all the forces in Newtons ($F_n$), biasing each hinge element towards its associated contact surface within the number n of hinge joints of this type within the hinge system, the rotational inertia of the diaphragm assembly about the axis of rotation of the diaphragm assembly with respect to the contact surface in $kg \cdot m^2$ (I), and the fundamental resonance frequency of the diaphragm in Hz (f) consistently satisfies the following relationship, when constant excitation force is applied such as to displace the diaphragm to any position within its normal range of movement:

$$\frac{\sum F_n}{n} > D \times \frac{1}{n} \times (2\pi f)^2 \times I$$

where D is a constant preferably equal to 5, or more preferably equal to 15, or even more preferably equal to 30, or more preferably equal to 40.

If the biasing force is too large this can unduly restrict the fundamental diaphragm resonance frequency, and can make the transducer susceptible to noise generation at low frequencies, for example if dust gets into the contact region.

Therefore, preferably the average ($\Sigma F_n/n$) of all the forces in Newtons ($F_n$) biasing each hinge element towards its associated contact surface within the number n of hinge joints of this type within the hinge system, consistently satisfies the following relationship when constant excitation force is applied such as to displace the diaphragm to any position within its normal range of movement:

$$\frac{\sum F_n}{n} < D \times \frac{1}{n} \times (2\pi f)^2 \times I$$

where D is a constant preferably equal to 200, or more preferably equal to 150, or more preferably equal to 100, or most preferably equal to 80.

As has been described above, each biasing mechanism applies a biasing force compliantly in order to provide a degree of constancy of contact force.

As mentioned the biasing mechanism H705 is preferably also designed or configured to apply a force that is sufficient to firmly hold the hinge element H702 against the contact member H703. The amount of force applied by the biasing mechanism may be dependent on a number of factors including (but not limited to):

The intended FRO of the audio transducer;

The rotational inertia of the diaphragm structure or assembly and/or the length, width, depth shape or size of the diaphragm structure or assembly; and/or The mass of the diaphragm structure or assembly.

Preferably the net force F biasing a hinge element to a contact member satisfies the relationship:

$$F > D \times (2\pi f_l)^2 \times I_s$$

where $I_s$ (in kg·m$^2$) is the rotational inertia, about the axis of rotation, of the part of the diaphragm assembly that is supported by the hinge element, $f_l$ (in Hz), is the lower limit of the FRO, and D is a constant preferably equal to 5, or more preferably equal to 15, or more preferably equal to 30, or more preferably equal to 40, or more preferably equal to 50, or more preferably equal to 60, or most preferably equal to 70.

Preferably the above relationship is satisfied consistently, at all angles of rotation of the hinge element relative to the contact member during the course of normal operation.

In general, increasing the biasing force will form a stiffer and more rigid connection thereby mitigating or partially alleviating potential unwanted translational movement of the hinge element H702 relative to the contact member H703. This means, a higher force may be desirable in some cases and particularly so for audio transducers intended to operate at relatively high frequencies, such as treble drivers. Also a high diaphragm structure mass, means a higher force may be required to maintain sufficient contact during operation at high frequencies. At low frequencies of operation, such as for bass drivers, a relatively high biasing force can have a negative impact in that it may cause noise generation and/or resistance to movement due to higher frictional/contact forces during rolling of the contact surfaces. Also a high rotational inertia of the diaphragm structure may mean a higher contact force can be used without overly compromising operation at low frequencies, all else being equal.

Biasing Compliance

The biasing mechanism preferably applies a force that is compliant in a lateral direction with respect to the contact surfaces, such that rolling resistance originating in the hinge system may be reduced in certain circumstances during operation. In other words, the biasing mechanism, introduces a level or degree of compliance between the hinge element and contact member to enable the hinge element to rotate or roll relative to the contact member about the desired axis of rotation, and also to allow some relative lateral movement in some circumstances.

The degree or level of compliance of the biasing mechanism may also affect the oscillation frequency of the diaphragm during operation, similar to the way that an object attached to a spring is affected by the stiffness of the spring. Therefore, the compliance of the biasing mechanism may also be designed with one or more factors taken into consideration including (but not limited to) the audio transducer's intended FRO. For an audio transducer configured to operate at relatively low frequencies for example, such as a bass driver, the biasing mechanism compliance can be relatively high, whereas for a transducer configured to operate at a relatively high frequency, such as a treble driver, the biasing mechanism compliance can be relatively low (i.e. stiff) without unduly affecting performance at the lower end of the FRO.

Other hinge system compliances may also be taken into consideration when designing the hinge system and these will be explained in some detail further below. Preferably the biasing mechanism is sufficiently compliant such that:

when the diaphragm assembly is at a neutral position during operation; and an additional force is applied to the hinge element from the contact member, in a direction through the a region of contact of the hinge element with the contact surface that is perpendicular to the contact surface; and the additional force is relatively small compared to the biasing force so that no separation between the hinge element and contact member occurs;

the resulting change in a reaction force exerted by the contact member on the hinge element is larger than the resulting change in the force exerted by the biasing mechanism.

Preferably the biasing structure compliance excludes compliance associated with and in the region of contact between non-joined components within the biasing mechanism, compared to the contact member.

Preferably the biasing mechanism H705 is sufficiently compliant such that the biasing force it applies does not vary by more than 200%, or more preferably 150% or most preferably 100% of the average force when the transducer is at rest, when the diaphragm traverses its full range of excursion.

A computer model simulation method such as Finite element analysis (FEA) of the structure can be used to analyze compliance inherent in a biasing mechanism. For example, a force can be applied to a hinge element, from the contact surface, and the displacement due to compliance in the biasing mechanism can then be observed. Preferably the stiffness k (where "k" is as defined under Hook's law) of the biasing mechanism acting on a hinge element is less than 5,000,000, more preferably is less than 1,000,000, more preferably is less than 500,000, more preferably is less than 200,000, more preferably is less than 100,000, more preferably is less than 50,000, more preferably is less than 20,000, more preferably is less than 5,000, and most preferably is less than 500.

Preferably, when the diaphragm is at its equilibrium displacement during normal operation, if two equal and opposite forces are applied perpendicular to the contacting surfaces, one force to each surface, in directions such as to separate them, the ratio dF/dx between a small increase in force in Newtons (dF), above and beyond the force required to just achieve initial separation, and the resulting change in separation at the surfaces in meters (dx) resulting from deformation of the rest of the driver, excluding compliance associated with and in the localized region of points of contact between non-joined components within the biasing mechanism, is less than 10,000,000. More preferably, this is less than 5,000,000, more preferably less than 3,000,000, more preferably is less than 1,000,000, more preferably is less than 500,000, more preferably is less than 200,000, more preferably is less than 100,000, more preferably is less than 40,000, more preferably is less than 10,000, more preferably is less than 1,000, and most preferably is less than 500.

dF/dx can be thought of as the rigidity (or inverse compliance) of the structure in terms of translational forces applied to a hinge joint, in a direction perpendicular to the contact surfaces and such as to separate the hinge element and the contact surface.

Note that compliance associated with localised points of contact between rigid materials, for example due to microscopic surface features, is not always useful in the context of analysis of biasing mechanism compliance, and so may be neglected. This is because such compliance may be inconsistent with diaphragm excursion, time/wear, if dust enters the gap, and between units due to manufacturing variations. The biasing mechanism therefore preferably provides compliance via more controllable, reliable and manufacturable structures.

If computer simulation is used to determine compliance, and if one desires to exclude compliance associated with and in the localized region of points of contact between non-joined components within the biasing mechanism, for reasons outlined above and also to avoid inaccuracy associated with an inability of computer simulations to calculate compliance in point load situations, these contact points can be replaced with a very small solid connection, equivalent to a spot weld. Such connections should be sufficiently small such that resistance to pivoting (the equivalent to rolling for the purposes of the analysis) at said point is negligible compared to other sources of compliance affecting the variables being investigated. Additionally, care should be taken that spot welds are only applied to joints that are in compression, and that joints that are in tension are free to separate as would occur in the real-world scenario.

Figure 16B:
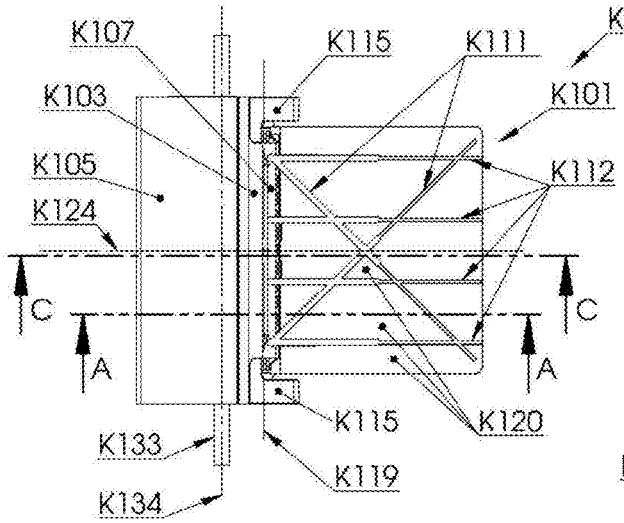
FIG. 16B being a plan view of the embodiment K driver.
Figure 16A:
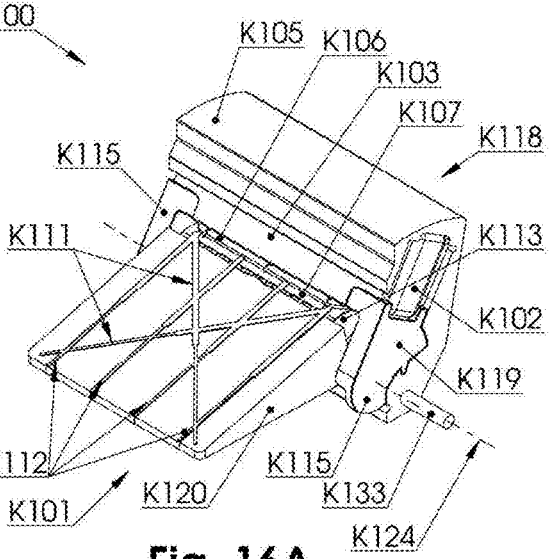
Figure 16C:
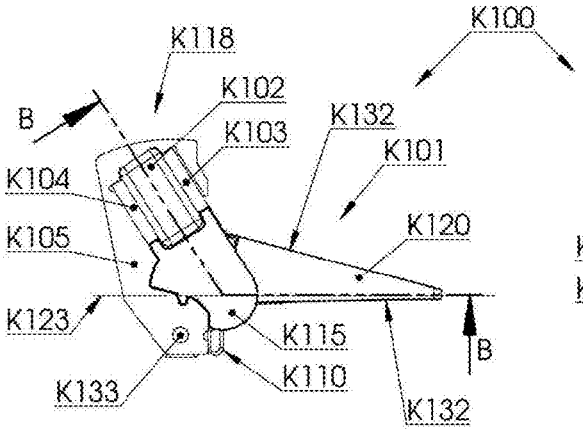
FIG. 16C being a side elevation view of the embodiment K driver.
Figure 16D:
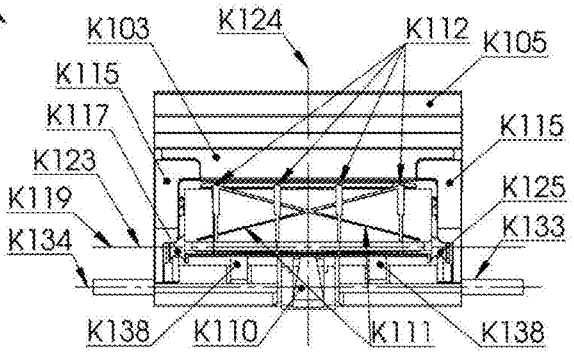
FIG. 16D being a front (tip of diaphragm) elevation view of the embodiment K driver, FIG. 16E being a bottom view of the embodiment K driver, FIG. 16F detail view of a side member shown in FIG. 16E, FIG. 16G being a cross-sectional view (section A-A of FIG. 16B), FIG. 16H being a detail view of the magnetic flux gap shown in FIG. 16G, FIG. 16I being a detail view of the hinging joint shown in FIG. 16G, FIG. 16J being a cross-sectional view (section B-B of FIG. 16K), FIG. 16K being a detail view of the side member shown in FIG. 16J, FIG. 16L being a cross-sectional view (section C-C of FIG. 16B), FIG. 16M being a detail view of the biasing spring shown in FIG. 16L, FIG. 16N being an exploded 3D isometric view of the embodiment K driver, FIG. 16O being a detail view of the diaphragm base frame shown in FIG. 16N.
Figure 16E:
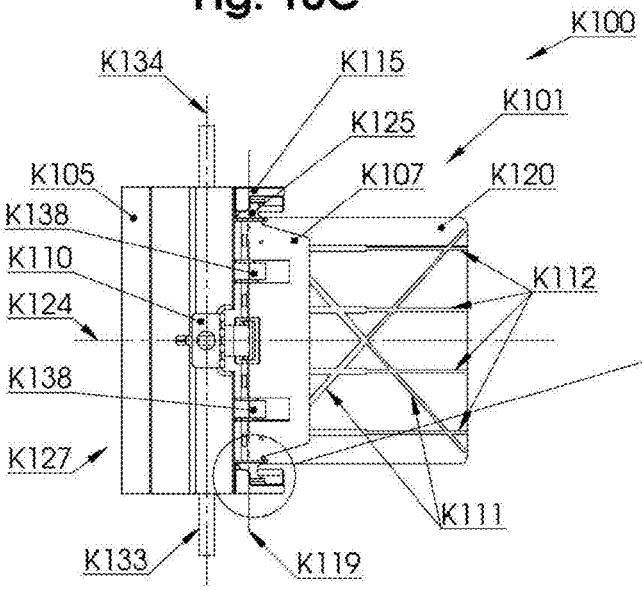
Figure 16F:
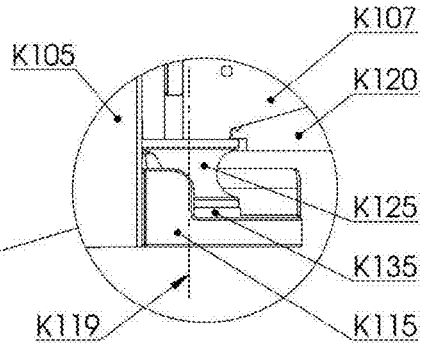
Figure 16H:
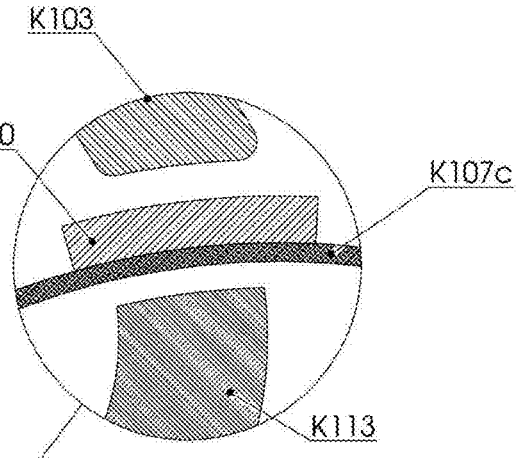
Figure 16G:
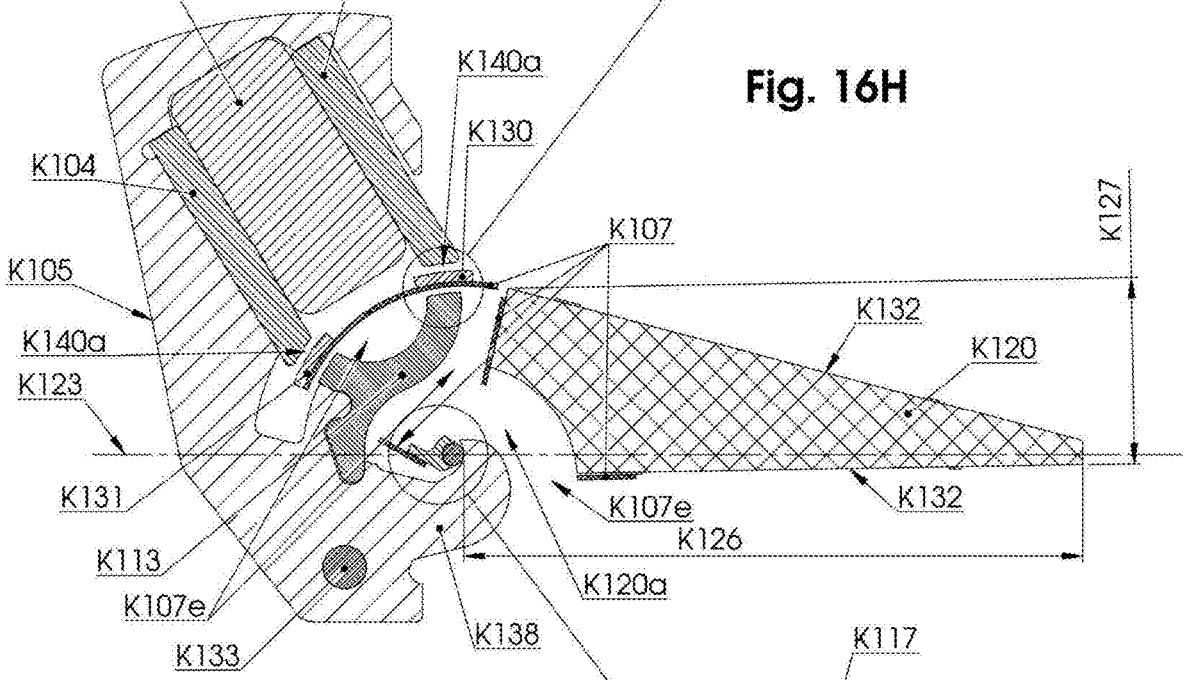
Figure 16I:
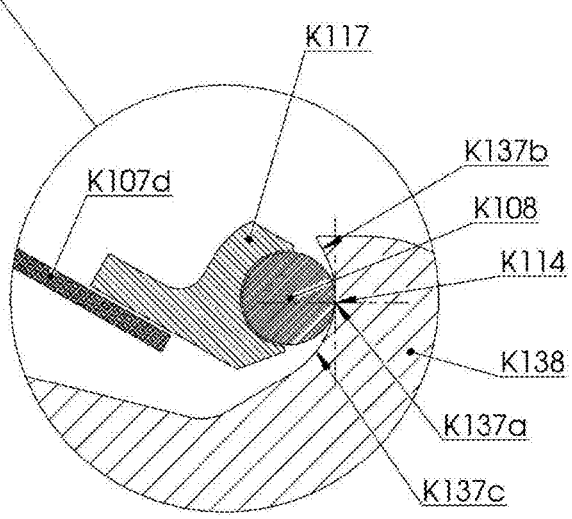

As an example, referring to FIGS. 16G and 16I, which show a contact hinge system in an embodiment K audio transducer, to analyze the compliance inherent in the biasing mechanism of this hinge system one possible method is to apply, at a first contact location k114 to be analyzed, a force separating the hinge element K108 from the contact member K138 (refer to FIGS. 16G and 16I.) The force is then varied to determine, by trial and error that required to only just cause separation at first contact location K114. Once a small separation has been achieved, the other contact surfaces or surface of the hinge system (there is only one other in this example) are observed to see whether separation occurs. If separation occurs at another contact location then this is fine, or if no separation occurs then a very small 'spot weld' is added to the model at this location in order to join the contacting elements in terms of translations towards/away from one-another, and thereby eliminate compliance associated with microscopic surface features at this location. This isolates the analysis towards compliance associated with the biasing mechanism, as opposed to microscopic surface features or inaccurate analysis associated with a point load. The force applied is then be increased, and the associated change in separation is observed. The increase in force combined with the change in separation indicates the compliance of the biasing mechanism.

As a possible check, the spot weld size can be reduced and the above analysis repeated, in order to confirm that the weld in both cases is sufficiently small so that results are only negligibly affected by this change.

Preferably the overall stiffness k (where "k" is as defined under Hook's law) of the biasing mechanism acting on the hinge element, the rotational inertia of about its axis of rotation of the part of the diaphragm assembly supported via said contacting surfaces, and the fundamental resonance frequency of the diaphragm in Hz (f) satisfy the relationship:

$$k<C\times 10{,}000\times(2\pi f)^2\times I$$

where C is a constant preferably given by 200, or more preferably by 130, or more preferably given by 100, or more preferably given by 60, or more preferably given by 40, or more preferably given by 20, or most preferably given by 10.

Preferably also, when the diaphragm is at its equilibrium displacement during normal operation, if two small equal and opposite forces are applied perpendicular to the contacting surfaces, one force to each surface, in directions such as to separate them, the relationship between a small increase in force in Newtons (dF), above and beyond the force required to just achieve initial separation, the resulting change in separation at the surfaces in meters (dx), resulting from deformation of the rest of the driver, excluding compliance associated with and in the localized region of points of contact between non-joined components within the biasing mechanism, the rotational inertia of the diaphragm about the axis of rotation of the diaphragm, with respect to the contact surface in $kg\cdot m^2$ (I), and the fundamental resonance frequency of the diaphragm in Hz (f), satisfies the relationship:

$$\frac{dF}{dx} < C\times 10{,}000\times(2\pi f)^2\times I$$

where C is a constant preferably given by 200, or more preferably by 130, or more preferably given by 100, or more preferably given by 60, or more preferably given by 40, or more preferably given by 20, or most preferably given by 10.

Achieving Equilibrium

The biasing mechanism preferably applies the contact force in a location and direction such that either:

1) in the case that there is a separate means to applying a diaphragm pivotal restoring force, the biasing force results in no significant moment that may otherwise either destabilise the diaphragm creating an unstable equilibrium or else unduly increase said diaphragm's fundamental mode frequency, or
2) in the case that the biasing force is responsible, either directly or indirectly, for applying the diaphragm restoring force, then the restoring force should be sufficiently linear with diaphragm excursion during normal operation.

Preferably, the biasing force applied to the hinge element is applied close to an edge that is co-linear with the axis of rotation of the diaphragm, relative to the contact surface throughout the full range of diaphragm excursion. More preferably, the biasing force applied between the hinge element and the contact surface is applied at a location that is co-linear to an axis passing close to the centre of the contact radius of the contacting surface side which is convexly curved with a relatively smaller radius, when viewed in cross-sectional profile in a plane perpendicular to the axis of rotation, out of the contacting surface of the hinge element and the contacting surface of the contact member, throughout the full range of diaphragm excursion. Preferably, at all times during normal operation the location and direction of the biasing force is such that it passes through a hypothetical line oriented parallel to the axis of rotation and passing through the point, line or region of contact between the hinge element and the contact member.

The configurations described can help to minimize any restoring force (minimizing Wn) acting on the diaphragm, avoid creating an unstable equilibrium, and help to prevent excessive restoring force on diaphragm that could unduly increase the fundamental diaphragm resonance frequency Wn.

It will be appreciated that many different forms of biasing mechanisms are possible and can be designed in accordance with the abovementioned requirements. For example, spring or other resilient member structures may be used in some embodiments. Otherwise a magnetic force based structure may also be utilized. Examples of these will be given with reference to the embodiments of this invention. However, it will be appreciated that other biasing mechanisms known in the art can be used instead and the invention is not intended to be limited to such examples.

2.2.1e Rigid Restraint Provided by Contact

The contact between the hinge element H702 and the contact member H703 preferably substantially rigidly restrains the hinge element at the point/region of contact H704 against translation relative to the contact member in, at a minimum, directions perpendicular to the plane tangent to the surface of the hinge element at the point/region of contact. This is preferably provided by the biasing mechanism, but may not be in some embodiments. In normal operation, when forces that are small (and in opposition) compared to the biasing force are applied to the hinge element H702, the consistent physical contact between the hinge element and the contact member rigidly restrains the contacting part of the hinge element against translational movements, relative to the contact member in a direction perpendicular to the contact surface. Preferably, when forces that are small compared to the biasing force, i.e. forces that are typical during normal operation, are applied to the hinge element, the consistent physical contact will also rigidly restrain the hinge element, at the point of contact, against translation, relative to the contact member, in directions substantially parallel to or substantially within the plane tangent to the surface of the hinge element at the point/region of contact. Such restrain most preferably results from static friction between the hinge element and the contact surface. If significant translational restraint is not provided, the hinge system will not perform well, or at all, in terms of being able to prevent breakup modes from occurring within the FRO.

2.2.1f Modulus and Geometry

It is preferable that both the hinge element H702 and contact member H703 are formed from a substantially rigid material. A small amount of deflection in the contact region can result in a significant reduction in the frequency of diaphragm breakup modes, and a corresponding reduction in sound quality. For example, the hinge element and the contact member are made from a material having Young's modulus higher than approximately 8 GPa, or more preferably higher than approximately 20 GPa. Suitable materials include for example a metal such as steel, titanium, or aluminium, or a ceramic or tungsten.

The contacting surfaces of the hinge element H702 and the contact member H703 may also be coated with a hard, durable and rigid coating. An aluminum component could be anodized or a steel component could have a ceramic coating. A ceramic coating on one or preferably both of the components will reduce or eliminate corrosion due to fretting and/or other corrosion mechanisms, at the contact points. Either or (preferably) both of the contact surfaces of the hinge element and the contact member at the location of contact may comprise a non-metallic material or coating and/or corrosion resistant material or coating and/or material or coating resistant to fretting-related corrosion for this reason.

The geometry of the hinge element H702 and contact member H703 must also be substantially rigid close to the point/region of contact H704. If either component was to have a particularly thin wall that was unsupported, in the vicinity of the point/region of contact for example, then there could be a risk of deflection and associated hinge compliance—allowing translation movement within the tangential plane for example. For this reason, it is preferable that both the hinge element and contact member are substantially thick and/or wide compared to the radius of curvature of the relatively smaller radius contacting surface, at the location of contact H704.

Preferably the hinge element is thicker than $1/8^{th}$ of, or ¼ of, or ½ of, or most preferably thicker than the radius of the contacting surface that is more convex in side profile out of that of the hinge element and the contact member, at the location of contact. Also, it is preferable that the wall thickness of the contact member is thicker than $1/8^{th}$ of, or ¼ of, or ½ of or most preferably thicker than the radius of the contacting surface that is more convex in side profile out of that of the hinge element and the contact member, at the location of contact.

Preferably, there is at least one substantially non-compliant pathway by which translational loadings may pass from the diaphragm through to the transducer base structure via the hinge joint. For example there is at least one pathway connecting the diaphragm body to the base structure comprised of substantially rigid components and whereby, in the immediate vicinity of places where one rigid component contacts another without being rigidly connected, all materials have a Young's modulus higher than 8 GPa, or even more preferably higher than 20 GPa.

2.2.1g Rolling

The hinge element H702 is preferably capable of rolling and/or rocking against the contact member H703 in a substantially free manner during operation. It should be noted that a rolling mechanism does not necessarily define a perfectly pure rotational action. For instance, if the convexly curved surface of smaller radius has a radius greater than 0, when viewed in cross-sectional profile in a plane perpendicular to the axis of rotation, then there will also be an element of translation in the movement of that surface against the other and this may change the location of the axis of rotation during operation. Also, if the hinge element H702 has a parabolic cross-sectional profile, when viewed in a plane perpendicular to the axis of rotation, and the contact member has a flat cross-sectional profile, when viewed in a plane perpendicular to the axis of rotation, then the degree of translation may vary as the diaphragm deflects again changing the location of the axis of rotation. Although in some configurations the distance of translation may be significant, for the purposes of this invention reference to an axis of rotation will mean an approximate axis of rotation as defined by the hinge joint during operation.

2.2.1h Rubbing

In some configurations, it is also possible for the hinge element H702 to rub, twist, slide against or move along the surface of the contact member H703 as it hinges. For example, in one configuration, the hinge element contacts the contact member and rotates (or twists) about an axis that lies perpendicular to the plane tangent to the surface at point/region of contact H704. Suitable materials for both hinge element and contact member could include a hard and rigid material such as sapphire or ruby. In this configuration, one hinge joint would be located on one side of the diaphragm width and a second element would be located on the other. Both hinge joints together would define an axis of rotation.

It is preferable that all points of rubbing or sliding should be located as close to the axis of rotation as possible. Preferably, whichever of the contacting surface of the hinge element and the contact surface has the smaller convex curvature radius, when viewed in cross-sectional profile along a plane perpendicular to the axis of rotation, also has a radius that is relatively small compared to the length of the diaphragm assembly as measured from the axis of rotation of the two parts to the furthest periphery of the diaphragm. This radius is for example less than 2% of the diaphragm assembly length, most preferably less than 1% of the diaphragm assembly length.

2.2.1i Connection to Base Structure and Diaphragm

The hinge system including hinge joint H701 may be configured to couple between a diaphragm assembly and a transducer base structure. For example, the hinge assembly of the hinge system, including the hinge element H702 of contact hinge joint, H701 may be rigidly connected to the diaphragm assembly, and the contact member H703 of the hinge joint of the assembly may be rigidly attached to the transducer base structure. This forms a simple and effective hinge joint mechanism whereby the path that translational forces are transferred between the diaphragm and base structure is direct, which helps to achieve rigidity against pure translations. The absence of intermediate components helps to minimise opportunity for compliance. In other words, the connections are rigid such that there is low to zero compliance at the interface of the diaphragm structure or assembly with the hinge element, and at the interface of the base structure with the contact member.

Alternatively, the hinge joint could be reversed so that the hinge element H702 is rigidly attached to the transducer base structure and the contact member H703 is rigidly attached to the diaphragm assembly.

Preferably, the diaphragm is operatively supported by the hinge system to substantially rotate about an approximate axis of rotation relative to the transducer base structure. Preferably, the hinge element rolls against the contact surface about an axis that is substantially collinear with an axis of rotation of the diaphragm. But alternatively the hinge element rolls about an axis that is parallel but not collinear with the axis of rotation.

The diaphragm assembly, including the diaphragm structure or body is preferably in close proximity to, closely associated with and/or in contact with each hinge joint and the associated contact surfaces. It is also preferable that the hinge element (or the contact member) is rigidly attached to the diaphragm structure and therefore is a component and forms part of the diaphragm assembly so that, to all intents and purposes, the diaphragm structure is in direct contact, leading to improved translational rigidity. Similarly transducer base structure, and in particular the squat bulk of the base structure is preferably in close proximity to, closely associated with and/or in contact with each hinge joint and the associated contact surfaces. It is also preferable that the contact member (or the hinge element) is rigidly attached to the squat bulk of base structure and therefore is a component and forms part of the base structure so that, to all intents and purposes, the base structure is in direct contact, leading to improved translational rigidity.

If there is a distance separating the diaphragm structure and the contact surface it is preferable that this distance is small compared to the total distance from the axis of rotation to the most distal periphery of the diaphragm structure, such that the diaphragm and each hinge joint are closely associated. For example, it is preferable that this distance is less than ¼ of the maximum distance from the diaphragm tip to the axis of rotation, or even more preferably less than ⅛ the maximum distance of the diaphragm tip to the axis of rotation, or most preferably less than 1/16 the maximum distance of the diaphragm tip to the axis of rotation. This helps to reduce compliance between the diaphragm body and the hinge joint. Similarly the squat bulk of the transducer base structure and each hinge joint are preferably closely associated by similar distances if there is separation.

2.2.1j Shim in Hinge System

In some possible configurations the contact member H703 may be attached to the transducer base structure, via one or more shims or other substantially rigid members. These may be considered to form part of the contact member H703 in some instances. For example, a designer may perhaps decide that it is useful to insert a shim into gap H704. In this case the hinge system H701 may still work well with only minimal increase in translational compliance. It is preferable that a shim used in this configuration is of high rigidity, and is preferably be made from a material having Young's modulus higher than approximately 8 GPa, or more preferably higher than approximately 20 GPa. Suitable materials include for example a metal such as steel, titanium, or aluminum, or a ceramic or tungsten.

Preferably one of the diaphragm assembly and transducer base structure is effectively rigidly connected to at least a part of the hinge element of each hinge joint in the immediate vicinity of the contact region, and the other of the diaphragm assembly and transducer base structure is effectively rigidly connected to at least a part of the contact member of each hinge joint in the immediate vicinity of the contact region.

It is also preferable that at all times during the course of normal operation, the point or region where the hinge element and the contact member are in contact is effectively rigidly connected to both the hinge element and the transducer base structure in terms of translational displacements in all directions. In this manner the contact surface and the hinge element of each hinge joint is effectively substantially immobile relative to both the diaphragm assembly and the transducer base structure in terms of translational displacements.

Preferably one of the diaphragm assembly and transducer base structure is effectively rigidly connected to the hinge element, and the other of the diaphragm assembly and transducer base structure is effectively rigidly connected to the contact member. Furthermore preferably, one of the diaphragm assembly and transducer base structure is effectively rigidly connected to a part or parts of the hinge element in the immediate vicinity of the location where the hinge element and the contact member are in contact, and the other of the diaphragm assembly and transducer base structure is effectively rigidly connected to a part or parts of the contact member in the immediate vicinity of the location where the hinge element and the contact member are in contact.

Figure 1E:
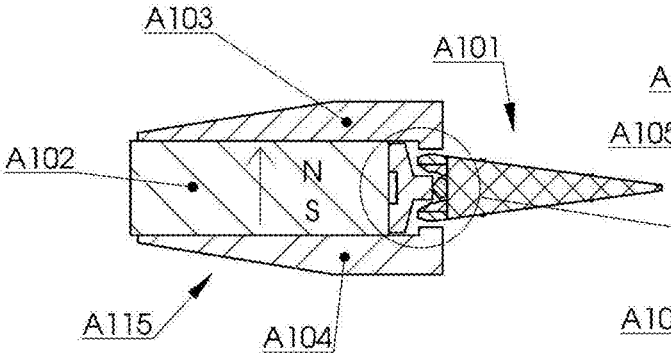
Figure 1F:
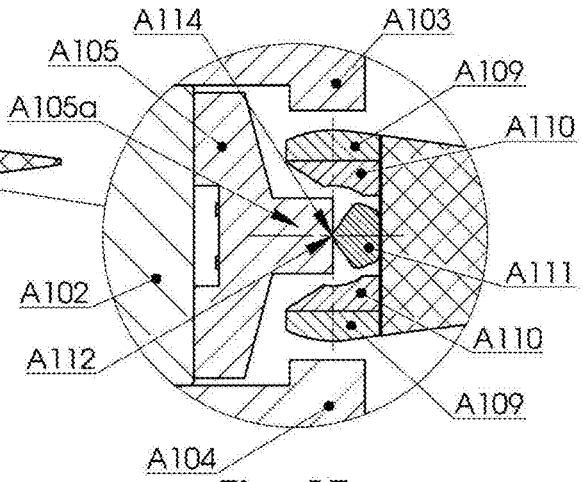

The embodiment shown in FIG. 1F is an example of this configuration, which provides advantages including simplicity, low cost, and low susceptibility to unwanted resonance, as will be described in further detail below.

Note that if a flat metal shim was to be inserted in the gap between the diaphragm assembly and the transducer base structure such that this was held in constant contact against the transducer base structure by the diaphragm assembly, the device would still function fairly well. The shim would behave, at least in the localised area of the point/region of contact, as if it was rigidly connected to the transducer base structure. In this case, if contact member comprises the shim and the diaphragm assembly comprises the hinge element, the transducer base structure remains effectively rigidly connected to shim/contact member, and the hinge element is rigidly connected to the diaphragm assembly, so the advantageous configuration still exists as described above.

2.2.2 Embodiment A—Contact Hinge System

Hinge System Overview

An example of a contact hinge system configuration of the invention designed in accordance with the above described design principles and considerations is shown in an embodiment A audio transducer depicted in FIGS. 1A-F. The embodiment A transducer of the present invention comprises a rotational action driver having a diaphragm assembly A101 that is pivotally coupled to a transducer base structure A115 via a hinge system. The diaphragm assembly comprises a diaphragm body that remains substantially rigid during operation. In alternative embodiments the diaphragm may be flexible or soft. The diaphragm assembly preferably maintains a substantially rigid form over the FRO of the transducer, during operation. The hinge system is configured to operatively support the diaphragm assembly and forms a rolling contact between the diaphragm assembly A101 and the transducer base structure A115 such that the diaphragm assembly A101 may rotate or rock/oscillate relative to the base structure A115. In this example, the hinge system comprises a hinge assembly A301 (shown in FIG. 3A) having one or more hinge joints, wherein each hinge joint comprises a hinge element and a contact member, the contact member having a contact surface. In this embodiment, the hinge assembly comprises a pair of hinge joints on either side of the diaphragm assembly. It will be appreciated that the hinge elements of the hinge joints may be elements of the same or a separate components, and/or the contact members of the hinge joints may be members of the same or separate components as will be apparent from the description below. During operation each hinge joint is configured to allow the hinge element to move relative to the associated contact member while maintaining a substantially consistent physical contact with the contact surface. Furthermore, the hinge system biases the hinge element towards the contact surface. Preferably the hinge system is configured to apply a biasing force to the hinge element of each joint toward the associated contact surface, compliantly.

In this embodiment, both hinge joints comprise a common hinge element, being a longitudinal hinge shaft A111, which rolls against a contact member, being a longitudinal contact bar A105 having a contact surface (also shown in FIG. 1F), with substantially no or insignificant sliding during operation. In this example, the hinge shaft A111 comprises a substantially convexly curved contact surface or apex on one side of the hinge element at the contact region A112, and the contact surface on one side of the contact bar A105 at the contact region A112 is substantially planar or flat. It will be appreciated that in alternative configurations as described above, either one of the hinge shaft A111 or the contact bar A105 may comprise a convexly curved contact surface on one side and the other corresponding surface of the contact bar or hinge element may comprise a planar, concave, less convex (of relatively larger curvature radius) surface, or even another convex surface of similar radius, to enable rolling of one surface relative to the other.

The hinge shaft A111 and contact bar A105 components are held in substantially constant and/or consistent physical contact by a substantially consistent force applied with a degree of compliance by a biasing mechanism of the hinge system. The biasing mechanism may comprise part of the hinge assembly, for example part of the hinge element and/or separate thereto as will be explained further with some examples below. The diaphragm assembly, structure or body may also comprise the biasing mechanism in some embodiments. In the example of the embodiment A audio transducer, the biasing mechanism of the hinging system comprises a magnetic structure or assembly having a permanent magnet A102 with opposing pole pieces A103 and A104 and also the magnetically attractive steel hinge shaft A111 embedded in the diaphragm assembly. The biasing mechanism acts to force the hinge element against the contact member with a desired level of compliance. The biasing mechanism ensures the hinge shaft A111 and contact bar A105 remain in physical contact during operation of the audio transducer and is preferably also sufficiently compliant such that the hinge system, and particularly the moving hinge element, is less susceptible to rolling resistances that may exist during operation due to factors such as manufacturing variances or imperfections in the contact surfaces and/or due to dust or other foreign material that may be inadvertently introduced into the assembly, during manufacture or assembly of the hinge system for example. In this manner, the hinge shaft A111 can continue to roll against the contact bar A105 without significantly affecting the rotating motion of the diaphragm during operation, thereby mitigating or at least partially alleviating sound disturbances that can otherwise occur.

Preferably the biasing force is applied in a direction substantially perpendicular to the contact surface at the region of contact between the hinge element and contact member. Preferably the biasing mechanism is substantially compliant. Preferably the biasing mechanism is substantially compliant in a direction substantially perpendicular to the contact surface at the region of contact between the hinge element and contact member. The contact between the hinge shaft A111 and the contact bar A105 preferably substantially rigidly restrains the hinge shaft A111 at the point/region of contact against translation relative to the contact bar A105 in, at a minimum, directions perpendicular to the plane tangent to the surface of the hinge shaft A111 at the point/region of contact.

The biasing mechanism is configured to apply a force in a direction substantially parallel to the longitudinal axis of the diaphragm structure and/or substantially perpendicular to the plane tangent to the region or line of contact A112 or apex of the hinge shaft A111 to hold the hinge shaft A111 against the contact bar A105. The biasing mechanism is also sufficiently compliant in at least this lateral direction such that the rolling hinge element can move over imperfections or foreign material that exists between the contact surfaces of the hinge system with minimal resistance, thereby allowing a smooth and sufficiently undisturbed rolling action of the hinge element over the contact member during operation. In other words, the increased compliance of the biasing mechanism allows the hinge to operate similar to a hinge system having perfectly smooth and undisturbed contact surfaces.

Biasing Mechanism

In the example of the embodiment A audio transducer, the biasing mechanism of the hinging system comprises a magnet based structure having a magnet A102 with opposing pole pieces A103 and A104, and also the magnetically attractive hinge shaft A111 embedded in the diaphragm assembly. The magnet A102 may be made from for example, but not limited to, a Neodymium material. The opposing pole pieces A103 and A104 may be made from for example a ferromagnetic material such as, but not limited to mild steel). The pole pieces A103 and A104 are located on either side of the contact bar A105 and hinge shaft A111 to thereby create a magnetic field therebetween that exerts a force on hinge shaft A111 biasing it toward the contact bar A105. In this example, the magnet A102 is located in longitudinal alignment with the diaphragm assembly and the pole pieces are located adjacent either side of the opposing major faces of the diaphragm assembly to achieve the required magnetic field, however it will be appreciated that other configurations are also possible.

The hinge shaft A111 may be made from, for example but not limited to, a ferromagnetic material such as stainless steel and in this case forms part of the diaphragm assembly A101. In this example, the contact bar A105 is also made from a ferromagnetic material such as stainless steel, however other suitable materials may be incorporated in alternative configurations. A sufficiently magnetic steel is preferably used such as 422 grade steel, however other types are also possible. Both contact bar A105 and hinge shaft A111 are, in the preferred form, coated using a thin physical vapour deposition ceramic layer such as chromium nitride which: has a reasonably high co-efficient of friction (which helps to prevent slippage at a point of contact), has preferably low wear characteristics, and being non-metallic is useful in terms of helping to prevent corrosion such as fretting. It will be appreciated that other materials and/or coatings may be utilised for the contact bar A105 and/or hinge shaft A111 as explained in the preceding section and the invention is not intended to be limited to this particular example. The diaphragm assembly A101 and transducer base structure A115 are substantially rigid. The materials, geometries and/construction of both the diaphragm assembly and the transducer base structure are relatively rigid in the immediate vicinity of and/or proximal to the contact region A112 on the contact bar A105.

As mentioned the biasing mechanism including the magnet A102, pole pieces A103, A104 of the transducer base structure, and the hinge shaft A111 of the hinge and diaphragm assemblies, forms a magnetic field that applies a particular biasing force on the hinge shaft A111 and that carries a particular degree of compliance and/or stiffness to movement. In other words the magnetic force is compliant to a degree that enables the hinge element to move translationally relative to the contact member along an axis substantially parallel to the longitudinal axis of the diaphragm assembly A101.

The magnetic field generated by this structure includes magnetic field lines that traverse from the north side of the magnet A102 (the north side as indicated by the arrow direction and "N" symbol in FIG. 1E) and extends through the north side outer pole piece A103 towards its end closest to a coil winding A109, and then in an approximately linear manner through: the first long side of the coil winding A109, the first side of a spacer A110, the hinge shaft A111, and through to the end of the south side outer pole piece A104. The field then follows the south side outer pole piece A104 and re-enters the magnet A102 at the south side (the south side as indicated by the arrow direction and "S" symbol in FIG. 1E). It will be appreciated that the orientation of the North and South Poles of the magnet may be altered in alternative configurations.

The direction of the force exerted by one long side of the coil winding A109 will depend on the direction of the electrical current through the coil winding A109. As the force generated is always perpendicular to both the direction of the current and magnetic field, with reference to FIG. 1E and FIG. 1F the direction of the force applied by one long side of the coil winding A109 will be approximately left or right.

A magnetic biasing mechanism provides advantages with respect to the aims of a biasing mechanism, preferably providing a substantial force to one or more hinge joints applied with substantial compliance, and biasing one or more hinge elements to one or more contact members, while still allowing a substantially unobstructed rotational motion between respective pairs of hinge elements and contact members.

In other configurations, a biasing mechanism could consist of multiple magnets arranged to repel and/or attract one another.

The degree of compliance and amount of force can be designed based on any one of the following factors as explained in detail above:

The intended FRO of the audio transducer;

The rotational inertia of the diaphragm structure or assembly and/or the length, width, depth shape or size of the diaphragm structure or assembly; and/or The mass of the diaphragm structure or assembly.

Finite Element Method analysis is a good way to determine compliance inherent in biasing mechanism of a hinge system as described under section 2.2.1d.

The hinge system of the present invention that is employed in the embodiment A audio transducer provides a win-win benefit being that translational compliance (i.e. the ease with which the hinge shaft A111 can translate relative to the contact bar A105) at the hinge joint is relatively low or mitigated, as the main path through which loads are passed between the diaphragm assembly A101 and transducer base structure A115 consists entirely of components made from rigid materials and having rigid geometries. Also, since the force holding the hinge shaft A111 and contact bar A105 together is applied compliantly, resistance to rotation can be made to be relatively low, consistent and reliable, especially in relation to the firmness of contact.

This performance is achieved through the asymmetry inherent in the hinge system whereby, from one side, the biasing mechanism compliantly applies a consistent force which holds the diaphragm assembly A101 against the transducer base structure A115, and from the opposite side, the transducer base structure responds by defining a substantially constant displacement, resulting in an equal and opposite reaction force applied in the opposite direction and minimal translational compliance that could otherwise exacerbate unwanted diaphragm base structure resonance modes. Preferably the reaction force is provided by parts of the contact member connecting the contact surface to the main body of the contact member which are comparatively non-compliant.

The biasing mechanism of this embodiment is sufficiently compliant such that it does not exhibit significant internal loadings relative to the diaphragm assembly during operation. For instance, during operation, when small loads are applied to the diaphragm assembly A101 in use, for example when a break-up resonance mode is excited, displacement of the hinge shaft A111 of the hinge and diaphragm assemblies is resisted primarily by the contact with the contact bar A105, since this connection is constructed non-compliantly. On the other hand, the biasing mechanism, is relatively compliant and is therefore configured to maintain relatively constant internal loadings and does not effectively resist such displacements.

Preferably, the hinge shaft A111 is rigidly connected to the diaphragm structure and forms part of the diaphragm assembly A101, and the region of the hinge shaft A111 immediately local to the contact surface A112, particularly, and also connections between this region and the rest of the diaphragm assembly, are relatively non-compliant compared to the biasing mechanism.

In the case of the embodiment A audio transducer, the force exerted by the excitation mechanism force generating component, being the coil windings A109, may potentially act in a way that causes the hinge element and contact member to slip unpredictably. In order to minimise this possibility the net force applied by all biasing mechanisms should preferably be larger than the maximum force applied by the excitation mechanism. Preferably, the force is greater than 1.5, or more preferably 2.5, or even more preferably 4 times the maximum excitation force experienced during normal operation of the transducer.

The force that biases the hinge shaft A111 towards the contact bar A105 is preferably sufficiently large such that substantially insignificant or non-sliding contact is maintained between the hinge shaft A111 and the contact bar A105 when the maximum excitation is applied to the diaphragm assembly A101 during normal operation of the transducer. Preferably, the biasing force in a particular hinge joint is 3 times, or more preferably 6 times, or most preferably 10 times greater than the component of the reaction force occurring at the hinge joint in a direction parallel to the contact surface when the maximum excitation is applied to the diaphragm assembly A101 during normal operation of the transducer. Preferably at least 30%, or more preferably at least 50%, or most preferably at least 70% of contacting force between the hinge element and the contact member is provided by the biasing mechanism.

The net force applied by all biasing mechanisms is applied in a direction, approximately, and permitting some variation as the diaphragm rotates during the course of normal operation, which minimises tendency for slippage at the point(s) of contact. So, in the case of embodiment A, it is preferable that the biasing force is applied in a direction with an angle of less than 25 degrees, or more preferably less than 10 degrees, and even more preferably less than 5 degrees to an axis perpendicular to the contact surface (or a vector normal to the contact surface) where it contacts the hinge shaft A111 when in use. Most preferably the angle is approximately 0 degrees between the two, which is the case for embodiment A, when in use.

Hinge Joint

In the example of embodiment A, the contact bar A105, is rigidly connected to the transducer base structure A115. The contact bar A105 may be formed separately and rigidly coupled the base structure via any suitable mechanism or otherwise it may be formed integrally with another part of the transducer base structure A115. The contact bar A105 may form part of the transducer base structure A115. In this example, the contact bar A105 is rigidly coupled to a face of the magnet A102 of the base structure A115, and forms part of the base structure. Similarly, the hinge shaft A111 is rigidly coupled to the diaphragm structure A1300 and may therefore form part of the diaphragm assembly A101. The hinge shaft A111 may be formed separately or integrally with the diaphragm assembly A101. In this example, the hinge shaft A111 is formed separately and a planar end face opposing the convexly curved surface rigidly couples a corresponding planar end face of the diaphragm body A208, via any suitable mechanism known in the art.

In this example, the convexly curved surface A311 of the pivot shaft A111 comprises a relatively small radius of approximately 0.05-0.15 mm, for example 0.12 mm at the location/region of contact A112. This is less than 1% of the length A211 (shown in FIG. 2F) of the diaphragm body A208 from the axis of rotation A114 to the distal tip/edge of the diaphragm. For example, in this example the length of the diaphragm body is approximately 15 mm. This ratio helps to facilitate free diaphragm movement and a low fundamental diaphragm resonance frequency (Wn). It will be appreciated that these dimensions are only exemplary and others are possible as defined under the preceding design principles and considerations section of this patent specification.

Figure 2A:
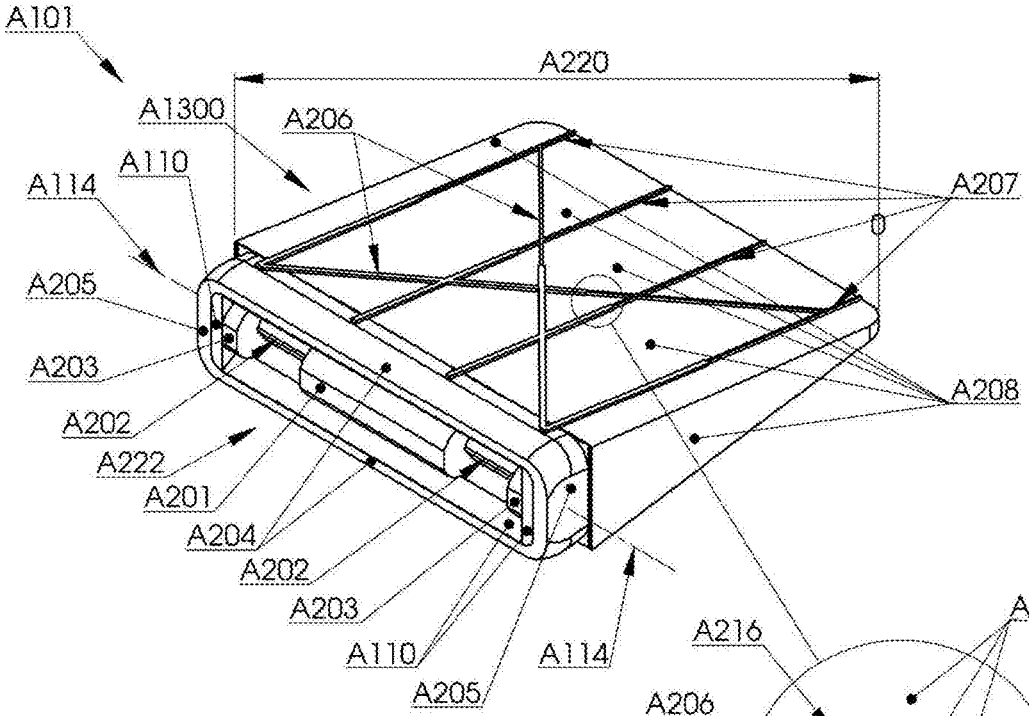
Figure 2B:
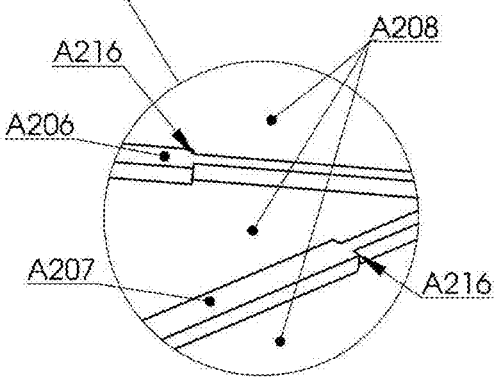
Figure 2C:
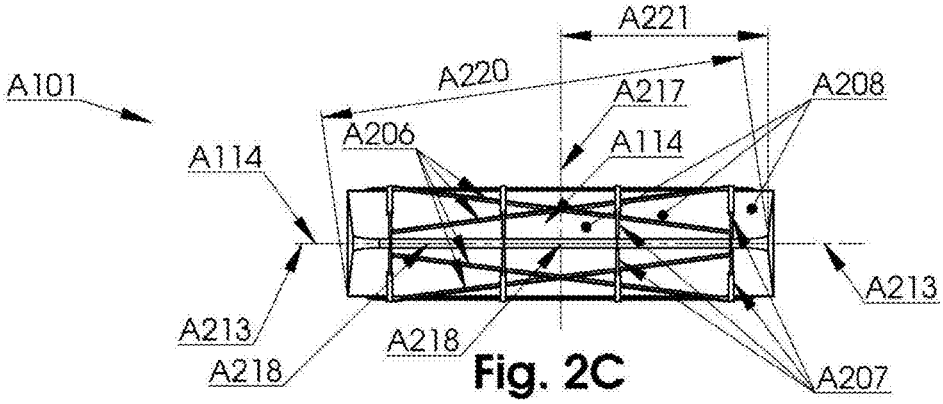
Figure 2D:
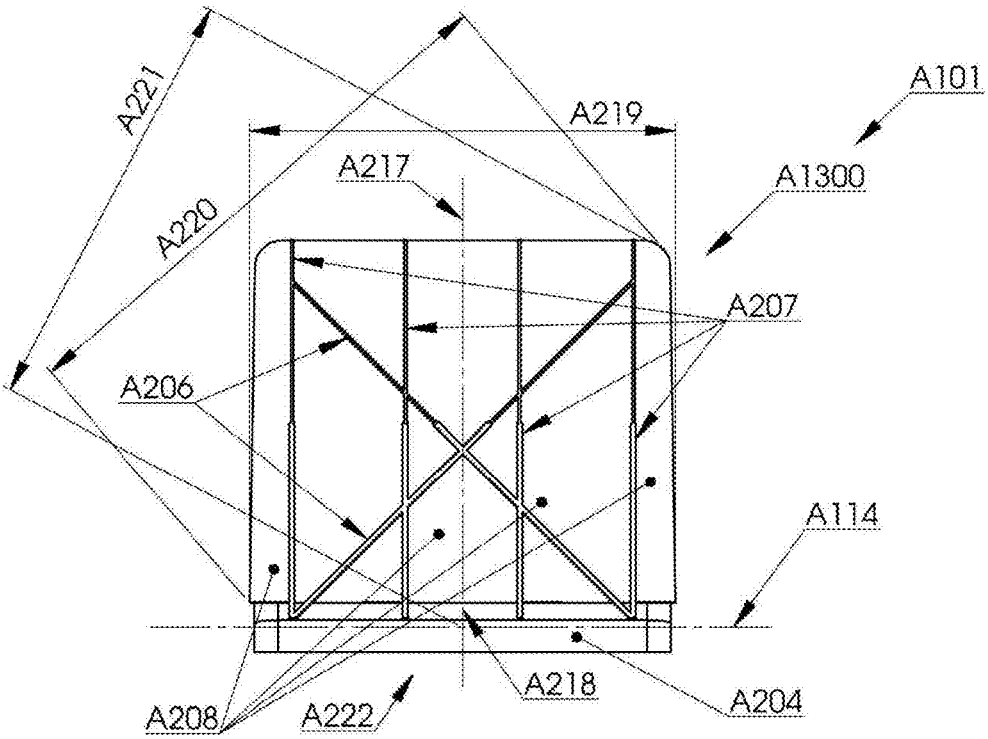
Figure 2E:
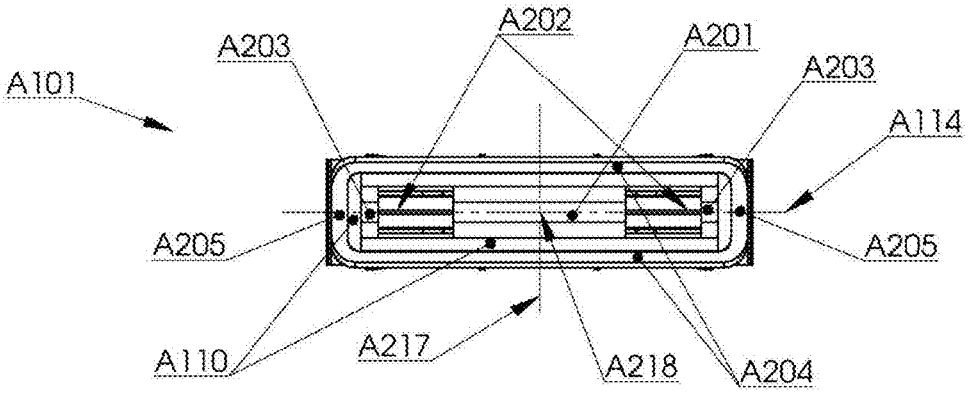
Figure 2F:
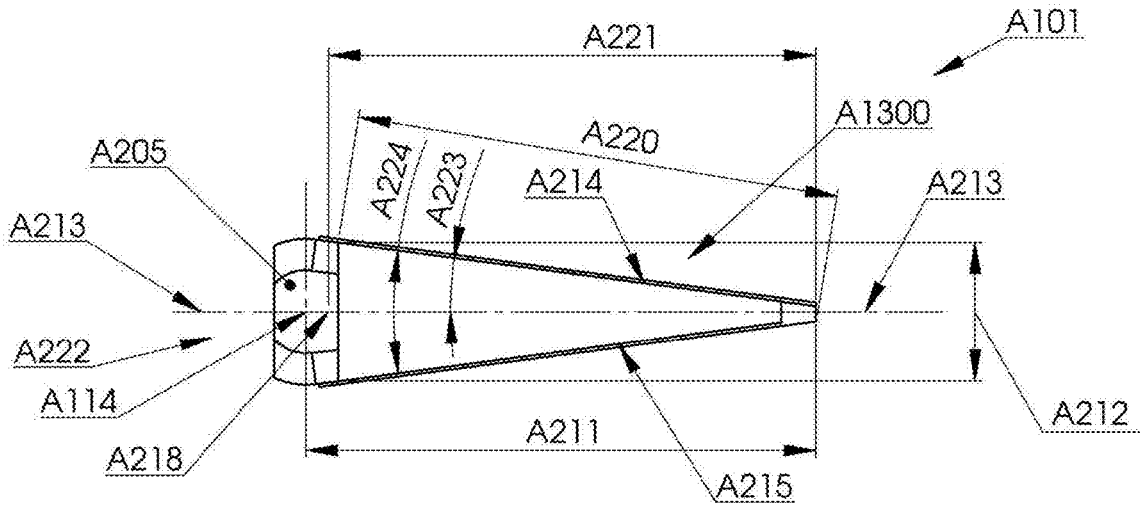
Figure 2G:
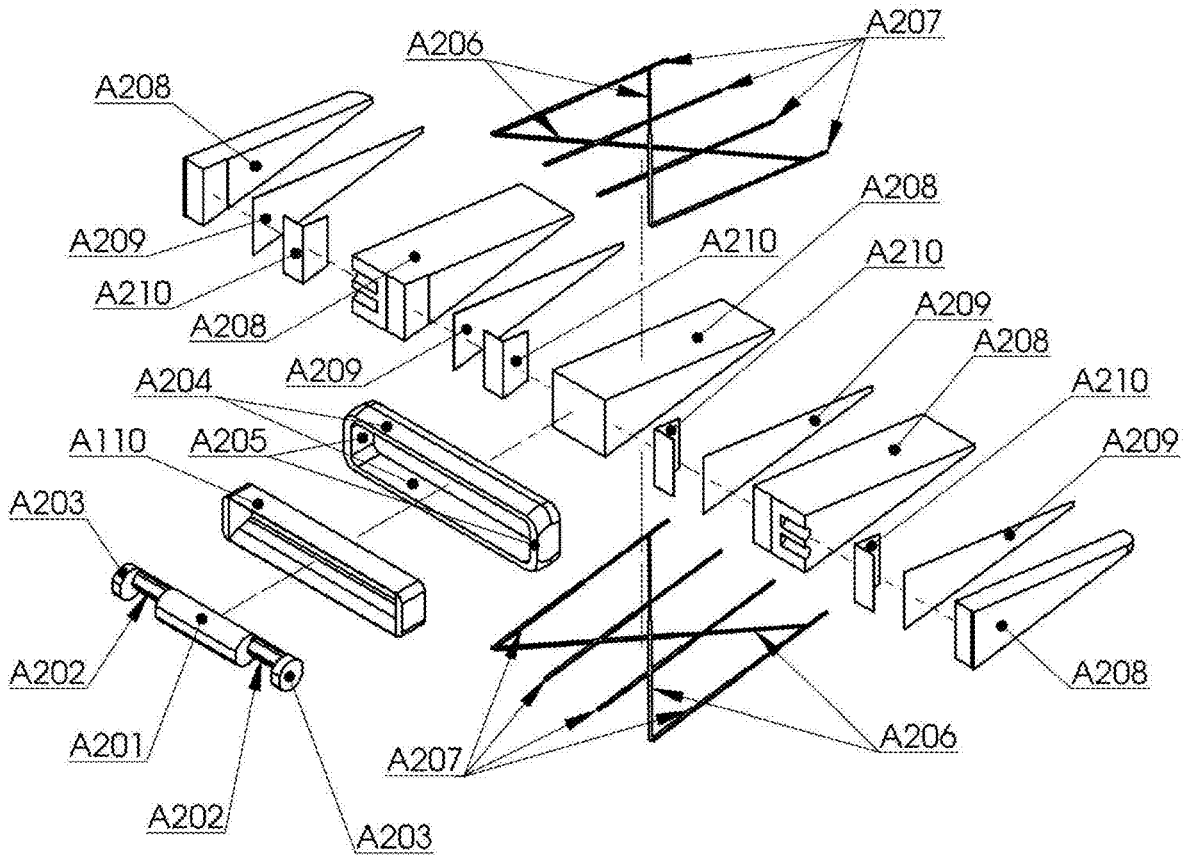
Figure 2H:
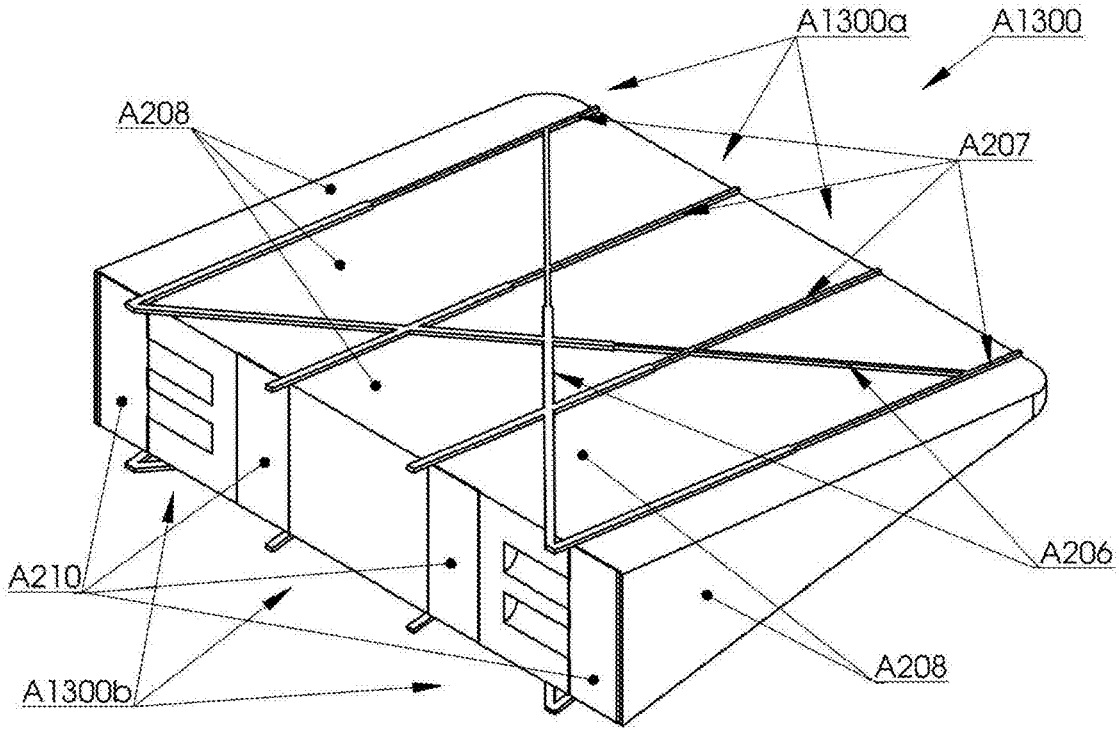
Figure 2I:
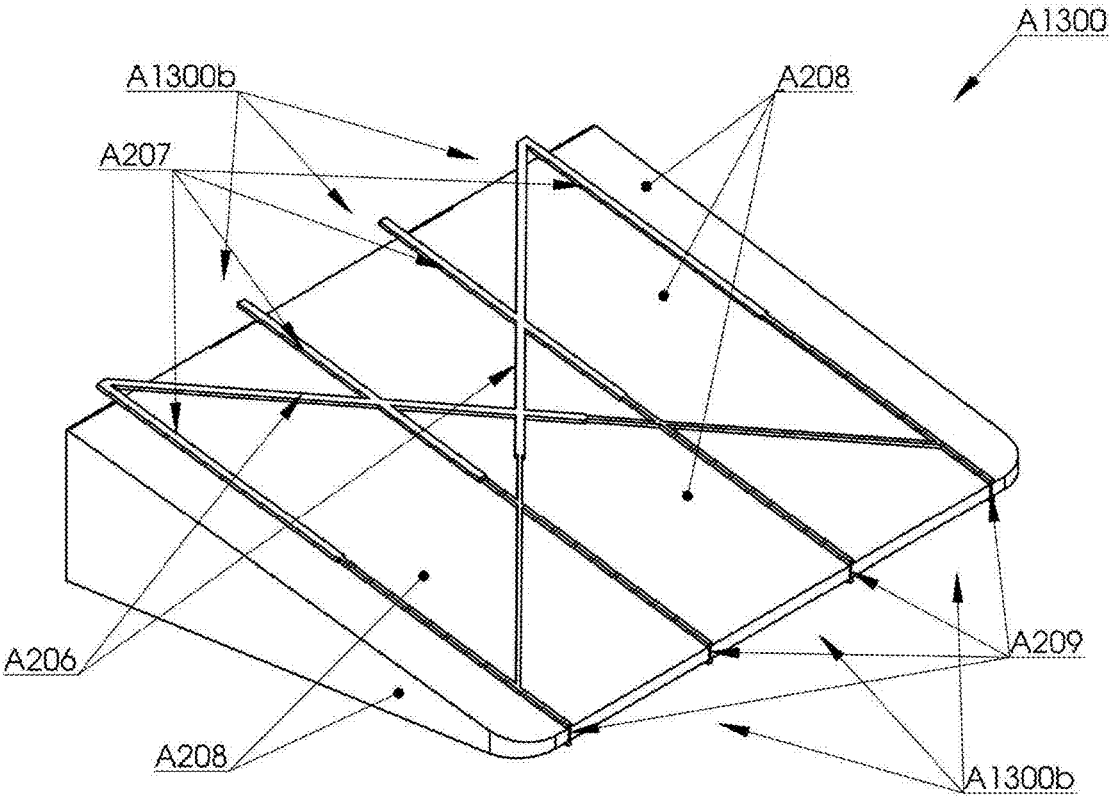
Figure 3A:
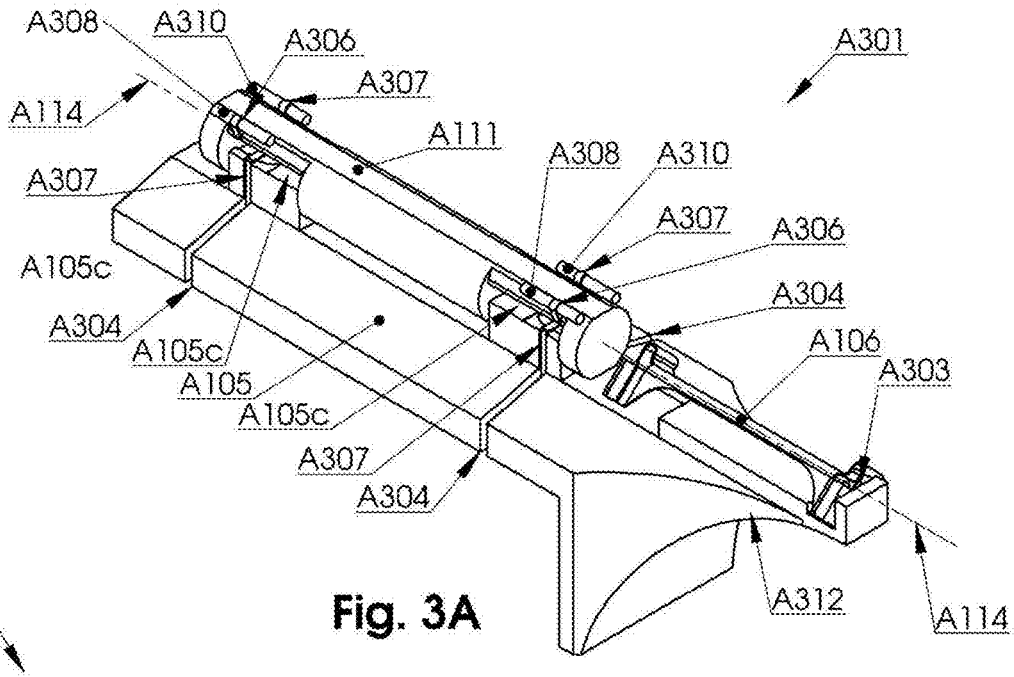
Figure 3B:
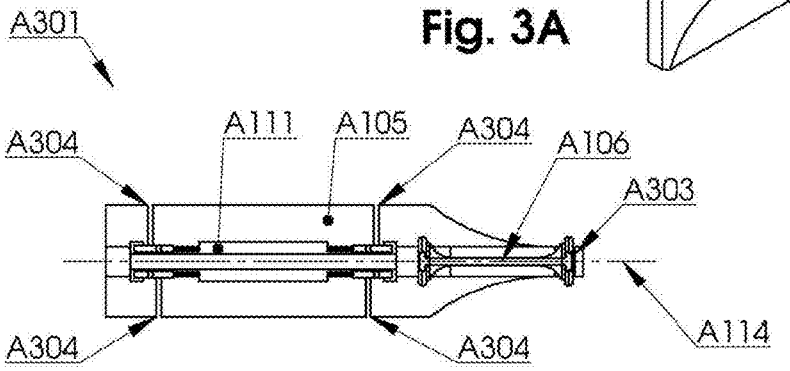
Figure 3C:
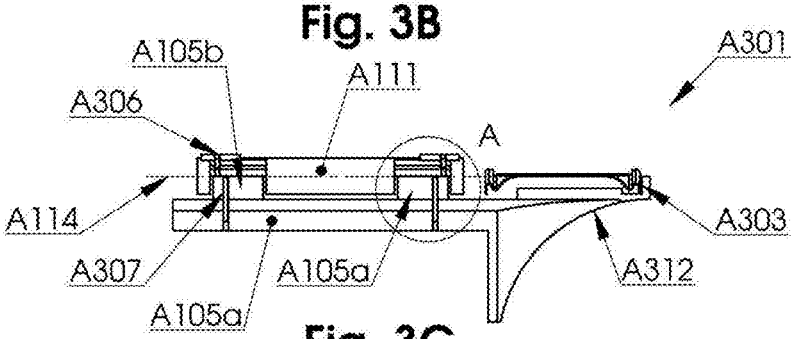
Figure 3D:
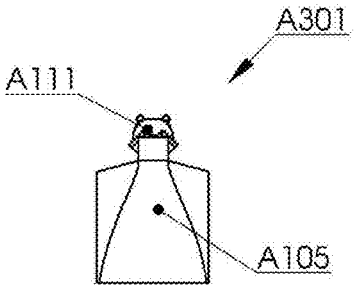
Figure 3E:
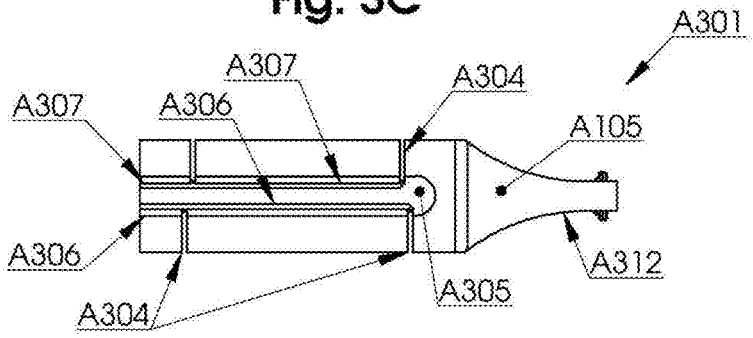

Referring to FIG. 3A, the components of the contact hinge assembly A301 of the hinge system are shown in more detail. The hinge shaft A111 comprises a substantially longitudinal body of an approximately cylindrical overall shape. The size of the shaft is dependent on the application and size of the transducer, for example it may be between approximately 1 mm-10 mm for a personal audio application. Other sizes are envisaged and this example is not intended to limit the range of sizes possible. Referring also to FIG. 2G, adjacent either end A203 of the shaft A111 is a recess or section of reduced diameter A202. In this manner the shaft A111 comprises a central section A201 and two end sections of substantially similar diameters and two recessed sections between the central section and either end section of substantially reduced diameters relative to the central and end sections. The contact bar A105 comprises a main body having a substantially planar surface. A pair of contact blocks protrude laterally from the planar surface. The main body is configured to couple the magnet A102 and/or transducer base structure A115 of the transducer assembly in the assembled state of the transducer.

Each recessed section A202 is sized to receive a corresponding contact block A105*a* and A105*b* protruding from a face of the contact member A105. Each contact block is sized to be accommodated within the corresponding recess and comprises a substantially planar contact surface A105*c* configured to locate against/adjacent an opposing face of the recessed section. Each recessed section A202 of the hinge shaft A111 comprises a substantially convexly curved (in cross-section) surface that is configured to contact against the contact surface A105*c* of the corresponding contact block A105*a*/A105*b* of the contact bar A105, in the assembled form of the assembly. The central section A201 of the pivot shaft A111 is configured to locate between the contact blocks of the contact bar and the ends A203 are configured to locate outside of the contact blocks. The central section A201 is preferably spaced from the contact bar A105. In this manner the hinge shaft A111 can roll against the contact bar A105 by action of the recessed sections A202 rolling against the contact surfaces A105*c* of the contact blocks A105*a*, A105*b*. The hinge system thus allows the diaphragm assembly A101 to freely rock back and forth/oscillate with minimal restriction.

Figure 3F:
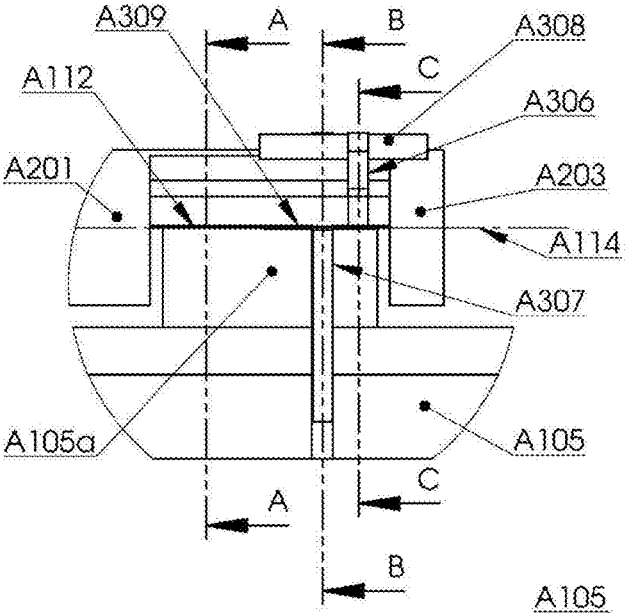
Figure 3J:
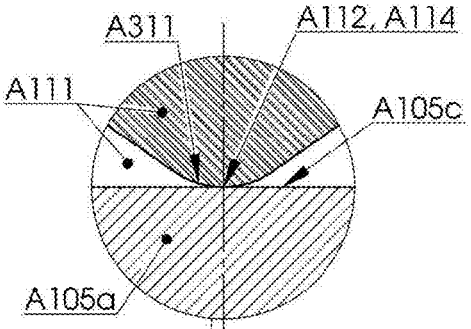
Figure 3G:
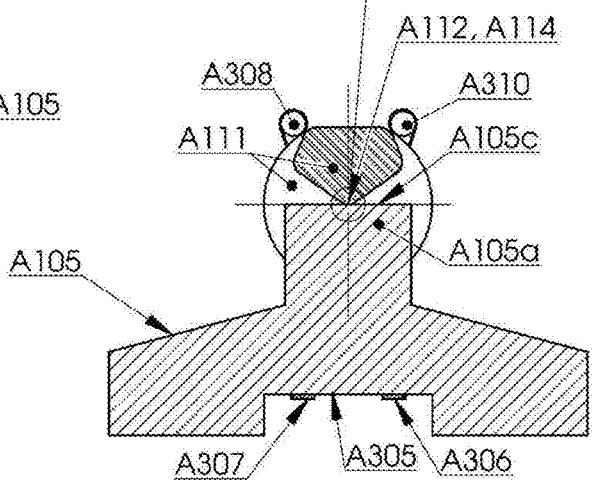
Figure 3H:
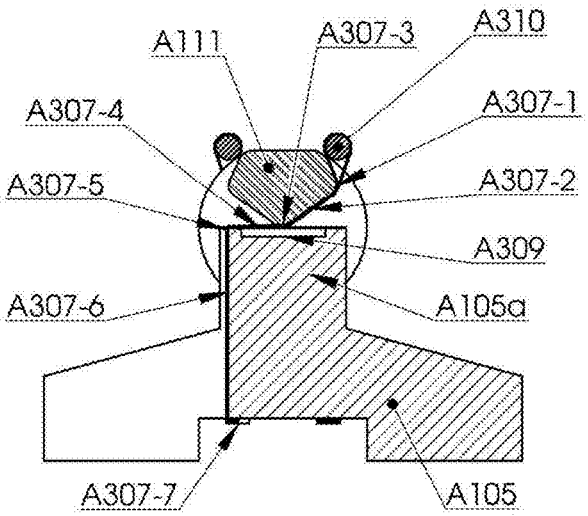

As shown in FIG. 3J, each recessed section A202 of the hinge shaft A111 has an angled surface leading up to the convexly curved contact surface A311. This provides space for the hinge shaft A111 to roll relative to the contact surface A105*c* of the contact member A105 with minimal resistance. The angled surfaces may be for example about 120 degrees but other angles are also possible and the invention is not intended to be limited to such. At the apex of the angled sections, the cross-section of each recessed section A202 has a convexly curved surface A311 of a relatively small radius (such as between 0.05 mm-0.15 mm as mentioned above) which contacts and rolls against the substantially planar contact block A105*a*/A105*b* or platform on the contact bar A105 at the contact regions A112.

As shown in FIGS. 3A and 3J, in this example, the hinge system comprises a pair of hinge joints spaced along the axis of rotation A114 of the assembly and each being defined by a recessed section and a corresponding contact block A105*a*/A105*b*. The pair of hinge joints and in particular the contact regions A112 of both are substantially aligned, such that the contact regions A112/lines are collinear to form a common approximate axis of rotation A114 for the hinge system. It will be appreciated that in alternative embodiments there may be more than two hinge joints along the longitudinal axis, or there may be a single hinge joint extending across a substantial portion of the longitudinal length of the hinge system. In this example, the pair of hinge joints are configured to locate adjacent either side of the width of the diaphragm body A208 of the diaphragm assembly A201 in the assembled state of the transducer.

Fixing Structure

FIG. 3A shows a close up perspective view of parts that comprise the hinge assembly A301 of the hinge system of this embodiment. In this embodiment, the hinge assembly A301 comprises ligaments A306 and A307 that are operative to hold the diaphragm assembly A101 in position in directions substantially perpendicular to the contact plane. These are designed such that they do not greatly influence rotation. They are too fine and compliant to contribute significantly to resisting translational displacement for the purpose of minimising diaphragm break-up resonances, and they primarily serve to hold the diaphragm roughly in position.

As it is possible that in the course of normal operation, or in other situations such as in a drop or bump scenario, a force may be applied to the hinge element in a direction tangential to the contact surface at the point of contact, a fixing structure preferably positions the hinge element, relative to the contact member, in the desired location for operation, while still allowing a free rotational mode of operation.

There are many possible configurations of fixing structure. The transducer of embodiment A has a hinge/motor configuration where there is likely to be a force acting on the hinge shaft A111 to rotate it into a diagonal position where one end is attracted towards pole piece A103 and the other end is attracted to pole piece A104. For such configurations incorporating a magnetic element (being the steel hinge shaft A111) embedded in the diaphragm assembly, the fixing structure must be able to apply a large reaction force yet still provide low compliance in terms of the allowable rotational mode of vibration.

In embodiment A this is achieved by a fixing structure comprised of ligaments. Such ligaments are preferably comprised of multiple strands to facilitate having a: greater bending compliance resulting in a reduced fundamental diaphragm resonance frequency; high tensile modulus, e.g. higher than 10 GPa or more preferably higher than 20 GPa, or more preferably higher than 30 GPa, or most preferably 50 GPa; low tendency to creep over time, since this can result in a change in diaphragm positioning away from an ideal location; a high resistance to abrasion to help prevent wear. A suitable material for the ligaments is a liquid crystal polymer fibre such as Vectran™.

Figure 5A:
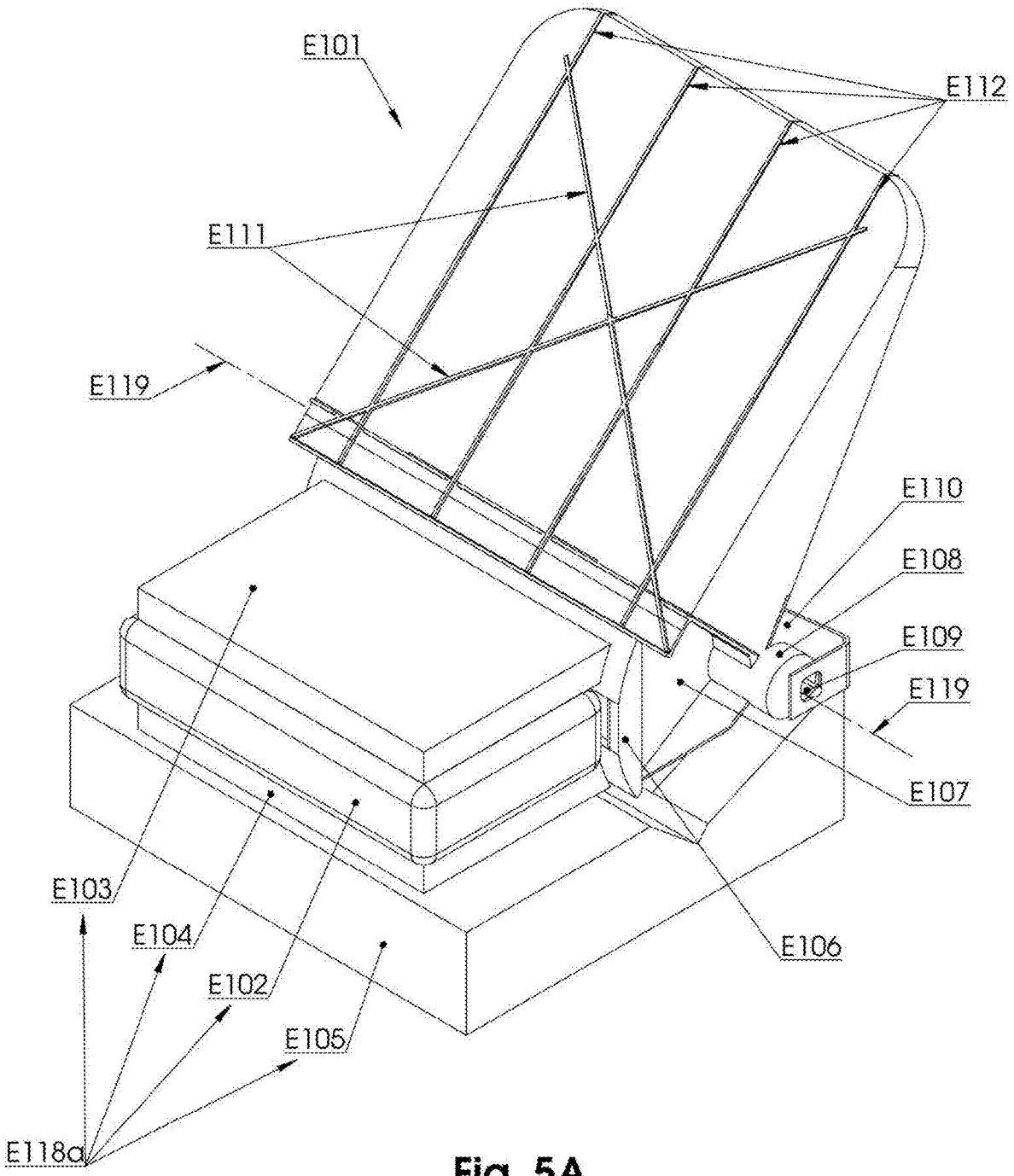
Figure 5B:
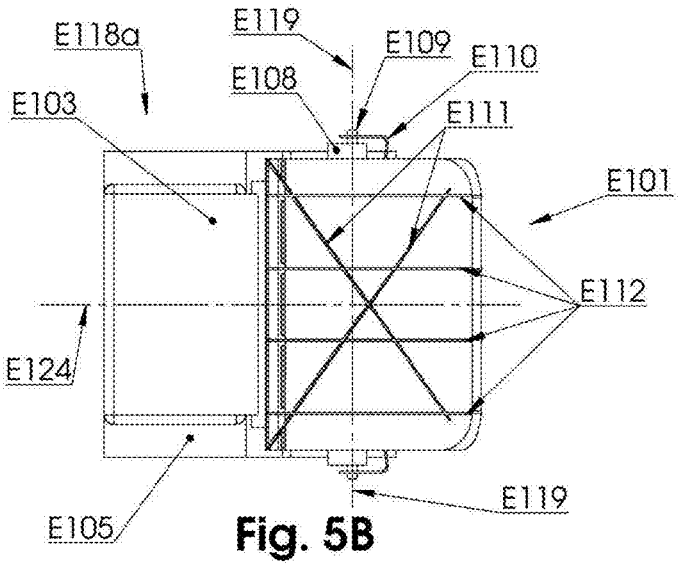
Figure 5C:
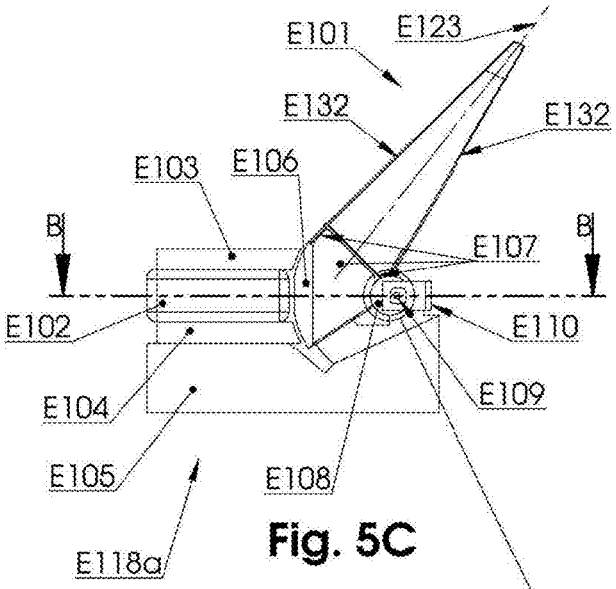
Figure 5D:
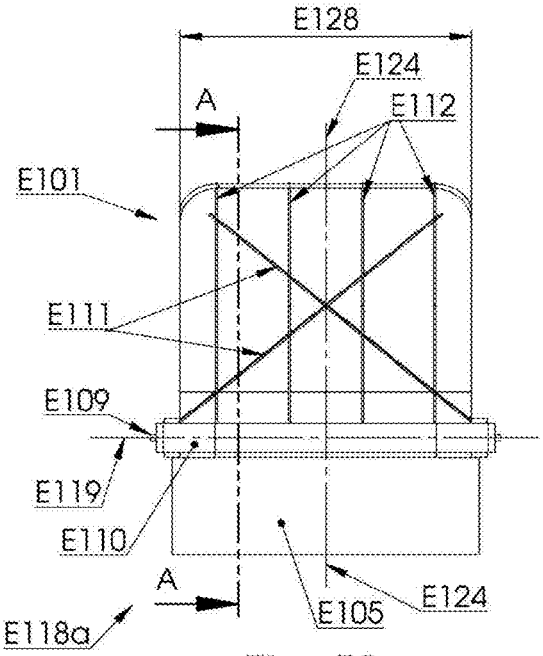
Figure 5E:
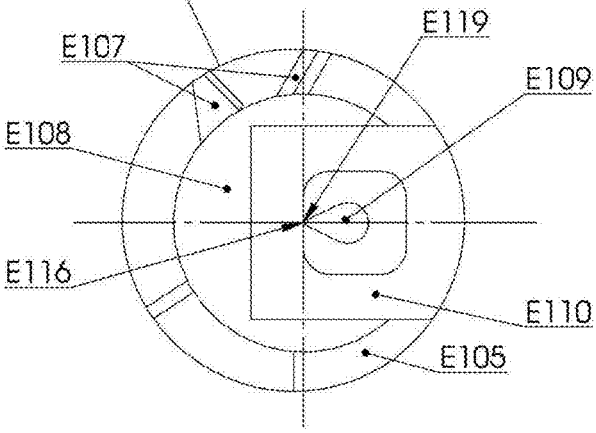
Figure 5F:
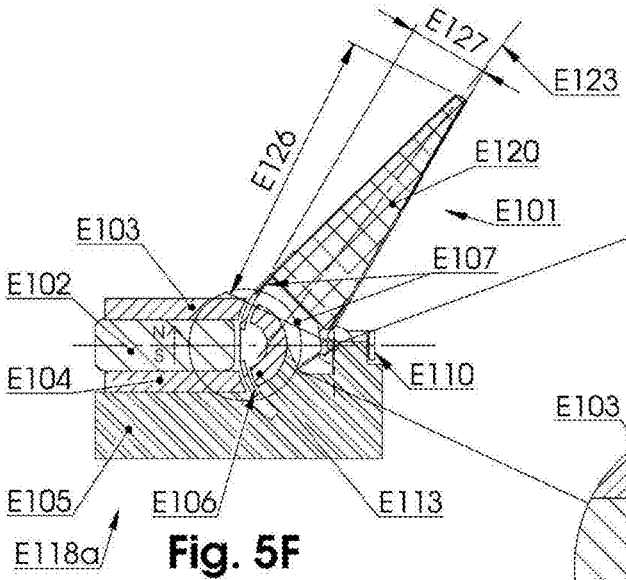
Figure 5G:
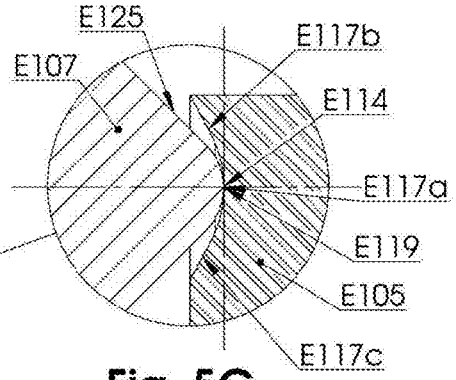
Figure 5H:
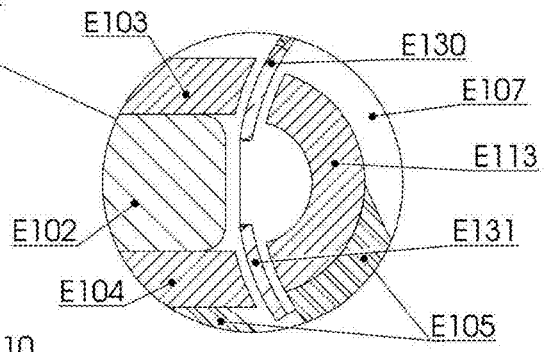

For hinge/motor configurations that do not incorporate a magnetic element embedded in the diaphragm assembly, for example embodiment E, other simpler fixing structures may be more cost-effective. For example, embodiment E, shown in FIGS. 5A-K, has base block E105 with contact member indentations E117 and hinge element protrusions E125 that contact and roll within the indent at contact location E114, the protrusion being part of the diaphragm base frame E107. In the event of impact such as may occur if the transducer is dropped, the protrusion E125 contacting a sloped side wall E117*b*/E117*c*/E117*c* of an indentation E117 (shown in FIG. 5G) can prevent excessive displacement of the protrusion. In the case that the protrusion moves in the direction of the axis, sloped side wall E117*d* (shown in FIG. 5K) can prevent excessive displacement of the protrusion. Preferably, the other outer side of the hinge element and the contact surface has, in the cross-sectional profile in a plane co-linear to the axis of rotation and perpendicular to the plane of the contact surface (i.e. the cross-section as shown in FIG. 5K) one or more raised portions preventing the first element moving too far in the direction of the axis of rotation.

The torsion bar A106 detailed in FIGS. 4A-D of embodiment A is a different type of fixing structure, being a metal spring that contributes towards locating the hinge shaft A111 relative to the transducer base structure A115.

As an alternative to the ligament fixing structure of embodiment A, two torsion bars similar to, but not the same as, torsion bar A106 could be used, one in the position shown in FIGS. 1A-F, and the other attached on the opposite side of the diaphragm. They could be modified because torsion bar A106 was not designed to provide rigidity in terms of translational forces perpendicular to the axis of rotation. The flexible tabs A401 may need to be reduced or eliminated, and preferably the cross-section of the torsion bar would be greater. This dual torsion bar fixing structure could be simpler and cheaper to produce than the ligament type fixing structure, but would likely restrict the fundamental diaphragm resonance frequency as well as diaphragm excursion.

For such fixing structures using flexing springs it is preferable that the spring is resistant to fatigue. For example, a metal such as steel or titanium would be suitable.

Other types of fixing structures can be used, such as soft flexible blocks of elastomer, or magnetic centering, to provide positioning of the hinge element with respect to the contact member.

Referring to FIGS. 3A and 3F-3I, to help locate the hinge shaft A111 relative to the contact bar A105 the hinge assembly A301 further comprises a fixing structure. The fixing structure consists of a pair of ligaments A306 and A307 at each hinge joint, adjacent each end of the shaft. For each hinge joint, a first ligament A306 wraps around a first ligament pin A308 on one side of a planar surface of the shaft (opposing the contact bar A105) and a second ligament A307 wraps around a second ligament pin A310, and a second ligament on the opposing side of the planar surface of the shaft A111. Each ligament pin A308, A310 is rigidly attached to both the hinge shaft A111 and the spacer A110 of the diaphragm assembly. This can be via any suitable mechanism, for example via an adhesive agent such as epoxy adhesive. Each ligament A306, A307 comprises an elongate strand of material that wraps around the ligament pin, past and under the hinge shaft A111 and onto the opposing side of the contact member, and is fixed along its length to the hinge shaft A111 and contact bar A105 to thereby fix the two components together.

Figure 3I:
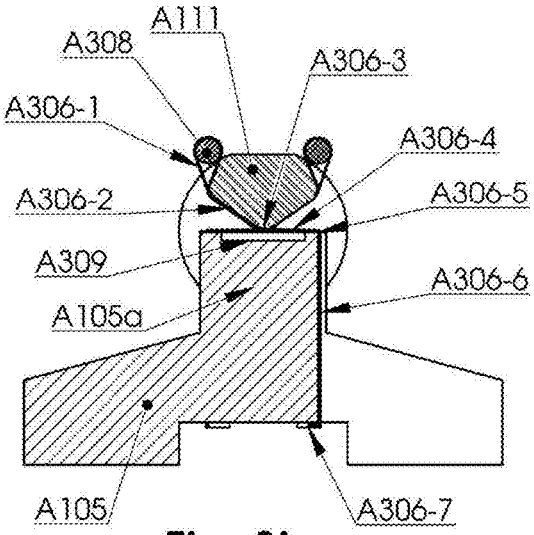
Figure 4A:
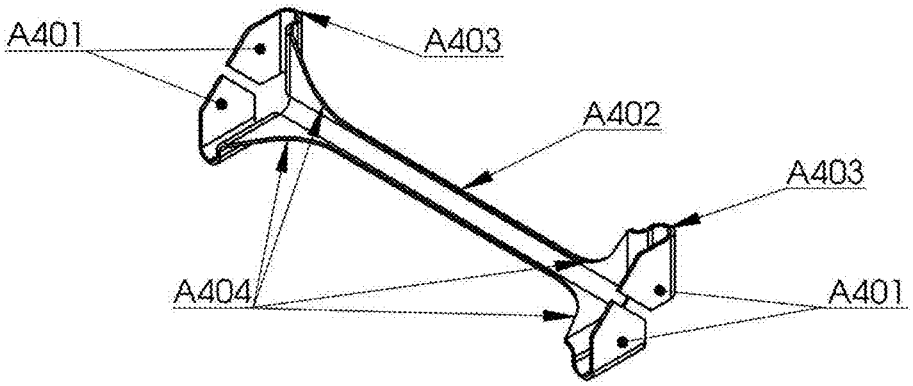
Figure 4B:
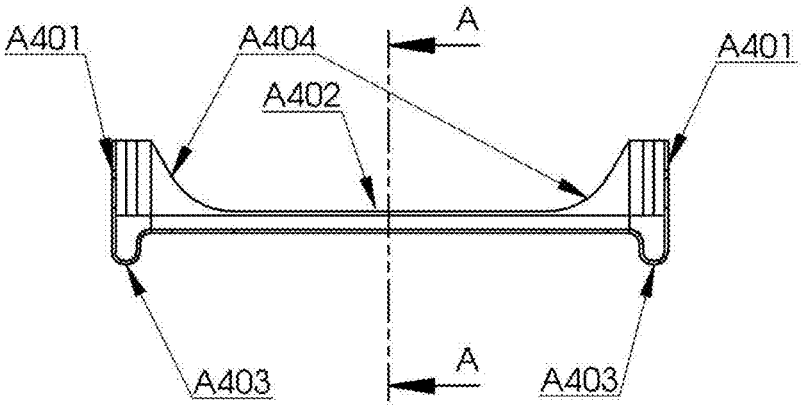
Figure 4C:
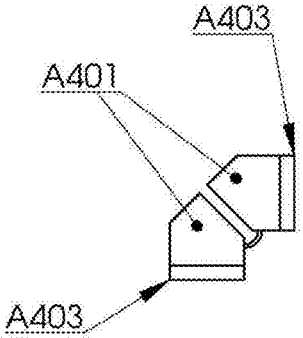
Figure 4D:
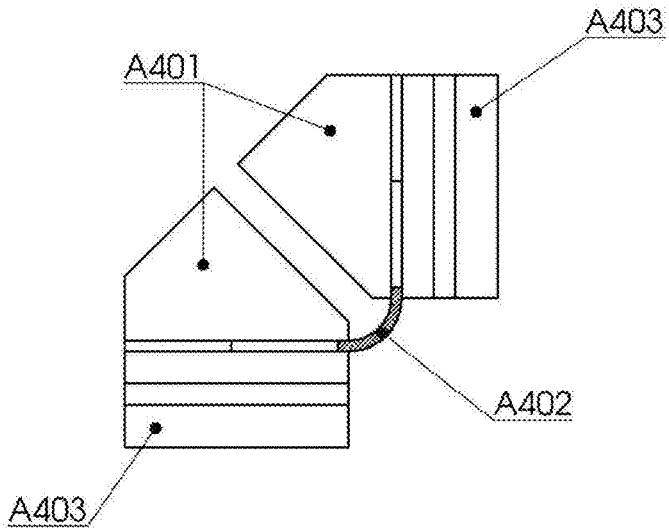

Referring to FIG. 3F for example, the ligament A307 loops around the pin A310 and intersects itself at location A307-1 as it passes around the side of the hinge shaft A111. The ligament A307 then extends along an angled flat surface A307-2 where it preferably attaches to the hinge shaft A111 using an adhesion agent, for example epoxy adhesive. However, care is taken to prevent the adhesion agent from getting close to the small radius at location A307-3. This means that about half of the length of the flat surface A307-2, close to location A307-3 is free from adhesive. This allows the ligament A307 to be as flat as possible as it passes around the convexly curved surface A311 at location A307-3, facilitating a low fundamental frequency (Wn). The ligament A307 then passes through air to a corner/edge at location A307-5 on an opposing side of the contact block A105*a* to the ligament pin A310. Beneath the region of the radius at location A307-3 there is a small clearance A309 recessed into contact block A105*a* of the contact bar A105. This recess A309 prevents the hinge shaft A111 from squashing the ligament A306, A307, since this could cause it to break with time, and it also prevents the ligament from restricting the shaft from directly contacting the contact bar A105 at contact region A112. The ligament A307 passes around corner/edge A307-5 of the block, and then within a slot A304 formed in the contact bar A105 along the block and the main body. The ligament preferably attaches to the contact bar along region A307-6 using an adhesion agent, for example epoxy adhesive. The ligament then passes underneath the main body of the contact bar A105 at location A307-7 and into the channel A305 on an opposing side of the body to the contact block A105*a* where it is again attaches to the contact bar using an adhesion agent, for example epoxy adhesive. Ligament A306 follows a similar path to that of ligament A307, except in an opposite direction. It starts by looping over ligament pin A308, the loops combine into one ligament at location A306-2, and follows a path via locations A306-2, A306-3, A306-4, A306-5, A306-6 and A306-7 as shown in FIG. 3I. Both ligament pin A308 and ligament A306 are connected as per ligament pin A310 and ligament A307. The direction of the ligament A306 at location A306-4 is in a direction substantially parallel to the ligament A307 at location A307-4. The two ligaments may overlap in this region.

At all times and all angles of diaphragm excursion the ligaments remain substantially co-linear to the contact surface A105*c* of the contact bar A105 that is in contact with the hinge shaft A111. Both of these features allow the hinge shaft A111 to be only minimally constrained in respect to the allowable rotational diaphragm action, thereby facilitating a low fundamental frequency (Wn).

All ligaments are placed under a small tensile load, approximately 80 g in this case, before adhesive agent is applied to the regions to be adhered, to help minimise slack that could otherwise result in inaccurate diaphragm positioning.

Hinge Shaft

The hinge shaft A111 is subjected to a magnetic field in situ, and is fixed in a manner such that the hinge shaft A111 can rock against the contact bar A105 and/or transducer base structure A115 at the contact region A112. The magnetic field provides a benefit being that it exerts the biasing force holding the hinge shaft A111 to the transducer base structure A115.

In some, but not all cases, this magnetic force may create problems. The magnetic field can rotate the shaft in two ways being 1) create an unstable equilibrium whereby the diaphragm wants to move to an extreme excursion angle or 2) apply a centering force that holds the diaphragm at its equilibrium angle, thereby raising the diaphragm fundamental frequency during operation.

Two of the factors governing any torque applied to the shaft by the magnetic field are: 1) net movement of the shaft towards one or other pole piece will generally release potential energy, and so if this is possible then there may be a force exerted by the magnetic field in this direction, and 2) The magnetic field will try to position the shaft towards an angle that maximises magnetic flux travelling through the shaft from one pole piece to the other. So the magnetic field will try to rotate the shaft to an angle where the widest part of the shaft in cross-sectional profile, assuming that there is a widest part, is aligned so that it spans the gap between the pole pieces.

The radius of curvature of the surfaces of the hinge shaft A111 at the contact regions A112, and the location of the curved surfaces relative to the net location at which the biasing in force is applied, may also apply a torque to the hinge shaft A111, due to simple geometrical considerations. The direction and strength of the magnetic field lines also influence the equilibrium.

The aim for a high performance transducer is to achieve a balance between all these factors so that a low fundamental frequency (Wn) is achieved.

In the example of embodiment A, the above problematic factors associated with the magnetic field of the transducer are substantially mitigated in the following manner.

Firstly the hinge shaft A111 is largely cylindrical in shape. Although the hinge shaft A111 has two large recesses A202 as mentioned earlier which are located in the region where the contact regions A112 and where the centering ligaments A306 and A307 are located (meaning that the shaft is not a simple annular cross-section all the way through), both recesses are still relatively small such that they do not significantly alter the bulk or overall profile/shape of the hinge shaft A111. Also, the recesses A202 are shaped/sized such that the curved contact surfaces are located in proximate to and/or substantially in alignment with the central longitudinal axis of the hinge shaft A111. By locating the approximate axis of rotation A114, as defined by the contact regions A112 close to the central longitudinal axis of the cylindrical shape of the hinge shaft A111, the body of the hinge shaft A111 hardly moves closer to either outer pole piece A103, A104 during rotation.

Referring to FIGS. 2G and 3A, the body of the hinge shaft A111 may translate slightly towards one or other pole piece, for example as the diaphragm assembly rotates during operation or if the ligaments 306 or 307 are installed inaccurately or stretch, and in this case an unstable equilibrium may result. To counteract this, the hinge shaft A111 comprises flattened surfaces on the opposing ends A203 and the central section A201 of the shaft configured directly adjacent the contact member A105. A further flattened surface is created against the entire face where the hinge shaft A111 contacts the diaphragm body A208. This creates a slightly oblong cross-sectional profile. The major axis of the oblong profile will, to an extent, want to align with the magnetic field lines extending between the two outer pole pieces A103 and A104, and this counteracts the instability providing a low/neutral net torque.

Also, as shown in FIG. 3J the radius of curvature of the contact surface A311 of the shaft A111 at the contact region A112 is relatively small, and selected to balance conflicting requirements for translational rigidity (better if the radius is larger) and low fundamental diaphragm resonance frequency and low noise generation (better when the radius is smaller) as explained in more detail in the design principles and considerations section of the specification. The relatively small radius also minimises translation towards the pole pieces as the hinge element rolls against the contact member, which could drive an unstable equilibrium.

By adjusting the geometry of the contacting parts, and also the magnetic structures of embodiment A as described, the diaphragm assembly can be positioned in a state of either equilibrium or unstable equilibrium whereby the magnetic forces holding the diaphragm assembly in either of these states is small. Once this is achieved, another easier to control method of centering the diaphragm assembly into its rest position can be used to overcome the small forces and yet still provide a low fundamental frequency.

Restoring Mechanism

During operation, the hinge shaft A111 is configured to pivot against the contact bar A105 between two maximum rotational positions, located preferably on either side of a central neutral rotational position. In this embodiment, the hinge system further comprises a restoring mechanism for restoring the hinge and diaphragm assembly to a desired neutral or equilibrium rotational position, in terms of its fundamental resonance mode, when no excitation force is applied to the diaphragm. By using a restoring mechanism the bass roll-off frequency response can be tailored to the transducer's diaphragm excursion capability to optimise bass response to make best use of the excursion capability.

The restoring mechanism may comprise any form of resilient means to bias the diaphragm assembly toward the neutral rotational position. In this embodiment, a torsion bar is utilized as the restoring/centering mechanism. In another form the restoring mechanism comprises a compliant, flexible element such as a soft plastics material (e.g. silicone or rubber), located close to the axis of rotation. In another form, such as described herein in regards to embodiment E, part, or all of the restoring mechanism and force is provided within the hinge joint through the geometry of the contacting surfaces and through the location, direction and strength of the biasing force applied by the biasing mechanism. In the same or an alternative form, a significant part of the restoring/centering mechanism and force is provided by a magnetic structure.

As mentioned, the embodiment A transducer shown in FIGS. 1A-F, comprises a diaphragm restoring and/or centering mechanism in the form of a torsion bar A106 (as shown in FIG. 1A). The torsion bar A106 is connected between the diaphragm assembly A101 and the transducer base structure A115 to restore the diaphragm to a neutral rotational position.

A resilient member such as a spring or as in this case, a torsion bar A106 is an easy, linear and reliable mechanism to use. The torsion bar also serves secondary purposes being to position the diaphragm assembly A101 in the translational direction parallel to the axis of rotation A114 so that the moving parts of the diaphragm assembly A101 do not touch and rub against the transducer base structure A115 or a transducer housing that may extend around the perimeter of the diaphragm assembly A101 in situ and during operation. The torsion bar furthermore supports the wires leading to the coil windings A109, and prevents them from resonating and thereby adversely affecting the quality of audio reproduction.

FIGS. 4A-D details the construction of the torsion bar A106 used in embodiment A. The torsion bar may be formed from any suitable resilient material, such as a metallic or a resilient plastics material. In this example, the torsion bar is folded out of titanium foil of a relatively small thickness, such as 0.05 mm for example. The shape of the torsion bar is sufficiently rigid such that it has minimal to no adverse resonances within the transducers FRO, and yet also is sufficiently flexible in torsion that it provides a low fundamental diaphragm resonance frequency (Wn).

The material used preferably comprises a relatively low Young's modulus (to help facilitate low fundamental frequency and high excursion), reasonably high specific Young's modulus (i.e. low density, in order to mitigate internal resonances in spite of the low Young's modulus), high yield strength and/or preferably does not suffer significantly from creep nor fatigue over many of cycles of operation. A non-magnetic material, such as titanium may also be useful in preventing or mitigating complications due to attraction to the magnetic assembly. Other materials are also suitable, for example 402 grade stainless steel may suffice.

The torsion bar comprises a longitudinal body having a central longitudinal flexing section/region A402. This region preferably has a consistent cross-section (as seen cross-hatched in FIG. 4D). This section A402 comprises a substantially bent or curved wall that forms a channel extending the length of the bar. The wall of section A402 is bent at approximately 90 degrees. Section A402 is long (as seen in the side elevation view of FIG. 4B) and is thin-walled in side profile, hence it is compliant in torsion. Section A402 is preferably also substantially rigid/stiff against bending in response to forces that are normal to the section A402. This is achieved by forming the section A402 to have a significantly larger height and width dimensions relative to the thickness of the foil. This geometry is important for mitigating or preventing resonances over such a long span.

The torsion bar further comprises a widened and relatively broad winged section A401 at either end of the central flexing section A402. The central flexing section A402 widens at regions A404 at or adjacent either end of the torsion bar to transition into the winged sections. The widening at this region A404 is gradually tapered, preferably (but not exclusively) using a curved taper as shown, and is not stepped, to avoid creating stress raisers that might fatigue over time, and to transition into the broader flat-winged spring section A401 smoothly. It will be appreciated that the taper may be linear in other configurations and/or it may be made up of a series of steps to reduce the risk of creating stress raisers. Each end of the torsion bar A106 then comprises a pair of separated tabs forming a wing section A401. For each wing section A401, each tab extends from one side of the folded wall of the central flexing section A402 and comprises a folded wall that is bent toward the opposing tab. The opposing walls of the tabs are spaced and disconnected in this embodiment to form a channel therebetween. These wing sections A401 provide a sufficiently large surface area for effective attachment to the lateral end tab A303 (which can be seen in FIG. 3A) extending from one end of the main body of the contact bar A105, and also to a short side A205 of the coil windings A109 of the diaphragm assembly.

Referring to FIGS. 3A-3E, in situ, the torsion bar is configured to locate on an arm A312 of the main body of the contact bar A105 extending longitudinally from one side of the body and having a laterally projecting tab A303 at the end. A recess in the arm A312 locates adjacent the tab for retaining a wing section A401 of the torsion bar therein. Another recess between the arm A312 and the hinge shaft A111 retains the other wing A401 of the torsion bar, and the central section A402 locates on the arm A312. One wing section A401 is rigidly coupled to the tab A303 and the other wing section A401 is rigidly coupled to the diaphragm assembly, such as a side of the coil winding A109. Any suitable fixing mechanism may be used, for example via a suitable adhesive.

Referring back to FIGS. 4A-4D, with respect to the torsion bar A106, the bends in the end tab walls (that are substantially planar and thin) at the four bend locations A403 introduce a degree of rotational flexibility similar to a universal joint, because as the flexing central section A402 of the torsion bar A106 twists, it tends to want to skew the end parts of the torsion bar. If this compliance is not provided, this has some effect of restraining the flexing central section A402 against torsion, which would increase the fundamental frequency (Wn) of the assembly. Also, the skewing force may act to break the adhesive or other mechanism securing the ends of the torsion bar. Preferably one, or more preferably both, of the end wing sections A401 incorporates rotational flexibility, in directions perpendicular to the length of the middle section. Preferably the translational and rotational flexibility is provided by one or more flat springs/end tab walls at one or both ends of the torsion bar, the plane of which is/are oriented substantially perpendicular to the primary axis of the torsion bar. Preferably both end wing sections are relatively non-compliant in terms of translations in directions perpendicular to the primary axis of the torsion bar Preferably at least one end of the sections provides translational compliance in the direction of the primary axis of the torsion bar. The bends in the end tab walls at the four bend locations A403 also introduce a small degree of translational flexibility along the longitudinal axis of the torsion bar to help ensure that the contact region A112 does not slide in along the axis of rotation A114 due to any shortening of the flexing central section A402 of the torsion bar A106 as it undergoes torsion during operation. Also, in an impact scenario such as a drop the bends at the four bend locations A403 also help ensure that the torsion bar is not ripped from its connections to the transducer base structure A115 and the diaphragm assembly A101.

The torsion bar design shown in FIGS. 4A-D is substantially resonance-free within the FRO of the transducer.

Preferably the mechanism of providing a restoring force is substantially linear with respect to the force vs displacement relationship (displacement measured in either distance displaced or degrees rotated). If the mechanism substantially obeys Hooke's law, this means that audio signal will be reproduced more accurately.

Preferably conducting wires connecting to the motor coil are attached to the surface of the middle section of the torsion bar. Preferably the wires are attached close to an axis running parallel to the torsion bar and about which the torsion bar rotates during normal operation of the transducer.

Biasing Mechanism Variations

As described with regards to embodiment E, a mechanical biasing mechanism provides advantages with respect to the aims of a biasing mechanism, preferably providing a substantial force to one or more hinge joints, applied with substantial compliance, biasing one or more hinge elements to one or more contact members, while allowing a substantially free rotational motion between respective pairs of hinge elements and contact members.

There are many types and configurations of mechanical biasing mechanisms. In one form, the biasing mechanism comprises a resilient element, part or component which biases or urges the hinge element towards the contact surface. The resilient element could be a pre-tensioned resilient member such as a spring member located at each end of the hinge element to bias or urge the diaphragm towards the contact surface, as described in embodiment E, or an elastomer with a low Young's modulus such as silicon rubber, or natural rubber, or viscoelastic urethane Polymer® configured to be used in either tension (e.g. a stretched latex rubber band) or in compression (e.g. a squashed block of rubber). Other kinds of springs including needle springs, torsional springs, coiled compression springs, and coiled tension springs may also be effective. These springs are preferably made from a material with high yield stress such as steel or titanium.

In another configuration the biasing mechanism comprises a metal flat spring (in a flexed state) that has one end attached to the transducer base structure, the other end is connected to one end of an intermediate component consisting of a ligament and the other end of the ligament is connected to the diaphragm assembly. For such a configuration, it would be preferable to use a multi strand ligament of high tensile modulus (e.g. higher than 10 GPa) such as a liquid crystal polymer fibre such as Vectran™ or an ultra-high molecular weight polyethylene fibre such as Spectra™.

In some configurations the biasing mechanism may comprise a first magnetic element that contacts or is rigidly connected to the hinge element, and also a second magnetic element, wherein the magnetic forces between the first and the second magnetic elements biases or urges the hinge element towards the contact surface so as to maintain the consistent physical contact between the hinge element and the contact surface in use. The first magnetic element may be a ferromagnetic fluid. The first magnetic element may be a ferromagnetic fluid located near an end of the diaphragm body. The second magnetic element may be a permanent magnet or an electromagnet. Alternatively the second magnetic element may be a ferromagnetic steel part that is coupled to or embedded in the contact surface of the contact member. Preferably, the contact member is located between the first and the second magnetic elements.

It should be apparent to those knowledgeable in the art that a wide range of other possible configurations of biasing mechanism that may perform an equivalent or similar function consistent with the principles outlined herein.

As mentioned, the biasing mechanism provides a degree of compliance when applying a biasing force between the hinge element and the contact member. The structure connecting the hinge element to the diaphragm assembly, on the other hand, should preferably be rigid and non-compliant. For this reason, it is preferable that the biasing mechanism is a structure that is separate from or at least operates separately from the structure or mechanism that connects the hinge element to the diaphragm assembly. It should be noted that it is possible for the biasing mechanism to operate separately from the structure or mechanism connecting the hinge element to the diaphragm assembly, yet still be integral with the structure or mechanism connecting the hinge element to the diaphragm assembly. This is explained further in relation to the hinge system of the embodiment S audio transducer for example.

The biasing mechanism of the hinge system described above in relation to the embodiment A audio transducer may therefore be replaced by any one of these variations without departing from the scope of the invention.

Diaphragm Assembly

Although the above described hinge system may be utilised with any form of diaphragm assembly, it is preferred that a diaphragm assembly A101 comprises a substantially thick and rigid diaphragm employing a rigid approach to resonance control. Given that hinge systems according to the present invention has the advantage of minimising translational compliance across the contact surfaces that leads to diaphragm breakup, combining such hinge mechanisms with a rigid diaphragm construction will often compound the benefit.

Referring to FIGS. 1A-F and 2A-I, the audio transducer incorporating the above described hinge system further comprises a diaphragm structure A1300 comprising a sandwich diaphragm construction. This diaphragm structure A1300 consists of a substantially lightweight core/diaphragm body A208 and outer normal stress reinforcement A206/A207 coupled to the diaphragm body adjacent at least one of the major faces A214/A215 of the diaphragm body for resisting compression-tension stresses experienced at or adjacent the face of the body during operation. The normal stress reinforcement A206/A207 may be coupled external to the body and on at least one major face A214/A215 (as in the illustrated example), or alternatively within the body, directly adjacent and substantially proximal the at least one major face A214/A215 so to sufficiently resist compression-tension stresses during operation. The normal stress reinforcement comprises a reinforcement member A206/A207 on each of the opposing, major front and rear major faces A214/A215 of the diaphragm body A208 for resisting compression-tension stresses experienced by the body during operation.

The diaphragm structure A1300 further comprises at least one inner reinforcement member A209 embedded within the core, and oriented at an angle relative to at least one of the major faces A214/A215 for resisting and/or substantially mitigating shear deformation experienced by the body during operation. The inner reinforcement member(s) A209 is/are preferably attached to one or more of the outer normal stress reinforcement member(s) A206/A207 (preferably on both sides—i.e. at each major face). The inner reinforcement member(s) acts to resist and/or mitigate shear deformation experienced by the body during operation. There are preferably a plurality of inner reinforcement members A209 distributed within the core of the diaphragm body.

The core A208 is formed from a material that comprises an interconnected structure that varies in three dimensions. The core material is preferably a foam or an ordered three-dimensional lattice structured material. The core material may comprise a composite material. Preferably the core material is expanded polystyrene foam.

Preferably the diaphragm body thickness is greater than 15% of its length, or more preferably 20% of its length, in order that the geometry is sufficiently robust to maintain substantially rigid behavior over a wide bandwidth. Alternatively or in addition the diaphragm body comprises a maximum thickness that is greater than 11%, or more preferably greater than 14% of a greatest dimension (such as the diagonal length across the body).

In some embodiments the inner stress reinforcement of the diaphragm structure of this exemplary transducer may be eliminated. However, it is preferred that there is inner stress reinforcement. In this preferred configuration, the inner reinforcement addresses diaphragm shear deformation, and the hinge system provides a high degree of support against translational displacements that might otherwise result in whole-diaphragm breakup resonance modes. The hinge system furthermore provides high diaphragm excursion and a low fundamental diaphragm resonance frequency.

Referring to FIGS. 2A-I, one end of the diaphragm structure A300, the thicker end, has a force generation component attached thereto. The diaphragm structure A1300 coupled to the force generation component forms a diaphragm assembly A101. In this embodiment, a coil winding A109 is wound into a roughly rectangular shape consisting of two long sides A204 and two short sides A205. The coil winding is made from enamel coated copper wire held together with epoxy resin. This is wound around a spacer A110 made from plastic reinforced carbon fibre, having a Young's modulus of approximately 200 GPa, although an alternative material such as epoxy impregnated paper would suffice. The spacer is of a profile complementary to the thicker end of the diaphragm structure A1300 to thereby extend about or adjacent a peripheral edge of the thick end of the diaphragm structure, in an assembled state of the audio transducer and/or diaphragm assembly. The spacer A110 is attached/fixedly coupled to the hinge shaft A111. The combination of these three components located at the base/thick end of the diaphragm body A208 forms a rigid diaphragm base structure of the diaphragm assembly having a substantially compact and robust geometry, creating a solid and resonance-resistant platform to which the more lightweight wedge part of the diaphragm assembly is rigidly attached.

Implementation and Performance

Figure 10A:
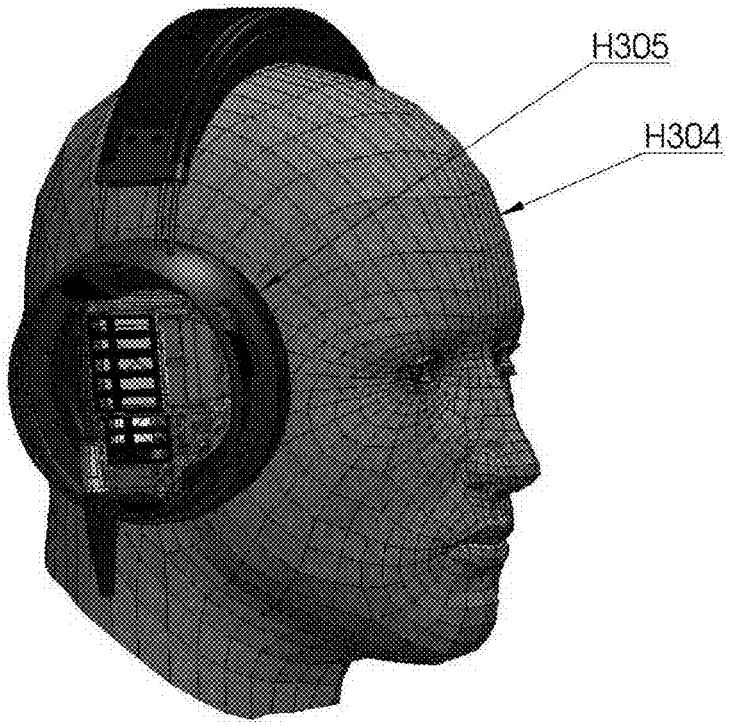
FIG. 10A shows a 3D view human head wearing a circumaural headphone consisting of four drivers, two on each ear; two shown on the right ear, one treble unit which is identical to the embodiment A driver, and one bass unit which is similar to the embodiment A driver, but is bigger and suitable for reproducing low bass.
Figure 10B:
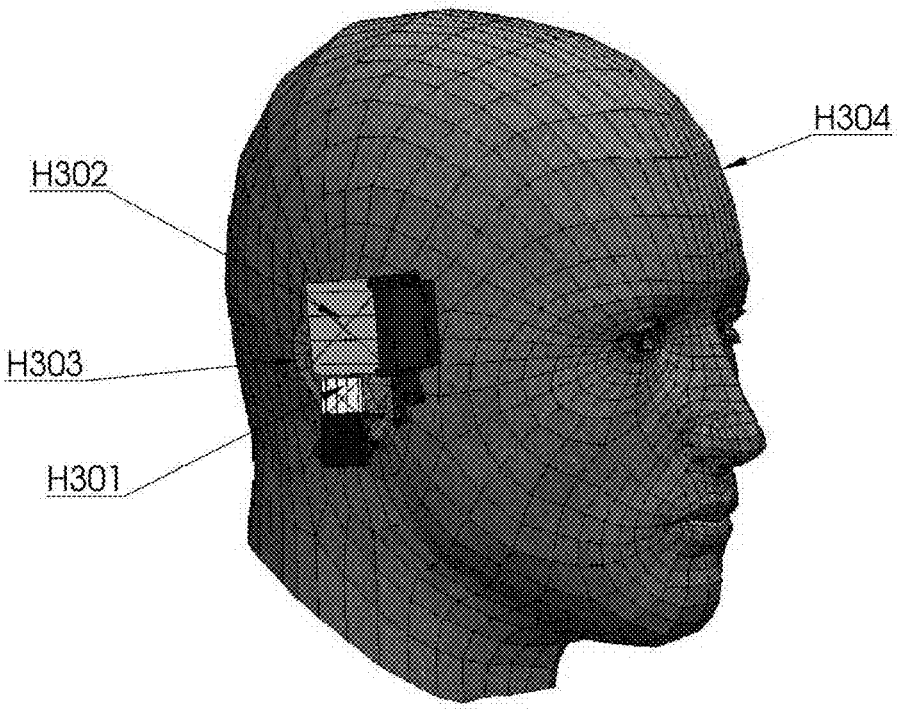
FIG. 10B shows the same image as in 10A, except that the all parts of the headphone have been hidden, except for the two loudspeaker drivers.

In one implementation, the audio transducer of embodiment A, for instance, may have a diaphragm body length of approximately 15 mm, for example, and designed to reproduce mid-range and treble frequencies, from 300 Hz to 20 kHz, in the two way headphone illustrated FIG. 10B (loudspeaker audio transducer H301). The same transducer could also be deployed as a mid-range-treble loudspeaker audio transducer for a home audio floor-standing speaker, for example reproducing the band of frequencies between 700 Hz and above, or, it could also be optimised to act as a full-range driver in a 1-way headphone.

The audio transducer of embodiment A can be scaled in size to fit a variety of applications. For example, FIG. 10B shows a bass loudspeaker audio transducer H302, which is an enlarged embodiment A audio transducer (in all dimensions) with respect to the mid-range and treble driver H301. The enlarged audio transducer may have a diaphragm length of about 32 mm, for example. In such a case, the transducer H302 may be capable of moving more air with a lower fundamental frequency of around 40 Hz. The transducer H302 may be suitable for reproducing frequencies up to around 4000 Hz. This driver would also be suitable for a mid-range driver of a home audio floor standing speaker, for example reproducing the band of frequencies between 100 Hz and 4000 Hz. Further approximate scaling (of all dimensions) to a diaphragm length of approximately 200 mm, for example, could result in a driver having substantially resonance-free bandwidth from 20 Hz to around 1000 Hz, or higher in some cases, with high volume excursion capability.

This configuration would be suitable for a subwoofer for a home audio floor-stander for example.

The treble loudspeaker driver H301 has both a diaphragm body width A219 and diaphragm body length A211 of 15 mm. The maximum designed excursion angle is +/−15 degrees, which corresponds to about a 7.6 mm peak to peak excursion distance at the tip of the diaphragm and a peak to peak volume of air displacement of about 800 mm^3.

Figure 9:
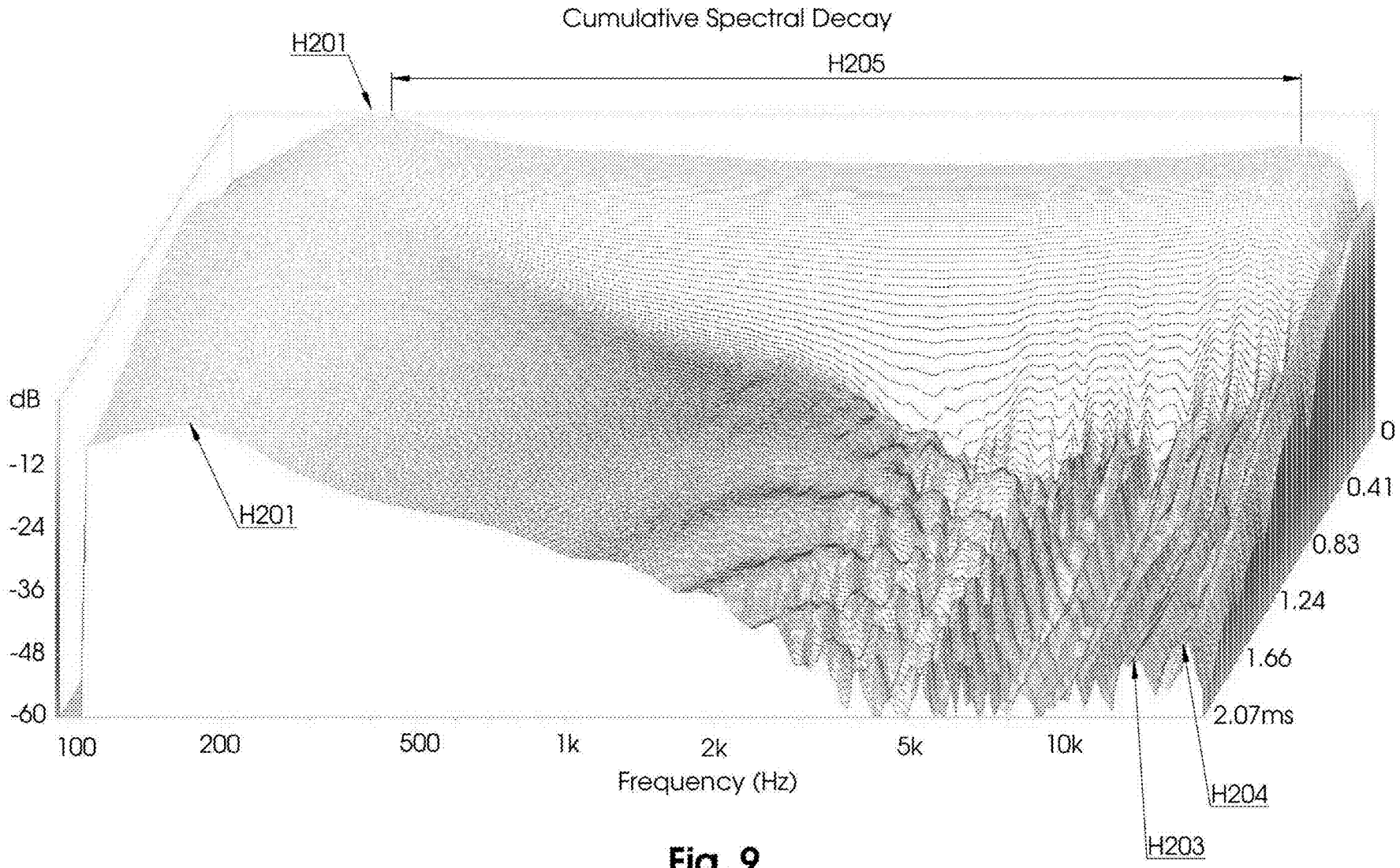
FIG. 9 shows a cumulative spectral decay plot of the embodiment A driver.

The response has been measured, on axis with a microphone in close proximity (about 5 mm distance) from the middle tip of diaphragm assembly A101 and the resulting cumulative spectral decay (CSD) plot is shown in FIG. 9. The y axis corresponds to sound pressure ranging from −60 dB to 0 dB, the x axis corresponds to frequency which ranges from about 100 hz to 20 kHz, and the z axis is time ranging from 0 to 2.07 ms.

The wide peak H201 of the fundamental resonance of the diaphragm at about 170 Hz can be seen with a wide ridge extending forward in time. The first breakup frequency of the diaphragm is located at about 15 kHz, and is a twisting mode. Because the microphone was positioned near the middle of the diaphragm the net air pressure generated was small and this mode it is hard to identify on the CSD plot of FIG. 9, but a small ridge that extends to location H203 is probably due to this resonance mode.

A ridge corresponding to the first breakup mode that seriously affects the frequency pressure response is located at H204, at approximately 20 kHz. It should be noted that the software creating the CSD plot starts to filter off the part of the graph from approximately 17 kHz.

This waterfall plot response of this transducer is very good. The height of the 'cliff' at about the 5 kHz region is an approximately a 50 dB drop, but the transducer is believed to be substantially resonance-free over the bandwidth indicated by H205, which implies that the cliff would be higher still were it not for experimental and mathematical limitations.

The bass loudspeaker driver H302 has a diaphragm body width of 36 mm and a diaphragm body length of 32 mm. The maximum designed excursion angle is +/−15 degrees, which corresponds to a 16 mm peak to peak excursion distance at the tip of the diaphragm and a peak to peak volume of air displacement of about 8900 mm^3.

Figure 12:
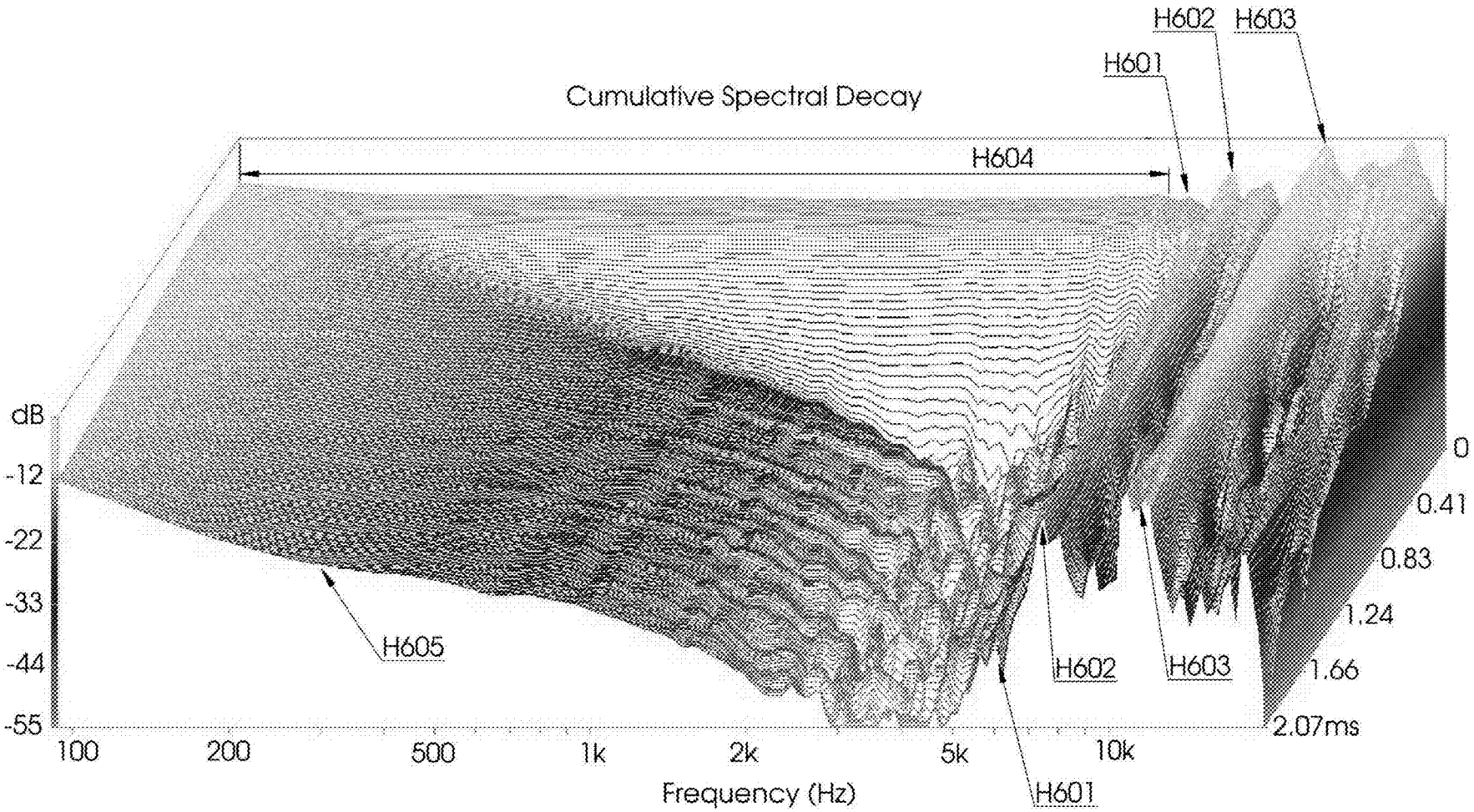
FIG. 12 shows a cumulative spectral decay plot of the bass driver shown in FIG. 10A.

The response has been measured, on axis with a microphone in close proximity (about 5 mm distance) from the middle tip of diaphragm, and the resulting CSD plot is shown in FIG. 12. The y axis corresponds to sound pressure ranging from −55 dB to 0 dB, the x axis corresponds to frequency which ranges from about 100 Hz to 20 kHz, and the z axis shows time ranging from 0 to 2.07 ms.

The fundamental resonance of the diaphragm at about 40 Hz is below the range of this chart, and is the cause of the wide ridge extending forward in time, H605 being one side of this ridge. The first breakup H601 frequency of the diaphragm occurs at about 6 kHz, and is a twisting mode. A ridge corresponding to a significant breakup mode that seriously affects the sound pressure response, located at H602, occurs at approximately 7 kHz. Possibly the largest break up mode ride on the plot is located at H603, at about 11 kHz.

The performance of the bass transducer is similar to the mid-range/treble transducer. The height of the 'cliff' at about the 4 kHz region is approximately 45 dB.

It will be appreciated that the above described implementation is only exemplary to describe the potential performance of the invention and variations to size, frequency of operation and other implementations are envisaged without departing from the scope of the invention.

2.2.3 Embodiment S & T

Two further embodiments of rotational action audio transducers of the invention will now be described having a hinge system for pivotally coupling a diaphragm structure to a base structure and designed in accordance with the principles of the invention will now be described. In particular, the biasing mechanism associated with these hinging systems will be described in detail. Other components will not be described in detail for the sake of conciseness. However it will be appreciated that the remaining components of the transducer, including the base structure, the diaphragm assembly, and the excitation mechanism can be of any one of the previously described audio transducer constructions, or even a different construction as would be apparent to those skilled in the art. In other words, the hinge systems described for the embodiment S or T audio transducers may be incorporated in any one of the audio transducers described in relation to embodiments A, E, K, S and T.

The following embodiments exemplify biasing mechanisms designed in accordance with the principles outlined above. In particular, the biasing mechanism or mechanism of the following embodiments is constructed such that it forces the hinge element of the hinge system against the contact member to maintain consistent physical contact during operation, in a manner that minimises translational displacement in the planes of the contact surfaces at the contact region (such as sliding, but not rolling, of the contact surfaces relative to one another). Furthermore, the biasing mechanism or mechanism comprise a degree of compliance in a lateral direction with respect to the contact surfaces to allow a relative reduction in frictional contact force between the surfaces during operation when necessary.

2.2.3a Background

Hinge joints based on rolling or pivoting elements offer potential for high diaphragm excursion and reasonably low compliance in rotational action loudspeakers as mentioned above.

Standard ball bearing race hinges are a somewhat standard mechanism used in most prior art rotational action audio transducers. This hinge design is susceptible to high rotational resistance and/or rattling of balls. These issues may be exacerbated by wear, corrosion and the introduction of foreign material such as dust. Manufacturing tolerances must be high which results in increased cost.

If a gap opens up between the (once) contacting surfaces, either by parts wearing, inaccuracy of parts during manufacture, or temperature fluctuations then this can allow parts to rattle and/or break-up frequencies to appear due to restraint not being able to be provided to the diaphragm. The mechanism can also be prone to becoming slightly jammed in situations such as when 1) the bearing is exposed to dust (which can be created as parts wear during operation), 2) the parts have manufacturing inaccuracies or 3) when temperature fluctuations cause dimensional changes. All of these problems can generate unwanted noise, and create a non-linear response resulting in poor sound quality.

When used with a diaphragm of very small size, for example a personal audio headphone or earbud loudspeaker driver, these kinds of problems become even more problematic because of the need in these kinds of applications for a low fundamental frequency (Wn) and the additional challenges of achieving this with a diaphragm that is small and of low mass, as well as the correspondingly smaller manufacturing tolerances required.

Some existing rolling element bearings (e.g. ball bearings) include spring elements in the construction that apply preload in a compliant manner. Many standard pre-load bearing types are not well suited to audio transducer applications, although they could still be utilised.

Referring to FIGS. 28A-E a standard prior art ball bearing V101 incorporating a compliantly applied pre-load is shown. The bearing V101 comprises an outer shell or sheath V102 and having housed therein a pair of bearing elements V106*a* and V106*b*, each having a series of balls V112, accommodated and rollable between an annular outer race V109 and an annular inner race V110. A central shaft V103 extends through the annular inner races V110 of the bearings. The mechanism can form a hinge between two components by coupling one component to the shaft and the other component to the sheath V102. Preload is applied to the mechanism via spring-loaded washers V108*b* and V108*a* located between the sheath V102 and the outer race V109*a* of one of the bearings. The spring loaded washers cause outer race V109*a* to slide towards the right hand side relative to outer sheath V102 which, because the profile of outer race V109*a* is curved, pushes contacting rolling elements towards the centre axis of the bearing thereby compliantly loading the right hand side bearing race V106*a*. There is also a reaction force side causing the outer race at the left hand side V109*b* to be pushed towards the left which, in an equivalent manner, compliantly loads the left hand side bearing element V106*b*. Note that this happens despite the fact that left hand side outer race V106*b* is not adjacent a spring.

If a diaphragm and force transducing component were to be mounted to bearing v101 to form a rotational action diaphragm assembly this would provide benefits over prior art audio transducers in terms of that the compliant loading of rolling elements would result in reduced and more consistent rolling resistance, all else being equal, which could potentially facilitate deeper bass with less distortion, for example self-noise generation may be reduced. An audio transducer embodiment of the invention may include such a bearing V101 for hingedly coupling the diaphragm assembly to the base structure for example.

However, the right hand side set of rolling elements V112*a* within bearing V101 are not optimal for high-frequency performance in a loudspeaker, as there is no rigid contact between outer race V109*a* and the outer sheath V102 against which it can slide. Instead there is a small air gap V113 where there is minimal contact between V109*a* and V102 (to allow the race V109*a* to slide relative to the sheath V102). This means that there is a discontinuity in the pathway by which loads are transmitted from the shaft V103 to the outer sheath V102, and this discontinuity introduces translational unwanted compliance in the hinge assembly (not the biasing mechanism) that is effectively between the diaphragm structure or assembly and the hinge element of the hinge assembly, indirections perpendicular to the axis of rotation. This unwanted compliance in the hinge assembly may result in diaphragm breakup or other forms of resonance during operation. As well as introducing compliance, this sliding contact also introduces a possibility of rattling. On the other hand, the hinge systems of the present invention, such as that described in relation to embodiment A for example, have relatively very low to zero compliance between the diaphragm assembly and the hinge element.

Another solution that solves the discontinuity issue would be to use two or more of bearing V101, for example one could be located at each end of one side of a hinge-action diaphragm. Since the left-hand side of the bearing element V106*b* is capable of passing translational loads in a non-compliant manner, if two such bearing elements are employed then both sides of the diaphragm will be non-compliantly restrained thereby reducing the possibility for unwanted resonance. For clarity in regards to compliance and non-compliance, the overall goal is to provide a hinge assembly that is compliant in terms of rotations about one axis and non-compliant in terms of translations and other rotational axes, and this is achieved via a hinge system that comprises a combination of a compliant biasing mechanism and non-compliant rolling contacts. Meanwhile the advantage of reduced and consistent rolling resistance is retained, so low frequency performance is improved compared to comparable prior art speakers.

FIGS. 21A-H and 24A-H illustrate two simpler and more effective solutions which are less prone to rattling and which remove the requirement for a sliding surface and/or a liquid. These embodiments show alternative hinge systems that have been developed in accordance with the principles of design outlined in the section 3.2.1 of this specification.

2.2.3b Embodiment S

Referring to FIGS. 21A-H, an alternative form of a rotational action audio transducer is shown having a diaphragm assembly S102 (shown in FIGS. 22A-E) that is pivotally coupled to a transducer base structure S101 (shown in FIGS. 23A-E) via a hinge system. The diaphragm assembly S102 comprises a diaphragm structure that is similar to that described under section 2.2.2 of this specification. Furthermore, the transducer base structure S101 comprises a relatively thick and squat geometry as per the embodiment A audio transducer, with a permanent magnet S119 and outer pole pieces S103, defining a magnetic field of the excitation mechanism. When implemented in an audio device, the diaphragm structure may have an outer periphery that is at least partially, substantially or approximately entirely free from physical connection with a surrounding structure of the device.

The hinge system of this embodiment is based on a standard rolling element bearing (e.g. ball bearing) construction, except that half of the original number of (typically eight or more) balls are removed so that there are only four or less balls in each sub bearing/bearing element. Preferably a cage made from a plastics material S118 maintains circumferential ball separation as plastics low mass and inherent damping mean that it is less susceptible to rattling, however other cage designs will also work. Preferably the outer race S116 of each bearing element is thinner, in profile, than is typical in a rolling element of this radius. The outer race S116 is preferably pressed and also adhered into a preferably thin-walled aluminium tube S112. The tube S112 may alternatively be made from any relatively rigid material, for example carbon fibre reinforced plastic would also be suitable. Interference-fit rolling elements S117 are used, and the outer race S116 and tube S112 compliantly deform to accommodate these without the jamming and other problems associated with standard rolling element bearings.

Figure 21A:
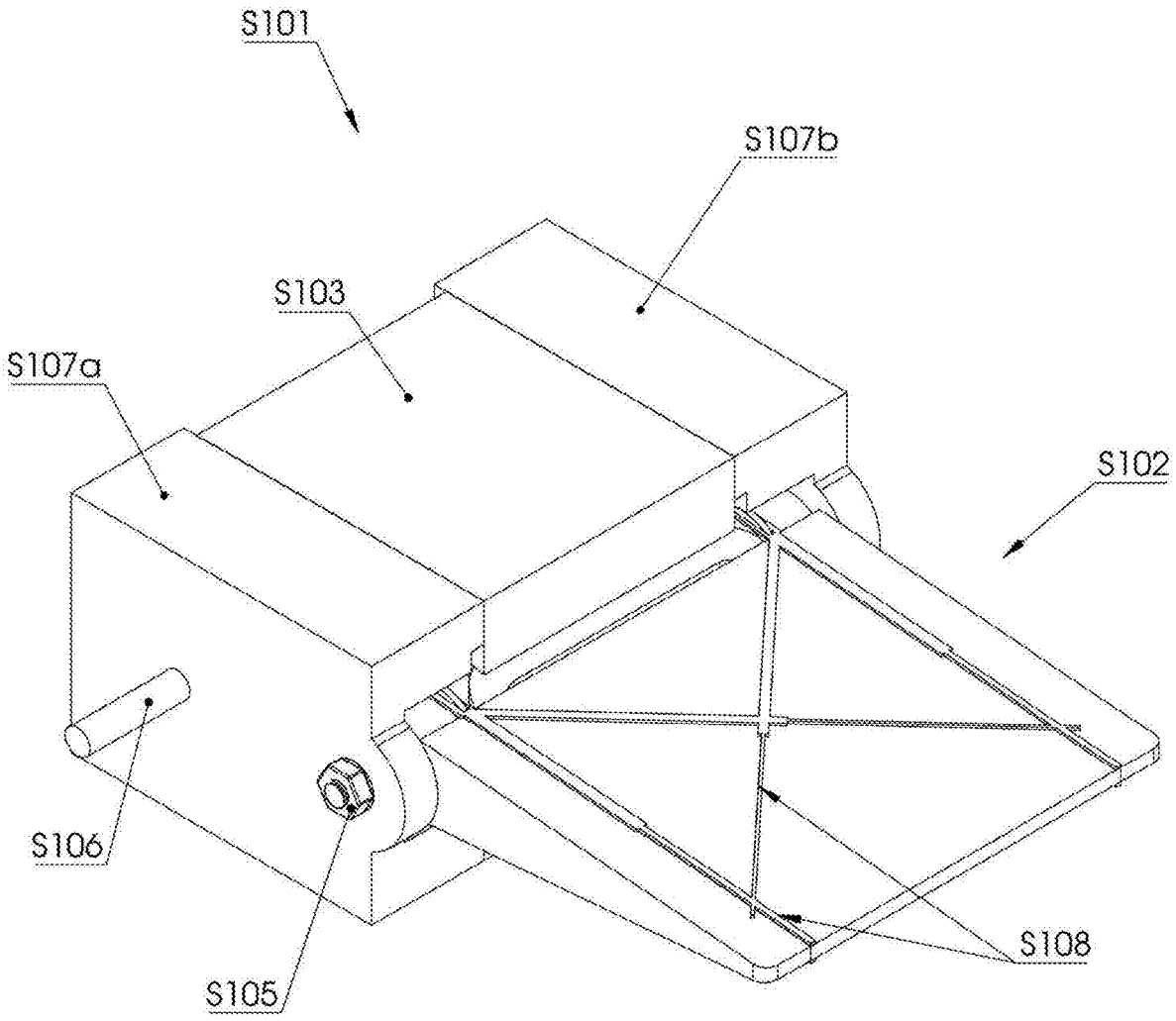
Figure 21B:
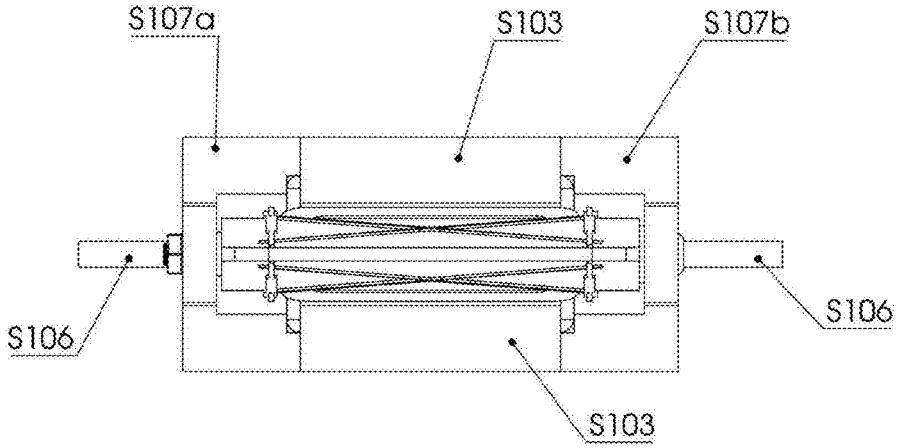
Figure 21C:
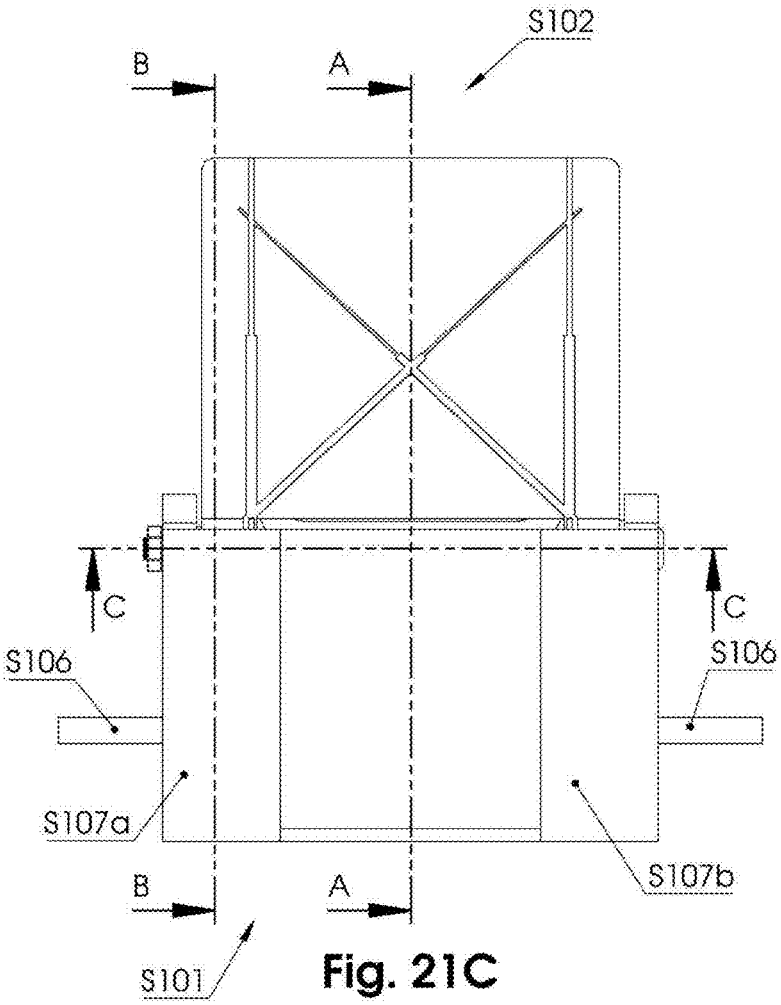
Figure 21D:
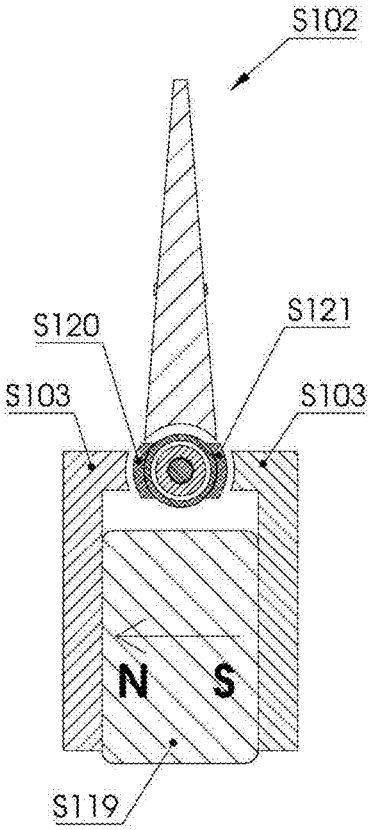
Figure 21E:
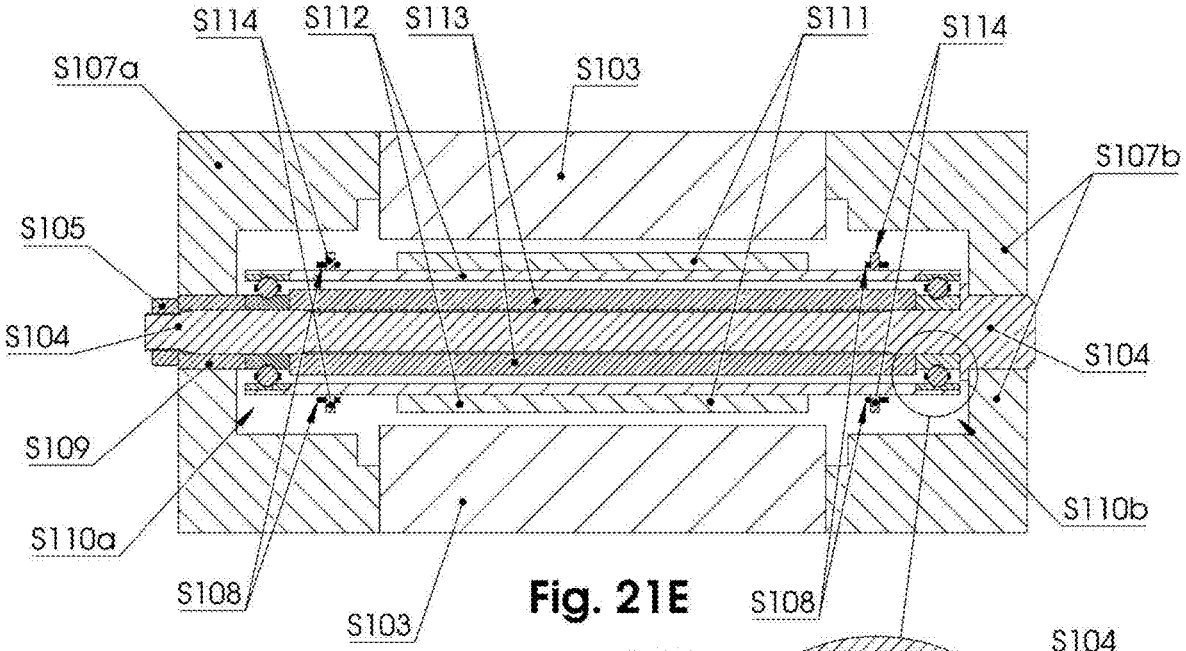
Figure 21F:
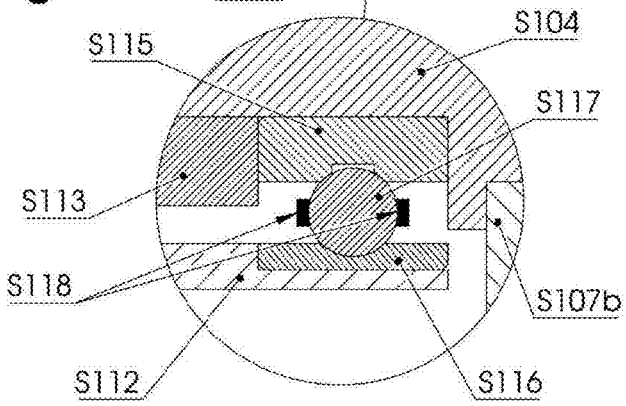
Figure 21G:
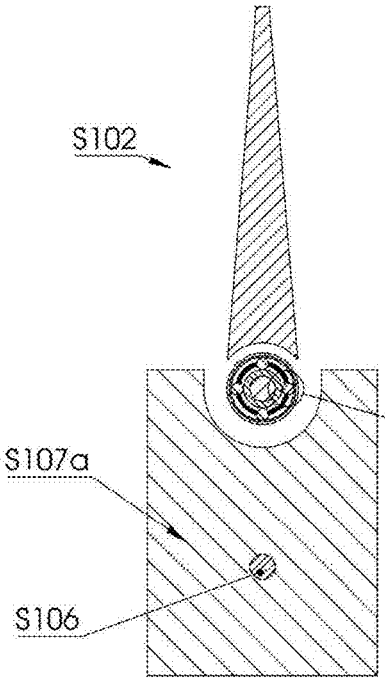
Figure 21H:
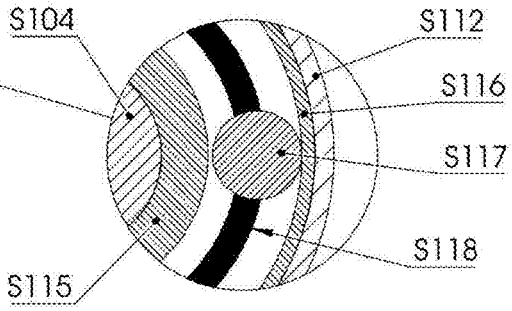
Figure 22A:
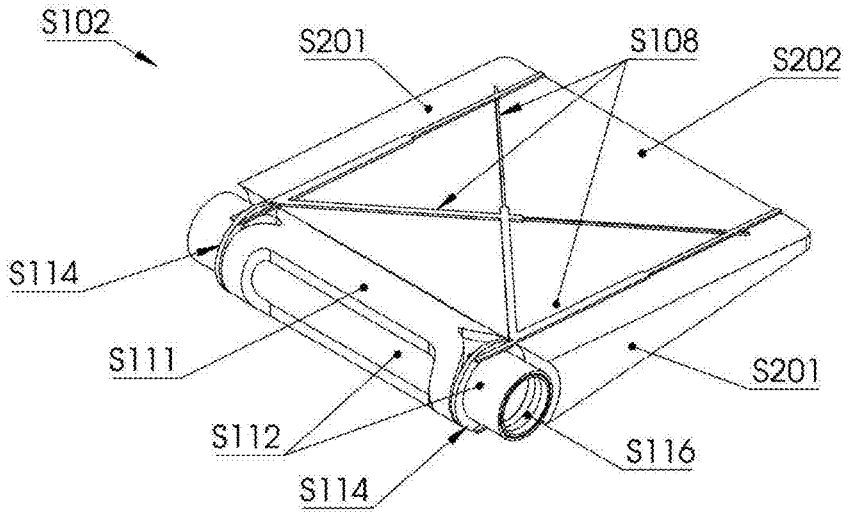
Figure 22B:
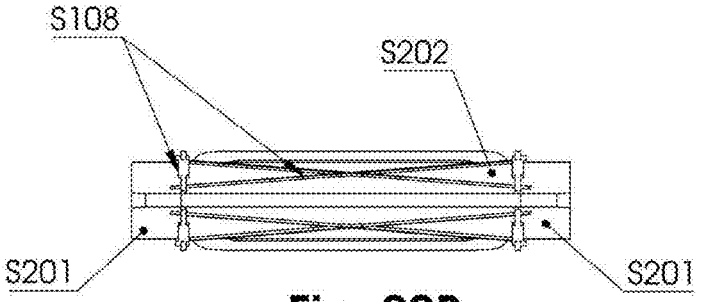
Figure 22C:
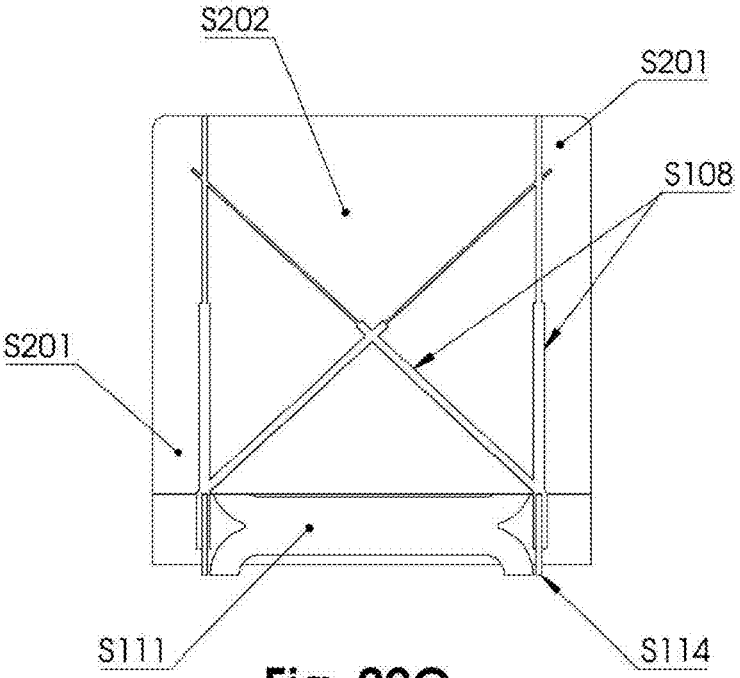
Figure 22D:
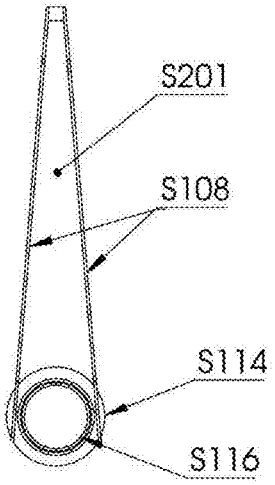
Figure 22E:
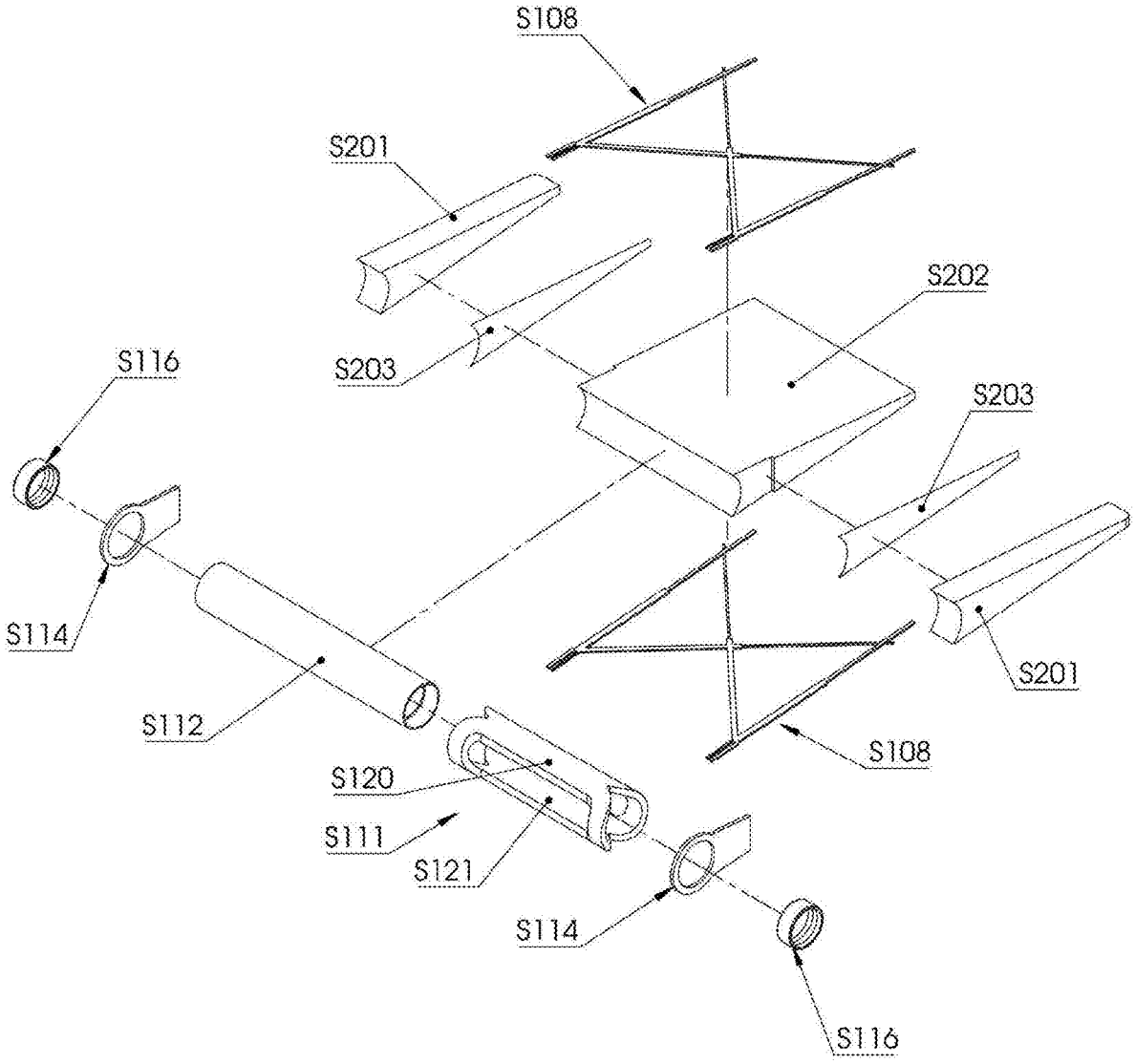
Figure 23A:
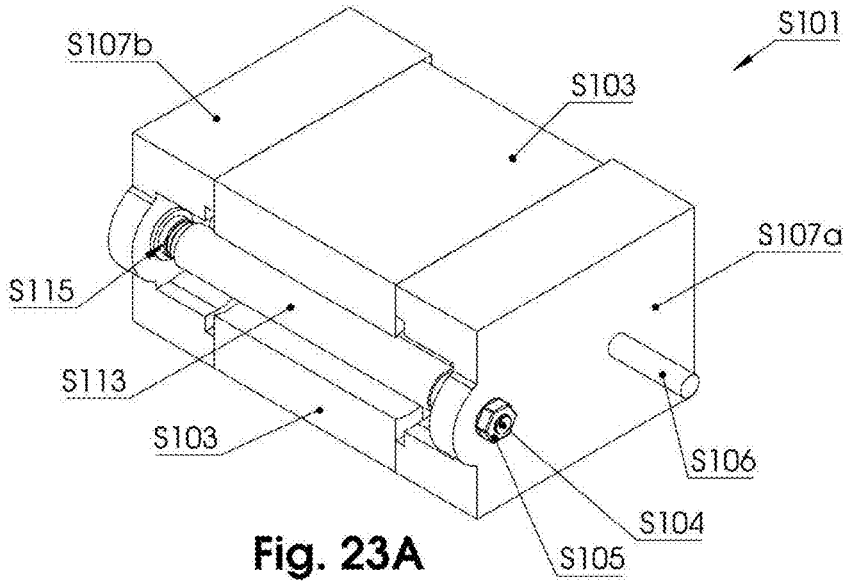
Figure 23B:
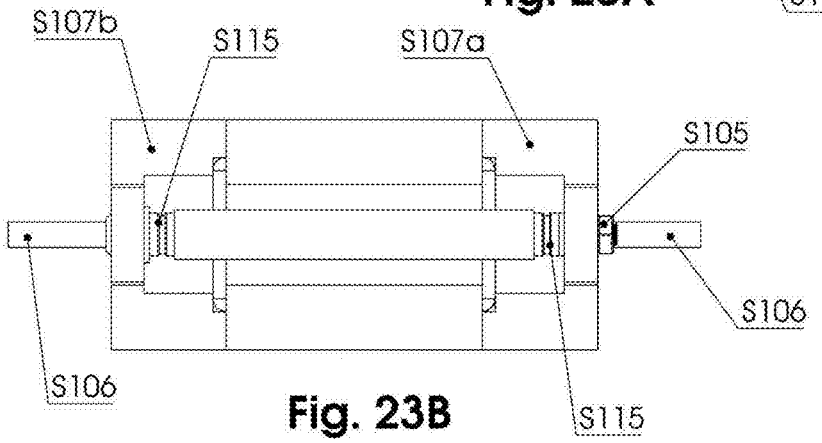
Figure 23C:
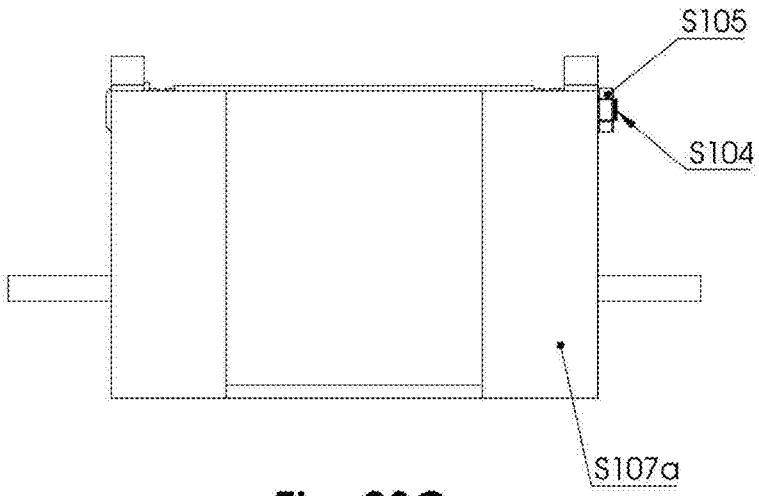
Figure 23D:
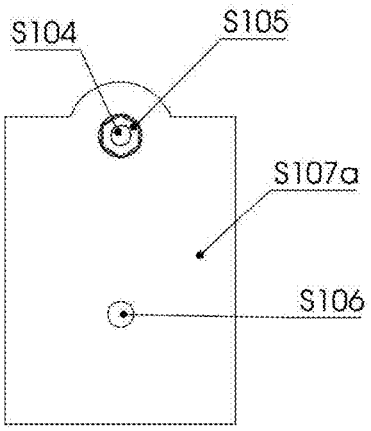
Figure 23E:
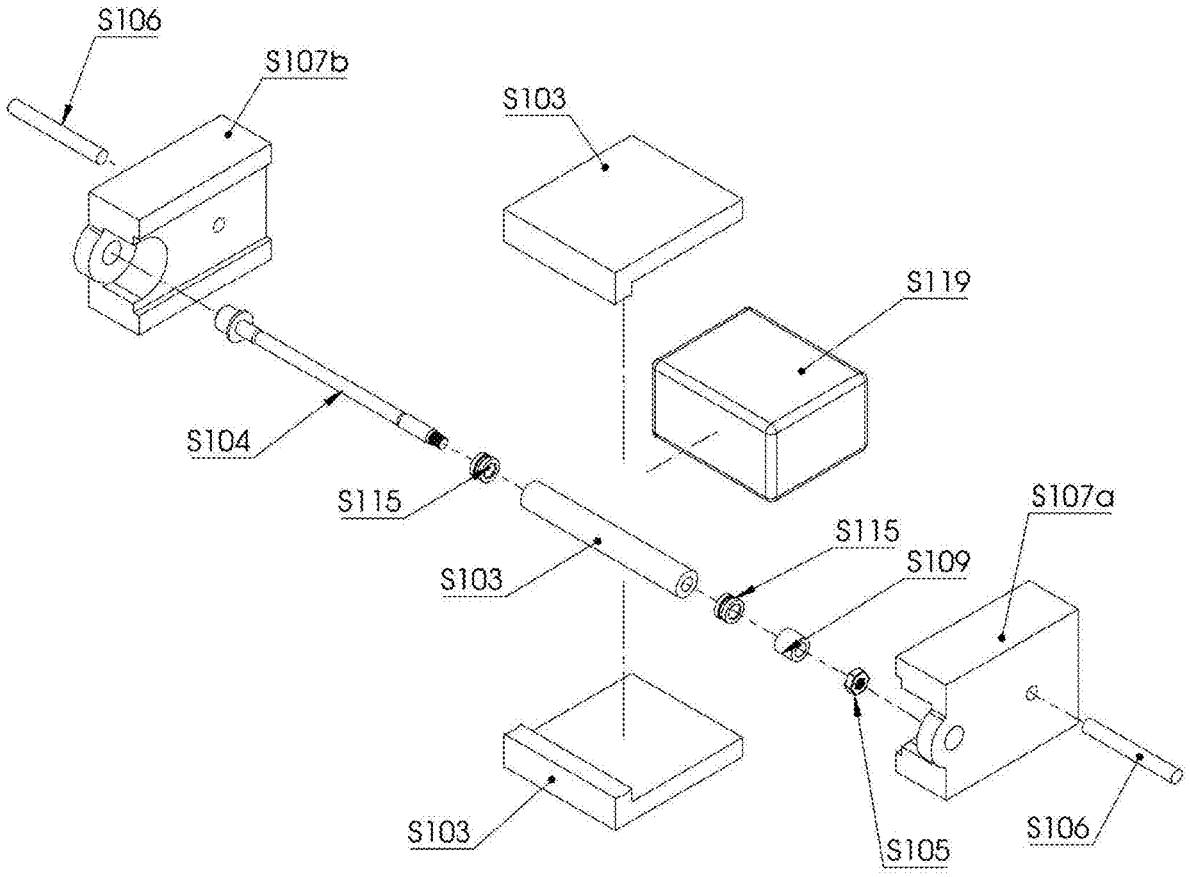

The fact that there are less rolling elements S117 in each bearing element means that the span or distance, between rolling elements S117, of the outer race and tube, when viewed from the side such as can be seen in FIG. 21G, is increased compared to the case of typical rolling element bearings, and this, in conjunction with the thin outer race S116 and tube S112, means that localised lateral compliance, in the immediate vicinity of each of the bearings element S117 (which in this case for part of the hinge system biasing mechanism), is greater than is typical in a typical rolling element bearing.

Note that although there may be lateral compliance inherent in the outer race S116 and its supporting tube S112 localised in the immediate vicinity of each ball, the overall translation compliance (other than lateral compliance) of the hinge system is low in terms of transmission of radial loads between the transducer base structure S101 and the diaphragm assembly S102. This is because overall compliance of the hinge system depends on the overall compliance/deflection of the tube relative to the transducer base structure, as opposed to depending on the compliance in the localised compliance/deflection in the immediate vicinity of a particular ball.

This means that, again, the advantage of reduced and consistent rolling resistance is retained due to the lateral translational compliance in the localised region of contact between each ball and the outer race, yet also, overall translational compliance in terms of translation of the entire diaphragm S102 relative to the base structure S103 is relatively low, because localised lateral deformation of the outer race in response to pressure from a particular ball does not result in a proportional compliance facilitating translation of the entire diaphragm. This low overall translational compliance in the hinge mechanism facilitates high-frequency extension with reduced susceptibility to unwanted resonance/diaphragm breakup.

In this case the property of reduced and/or more consistent rotational friction in the hinge facilitates use of larger radius bearings than would otherwise be possible all else being equal. This in turn facilitates support of a large diameter hollow shaft S112, which can house a stationary steel shaft S104/S113 that doubles as an inner pole piece and which is thick enough to remain resonance-free over a wide bandwidth. Variations on this design are possible, for example if smaller diameter rolling element bearings are used this will reduce rotational friction, thereby improving low frequency performance.

This design also removes the possibility of over-constraint of the rolling elements S117 whereby some are loaded while others are not and therefore may be free to rattle.

In this embodiment, the biasing mechanism, including the outer race S116 and supporting tube S112, operates separately from the structure or mechanism, which in this case is collectively all 4 balls S117 outer race S116 and tube S112, that supports the diaphragm assembly against translations with respect to the transducer base structure, but it is an integral part of the same structure. It should be noted that it is possible for the biasing mechanism to operate separately from the structure or mechanism connecting the hinge element to the diaphragm assembly, yet still be integral with the structure or mechanism connecting the hinge element to the diaphragm assembly.

2.2.3c Embodiment T

Referring to FIGS. 24A-H, a further embodiment of a rotational action audio transducer T1 of the invention is shown comprising a diaphragm assembly T102 (shown in FIGS. 25A-E) that is rotatably coupled to a transducer base structure T101 (shown in FIGS. 26A-E) via a hinge system incorporating a compliant biasing mechanism. The diaphragm assembly T102 comprises a diaphragm structure that is similar to a configuration of embodiment A. Furthermore, the transducer base structure T101 comprises a relatively thick and squat geometry as per the embodiment A audio transducer, with a permanent magnet T119 and outer pole pieces T103, defining a magnetic field of the excitation mechanism. When implemented in an audio device, the diaphragm structure may have an outer periphery that is at least partially, substantially or approximately entirely free from physical connection with a surrounding structure.

The hinge system is an adaptation of the bearing in FIG. 28A-E, where compliance is introduced in a manner that avoids the problematic sliding contact between the outer race V109*a* and the outer sheath V102. Instead, bearing preload is applied via compliance introduced within the diaphragm assembly T102, and this compliance is introduced in a manner such that this does not result in undue diaphragm breakup resonance. In this case the diaphragm is supported by two rolling element bearing assemblies T110*a* and T110*b*. Compliance is inherent in a number of flat springs T123 which make up a leaf spring bush component T122 located adjacent to rolling element bearing assembly T110*b*. The springs T123 are oriented in a plane perpendicular to the axis of rotation T127 in order that they can transmit force compliantly in the axial direction while transmitting force non-compliantly along their length, i.e. in the radial direction.

As with embodiments V and S the compliance introduced, in this case via flat springs T123, results in reduced and more consistent rolling resistance. In this case rolling elements T117 are located at a smaller radius relative to the radius of the coil T111, compared to that of embodiment S, and this results in further reduced rolling resistance and improved low frequency extension, as well as in further reduced noise generation at low frequencies for configurations of equivalent coil radius.

Figure 24A:
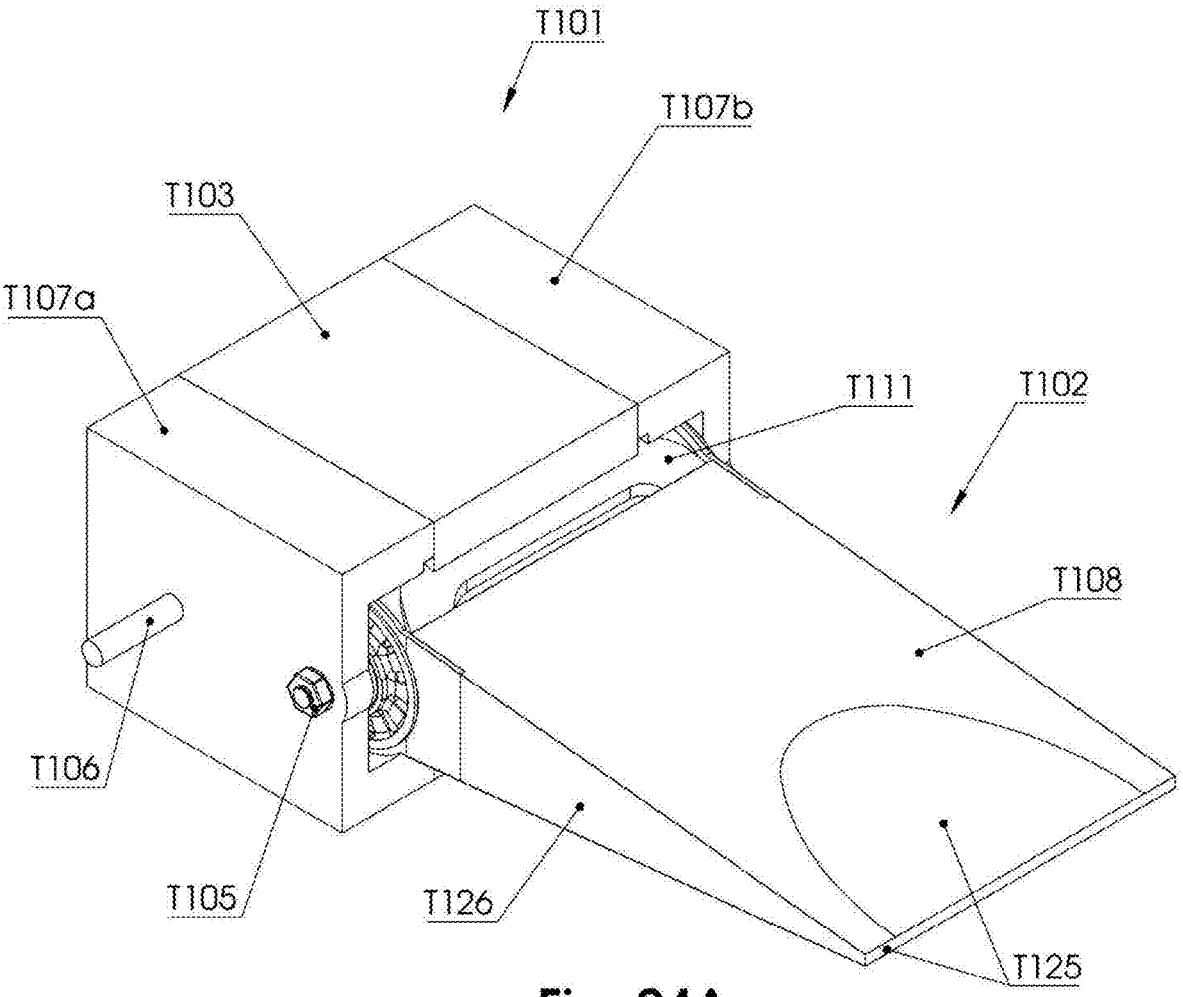
Figure 24B:
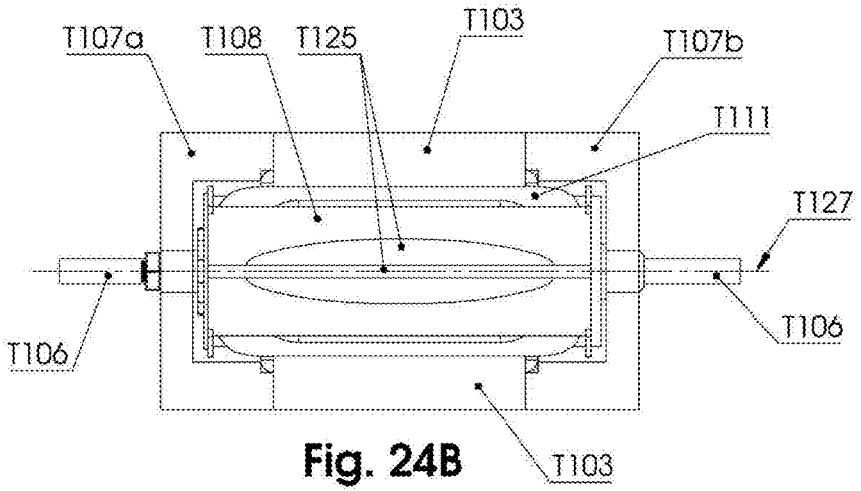
Figure 24C:
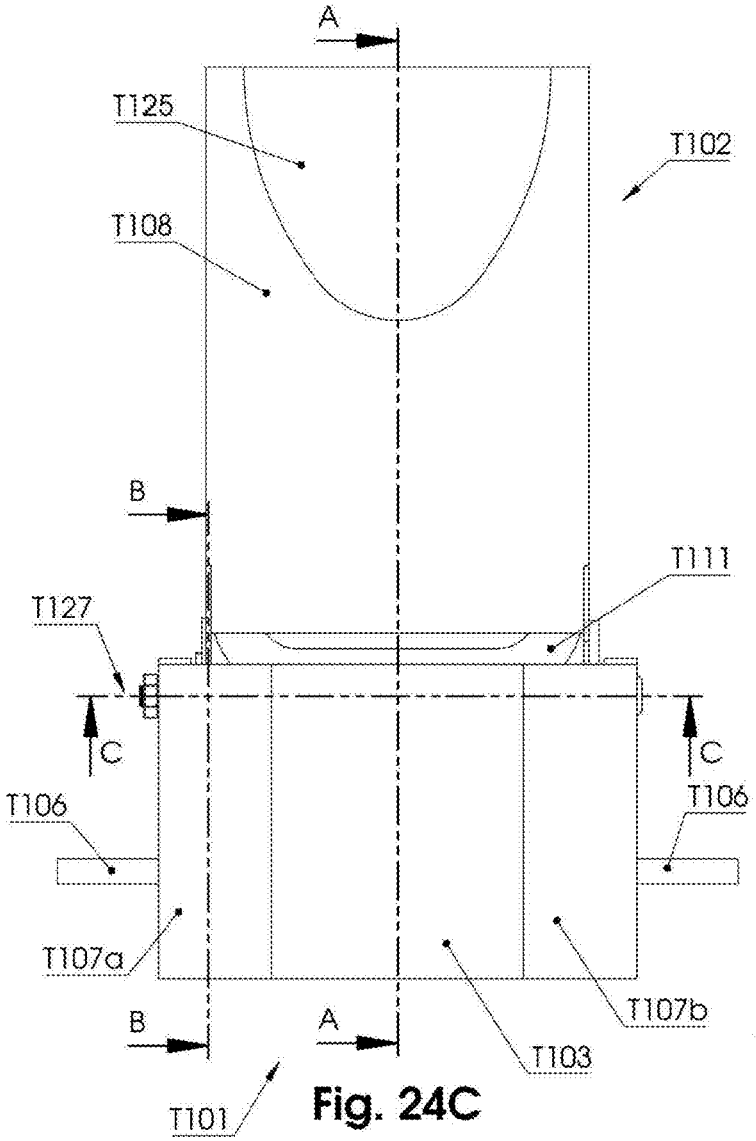
Figure 24D:
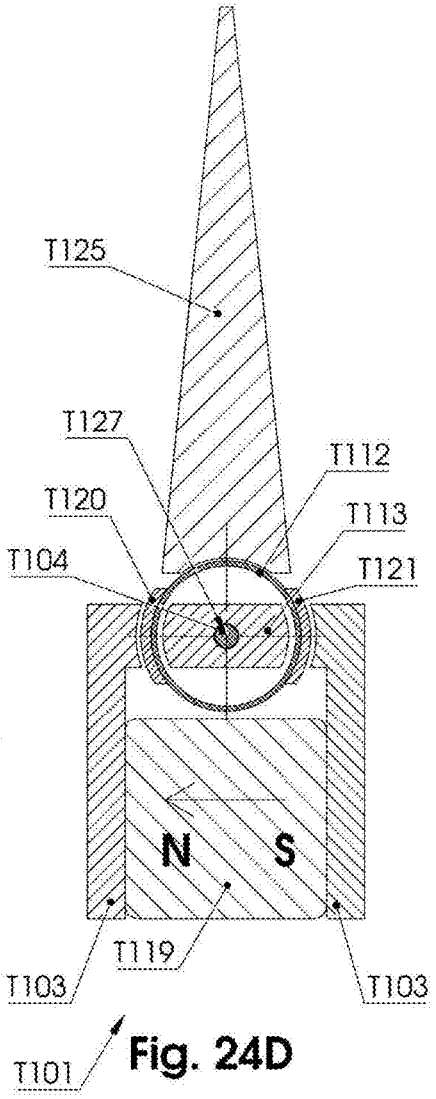
Figure 24E:
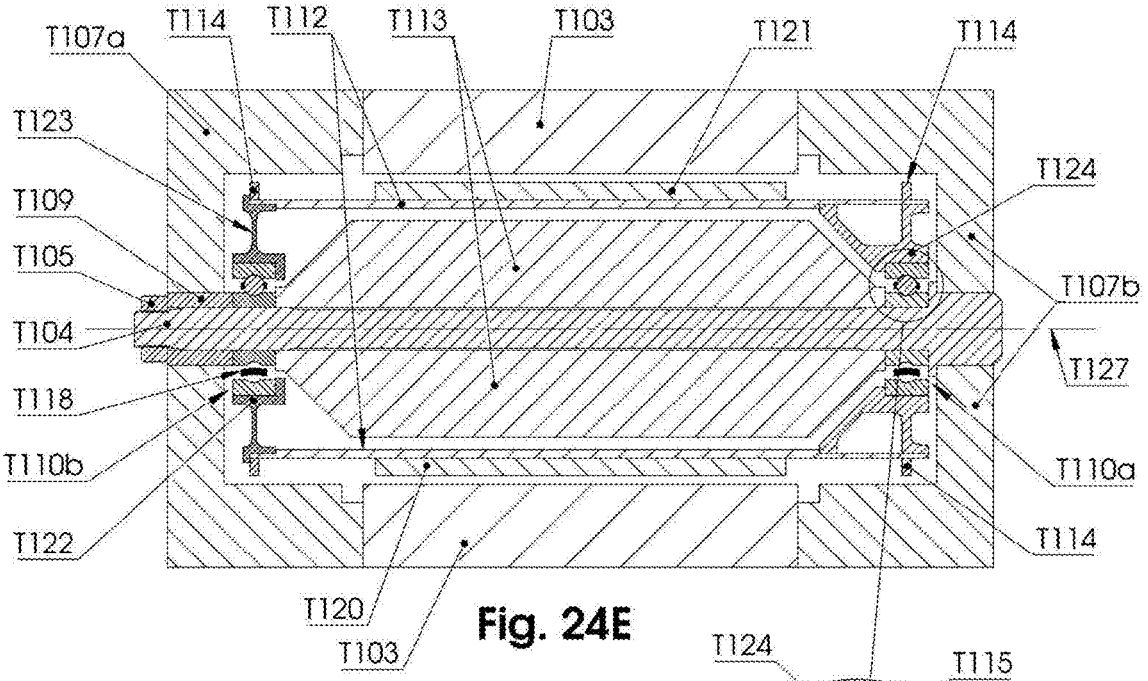
Figure 24G:
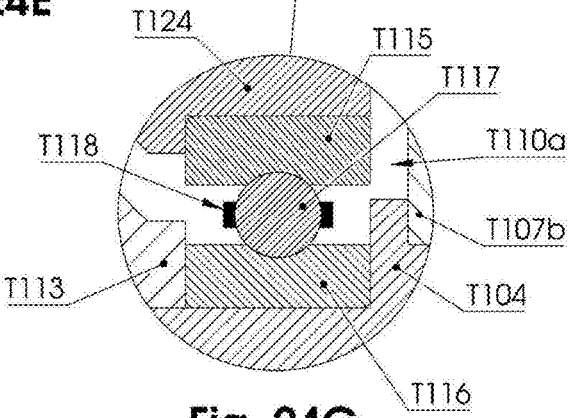
Figure 24F:
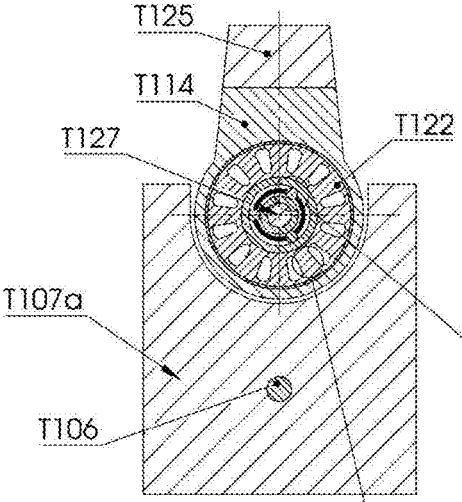
Figure 24I:
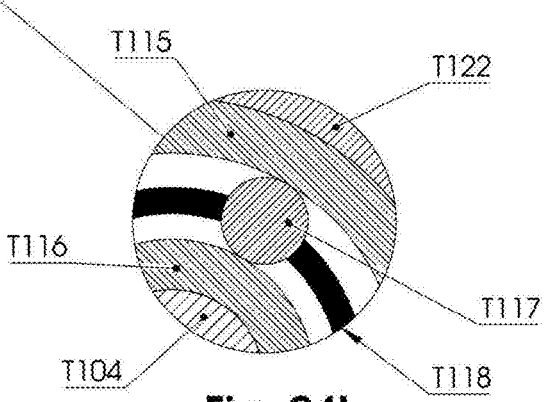
Figure 24H:
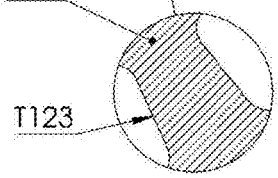
Figure 25A:
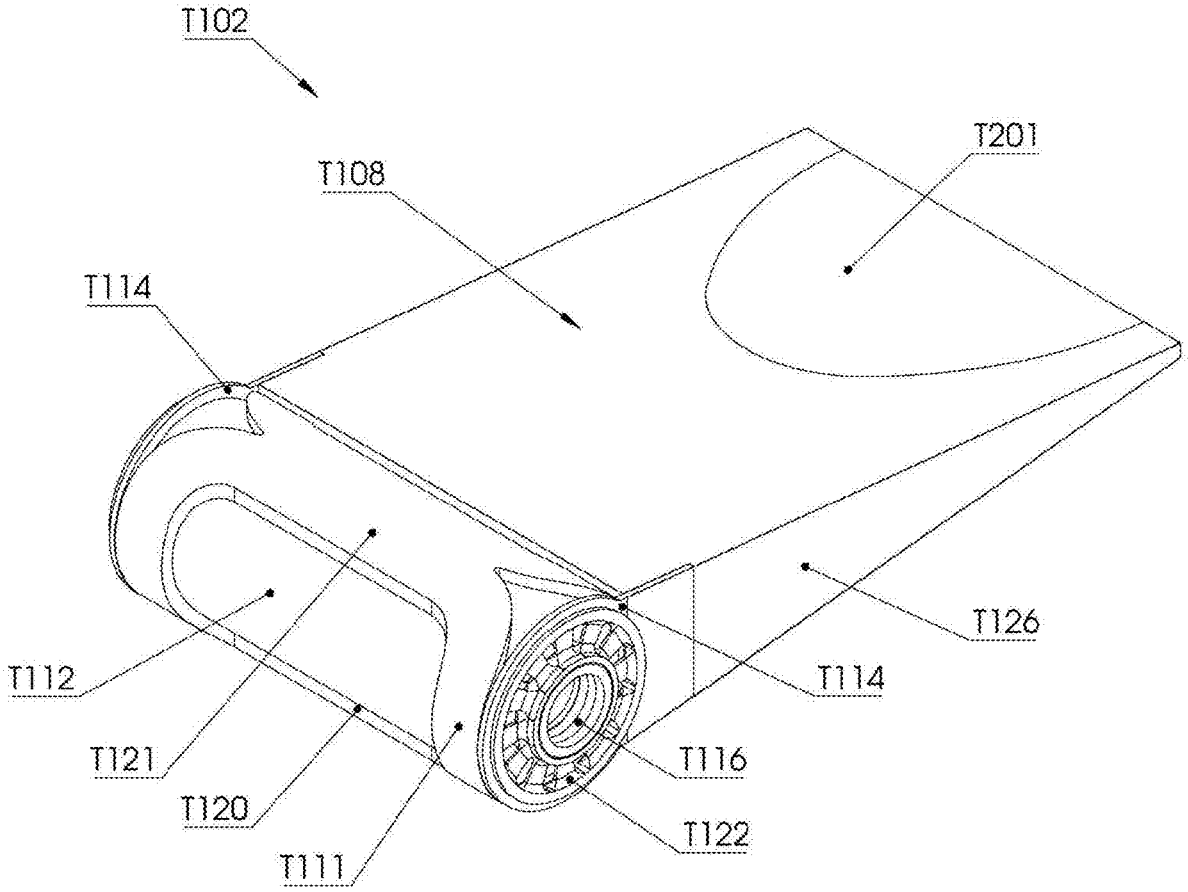
Figure 25B:
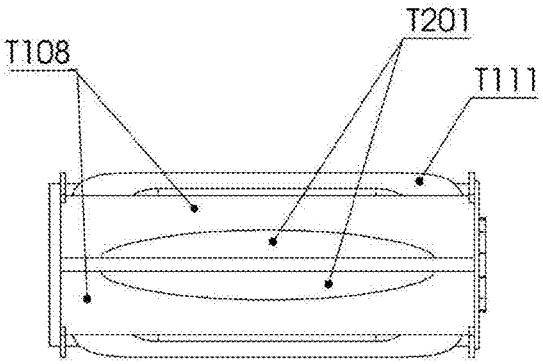
Figure 25C:
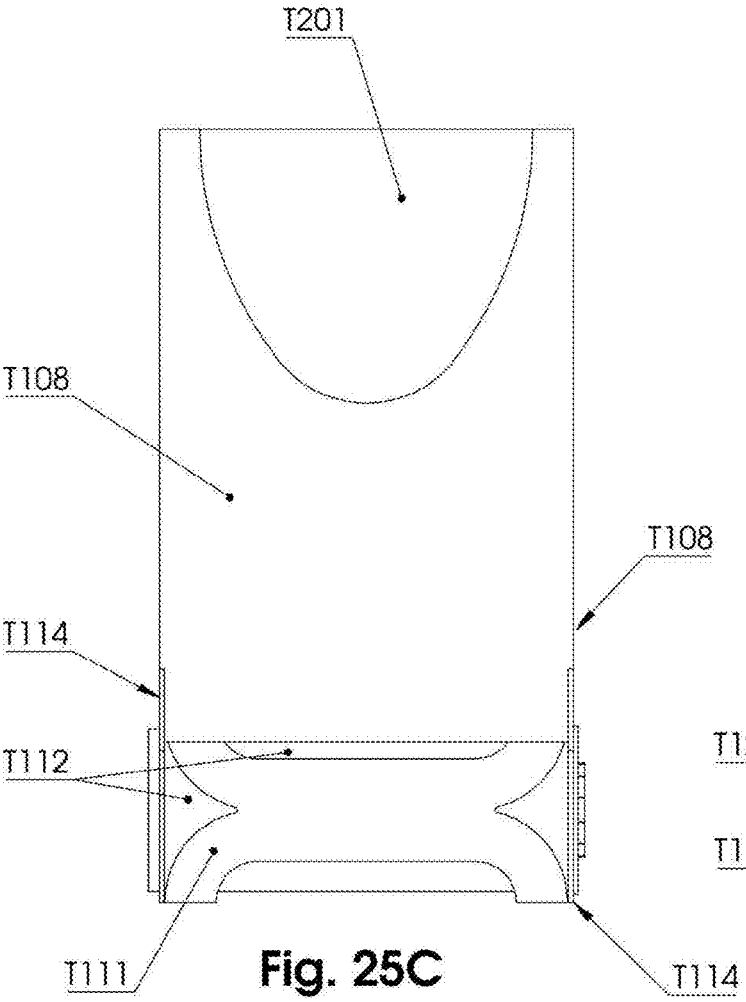
Figure 25D:
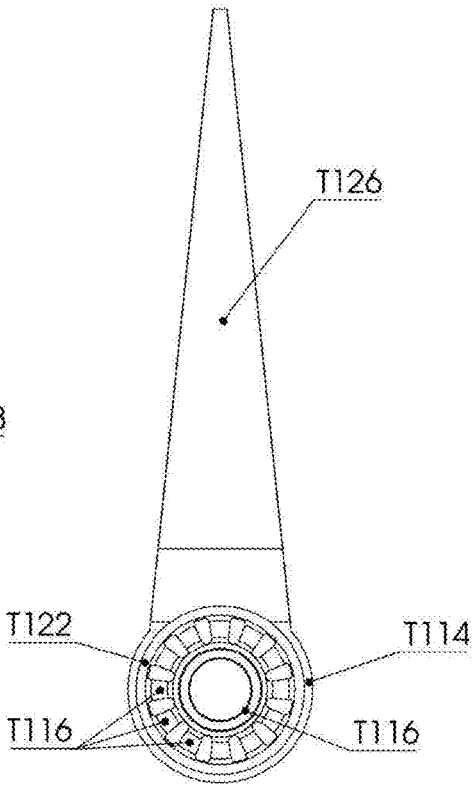
Figure 25E:
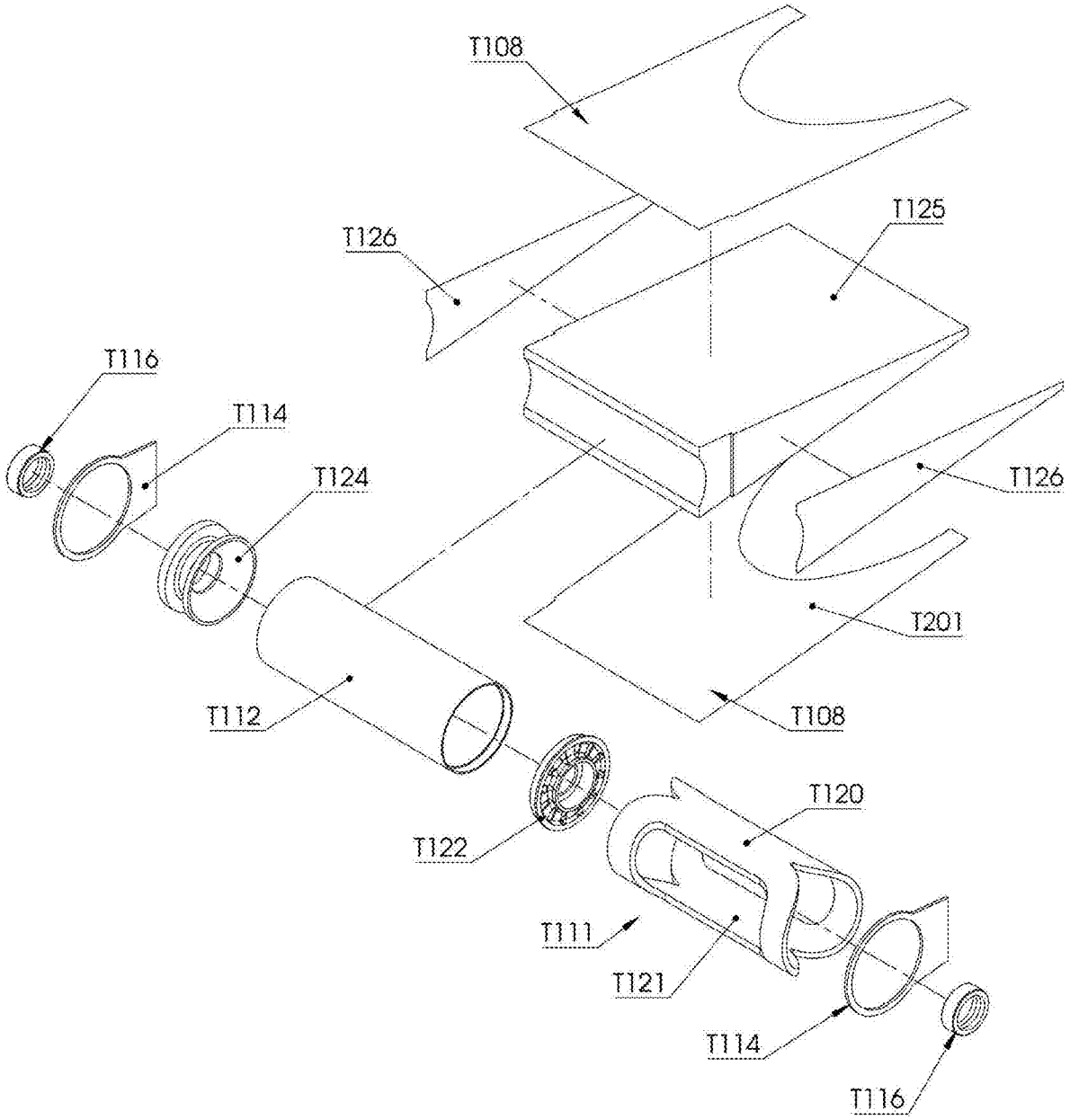
Figure 26A:
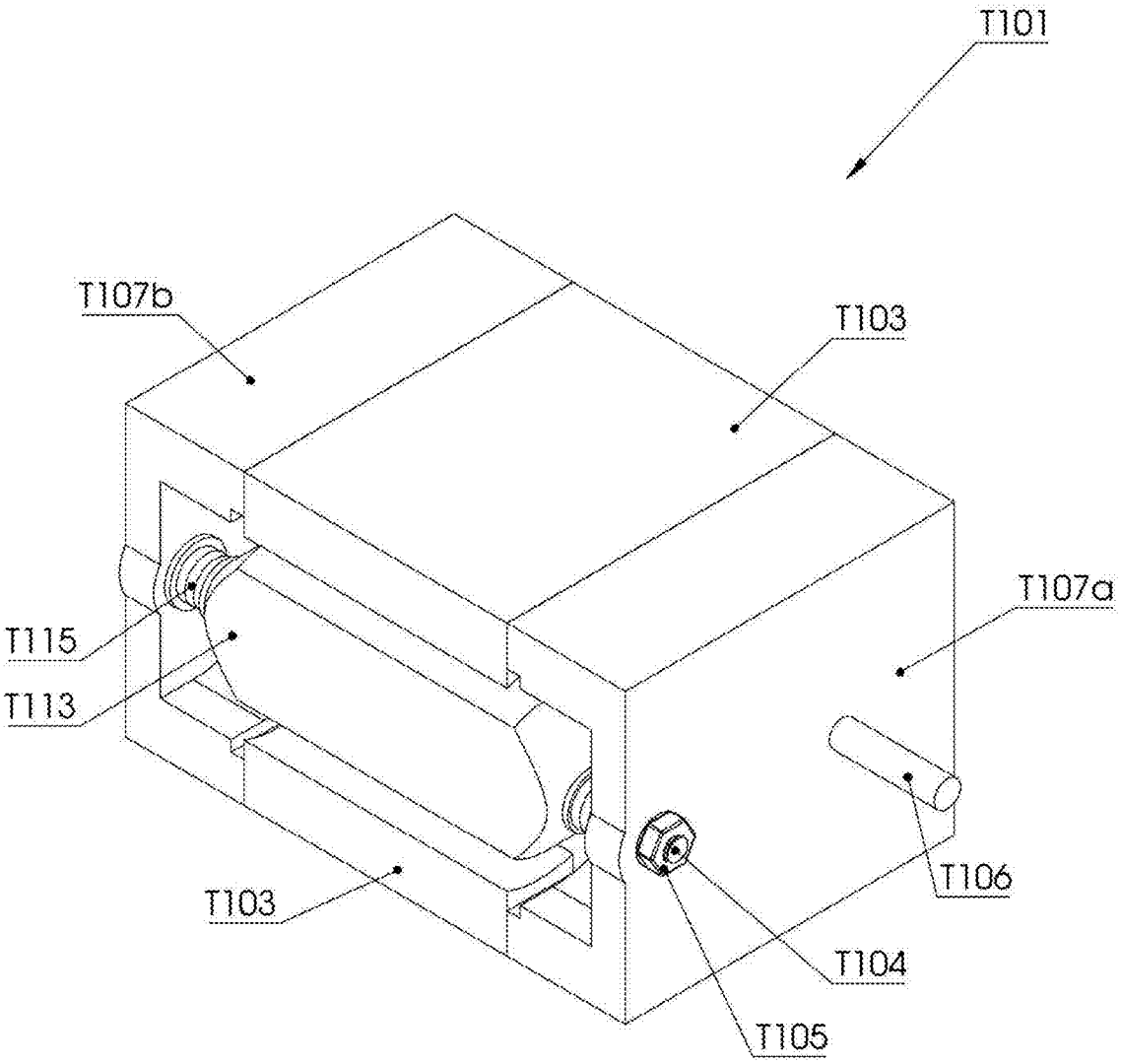
Figure 26B:
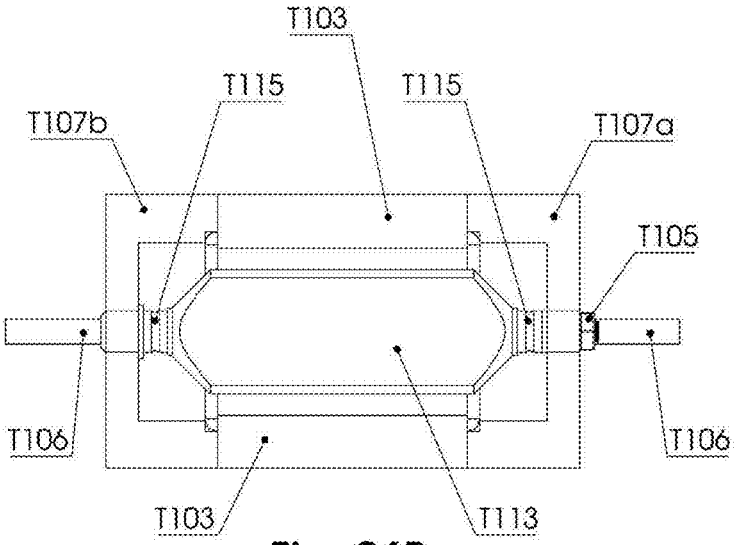
Figure 26C:
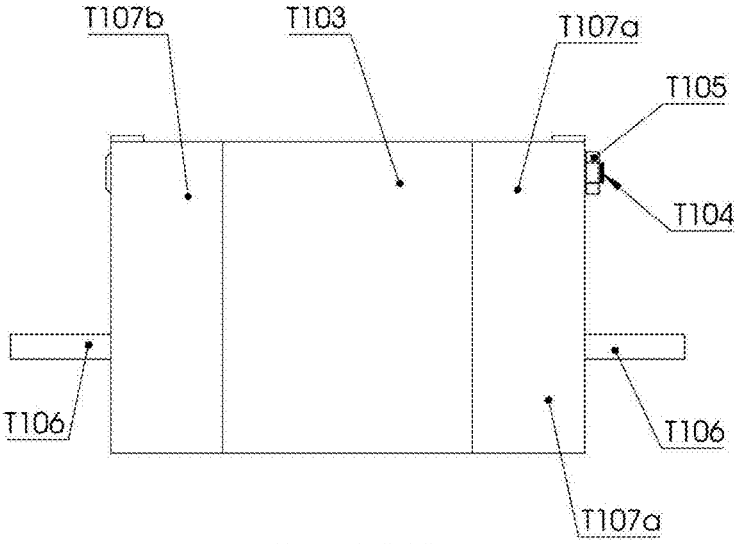
Figure 26D:
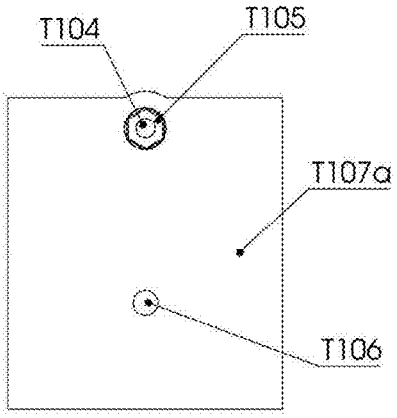
Figure 26E:
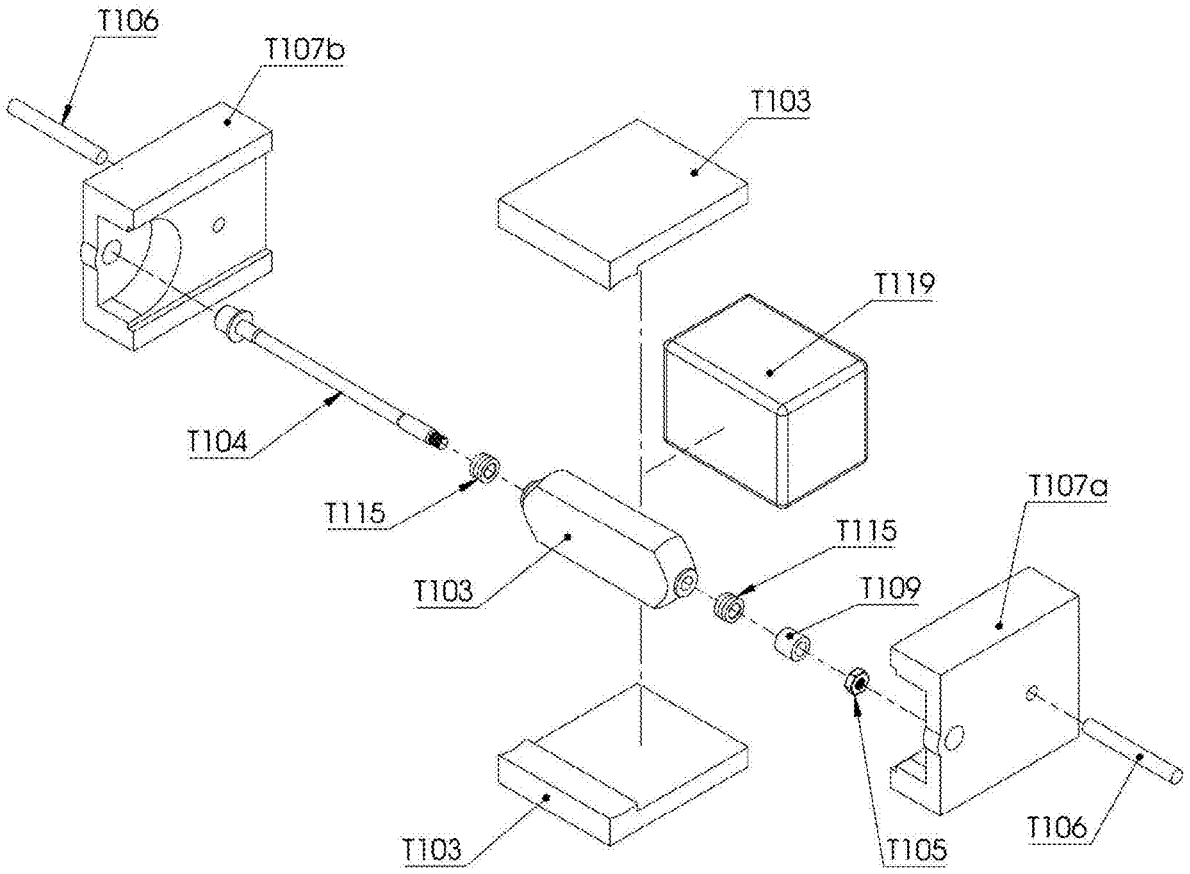
Figure 27A:
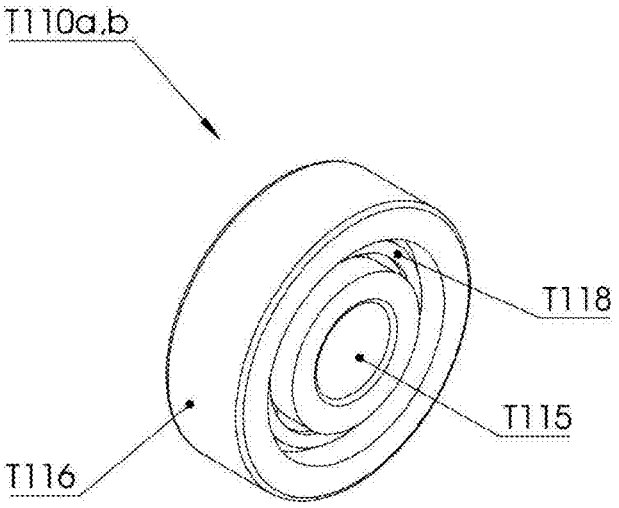
Figure 27B:
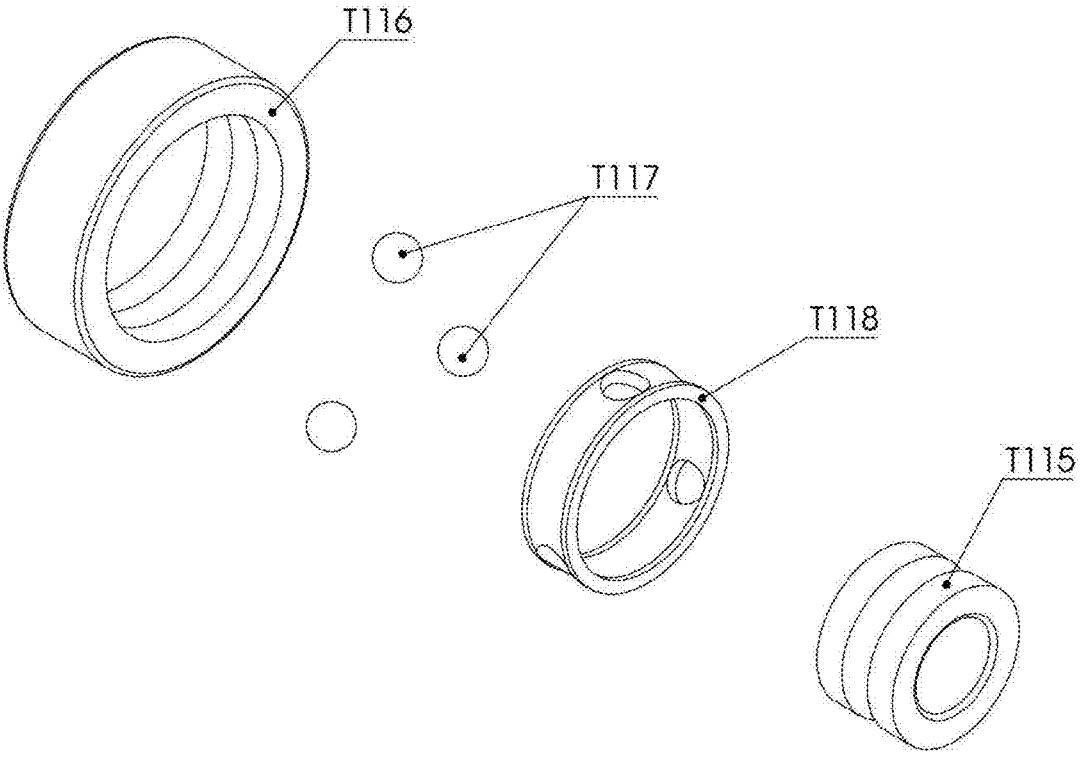
Figure 28A:
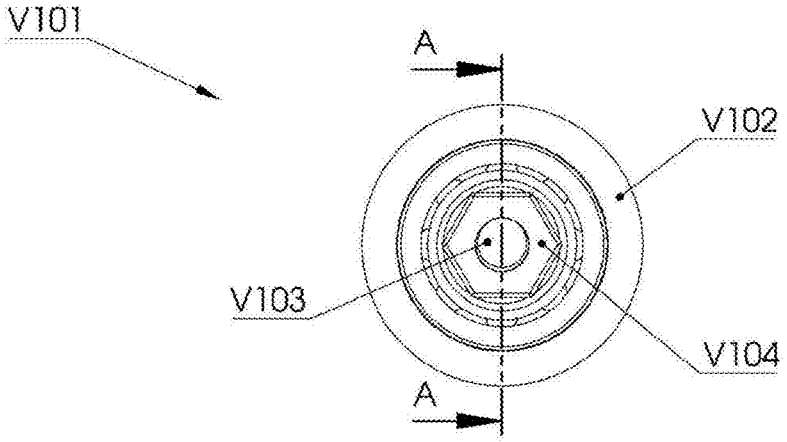
Figure 28B:
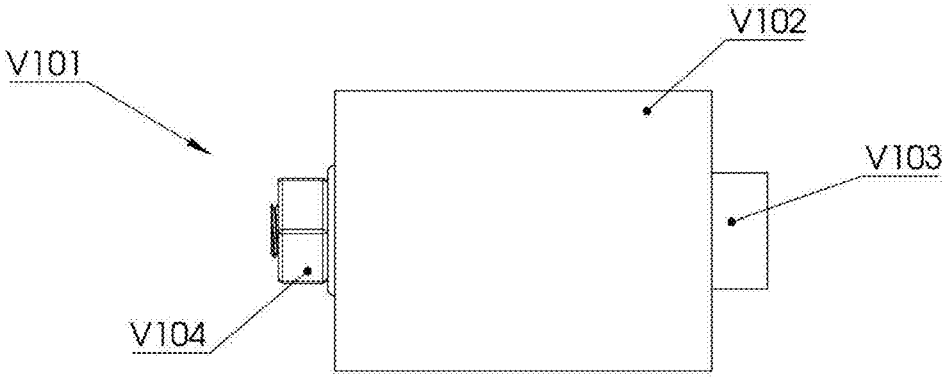
Figure 28C:
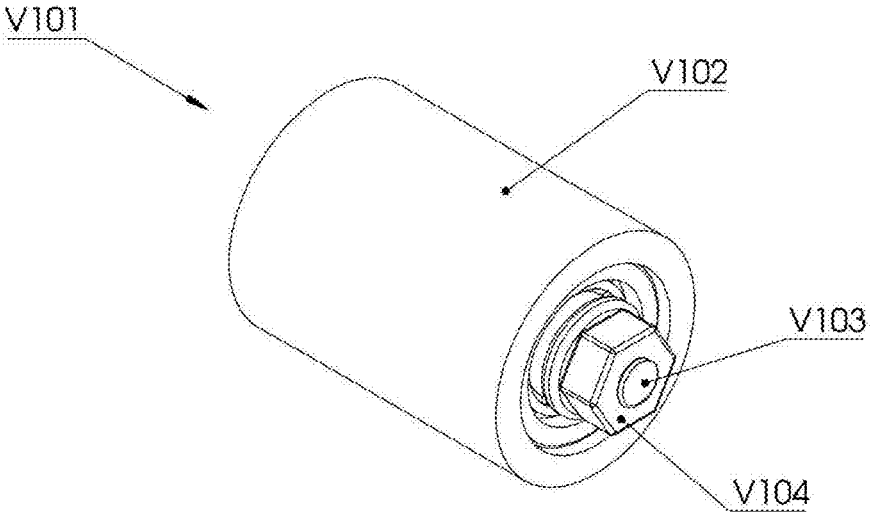
Figure 28D:
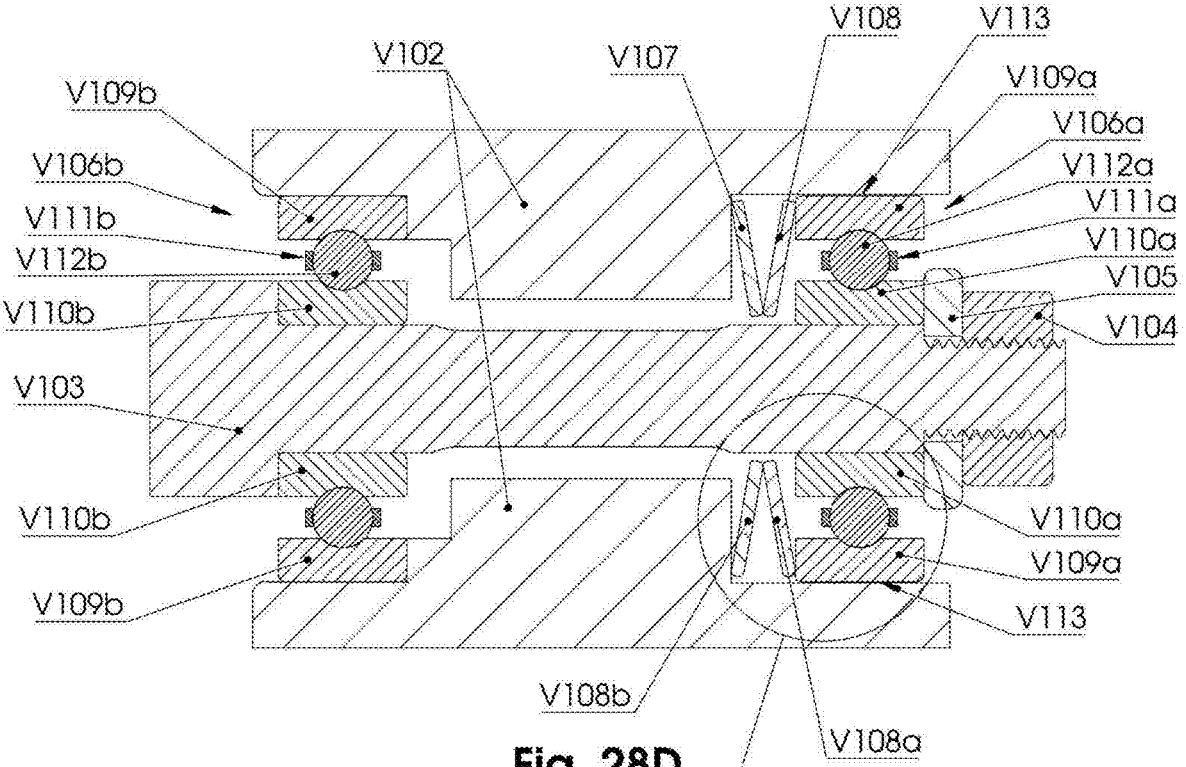
Figure 28E:
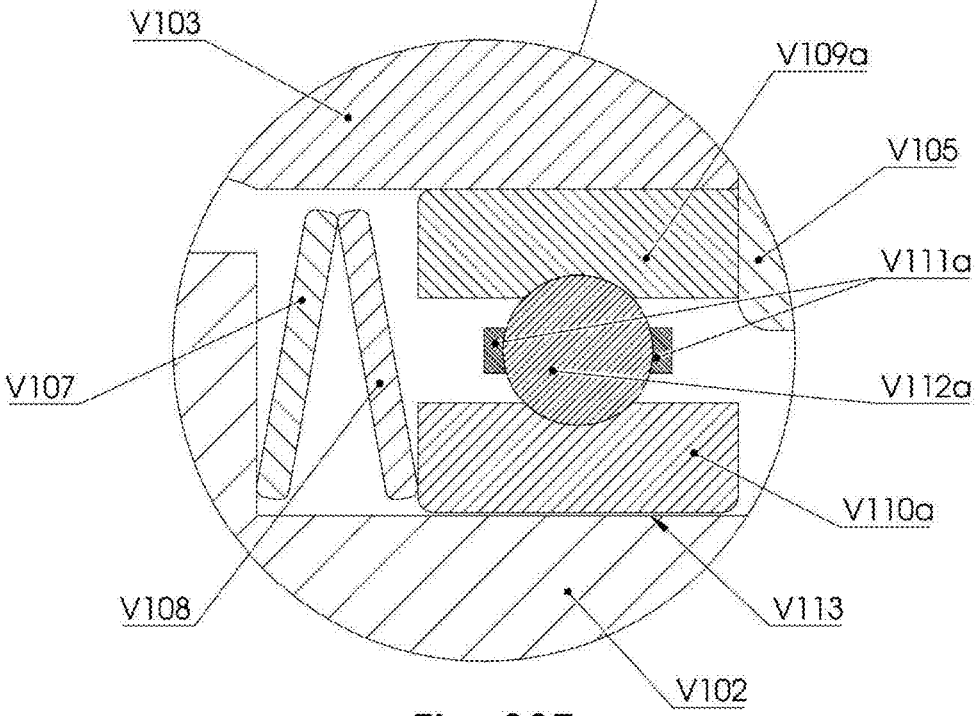
Figure 29A:
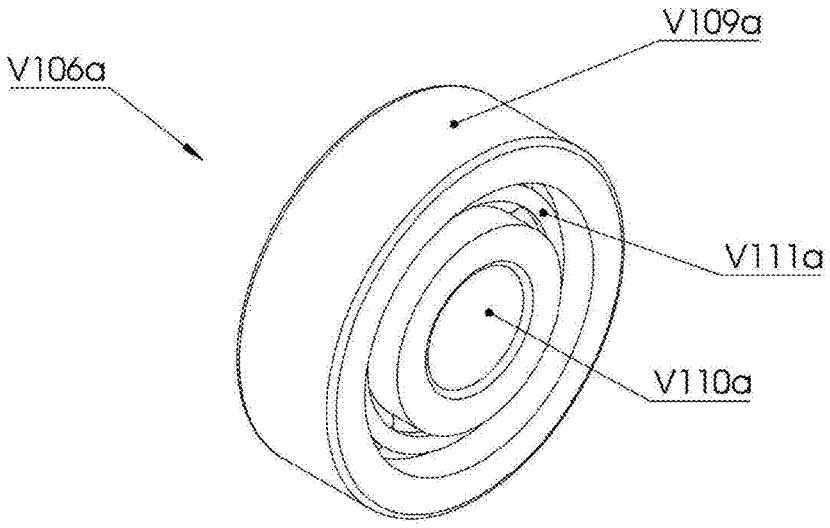
Figure 29B:
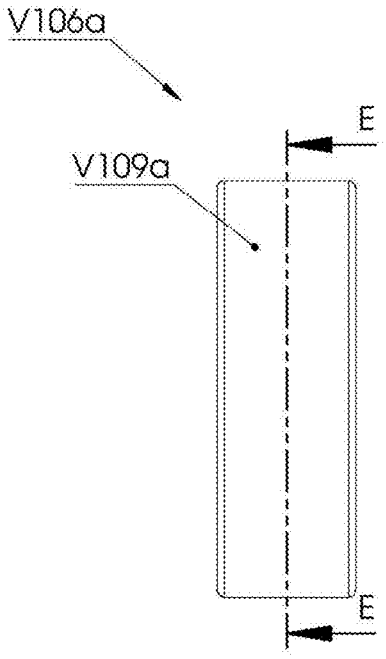
Figure 29C:
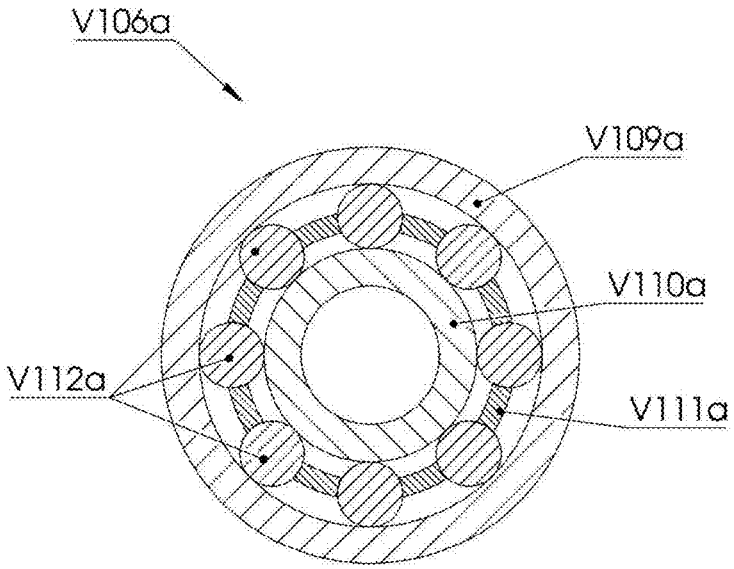
Figure 29D:
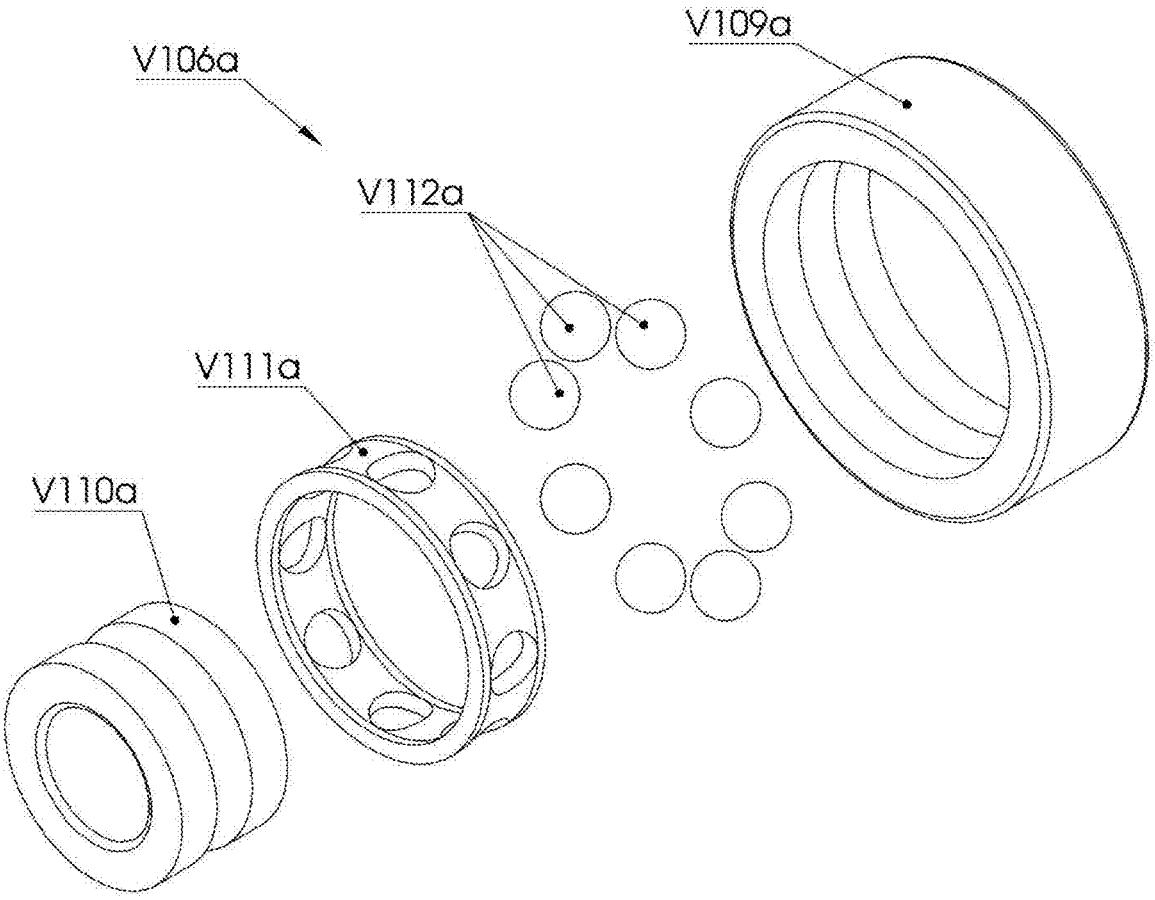
Figure 30A:
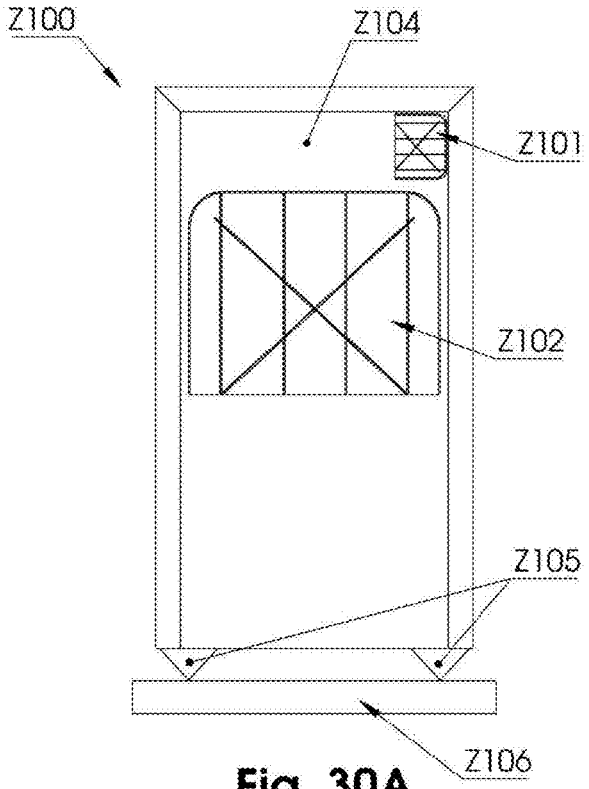
Figure 30B:
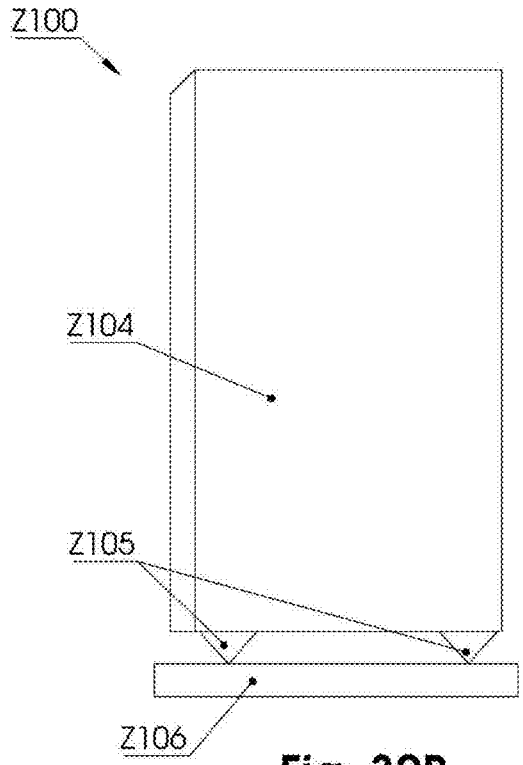
Figure 30C:
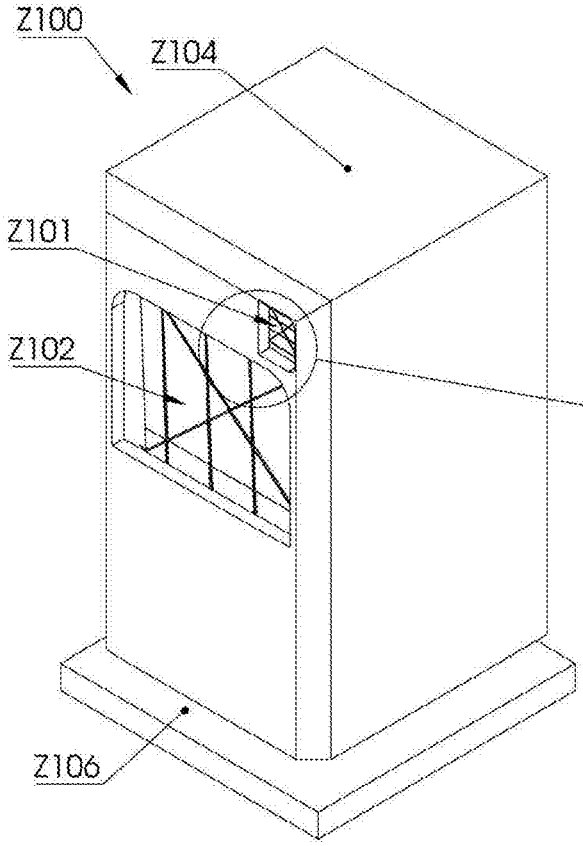
Figure 30D:
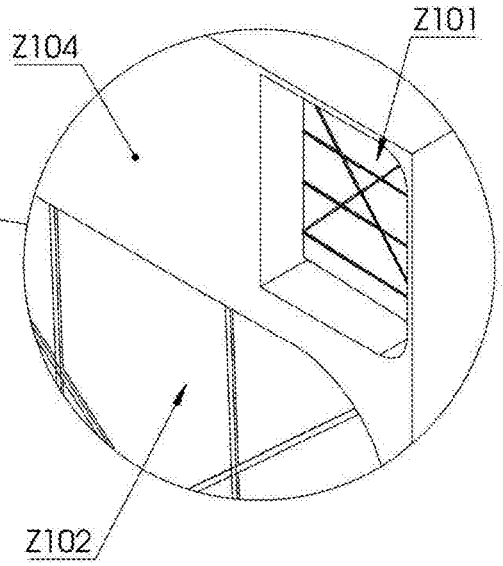

The entire diaphragm is rigidly restrained against axial displacements via the other rolling element bearing assembly T110*a*, which does not have flat springs adjacent. Axial loads are transmitted to the diaphragm via component T124 which, when rigidly adhered to diaphragm base tube T112, forms a triangulated profile for this purpose, as can be seen in FIG. 24E.

2.2.4 Embodiment K

Referring to FIGS. 16G-16J, a further contact hinge system embodiment of the invention is shown in association with the embodiment K audio transducer. Rotational action audio transducers can be well-suited for personal audio devices, since rotational action transducers have the potential to satisfy requirements of extended high-frequency bandwidth as well as extended bass via high diaphragm excursion and low fundamental diaphragm resonance frequency.

In this embodiment, the combination of a rotational action audio transducer with an audio device interface design that fully or at least partially seals off a volume of air between the ear and diaphragm assembly, performance is enhanced since sealing helps to facilitate increased bass extension, which reduces the requirement for audio transducer volume excursion capability and makes it easier to achieve better quality treble reproduction.

Hinge-type diaphragm suspensions help eliminate or at least alleviate low-frequency resonance modes.

The hinge system is a contact hinge system constructed in accordance with the design principles and considerations described in section 2.2.1 of this specification. The hinge system comprises a hinge assembly having a pair of hinge joints on either side of the assembly. Each hinge joint comprises a contact member that provides a contact surface and a hinge element configured to abut and roll against the contact surface. Each hinge joint is configured to allow the hinge element to move relative to the contact member, while maintaining a consistent physical contact with the contact surface, and the hinge element is biased towards the contact surface.

A hinge element, in the form of a hinge shaft K108 is rigidly coupled on one side via a connector K117 to the diaphragm base frame K107. On an opposing side, the hinge shaft K108 is rollably or pivotally coupled to contact members in the form of base blocks K138. As shown in FIG. 16I, in this embodiment, each contact member K138 comprises a concavely curved contact surface K137 to enable the free side of the shaft K108 to roll thereagainst. The concave contact surface K137 comprises a larger curvature radius than that of shaft K108. Each contact member is a base block K138 of the transducer base structure assembly K118 base component K105 that extends laterally from the base structure assembly toward the diaphragm assembly. A pair of base blocks K138 extend from either side of the base component K105 to rollably or pivotally couple with either end of the shaft K108 thereby forming two separated hinge joints. The base blocks may extend into a corresponding recess formed at the base end of the diaphragm structure. The contact hinge joints are preferably closely associate with both the diaphragm structure and the transducer base structure.

Figure 16J:
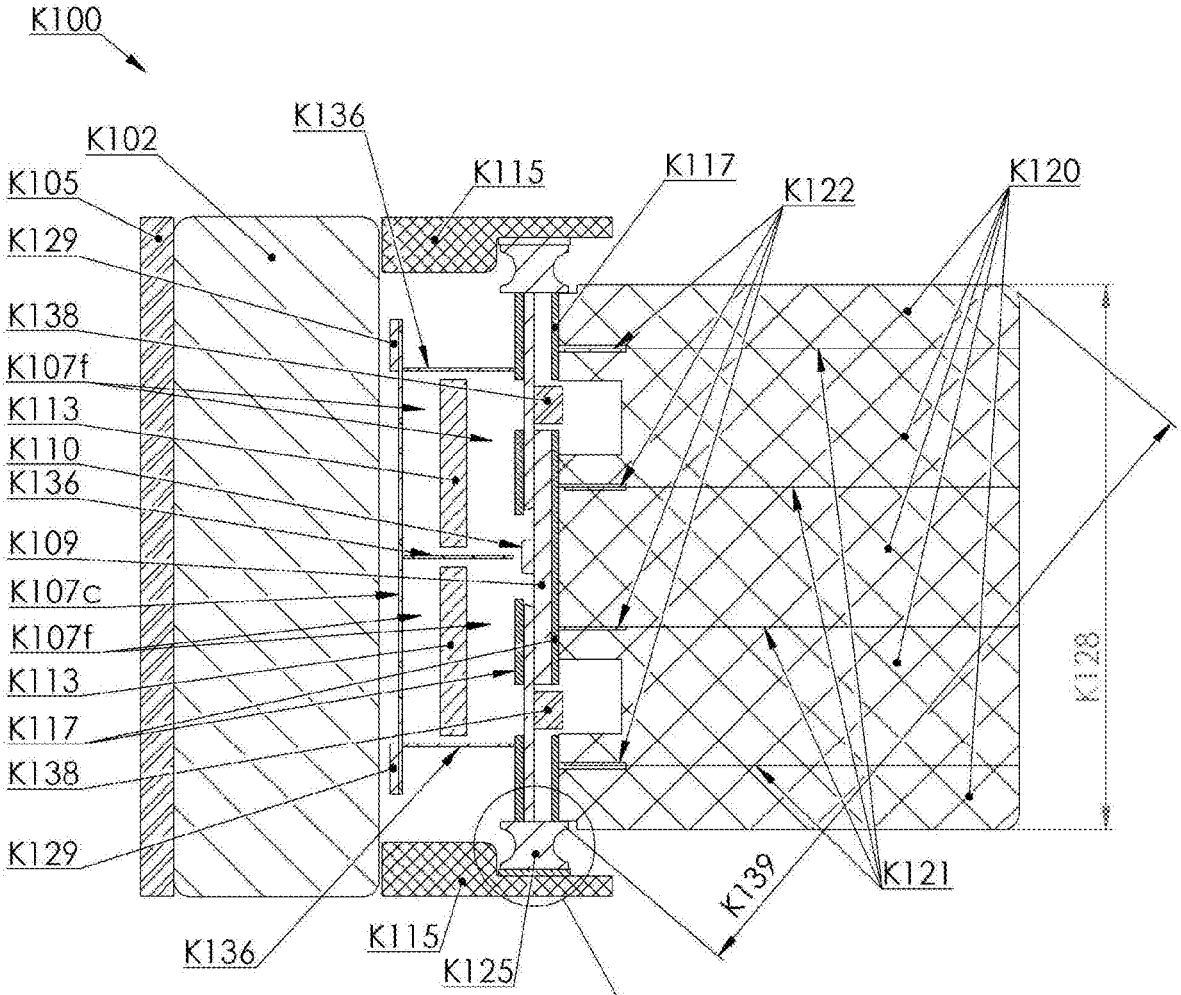
Figure 16K:
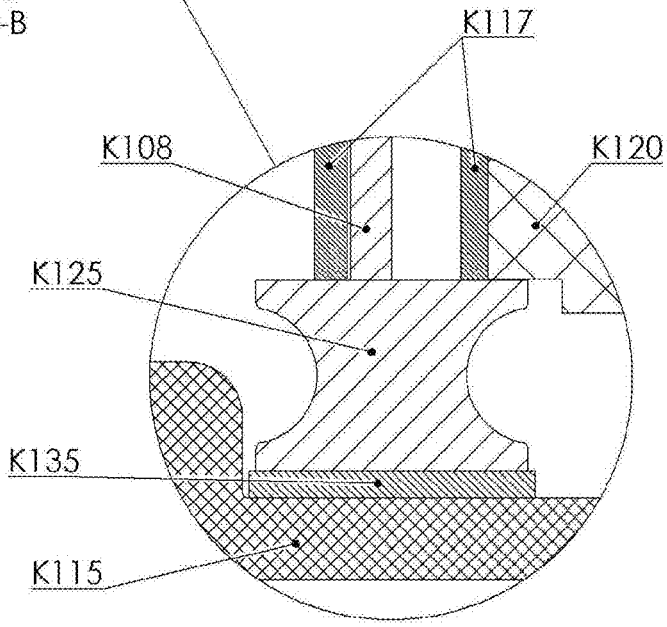
Figure 16L:
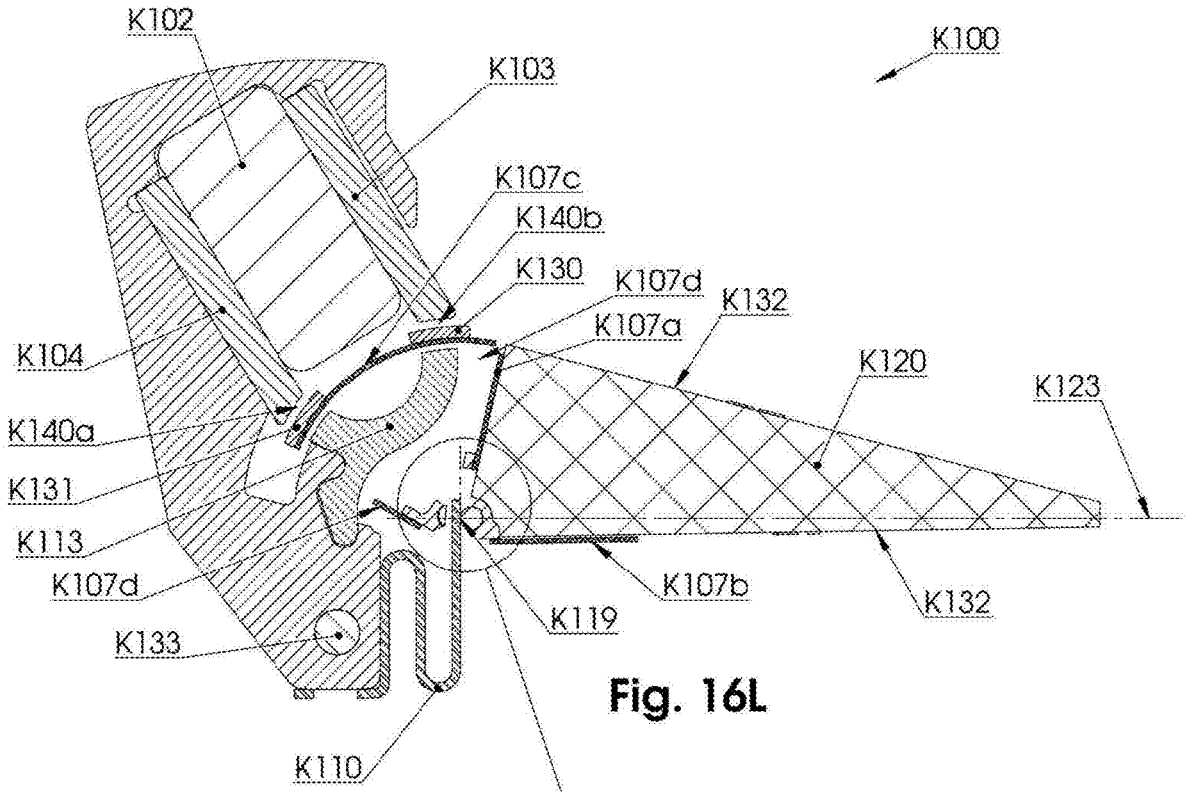
Figure 16M:
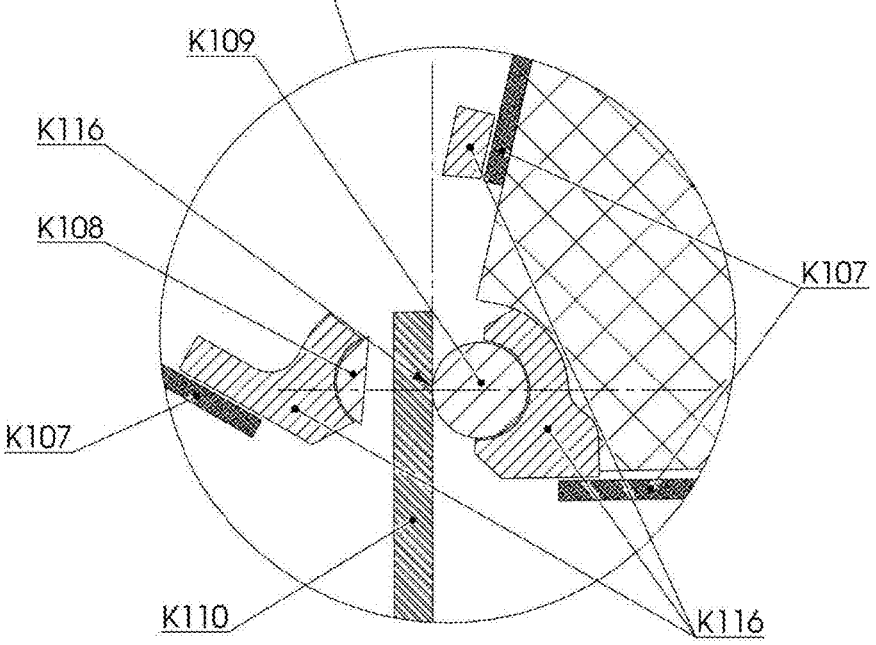

Referring to FIGS. 16L-M, the hinge shaft K108 is resiliently and/or compliantly held in place against the contact surfaces K137 of the base blocks K138 by a biasing mechanism of the hinge system. The biasing mechanism includes a substantially resilient member in the form of a compression spring K110, and a contact pin K109. The spring K110 is rigidly coupled to the base structure K105 at one end and engages the contact pin K109 at the opposing end at a contact location K116. The resilient contact spring K110 is biased toward the contact pin K109 and is held at least slightly in compression in situ. In situ, the contact pin K109 is rigidly coupled to the diaphragm base frame K107 via a connector K117 and extends between the base blocks K138 fixedly against a corresponding concavely curved surface of the connector K117. The contact pin K109 and corresponding biasing spring K110 are preferably located centrally between the hinge joints. This arrangement compliantly pulls the diaphragm base structure, including the base frame K107, the connector K117 and the hinge shaft K108 against the contact base blocks K138 of the hinge joints. In this manner, the shaft K108 contacts the curved surfaces K137 of base blocks K138 at two contact locations. The degree of compliance and/or resilience is as is described under section 2.2.2 of this specification.

The geometry of the hinge system is designed with the approximate rotational axis K119 (shown in FIG. 16B) of the transducer coinciding with the two locations of contact K137 between the diaphragm assembly K101 and the transducer base structure K118, and preferably also at the location of contact between the contact pin K109 and the contact spring K110. This configuration helps to minimise the restoring force generated by these components, and so helps reduce the fundamental resonance Wn of the transducer.

In some forms one of the hinge element or the contact member comprises a contact surface having one or more raised portions or projections configured to prevent the other of the hinge element or contact member from moving beyond the raised portion or projection when an external force is exhibited or applied to the audio transducer. Depending upon the application it may also be useful to provide stoppers that prevent impacts to potentially fragile components such as the motor coil. These may be independent from stoppers acting on the contact surfaces.

In this embodiment the hinge shaft K108, comprises at least in part, a convex cross-sectional profile, when viewed in a plane perpendicular to the axis of rotation, such as in FIG. 16I, and a contact member, being base block K138 protrusion of base component K105, comprising a contact surface K137 that is substantially concave.

This configuration contributes to the re-centering of the hinge mechanism in situations where the hinge element is forced to move away from the central, neutral region K137*a* of the contact surface K137. The concavely raised edge regions K137*b* or K137*c* of the contact surface K137 that locate on either side of the central region, will cause the associated hinge shaft K108 to re-centralize back towards the central region K137*a* in the event that the element is forced to move beyond its intended position. This feature is advantageous in the case of a minor impact, such as when a transducer is knocked or dropped and the contact points K114 slip, as the geometry described would prevent excess slippage that may potentially cause contact resulting in audible rattling distortion during operation of the device. Such a configuration can be applied to any one of the other contact hinge embodiments described herein, such as embodiment A, E, S or T.

Further refinements to this structure are preferable whereby during normal operation there are no locations where the convex surface of the hinge shaft K108, can contact the concave contact surface K137 in a place where the convex radius is larger than the concave radius, when viewed in cross-sectional profile in a plane perpendicular to the axis of rotation. This configuration substantially prevents an impact between surfaces that could, conceivably, repeat without causing centering, thereby generating an ongoing rattle distortion. Instead, as in Embodiment K which has a contact surface K137 with a larger radius than the hinge shaft K108 convex radius, centering can only be caused by a gradient at the contacting surfaces, which means that any distortion created by sliding on the gradient is necessarily associated with a correction in the centering location, thereby reducing the chance of any ongoing distortion. Such a configuration can be applied to any one of the other contact hinge embodiments described herein, such as embodiment A, E, S or T.

Personal Audio Device

Figure 16N:
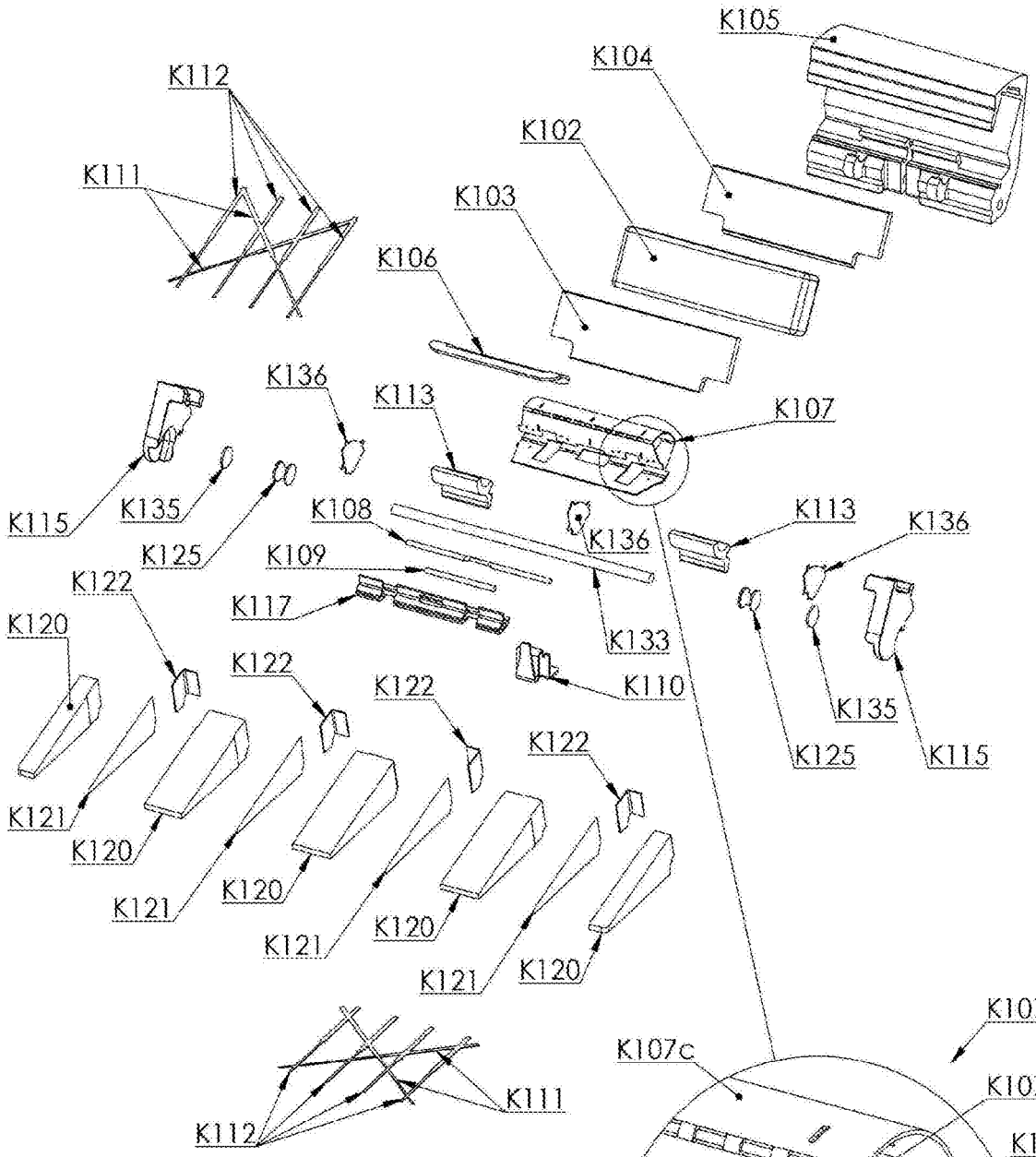
Figure 16O:
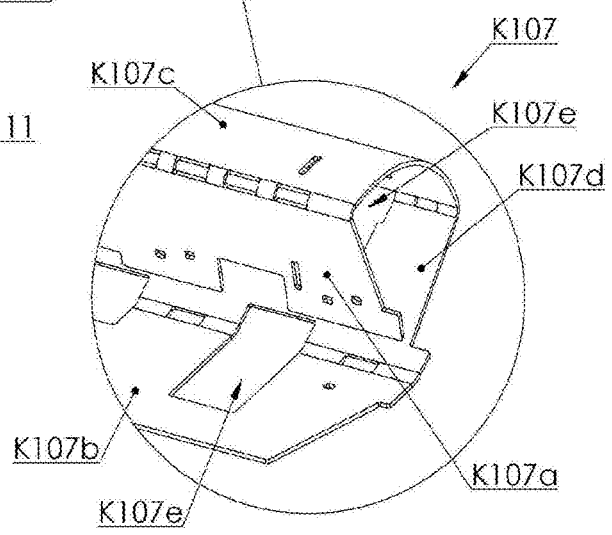
Figure 17:
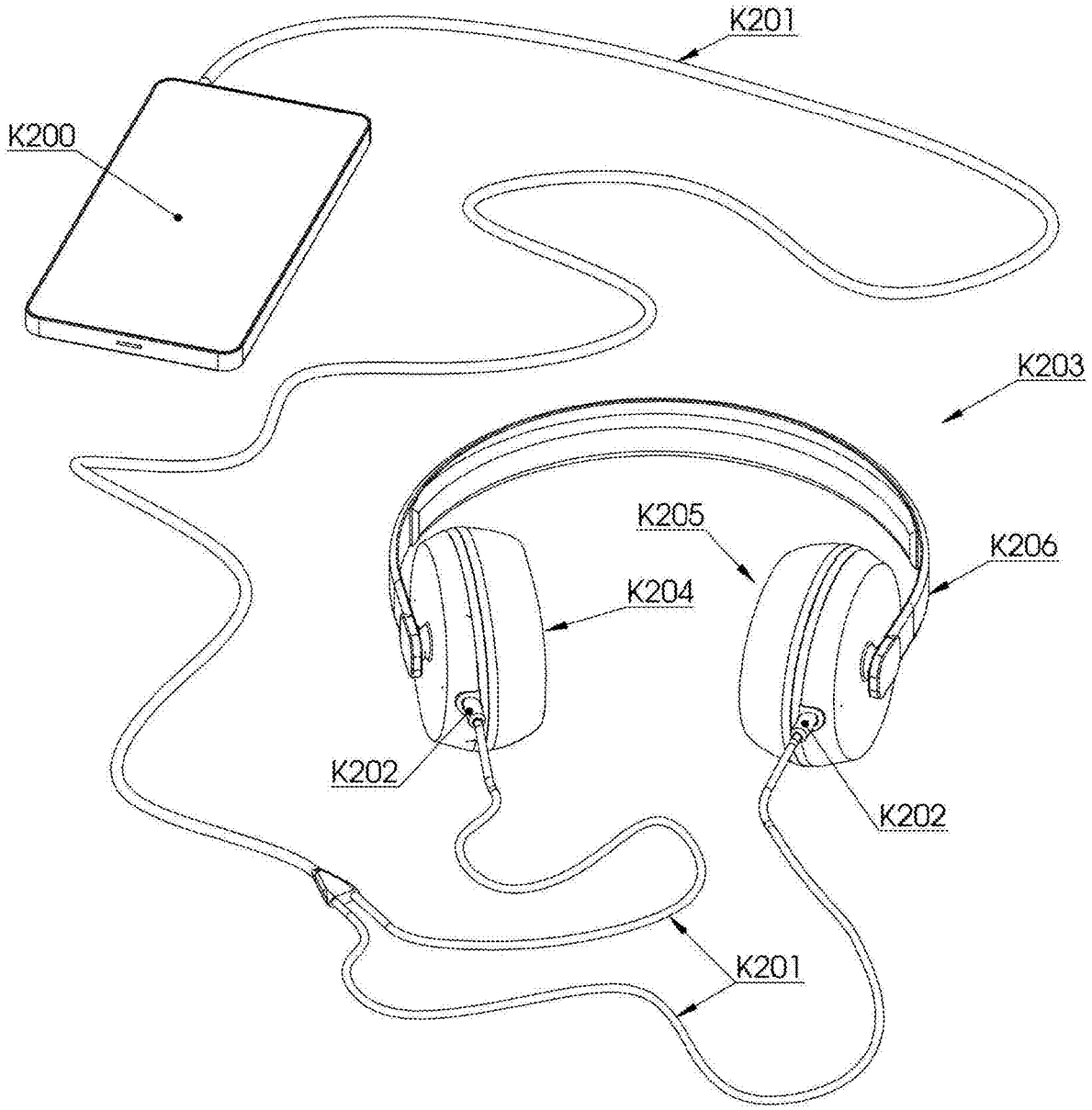
FIG. 17 shows a 3D isometric view, of an audio system comprising a smartphone connected to a pair of closed circumaural headphones, which uses the hinge-action loudspeaker driver of embodiment K in each ear cup.

Referring briefly to FIG. 17, the embodiment K audio device is a personal audio device that is in the form of a headphone apparatus K203, shown comprising left and right headphone interface devices K204 and K205 (hereinafter also referred to as headphone cups K204 and K205) and a bridging headband K206. Each headphone interface device comprises an audio transducer K100 (FIGS. 16A-O) mounted inside the cup housing K204 (FIGS. 18A-H and 19). Although this embodiment shows a headphone configuration, it will be appreciated that the various design features of the audio device may alternatively be incorporated in any other personal audio device, such as an earphone or a mobile phone device for example, without departing from the scope of the invention. The features of the left hand headphone cup K204 will now be described in further detail. It will be appreciated that the right hand headphone cup K205 will be of the same or similar configurations and therefore its features will not be described for the sake of conciseness.

Referring to FIGS. 16A-O, in this embodiment, the audio transducer is a rotational action transducer comprising a diaphragm assembly K101 that is rotatably coupled to a transducer base structure K118 via a hinge system configured to rotate the diaphragm about an associated axis of rotation K119 during operation. The diaphragm assembly preferably comprises a diaphragm body K120 that is substantially thick, for example where a maximum diaphragm body thickness K127 is at least 15% of a diaphragm body length K126, or at least 20% of the body length K126. In the embodiment shown for example, the maximum diaphragm body thickness K127 may be 5.7 mm which is 30% of the diaphragm body length K126 of 19 mm. This thickness may also be at least approximately 11%, or more preferably at least approximately 14% of a greatest dimension, such as the diagonal length across the diaphragm body. In the embodiment shown for example the maximum diaphragm body thickness K127 may be 5.7 mm which is 21% of the diaphragm body length K139 of 27.5 mm. In alternative embodiments, however, the diaphragm body may not be substantially thick. The transducer further comprises an excitation mechanism, such as an electromagnetic mechanism for transducing sound by imparting a substantially rotation motion on the diaphragm body in use. Parts of the excitation/transducing mechanism of the audio transducer that are connected to the associated diaphragm body are preferably connected rigidly.

Rigid Diaphragm Assembly

In this embodiment, the diaphragm structure has a geometry suitable for resisting acoustical breakup.

The diaphragm assembly comprises a diaphragm structure that is substantially rigid during operation. In this embodiment, the diaphragm structure is similar in construction to the diaphragm structure A1300 described in relation to the embodiment A and comprises a diaphragm body K120 that is reinforced with outer, normal stress reinforcement K111/K112 on or adjacent the opposing major faces K132 of the body and inner, shear stress reinforcement K121 oriented substantially orthogonally relative to the normal stress reinforcement. The outer stress reinforcement comprises a series of longitudinal struts of which a first group K112 are oriented longitudinally along the associated major face K132, and a second group K111 are oriented at an angle relative to the first group and to each other to thereby form a cross-strut formation. The outer stress reinforcement K111/K112 reduces in mass in regions distal from a centre of mass location of the diaphragm assembly K101 (by reducing the width or thickness of the struts for example).

The diaphragm body K120 also reduces in mass in regions distal from the centre of mass location (by tapering along its length to form a wedge shaped structure). The diaphragm body K120 is substantially thick, for example comprising a maximum diaphragm body thickness K127 of approximately at least 15% of a diaphragm body length K126 or more preferably at least 20% of the length. The diaphragm body length K126 may be defined by a total distance from the axis of rotation K119 to a most distal periphery of the diaphragm structure, in a direction substantially perpendicular to the thickness dimension (or for example, along a direction perpendicular to the axis of rotation K119). Angular connection tabs K122 locate at a base end of the diaphragm body K120 to enable the diaphragm base to rigidly connect to other components of the diaphragm assembly K101.

The diaphragm assembly K101 further comprises a diaphragm base frame K107 which rigidly connects to the base of the diaphragm structure, to part of the hinge assembly and to the force transferring component of the excitation mechanism for moving the diaphragm in use. As shown in FIGS. 16N and 16O the diaphragm base frame K107 comprises a first upright plate K107*a* and a second angled plate K107*b*, that are both substantially planar and angled relative to one another to correspond to the relative angle between one of the major faces K132 of the diaphragm body and the base face of the diaphragm body. These first and second plates are rigidly coupled to the diaphragm body at the base face and the aforementioned major face K132 respectively. The second angled plate K107*b* configured to couple the major face K132 also comprises a pair of spaced apertures K107*e* (as shown in FIGS. 16G, 16M and 16N) that are configured to align with the contact members K138 extending form the base block K105 of the transducer base structure and also with the recesses K120*a* formed at the base end of the diaphragm body. In this manner, in the assembled state of the audio transducer the base blocks K138 extend through the corresponding apertures K107*e* of the base frame K107 and also into the recesses K120*a* of the diaphragm body K120.

The diaphragm base frame K107 further comprises a third arcuate plate K107*c* extending from the first substantially upright plate K107*a* and connecting to a fourth angled and substantially planar plate K107*d* of the base frame that extends in a direction opposing the second plate K107*b*. The arcuate plate K107*c* is configured to couple a force transferring component such as the coils K130 in the assembled state. The coils K130 rigidly couple an outer face of the arcuate plate K107*c*. The arc of the plate is configured to correspond to the arc of a magnetic field gap K140*a* and K140*b* of the transducing mechanism formed by the transducer base structure. One or more arcuate plates K136 may be inserted within the diaphragm base frame cavity formed by the first, third and fourth plates of the frame K107. Preferably three plates are retained in this cavity, forming two inner cavities K107*f* (shown in FIG. 16J) within which the inner poles K113 of the transducing mechanism extend to operatively cooperate with the coils K130.

As shown in FIGS. 16L and 16M, in the assembled state the second plate K107*b* of the base frame K107 extends slightly past the associated major face of the diaphragm body/structure. This provides an edge against which a longitudinal connector K117 rigidly connects. The connector K117 also rigidly connects a corresponding face of the diaphragm body at the base end. The connector comprises recesses that align with the apertures K107*e* of the second plate K107*b* of the base frame K107. An opposing side of the connector (to that which is connected to the diaphragm body) comprises a substantially concavely curved surface (at least in cross-section) in a central region of the connector along its length. The concavely curved surface is configured to receive and accommodate the contact pin K109 of the hinge system biasing mechanism (which is described in further detail above). Extending from the part of the connector that couples the second plate K107*b* of the base frame K107, is an angled part configured to rigidly couple the fourth plate K107*d* of the diaphragm base frame K107. In this manner the connector K117 is rigidly coupled along its length to the base frame K107. This part also comprises a substantially concavely curved surface (at least in cross section) that extends along a substantial portion of the length of the connector K117 and that is configured to contact against and fixedly couple the hinge shaft K108 of the hinge system (described in further detail below). The hinge shaft K108 comprises a substantially convexly curved surface (at least in cross section) at least in sections of the hinge shaft K108 that extend across the recesses of the connector to engage the contact blocks K138 of the hinge system as explained in further detail above.

In this manner, in an assembled state, the diaphragm base structure is rigidly coupled to the base frame K107 and to the connector K117. In turn the base frame is also rigidly and fixedly coupled to the coils K130 of the transducing mechanism. The connector K117 is fixedly coupled to the hinge element K108 and to the contact pin K109 of the hinge assembly. These components in combination form the diaphragm assembly K101.

Referring to FIGS. 16F, 16J and 16K, the base frame K107, hinge shaft K108 and connector K117 preferably extend across the entire width of the diaphragm structure across the base face of the structure. Either end of these components are preferably coupled to the transducer base structure side block K115 via a substantially resilient connection member K125 and spacer disc or washer K135. Each side block K115 may be substantially rigid, for example formed from a substantially rigid plastics material or the like. The connection member K125 and/or washer K135 rigidly coupled to an inner wall of an associated side block K115. This arrangement compliantly positions the diaphragm base frame assembly (including connector K117 and the hinge element K118) to base component K105 of the transducer base structure. This mechanism is contributing to the overall hinge assembly. The two connection members K125 provide a restoring force to the diaphragm assembly that:

1) contributes to positioning the diaphragm into a neutral or rest position, and as such is a significant determining factor of the final transducer fundamental frequency Wn; and
2) contributes to positioning the hinge shaft K108 relative to the base blocks K138, so that in the unusual case of a bump or knock or other exhibited external force, the parts will re-align into a neutral position where parts of the diaphragm assembly do not contact and rub against the surrounding parts.

As such, this mechanism, as well as contributing to the overall hinging assembly, also acts as a diaphragm restoring mechanism.

Free Periphery

Figure 18A:
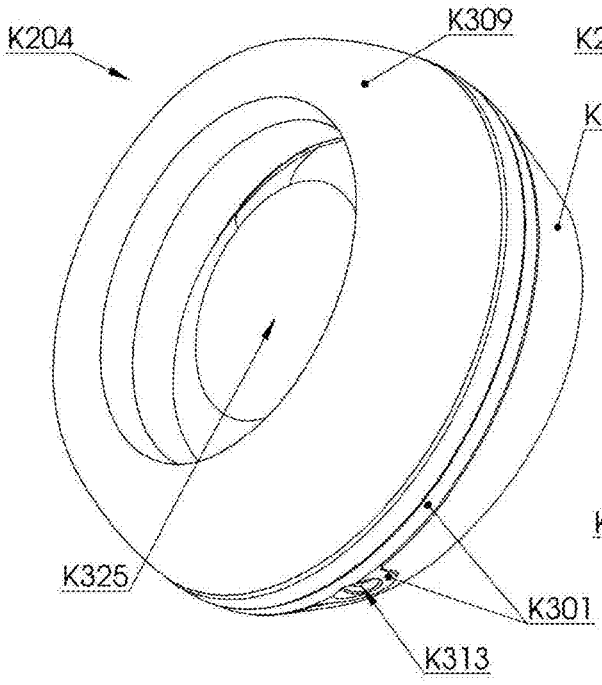
Figure 18B:
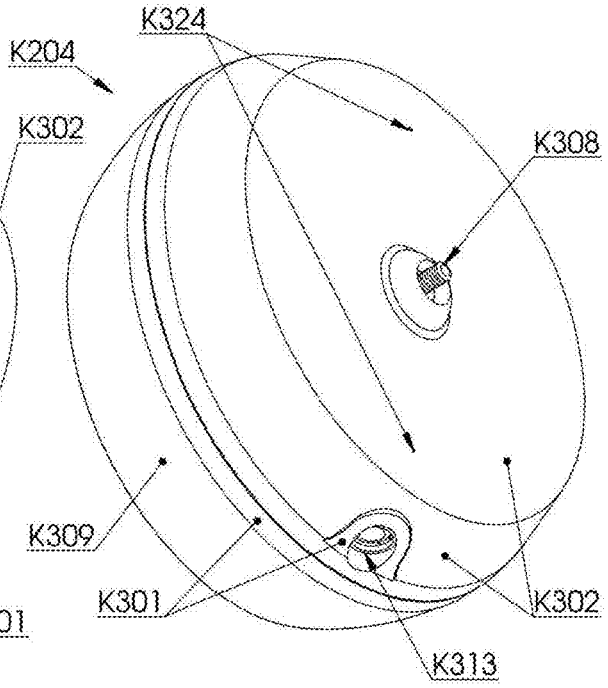
Figure 18C:
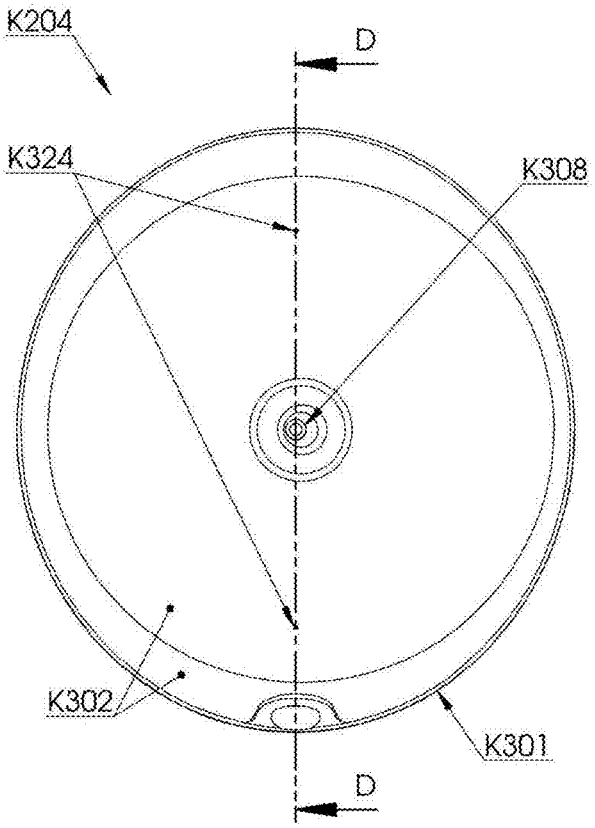
Figure 18D:
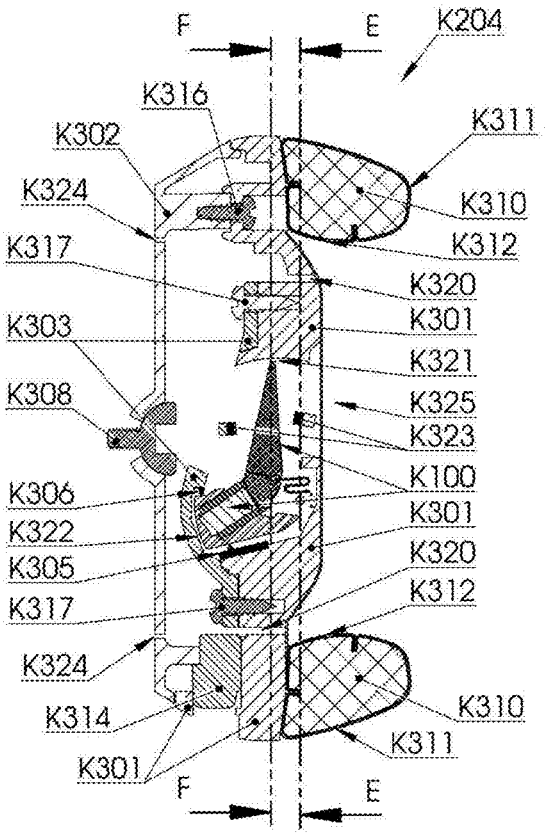
Figure 18E:
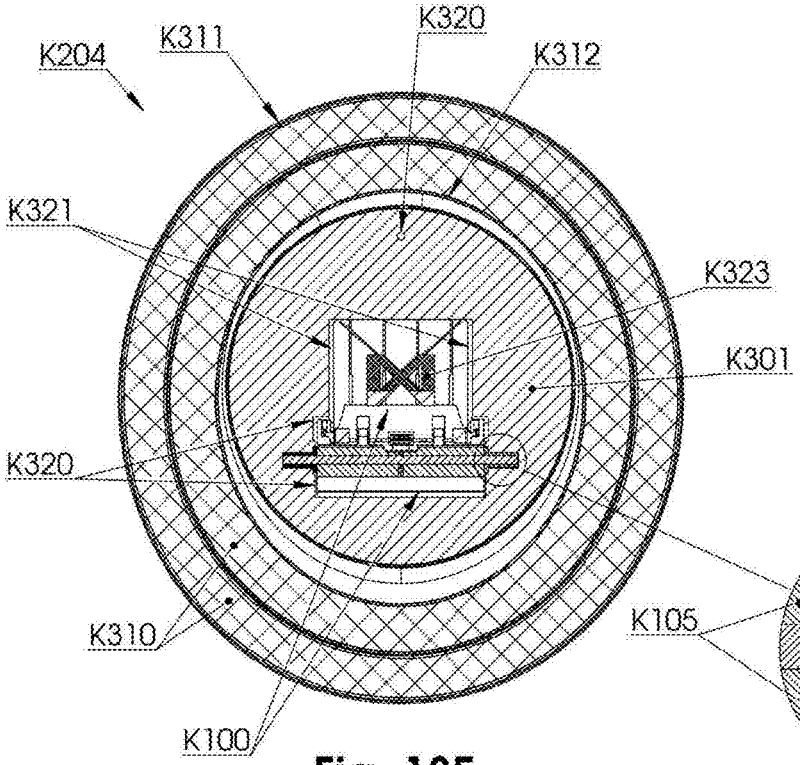

Referring to FIGS. 18D and 18E, the diaphragm structure comprises an outer periphery that is free from physical connection with a surrounding structure such as the surround K301. The phrase "free from physical connection" as used in this context is intended to mean there is no direct or indirect physical connection between the associated free region of the diaphragm structure periphery and the housing. For example, the free or unconnected regions are preferably not connected to the housing either directly or via an intermediate solid component, such as a solid surround, a solid suspension or a solid sealing element, and are separated from the structure to which they are suspended or normally to be suspended by a gap. The gap is preferably a fluid gap, such as a gases or liquid gap.

Furthermore, the term housing in this context is also intended to cover any other surrounding structure that accommodates at least a substantial portion of the diaphragm structure therebetween or therewithin. For instance a baffle that may surround a portion of or an entire diaphragm structure, or even a wall extending from another part of the audio transducer and surrounding at least a portion of the diaphragm structure may constitute a housing or at least a surrounding structure in this context. The phrase free from physical connection can therefore be interpreted as free from physical association with another surrounding solid part in some cases. The transducer base structure may be considered as such a solid surrounding part. In the rotational action embodiments of the invention for example, parts of the base region of the diaphragm structure may be considered to be physically connected and suspended relative to the transducer base structure by the associated hinge assembly. The remainder of the diaphragm structure periphery, however, may be free from connection and therefore the diaphragm structure comprises at least a partially free periphery.

The phrase "at least partially free from physical connection" (or other similar phrases such as "at least partially free periphery" or sometimes abbreviated as "free periphery") used in relation to the outer periphery in this specification is intended to mean an outer periphery where either:

approximately the entire periphery is free from physical connection, or otherwise in the case where the periphery is physically connected to a surrounding structure/housing, at least one or more peripheral regions are free from physical connection such that these regions constitute a discontinuity in the connection about the perimeter between the periphery and the surrounding structure.

It is preferred for any audio transducer embodiment that the diaphragm structure periphery is at least partially and significantly free from physical connection. For example a significantly free periphery may comprise one or more free peripheral regions that constitute approximately at least 20 percent of a length or two dimensional perimeter of the outer periphery, or more preferably approximately at least 30 percent of the length or two dimensional perimeter of the outer periphery. The diaphragm structure is more preferably substantially free from physical connection, for example, with at least 50 percent of the length or two dimension perimeter of the outer periphery free from physical connection, or more preferably at least 80 percent of the length or two dimensional perimeter of the outer periphery. Most preferably the diaphragm structure is approximately entirely free from physical connection.

Preferably the width of the air gaps K321 and K320 defined by the distance between the outer periphery of the diaphragm body and the housing/surround K301 is less than $1/10^{th}$, and more preferably less than $1/20^{th}$ of a diaphragm body length K126. For example, a width of each air gap defined by the distance between the outer periphery of the diaphragm body and the surround is less than 1.5 mm, or more preferably is less than 1 mm, or even more preferably is less than 0.5 mm. These values are exemplary and other values outside this range may also be suitable.

Transducer Base Structure and Transducing Mechanism

Referring to FIGS. 16L-N, preferably the diaphragm structure is rigidly attached to the force transferring component/coil K106, as opposed to if it is compliantly attached, or if it is attached via another component particularly if the geometry of the other component is slender. The force transferring component is preferably of a type that remains substantially rigid in-use, since this helps to minimize resonance.

Electrodynamic type motors are preferred due to their highly linear behavior over a wide range of diaphragm excursion. The excitation mechanism may comprise a force transferring component in the form of an electrically conducting component, preferably a coil K106, which receives an electrical current representing an audio signal. Preferably the electrically conducting component is located in a magnetic field, which preferably is provided by a permanent magnet.

In this embodiment, the transducer base structure K118 comprises a substantially thick and squat geometry and includes the magnetic assembly of the electromagnetic excitation mechanism. The base structure comprises a base component K105, a permanent magnet K102, outer pole pieces K103 and K104 coupled to the magnet K102 spaced from opposing inner pole pieces K113 located within the cavity of the diaphragm base frame K107 of the diaphragm assembly. The opposing outer and inner pole pieces have opposing surfaces that create a substantially curved or arcuate channel therebetween. An arcuate plate K107*c* of the diaphragm base frame K107 comprises a surface that corresponds in shape to this arcuate magnetic field channel. One or more coil windings K106 is/are coupled to the diaphragm base frame arcuate plate and extend within the channel in situ. Preferably, in a neutral position the coil windings K106 are aligned with the location of the corresponding inner and outer poles to enhance cooperation between these components. During operation, each coil winding K106 and part of the base frame K107 reciprocate within this channel, as the remainder of the diaphragm assembly oscillates and pivots about the axis of rotation K119.

Housing

Referring to FIGS. 18A-H, the audio transducer is shown housed within a surround K301. The surround K301 is enclosed by an outer cap K302. These two parts form the housing K204 for the transducer. The surround and outer cap may be fixedly and rigidly coupled to one another via any suitable method, for example via a snap-fit engagement, adhesive or fasteners K316. The surround K301 includes an inner cap K303 that extends proximal to and over part of the audio transducer to help provide mounting and decoupling of the transducer from the surround K301 (and housing K204). The inner cap K303 may be integrally formed with the surround K301 or otherwise separately formed and fixedly and rigidly coupled to the surround K301 via any suitable method, for example via a snap-fit engagement, adhesive or fasteners K317. The surround comprises a cavity for retaining the transducer therein and is open at both sides of the cavity. On one side, the opening forms an output aperture K325 through which sound propagates from the transducer assembly during operation.

Figure 19:
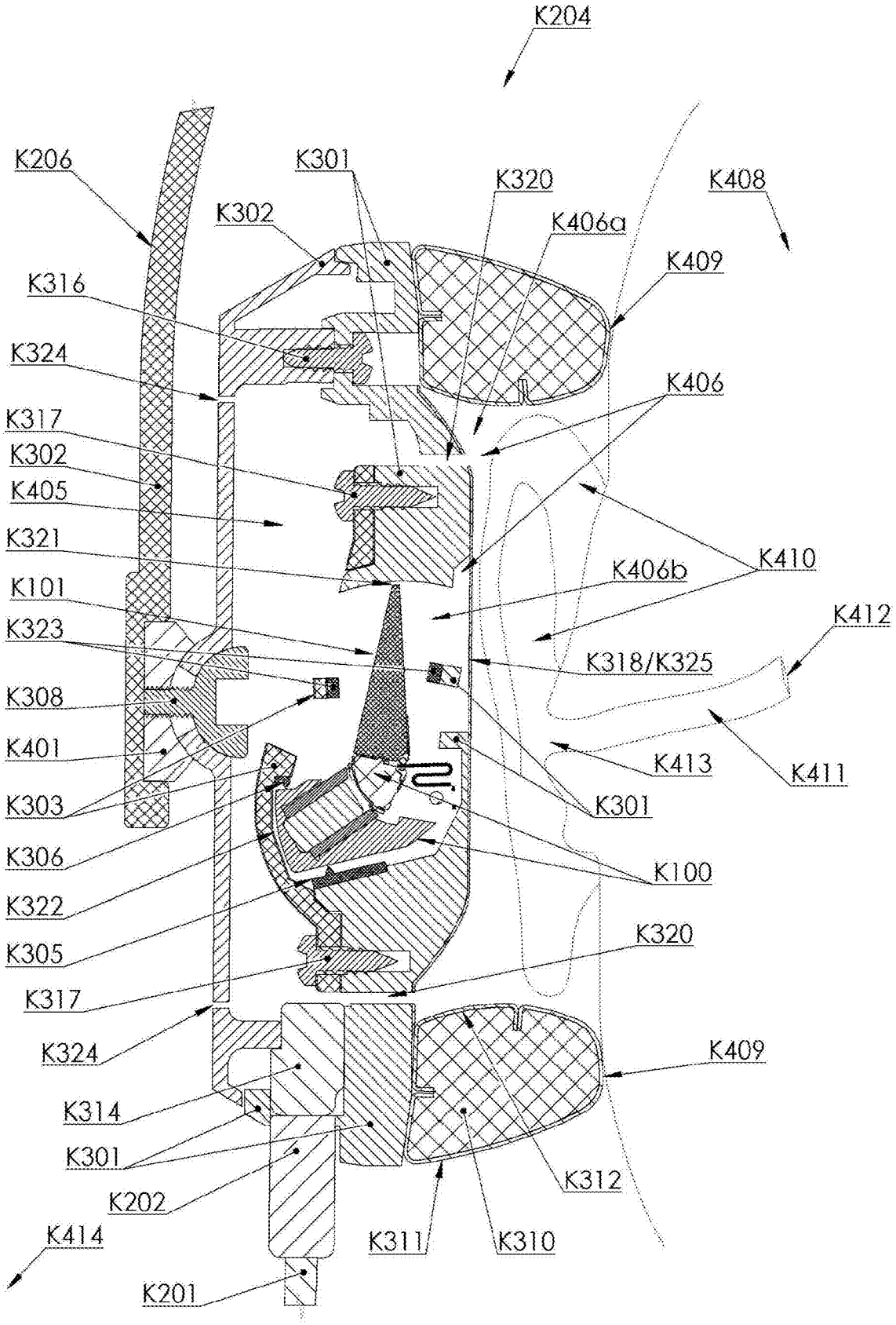
FIG. 19 shows a schematic/cross-sectional view, including the shown in FIG. 18C ear cup, but also showing it in situ, held against a human ear and head by the headband of the headphone in FIG. 17.
Figure 20A:
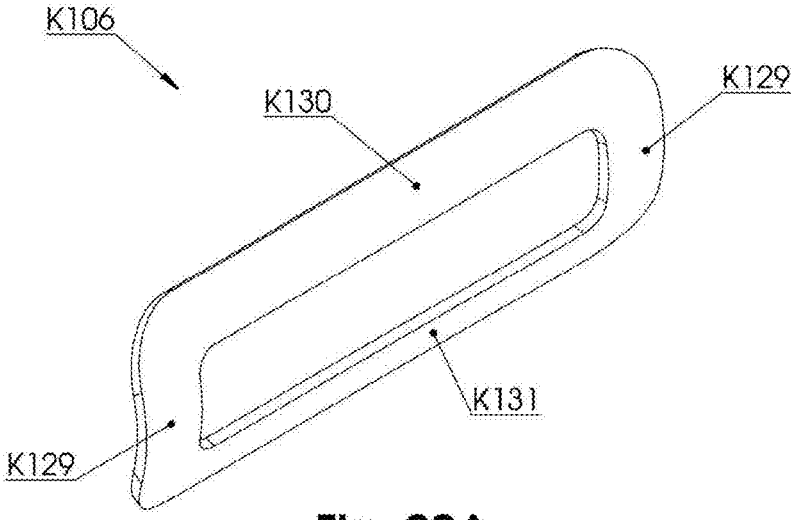
Figure 20B:
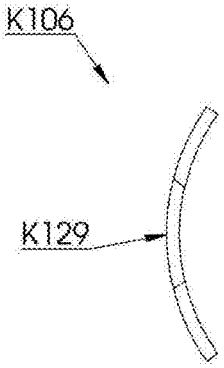
Figure 20C:
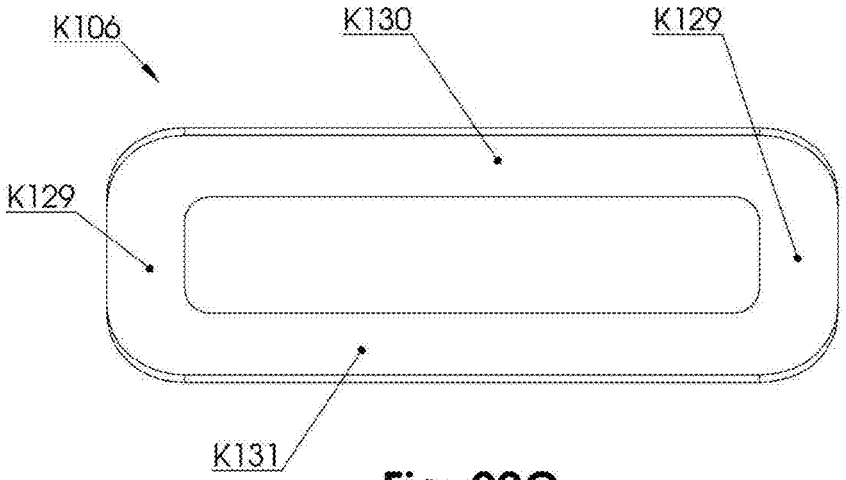
Figure 20D:
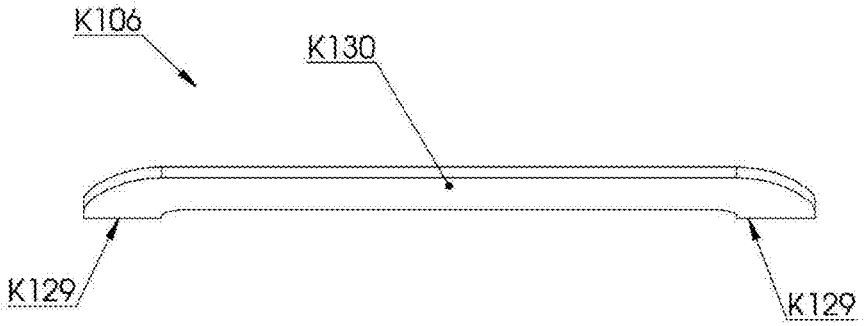

Referring to FIG. 19, the output aperture is configured to locate at or adjacent a user's ear K410 when the device is in use. A soft ear pad K309 extends about the periphery of the surround K301 on an opposing side to the outer cap K302 and about the output aperture K325. The soft ear pad K309 comprises a compliant inner K310 that may be formed from any suitable material well known in the art such as a foam material that is comfortable to the user. The inner K310 may be lined with a non-breathable fabric outer layer K311 and also a breathable fabric or mesh inner layer K312. Also, an open meshed fabric K318 may extend over the output aperture K325.

In this embodiment the audio device is configured to apply pressure to the human head K408 and to substantially seal at locations K409 situated beyond the outer part of the ear K410, as is typical for a circumaural headphone. It may also apply pressure to one or more other parts of the head K408 and to the ear K410. Other pad configurations such as but not limited to a supraaural configuration are also possible. The soft ear pad K309 preferably generates a substantial seal about the user's ear to thereby substantially seal a volume of air inside the device from a volume of air K414 external to the device in situ. The ear pad K309 is configured to provide a sufficient seal between a volume of air within a front cavity K406 inside the device, located at or adjacent the user's ear K410 in use, and a volume of air external to the device K414 (such as the surrounding atmosphere). The geometry and/or material used for the pad inner K310 and outer fabric K311 may affect the sufficiency of the seal K409 for example.

A substantial seal is one that is configured to enhance the sound pressure at, at least low bass frequencies (i.e. provide a bass boost) during operation for example. For example, the ear pad may be configured to substantially seal against the user's ear/head in situ to increase sound pressure generated inside the ear (at, at least low bass frequencies) during operation. In some implementation, sound pressure, for example, may increase by an average of at least 2 dB, or more preferably at least 4 dB, or most preferably at least 6 dB, relative to sound pressure generated when the audio device is not creating a sufficient seal in situ. The volume of air enclosed within front cavity K406 may be substantially small to also aid with providing a bass boost during operation.

As mentioned, the device of this embodiment provides a bass boost by substantial sealing of air around the ear from air surrounding the device. In some variations, the ear pad K309 consists of a porous and compressible inner K310 made from a material such as a foam, for example an open-cell foam such as low-resilience polyurethane foam or polyether foam, which is covered by an outer fabric K311 that is substantially non-porous and is located at an exterior periphery of the pad K301 (e.g. facing outward and parts of which are configured to contact the user's head/ears in use). Internal parts of the ear pad K309 that face the interior of the device are either left uncovered or else are covered in an inner fabric K312 that is porous, such that sound waves surrounding the ear are able to propagate inside the porous foam, where their energy may be dissipated to help control internal air resonances.

This also means that air cavity K406 is connected to and thereby extended to comprise the volume of the porous ear pad inner K310. This may result in further benefits including an improvement in passive attenuation of ambient noise, because sound pressure that moves from the surrounding air K414 to air cavity K406, for example via leaks between ear pad K309 and a wearer's head K408 or else via air passages K320, 321, 322 and 324, will take longer to fill a larger air cavity K406 that is connected to volume K310.

This variation addresses unwanted mechanical resonances of the transducer, especially of the diaphragm and surround, and provides improved diaphragm excursion and fundamental diaphragm resonance frequency, while simultaneously addressing internal air resonances via damping. Internal air resonances may be addressed in the front cavity K406, the rear cavity K405, and any other cavity contained within or by the device and/or the user's head.

Preferably, the compliant interface/ear pad K309 comprises a permeable fabric K318 covering the output aperture K325. Breathable cotton velour or polyester mesh are examples of suitable materials.

The outer cap K302 is preferably pivotally coupled to a respective end of the headband K206. For example, the outer cap K302 may comprise a pivot screw K308 that is rotatably coupled to a pivot nut K401 of the respective end of the headband K206. This enables the headband position to be adjusted by the user for comfort. Any suitable hinging mechanism may be used. Alternatively, the headband may be fixedly coupled to the headband.

Decoupling Mounting System

In this embodiment, the audio transducer is mounted within the surround K301 via a decoupling mounting system. The decoupling mounting system is configured to compliantly mount the audio transducer base structure K118 to the surround K301. such that the components are capable of moving relative to one another along at least one translational axis, but preferably along three orthogonal translational axes during operation of the associated transducer. Alternatively, but more preferably in addition to this relative translational movement, the decoupling system compliantly mounts the two components such that they are capable of pivoting relative to one another about at least one rotational axis, but preferably about three orthogonal rotational axes during operation of the associated transducer. In this manner, the decoupling mounting system at least partially alleviates mechanical transmission of vibration between the diaphragm and the surround K301, the inner cap K303 and the outer cap K302.

Figure 18F:
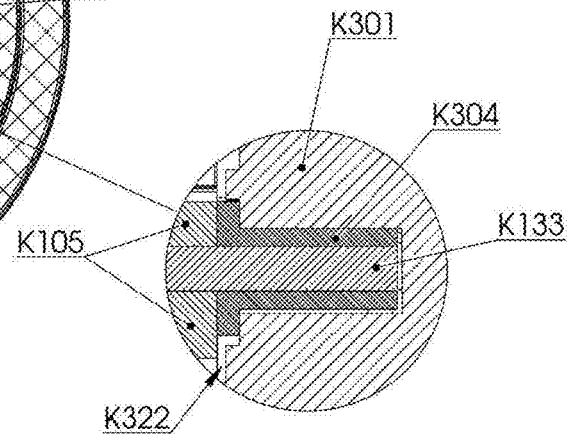
Figure 18G:
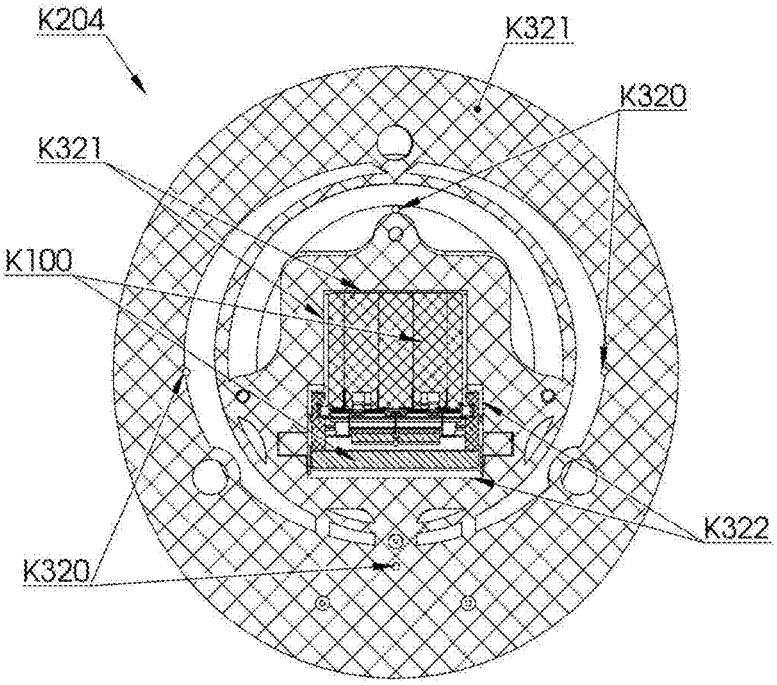
Figure 18H:
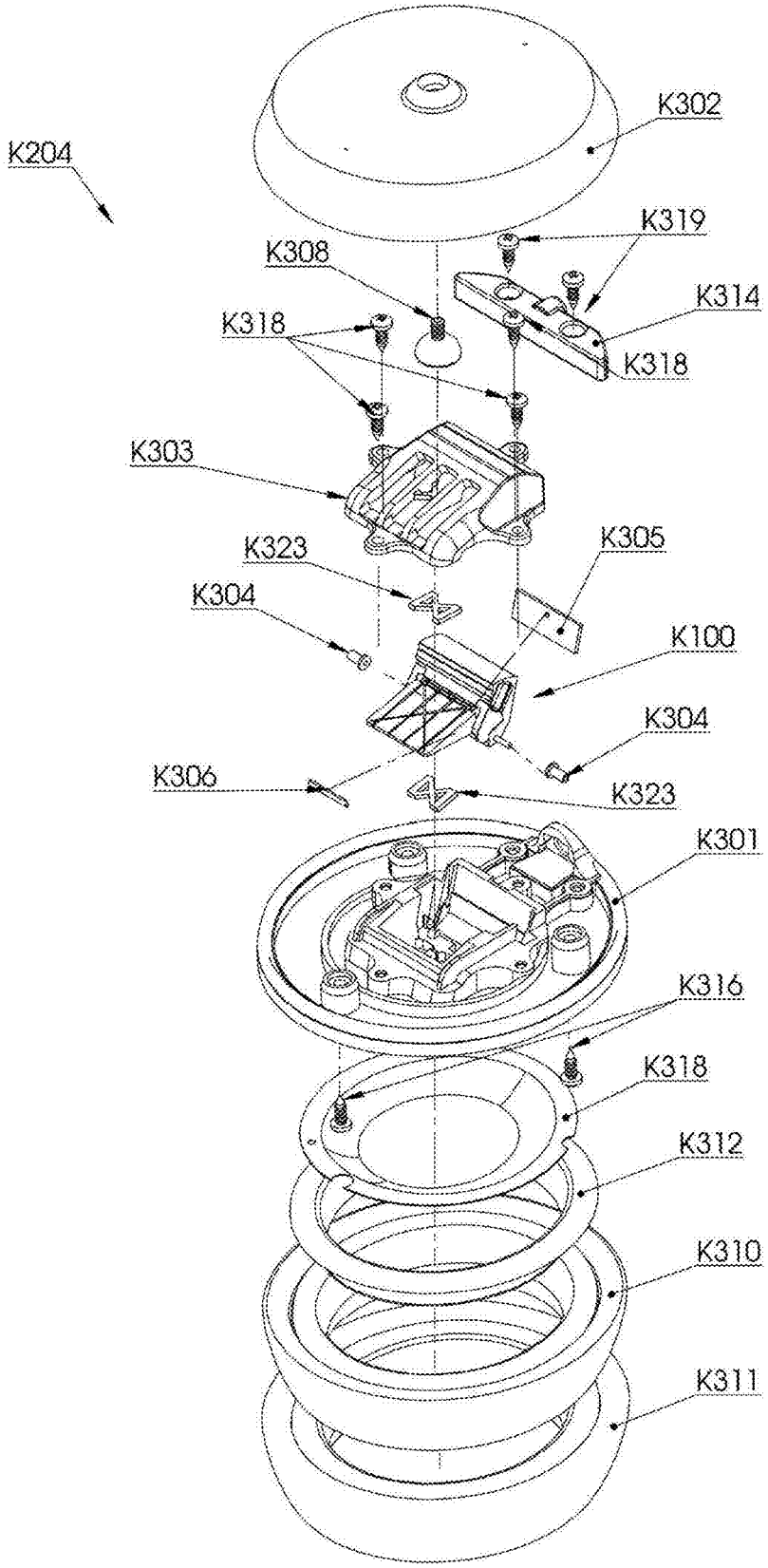

As shown in FIGS. 18D-F, the mounting system comprises a pair of decoupling pins K133 extending laterally from either side of the transducer base structure. The decoupling pins K133 are located such that their longitudinal axes substantially coincide with a location of a node axis of the transducer assembly. A node axis is the axis about which the transducer base structure rotates due to reaction and/or resonance forces exhibited during diaphragm oscillation. In this embodiment the node axis is located at or proximal to the base component K105. The decoupling pins K133 extend substantially orthogonal to a longitudinal axis of the transducer assembly from the sides between the upper and lower major faces of the base structure K118, and are rigidly coupled and/or integral with the base structure K118. A bush K304 is mounted about each pin K133. A washer may also be coupled between the bush and the associated side of the transducer base structure in some configurations. The bushes and washers are herein referred to as "node axis mounts".

The node axis mounts are configured to couple corresponding internal sides of the surround K301 via any suitable method, such as via adhesive for example.

The decoupling mounting system further comprises one or more decoupling pads K305 and K306 located on opposing faces of the transducer base structure K118. The pads K305 and K306 provide an interface between the associate base structure face and a corresponding internal wall/face of the surround K301 (including internal cap K303), to help decouple the components. The decoupling pads are preferably located at a region of the transducer base structure that is distal from the node axis location. For example, they are located at or adjacent an edge, side or end of the base structure K118 that is distal from the diaphragm assembly K101 in this embodiment as the node axis is located close to the diaphragm axis of rotation. Each pad is preferably longitudinal in shape. In the preferred form, each pad K305, K306 comprises a pyramid shaped body having a tapering width along the depth of the body. Preferably the apex of the pyramid is coupled to the associated face of the transducer base structure K118 and the opposing base of the pyramid is configured to couple the associated face of the transducer surround in situ. This orientation may be reversed in some implementations however. It will be appreciated that in alternative embodiments the decoupling mounting system may comprise multiple pads distributed about one or more of the faces of the transducer base structure. Such mounts are herein referred to as "distal mounts".

The node axis mounts and the distal mounts are sufficiently compliant in terms of relative movement between the two components to which they are each attached. For instance, the node axis mounts and the distal mounts may be sufficiently flexible to allow relative movement between the two components they are attached to. They may comprise flexible or resilient members or materials for achieving compliance. The mounts preferably comprise a low Young's modulus relative to at least one but preferably both components they are attached to (for example relative to the transducer base structure and housing of the audio device). The mounts are preferably also sufficiently damped. For instance, the node axis mounts may be made from a substantially flexible plastics material, such as a silicone rubber, and the pads may also be made from a substantially flexible material such as silicone rubber. The pads are preferably formed from a shock and vibration absorbing material, such as a silicone rubber or more preferably a viscoelastic urethane polymer for example. Alternatively, the node axis mounts and/or the distal mounts may be formed from a flexible and/or resilient member such as metal decoupling springs. Other substantially compliant members, elements or mechanisms such as magnetic levitation that comprise a sufficient degree of compliance to movement, to suspend the transducer may also be used in alternative configurations.

In this embodiment, the decoupling system at the node axis mounts has a lower compliance (i.e. is stiffer or forms a stiffer connection between associated parts) relative to the decoupling system at the distal mounts. This may be achieved through the use of different materials, and/or in the case of this embodiment, this is achieved by altering the geometries (such as the shape, form and/or profile) of the node axis mounts relative to the distal mounts. This difference in geometry means that the node axis mounts comprise a larger contact surface area with the base structure and surround relative to the distal mounts, thereby reducing the compliance of the connection between these parts.

A narrow and substantially uniform gap/space K322 is formed between the transducer base structure K118 and the surround/inner cap K301/K303 when the transducer is assembled within the surround. In some embodiments the gap may not be uniform. This narrow gap K322 may extend about at least a substantial portion of the perimeter (and preferably the entire perimeter) of the base structure K118. A width of each air gap defined by the distance between the outer periphery of the transducer base structure K118 and the surround/inner cap K301/K303 is less than 1.5 mm, or more preferably is less than 1 mm, or even more preferably is less than 0.5 mm. These values are exemplary and other values outside this range may also be suitable.

A narrow gap/space K321 exists between a portion or the entire perimeter of the diaphragm assembly K101 and the surround K301.

The audio device further comprises diaphragm excursion stoppers K323 which are also connected to surround K301 or inner cap K303. There may be one or more such stoppers. In situ, there may be one or more (in this example three) stoppers K323 extending longitudinally and substantially uniformly spaced along each face at a region proximal to the diaphragm structure of the surround K301. These stoppers K323 have an angled surface that is positioned to contact the diaphragm in the case of any unusual event, such as if the device is dropped or if a very loud audio signal is presented, that may cause over-excursion of the diaphragm. The angled surface is configured to locate adjacent the diaphragm body in situ, to match the angle of the diaphragm body if the diaphragm is caused to inadvertently rotate to this point. The stoppers K323 are made from a substantially soft material, such as an expanded polystyrene foam, to avoid damaging the diaphragm. The material is preferably relatively softer than that of the diaphragm body for example (e.g. it may be of a relatively lighter density than the polystyrene of which the diaphragm body) to alleviate damage. The stoppers K323 have a large surface area so as to effectively decelerate the diaphragm, but not so large as to block too much air flow and/or create enclosed air cavities that are prone to resonance.

Air Leak Fluid Passages

Each headphone cup K204 may also comprise any form of fluid passage configured to provide a restrictive gases flow path from the first cavity to another volume of air during operation, to help damp resonances and/or moderate base boost. For example, referring to FIGS. 18D, 18E and 19, this device comprises at least one fluid passage that fluidly connects a first, front air cavity K406 configured to locate adjacent a user's ear in situ, with a second, rear air cavity K405 configured to locate distal from the user's ear in situ or with a volume of air K414 that is external to the device. The front air cavity K406 may comprise two cavities K406*a* and K406*b* on either side of the grill mesh/output aperture K318/K325. In this embodiment, the device comprises fluid passages K320, K321 and K322 that fluidly connect the front air cavity K406 on a side of the diaphragm assembly that is configured to locate adjacent and/or to face the output aperture K325 of the surround K301 with the rear cavity K405 on an opposing side of the diaphragm assembly facing away and/or located distal from the output aperture K325 of the surround K301. The surround outer cap K302 has two small holes creating air passages K324 from the rear cavity K405 to the external air K414. These air passages, in combination with the fluid passages K320/K321/K322 fluidly connect the front, rear and external air cavities K406, K405 and K414 such that air that is otherwise sealably retained within front cavity K406 can restrictively flow into the rear cavity K406 cavity and also from the rear cavity to an external volume of air K414, to thereby damp internal air resonances and/or moderate bass boost in use. It is not essential that a separate flow restricting element is used for the passages K320 and K324 to provide a restrictive gases flow path, and the passages may be substantially open with no obstructive barriers and still be restrictive by having a reduced size, diameter and/or width. As will be explained in further detail below, at least one fluid passage K320/K321/K322 is configured to restrict air flow by either having a reduced diameter or width at the junction with the front cavity K406 or by otherwise incorporating a flow restricting element, or both.

In some variations of this embodiment an alternative or additional fluid passage is provided for fluidly connecting the front cavity directly to an external volume of air.

At least one fluid passage K320/K321/K322/K324 preferably comprises a fluid flow restrictor. The fluid flow restrictor may comprise, for example, any combination of: an entry or input from the adjacent cavity of reduced size, width or diameter; and/or a fluid flow restricting element or barrier at the entry or within the passage such as a porous or permeable material. For example, the fluid passage may be an entirely open passage having a reduced diameter or width entry. Alternatively, or in addition the fluid passage may comprise a fluid flow restricting element such as a foam barrier or mesh fabric barrier at the entry or within the passage for subjecting gases traversing therethrough to some resistance. The fluid passage may comprise one or more small apertures.

Preferably, the fluid passages K320/K321/K322/K324 also collectively permit the flow of gases therethrough to a sufficient degree such that there is a significant reduction in sound pressure within the ear canal during operation. A significant reduction in sound pressure for example may result in at least 10%, or more preferably at least 25%, or most preferably at least 50% of reduction in sound pressure during operation of the device over a frequency range of 20 Hz to 80 Hz. This reduction of sound is relative to a similar audio device that does not comprise any fluid passages such that there is negligible leakage in sound pressure generated during operation. The significant reduction in sound pressure is preferably observed at least 50% of the time that the audio device is installed in a standard measurement device. Other reductions in sound pressure are also envisaged however and the invention is not intended to be limited to these examples.

In this embodiment, the fluid passages K320, K321 and K322 comprise a reduced width at the junction with the front cavity K406 (and also with the rear cavity K405). The width of the passages may be the same or else different. Each fluid passage K320/K321/K322 is substantially open but is reduced in size relative to the front cavity to thereby reduce any unwanted resonances that might otherwise occur within the air cavity K406 and/or within the air cavity K405.

Each fluid passage may extend anywhere within the device, such as adjacent the periphery of the diaphragm assembly and/or audio transducer assembly or even through an aperture in the diaphragm assembly and/or audio transducer assembly and/or ear pad K309. In this embodiment the passage K321 extends about the periphery of the diaphragm assembly, and in particular the side faces and a terminal face/edge of the diaphragm structure.

In this embodiment, control of air resonances is improved via damping created by the fluid passage air leaks. Also, resonance control, as well as bass level moderation, can be made relatively consistent across different listeners/users and with different device positioning, particularly if the fluid passage leakage provided within the device is significant in comparison to fluid leakage that may occur between the ear pads K309 and the user's head.

In order to damp an air resonance inherent in a cavity such as K405 or K406, an air leak fluid passage should preferably provide sufficient resistance to air flow such as to avoid high air flow rates through the passage which might otherwise effectively connect the cavity to another air cavity or to the surrounding air K414, because this situation is likely to create significant new unwanted resonance modes. If a high air flow does occur then the flow path will preferably contain a resistive element such as a foam plug so that associated resonances decay quickly. An example of such a new resonance mode could be a Helmholtz type resonance involving movement of air within an air fluid passage, which in this scenario constitutes a mass, reciprocating within the passage against a restoring force provided by air contained within a connected cavity, which acts as a compliance.

In order to damp an unwanted air resonance inherent in a cavity such as K405 or K406 an air leak fluid passage preferably also permit sufficient air fluid flow such that there is a significant reduction in the air pressure, at the fluid passage entrance, associated with the mode in question. In general, for this to occur, a passage is preferably not be located at a pressure node associated with the mode in question, otherwise the mode will not drive air through the fluid passage and the resonance will be unaffected. Preferably, for maximum attenuation, an air passage is located at or close to a pressure antinode of an unwanted air resonance mode.

To attenuate a broad spectrum of unwanted air resonance modes within air cavity K406, it is preferable that the air leak fluid passages, such as K320, K321 and K322 are widely distributed across the volume of air cavity K406. This improves the likelihood that, for a given unwanted air resonance within a cavity such as K406, there will be an air leak fluid passage located away from a pressure node and preferably close to a pressure antinode. For example, the air leak fluid passages K320, K321 and K322 collectively extend (and are distributed) across a distance that is close to the maximum dimension across surround component K301. Preferably the air leak fluid passages K320, K321 and K322 collectively extend along a distance greater than a shortest distance across a major face K132 of the diaphragm body, or more preferably along a distance greater than 50% more than the shortest distance across a major face K132 of the diaphragm body, or most preferably along a distance greater than double the shortest distance across a major face K132 of the diaphragm. This helps to achieve more comprehensive damping of more distinct internal air resonances.

In an alternative embodiment air fluid passages are provided from cavity K406 to the outside air K414 via a permeable or porous fabric. An advantage of the configuration of the present invention however, is that fluid passages damping resonance in the cavity K406, which is adjacent to the ear, vent to the rear cavity K405 as opposed to the outside air K414, and this means that passive noise attenuation is improved because ambient noise must pass through the rear cavity K405 in order to move from the outside air K414 to the ear in cavity K406*a*.

Air leak fluid passages K320, K321, K322 and K324 are substantially distributed across the volume of rear air cavity K405. In a manner similar to the case of front cavity K406, this improves the likelihood that, for a given unwanted air resonance within cavity K405, there will be an air leak fluid passage located away from a pressure node and preferably close to a pressure antinode.

2.2.5 Embodiment E

Overview

Referring to FIGS. 5A-M, 6A-H, 7 and 8A-C a further audio transducer embodiment of the invention, herein referred to as embodiment E, is shown comprising a diaphragm assembly E101 that is rotatably coupled to a transducer base structure E118*a* via a contact hinge system designed in accordance with the principles set out in section 2.2.1 of this specification. By way of summary the diaphragm assembly E101 comprises a diaphragm structure that is similar to that of embodiment A. Furthermore, the transducer base structure E102 comprises a relatively thick and squat geometry as per the embodiment A audio transducer, with a permanent magnet E102 and outer pole pieces E103 and inner pole pieces E113, defining a magnetic field of the excitation mechanism. One or more coil windings E106 rigidly coupled to the diaphragm structure extend within the magnetic field to move the diaphragm assembly during operation. As shown in FIGS. 6A-H, the diaphragm structure has an outer periphery that is at least partially, substantially or approximately entirely free from physical connection with a surrounding structure E201-E204 of the transducer Diaphragm Base Structure FIG. 5H shows a cross-section of the audio transducer, and the cross-section of the long sides E130 and E131 of coil winding(s) E106 being curved at a radius centred on the axis of rotation E119, and overhung, so that as the diaphragm rotates, an angle of displacement is available before the coil winding long sides start to exit the region of the magnetic flux gaps between outer pole pieces E103 and E104, and the inner pole pieces E113. In this way a high degree of linearity of driving torque is achieved.

Figure 7:
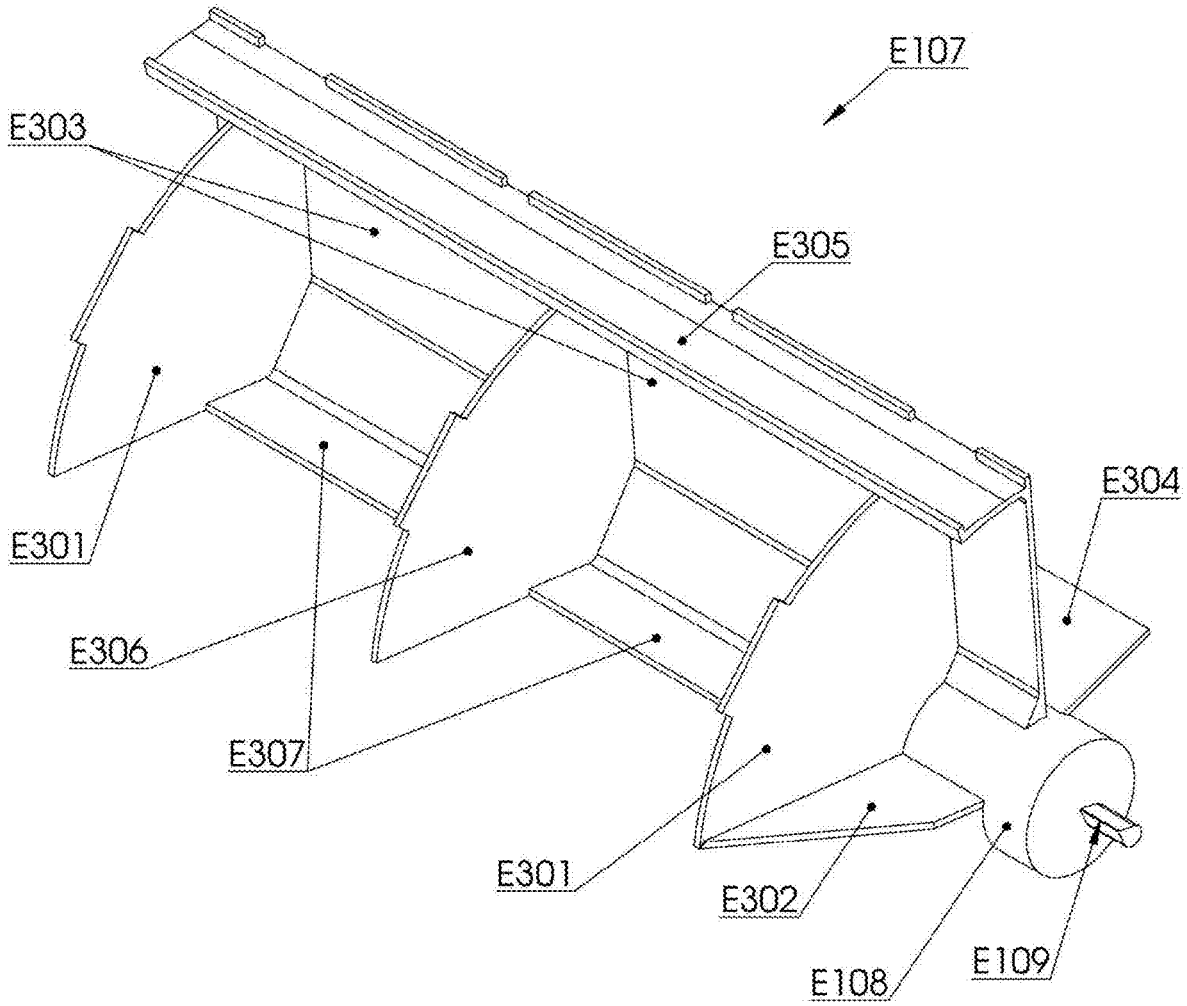
FIG. 7 shows a 3D isometric view of the diaphragm base frame E107 of the embodiment E driver illustrated in FIGS. 5A-M.

FIG. 7 shows the diaphragm base frame E107 by itself, which comprises two side arc coil stiffeners E301, two stiffener triangles E302, a main base plate E303 extending the width of the diaphragm, an underside strut plate E304 also extending the width of the diaphragm, a topside strut plate E305 again extending the width of the diaphragm, a middle arc coil stiffener E306 and an underside base plate E307 extending the width of the diaphragm.

Coil winding(s) E106 is(are) attached to diaphragm base frame E107. Each coil winding consists of short sides E129 that are attached to each of the two side arc coil stiffeners E301. The long sides E130 and E131 of the coil winding(s) E106 are attached to the two side arc coil stiffeners E301 and also the middle arc coil stiffener E306. Coil winding long side E130 is attached to the edge of the topside strut plate E305.

The combination of all the regions of diaphragm base frame E107: side arc coil stiffeners E301, stiffener triangles E302, main base plate E303, underside strut plate E304, topside strut plate E305, middle arc coil stiffeners E306 and underside base plate E307, adhered to the coil winding(s) E106 creates a diaphragm base structure that is substantially rigid, and does not resonate within the FRO. Although the mass of diaphragm base frame E107 and winding(s) E106 is relatively high compared to other parts that of the diaphragm assembly E101, because the mass is located close to the axis of rotation E119, the rotational inertia is reduced.

The three coil stiffeners E301 and E306 each comprise a panel extending in a direction perpendicular to the axis of rotation and connecting the first long side E130 of the coil winding(s) E106 to the second long side E131 of the coil winding(s) E106. Each side arc coil stiffener E301 is located close to and touches each short side E129 of the coil winding(s) E106 and extends from approximately the junction between the first long side E130 and the first short side E129 of the coil winding(s) E106, to approximately the junction between the second long side E131 and the first short side E129 of the coil winding(s) E106, and also extends in a direction perpendicular to the axis of rotation towards the other parts of the diaphragm base frame E107. If these diaphragm base frame parts are not made from the same piece of material (as in this embodiment, which is sintered as one part) then a suitable rigid method of connection should be employed, for example soldering, welding, or adhering using an adhesive such as epoxy resin or cyanoacrylate, taking care to ensure a reasonable size contact area between the parts to be glued is used.

Preferably the coil stiffening panels are made from a material have a Young's modulus higher than 8 GPa, or more preferably higher than 20 GPa.

The long sides E130 and E131 of the coil winding(s) E106 are not connected to a former, and instead they are sufficiently thick so as to be able to support themselves in regions between the coil stiffeners. A former could also be used.

Contact Hinge Assembly

The contact hinge assembly facilitates the diaphragm assembly E101 to rotate back and forth about an approximate axis of rotation E119 with respect to the transducer base structure E118*a* in response to an electrical audio signal played through coil winding(s) E106 attached to the diaphragm assembly E101.

The hinge assembly comprises a pair of hinge joints located on either side of the diaphragm assembly and transducer base structure. Each hinge joint comprises a hinge element and a contact member. The diaphragm base frame E107 has two convexly curved (in cross-section) protrusions located at either side of the diaphragm base frame (one of which is shown in cross-sectional detail views in FIGS. 5G and 5I), which form the hinge elements E125 of the hinge joints. The transducer base structure E118*a* comprises a base block E105, wherein either side forms the contact members of the hinge joints. Each side of the base block E105 comprises a concavely curved contact surface E117, against which the associated hinge element E125 bears and rolls during operation. The contact assembly could be reversed so that the concave indentations are on the diaphragm side and the convex protrusions on the transducer base structure side, in alternative embodiments.

The hinge elements E125 are formed from a material having a sufficiently high modulus to rigidly support the diaphragm against translational and rotational displacements (excluding the desired rotational mode) which might otherwise result in diaphragm break-up resonances.

At the region of contact with the contact base block E105, each hinge element E125 comprises a surface E114 with a radius that is substantially small relative to the diaphragm body length E126 as described in relation to embodiment A, in order to help facilitate a free movement and low diaphragm fundamental resonance frequency (Wn), but preferably not so small as to cause the contacting material to flex, affecting breakup performance.

During transportation, if the audio transducer has a knock or is dropped, or later, is subject to over-extended use (e.g. millions of cycles), it is possible that the hinge elements E125 may shift from sitting in the middle of the contact surface of the base block E105. The contact surface E117 comprises an increasing slope from the contact region, in all directions, such that if the hinge element E125 shifts too far from its optimal location (for example due to a one-off impact event), it will eventually reach a slope sufficient to bias it back into the appropriate contact position. The sides of the contact surface E117 of the contact block E105 also comprise a gradual change in slope so that there is no possibility of impact that might create on-going rattle distortion. Note that such slips of the hinge element E125 are one-off and rare occurrences and do not occur in the course of normal operation of the transducer.

The diaphragm is configured to rotate about an approximate axis E119 relative to the transducer base structure E118*a* via the hinge assembly. The coronal plane E123 of the diaphragm body E120 ideally extends outwards from the axis of rotation E119 such that it displaces a large volume of air as it rotates.

Unlike the embodiment A audio transducer, the embodiment E audio transducer does not have ferromagnetic material embedded in the diaphragm assembly E101, so the magnet E102 and pole pieces do not exert a biasing force on the diaphragm assembly or hinge element to maintain contact between the hinge element and the contact member.

The hinge assembly of this embodiment comprises a biasing mechanism having a resilient member E110 that holds the hinge elements on the diaphragm base frame E107 against the contact surface E117 in the transducer base structure E118*a*. The resilient member E110 is an elongate member made from a substantially thin body. The middle part of the body connecting either resilient end is rigidly connected to the base block E105 by any suitable method and therefore does not flex. Either end of the resilient biasing member E110 are coupled to the either side of the diaphragm base frame respectively to bias the base block toward the protrusions/hinge elements E125 of the base frame. The biasing member applies a consistent biasing force to hold the contact surfaces of the hinge joints together during operation, but is sufficiently compliant to enable rotation of the diaphragm assembly about the axis of rotation during operation, and also to enable some lateral movement therebetween in certain circumstances (such as due to the existence of dust or manufacturing tolerances as explained under sections 2.2.1 and 2.2.2 of this specification).

Figure 5I:
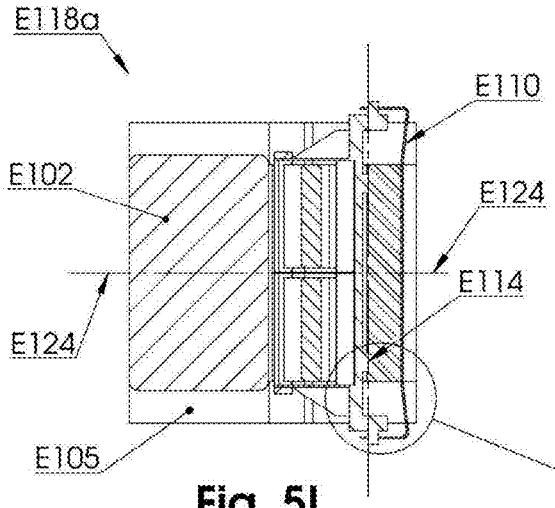
Figure 5J:
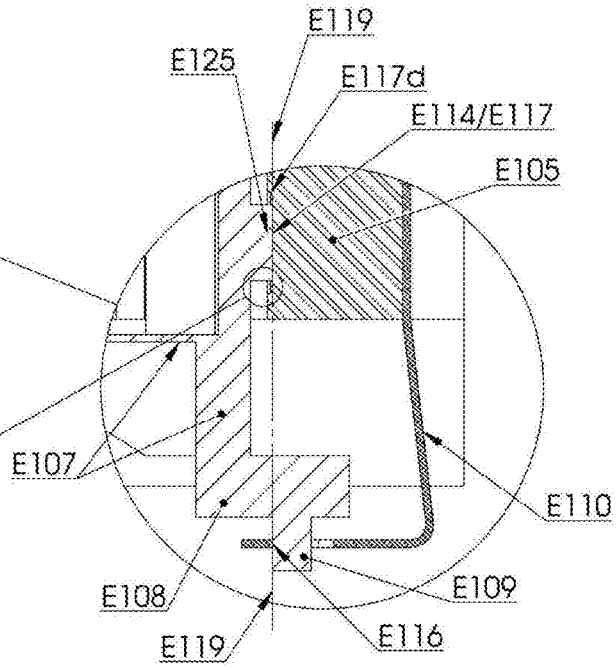
Figure 5K:
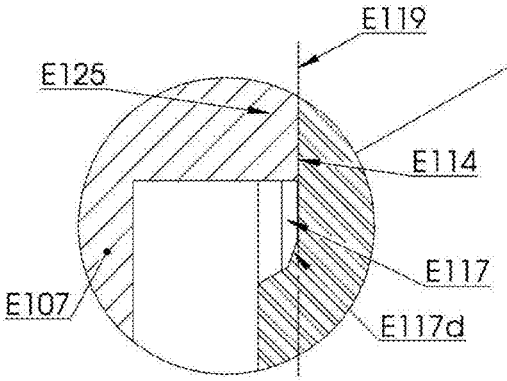
Figure 5L:
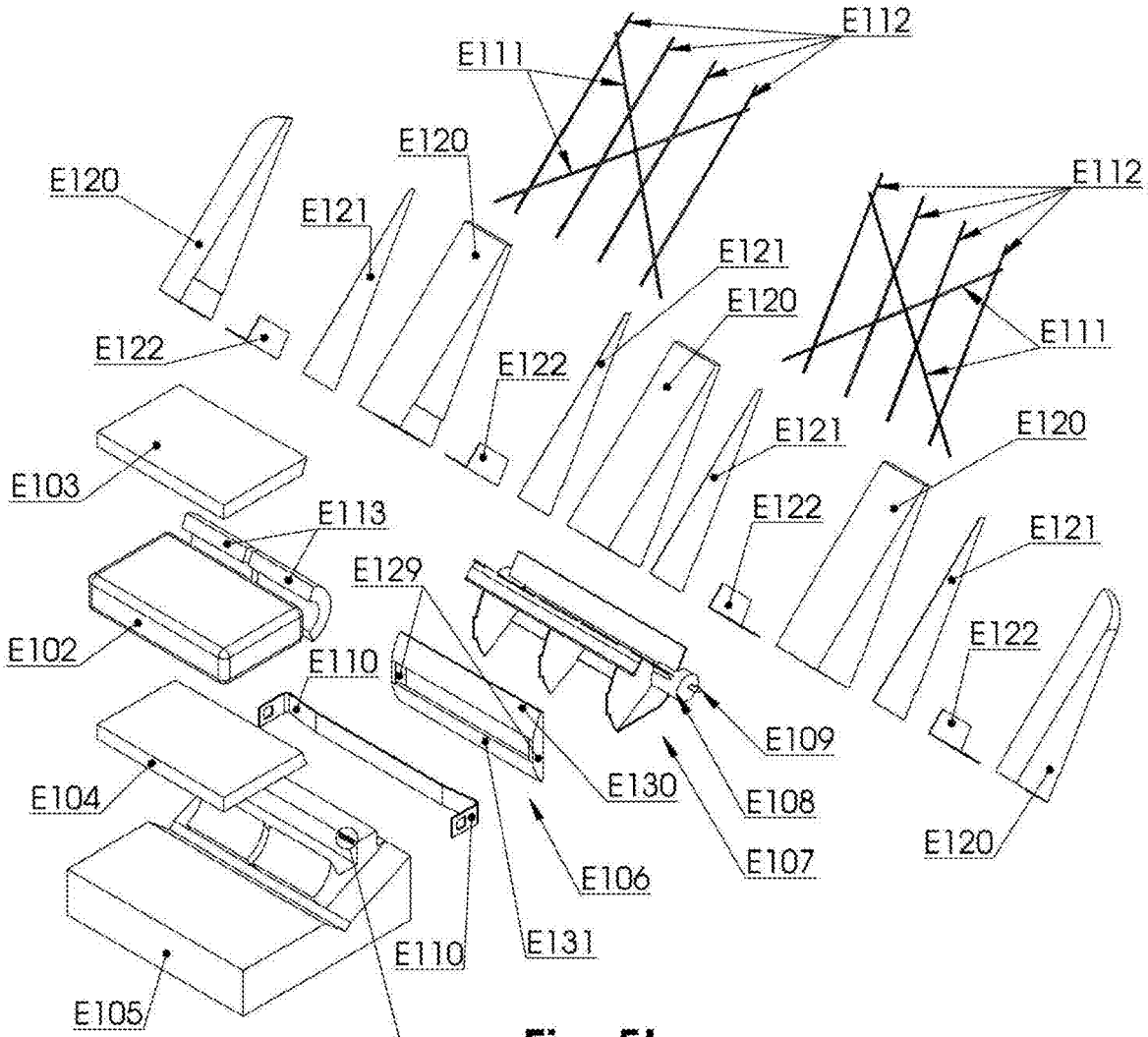
Figure 5M:
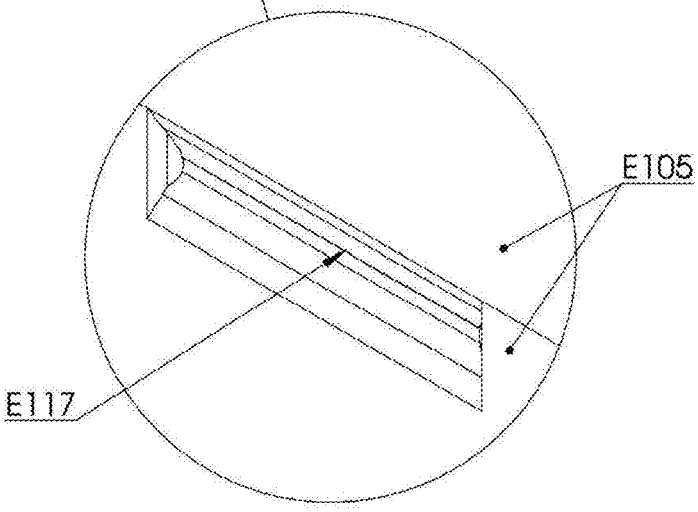

FIG. 5I shows a lengthways cross-section of a resilient biasing member E110 on one side of the audio transducer. Each end of the biasing member extends off the side of the base block E105, and is bent (approximately orthogonally relative to the intermediate section), and extends approximately parallel to the side of the audio transducer until it surrounds a force application pin E109 of the diaphragm base frame E107. Each bent end of the biasing member E110 preferably has sufficient length to allow the end to be unhooked from its position, by flexing it sideways. When the diaphragm assembly is first assembled with the transducer base structure E118*a*, and the ends of the biasing member E110 are hooked onto the base frame E107, the ends must be suitably pre-tensioned so that once hooked in place, they provide the required contact force (the size of which and reasons for are outlined in section 2.2.1 for example).

FIG. 5E shows a side view of one end of the resilient biasing member E110 hooked over the force application pin E109. An approximately square hole can be seen. The edge of the hole that contacts the force application pin E109 at the force application location E116 is substantially flat. The direction that the force is applied is substantially perpendicular to that flat edge and towards the force application pin E109. This direction was chosen to be substantially perpendicular to the plane tangent to the convexly curved surface of the hinge element at the contact region E114 on each side. In this manner a combination of forces are not applied to the diaphragm assembly that act to unbalance it with respect to the transducer base structure E118*a*. The force application pin location E116 coincides with the axis of rotation E119. The positioning of the axis defined by the two force application locations E116, relative to the axis of rotation E119, reduces the resonant frequency (Wn) and provides a restoring force to center the diaphragm to its equilibrium position. For example, if the axis defined by the force application location E116 is located offset from the axis of rotation E119 towards the diaphragm side (which is to the left with respect to FIG. 5E), then as the diaphragm rotates it will become unstable and flick towards one side. If the axis defined by the force application location E116 is located offset from the axis of rotation E119 towards the base structure side (which is to the right with respect to FIG. 5E) then the force will act to center the diaphragm at an equilibrium rest position.

The two hinge joint protrusions/hinge elements E125 are located at a reasonable distance apart, with respect to the diaphragm body width E128, with one on one side of the sagittal plane E124 of the diaphragm body E120, close to the maximum width of the diaphragm body and another protrusion/hinge element E125 similarly spaced on the other side. By spacing the contact hinge joints suitably apart, the combination are able to provide improved rigidity and support to the diaphragm assembly E101 with respect to rotational modes of the diaphragm that are not the fundamental rotational mode of the diaphragm (Wn). There are two such rotational modes, both having axes of rotation substantially perpendicular to the fundamental axis of rotation E119 of the diaphragm, and both substantially perpendicular to each other. These can be identified using a finite element analysis of a computer model of this transducer, similar to the analysis conducted on embodiment A within this specification.

In this embodiment, the configuration of the hinge system suspends the diaphragm assembly at an angle relative to the transducer base structure to provide a more compact transducer assembly. In other words, in an assembled state, a longitudinal axis of the base structure is oriented at an angle relative to a longitudinal axis of the diaphragm assembly, in the diaphragm assembly's neutral position/state. This angle is preferably obtuse, but it may be orthogonal or even acute in alternative configurations.

Transducer Base Structure

The transducer base structure E118*a* comprises the base block E105, outer pole pieces E103 and E104, magnet E102, and inner pole pieces E113. These transducer base structure parts are all adhered via an adhesion agent such as epoxy resin or otherwise rigidly connected to one another. The magnet E102 is magnetised such that the North Pole is situated on the face connected to outer pole piece E103, and the South Pole is on the face connected to outer pole piece E104. This may be the other way around in alternative embodiments.

A magnetic circuit is formed by the magnet E102, outer pole pieces E103 and E104 and the two inner pole pieces E113. Flux is concentrated in the small air gaps between outer pole pieces E103 and E104 and inner pole pieces E113. The direction of the flux in the gaps between outer pole piece E103 and inner pole pieces E113 is overall, approximately towards the axis of rotation E119. The direction of the flux in the gaps between inner pole pieces E113 and outer pole piece E104 is overall, approximately away from the axis of rotation E119. The coil winding(s) E106 which may be wound from enamel coated copper wire in an approximately rectangular shape, with two long sides E130 and E131 and two short sides E129 as described above. Long side E130 is located approximately in the small air gap between outer pole piece E103 and inner pole pieces E113, and the other long side E131 is located in the small air gap between outer pole piece E104 and inner pole pieces E113. During operation, as an electrical audio signal is played through the coil windings, torque is exerted by both coil winding long sides E130 and E131 in the same direction to cause the diaphragm assembly to oscillate. The coil winding(s) E106 is(are) wound thick enough (and adhered together with an adhesive such as epoxy) to be relatively rigid, and push unwanted resonant modes up beyond the FRO. It is preferably thick enough to not require a coil former, and this means that the magnetic flux gaps are able to be made smaller (increasing flux density and audio transducer efficiency) for a given coil winding thickness and given clearance gap in between the coil winding long sides E130 and E131 and pole pieces E103, E104 and E113.

Diaphragm Structure

Referring also to FIGS. 8A-8C, the diaphragm assembly E101 is configured to rotate about an approximate axis E119 relative to the transducer base structure E118*a*. The diaphragm body thickness E127 is substantially thick relative to the length of the diaphragm body length. For example the maximum thickness is at least 15% of the length, or more preferably at least 20% of the length. This thickness provides the structure with improved rigidity helping to push resonant modes up out of the range of operation. The geometry of the diaphragm is largely planar. The coronal plane E123 of the diaphragm body E120 ideally extends outwards from the axis of rotation E119 such that it displaces a large volume of air as it rotates. It is tapered, as shown in FIG. 8C at an angle E402 of about 15 degrees, to significantly reduce its rotational inertia, providing improved efficiency and breakup performance. Preferably the diaphragm body tapers away from the centre of mass E401 of the diaphragm assembly E101.

The diaphragm comprises a plurality inner reinforcement members E121 laminated in between wedges of low density core of body E120 and alongside a plurality of angled angle tabs E122. These parts are attached using an adhesion agent, for example epoxy adhesive, a synthetic rubber-based adhesive or latex-based contact adhesive. Once adhered, the base face end of this wedge laminate (including faces of four angle tabs E122) is then attached to the main base plate E303. Normal stress reinforcement comprising multiple thin parallel struts E112 are attached to a major face E132 of the body E120, preferably in alignment with the multiple inner reinforcement members E121, and connecting to the topside strut plate E305. Additional normal stress reinforcement comprising two diagonal struts E111 are attached in a cross configuration, across the same major face E132 of the body and over the top of the parallel struts E112, and also connecting to the topside strut plate E305. On the other major face E132 of the body, struts E111 and E112 are also attached in a similar manner, except connecting to the underside base plate E307. These parts are attached to each other using an adhesion agent, for example epoxy adhesive. Other connection methods however are also envisaged as previously described in relation to other embodiments.

The use of high modulus struts E111 and E112, connected on the outside of a thick, low density body E120 made from EPS foam, for example, provides a beneficial composite structure in terms of diaphragm stiffness, again due to the thick geometry maximising the second moment of area advantage that the struts can provide.

During operation, the diaphragm body E120 displaces air as it rotates, and as such, it is required to be significantly non-porous. EPS foam is a preferable material due to its reasonably high specific modulus and also because it has a low density of 16 kg/m^3. The EPS material characteristics help to facilitate improved diaphragm breakup compared to conventional rotational action audio transducers. The stiffness performance allows the core to provide some support to the struts E111 and E112 which may be so thin that without the core, they would suffer localised transverse resonances at frequencies within the FRO. The laminated inner reinforcement members E121 provide improved diaphragm shear stiffness. The orientation of the plane of each inner reinforcement member is preferably approximately parallel to the direction the diaphragm moves and also approximately parallel to the sagittal plane E124 of the diaphragm body E120. For the inner reinforcement members E121 to adequately aid the shear stiffness of the diaphragm body, reasonably rigid connections are preferably made to the parallel struts E112 laid on either side of each inner reinforcement member. Also, at the base end of the diaphragm the connection from the inner reinforcement members E121 to the main base plate E303 needs to be rigid, and to aid this rigidity, angle tabs E122 are used. Each tab E122 has a large adhesive surface area for connecting to each inner reinforcement member E121, and shear forces are transferred around the corner of the tab, the other side of which is another large adhesive surface area which is connected to the main base plate E303.

Diaphragm Assembly Housing

Referring to FIGS. 6A-6H, a surround E118*b* consisting of a surround body E201, a main grille E202 and side stiffeners E203 is attached to base block E105, outer pole piece E103, and magnet E102, and it is assembled such that there is a small air gap E206 of between approximately 0.1 mm to 1 mm between the periphery of the diaphragm structure and the inner walls of the surround E201.

Figure 6A:
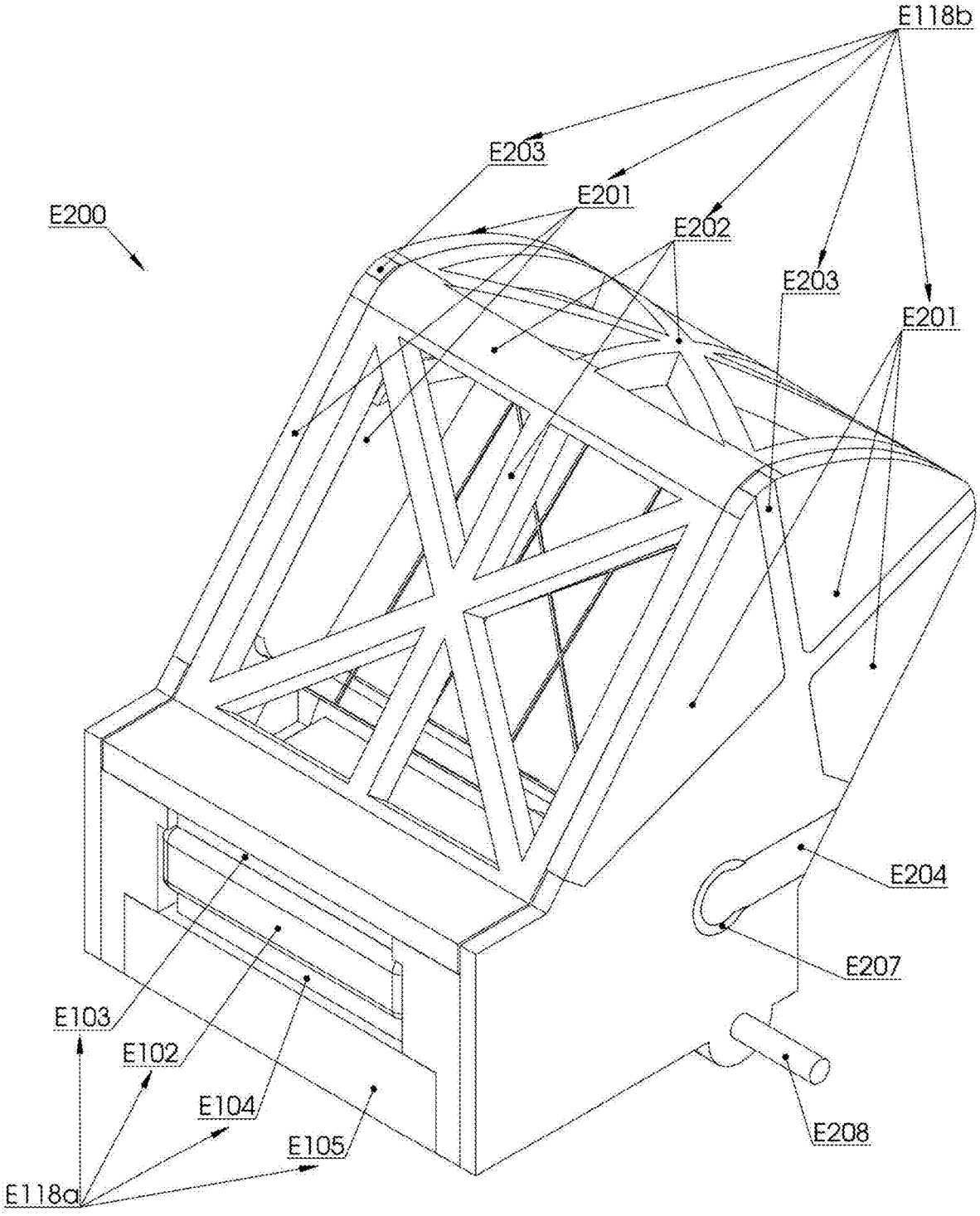
Figure 6B:
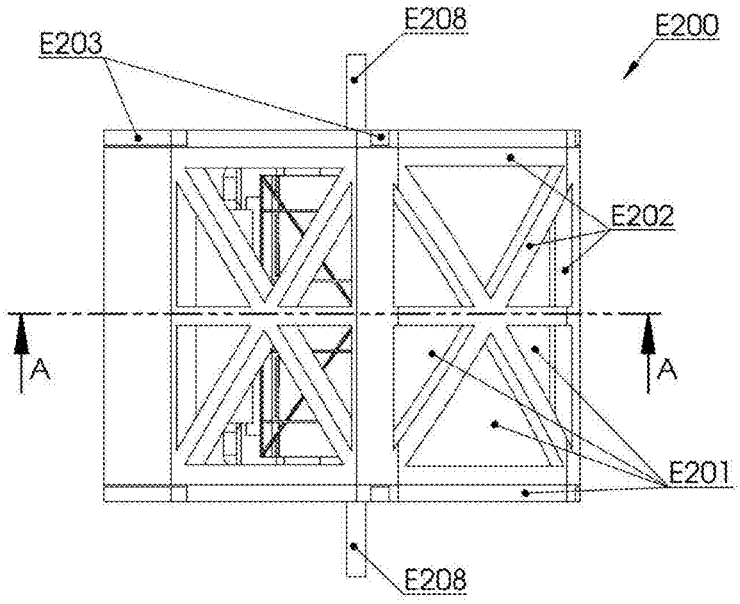
Figure 6C:
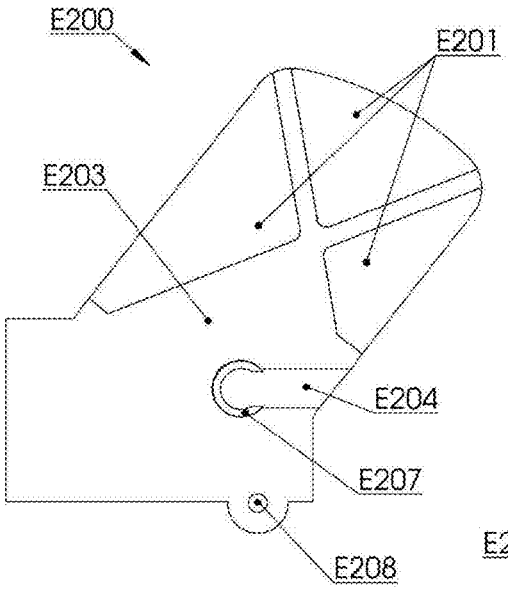
Figure 6D:
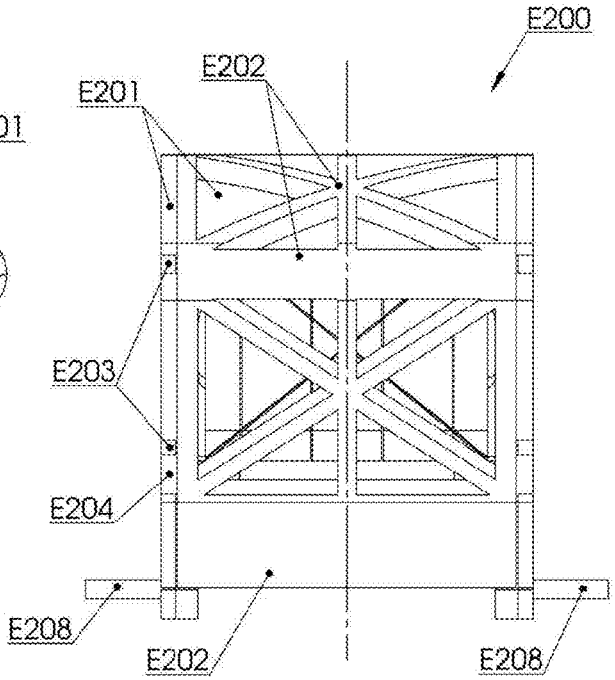
Figure 6E:
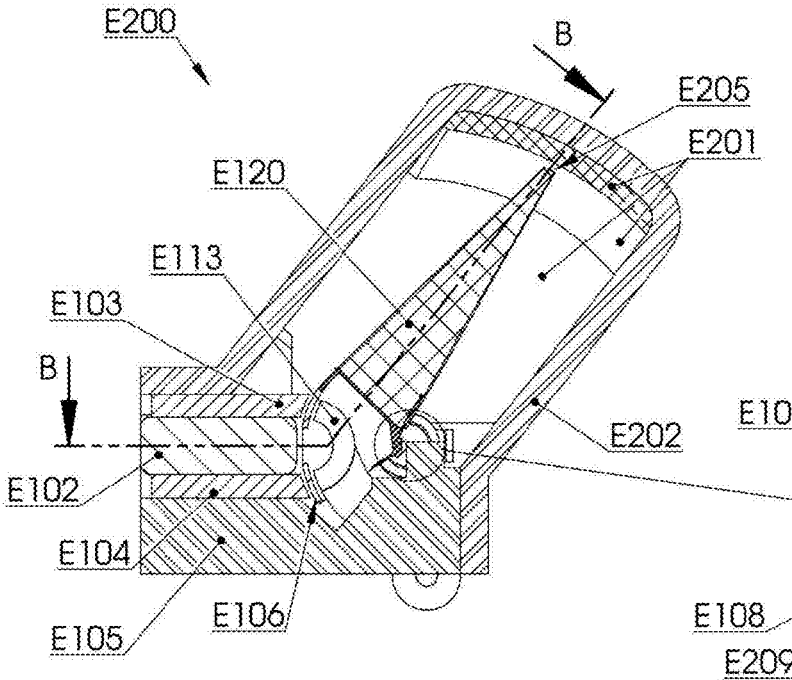
Figure 6F:
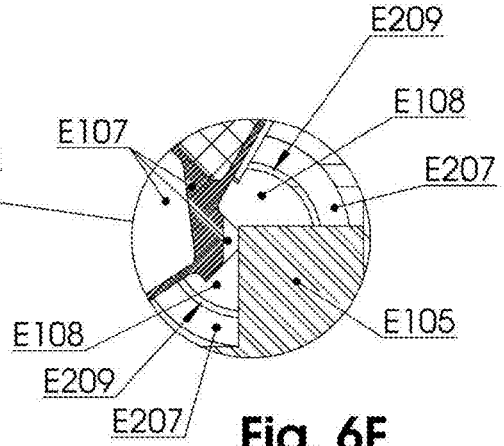
Figure 6G:
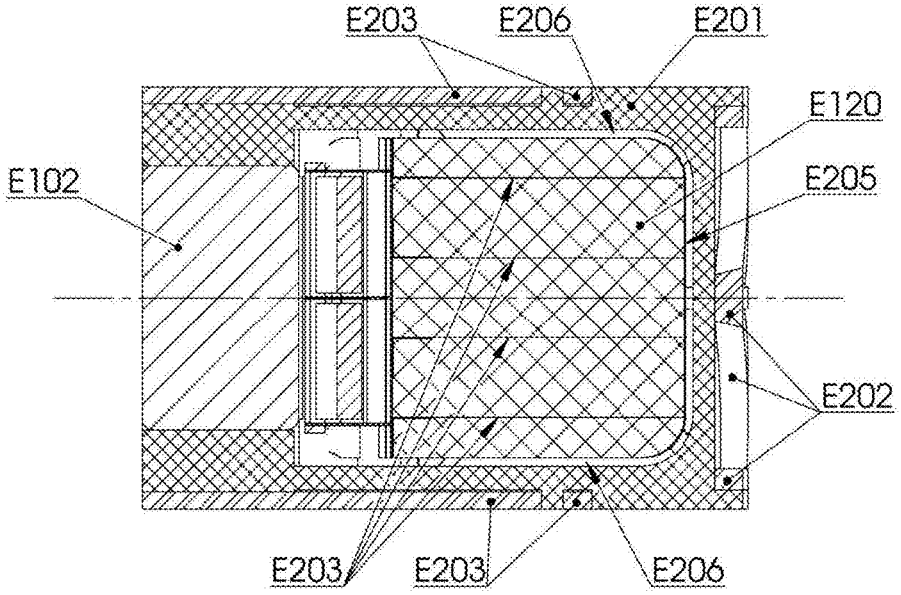
Figure 6H:
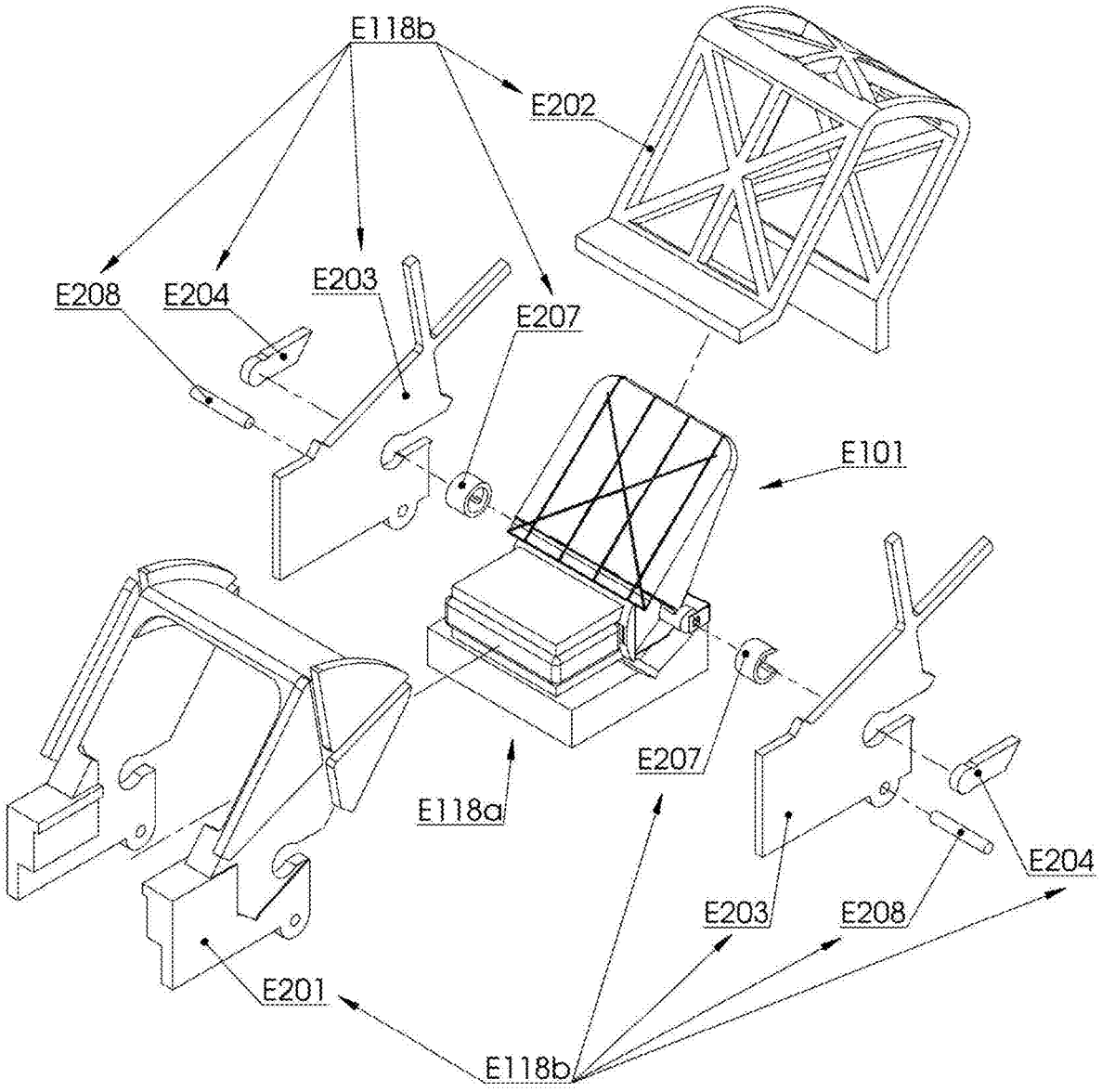

Cross-sectional view FIG. 6E shows that the surround E118*b* has a curved surface at the small air gap E205 at the tip of the diaphragm. The centre of radius of this curve is located approximately at the axis of rotation E119 of the audio transducer, such that as the diaphragm rotates, the small air gap E205 is maintained at the tip of the diaphragm. Air gaps E206 and E205 are required to be sufficiently small to prevent significant amounts of air from passing through due to the pressure differential that exists during normal operation.

Surround body E201 has walls that act as a barrier or baffle, reducing cancellation of radiation from the front of the diaphragm by anti-phase radiation from the rear. Note that, depending upon the application, a transducer housing (or other baffle components) may also be required to further reduce cancellation of frontward and rearward sound radiation.

A main grille E202 and two side stiffeners E203 are attached using a suitable method, such as via an adhesive agent (for example epoxy adhesive) to the surround body E201. Because these diaphragm housing components are all rigidly attached to the transducer base structure the combined structure, being the base structure assembly, is rigid enough for adverse resonance modes to be above the FRO. To achieve this, the overall geometry of the combined structure is compact and squat meaning no dimension is significantly larger than another. Also, the region of the diaphragm housing that extends around the diaphragm is stiffened by the use of triangulated aluminium struts incorporated into the main grille E202 and side stiffeners E203 which form a stiff cage around the plastic surround body E201. Triangulated structures have lower mass compared to structures that are not, and as the stiffness is not reduced as much, this means that a triangulated structure will in general perform better in terms of adverse resonances.

The diaphragm surround E118*b* also incorporates stoppers which do not connect with the diaphragm assembly except in the case of an unusual event such as a drop, or a bump as a means of preventing damage from occurring to more fragile parts of the diaphragm assembly. A cylindrical stopper block E108, which is part of the diaphragm base frame E107, protrudes out each side of the diaphragm assembly E101. After the transducer is mounted in the diaphragm surround E118*b*, and after parts of the transducer base structure E118*a* that are in contact with the diaphragm surround E118*b* are connected, for example by the use of an adhesive such as epoxy, two stopper rings E207 are inserted into each side of the diaphragm surround body E201. In an assembled state, a small gap E209 exits between each stopper ring E207 and each stopper block E108. The size of these gaps E209 are preferably small compared to the length of the diaphragm body E126 and also the size of the gaps around the perimeter edge of the diaphragm E205, E206. This is so that in the case of a drop, the stopper gaps close and the stopper components E207 and E108 connect before other parts of the diaphragm assembly E101 connect to something else, for example to the diaphragm surround body E201. Once each stopper ring E207 has been installed, two plugs E204 made from plastic are inserted into the remaining hole on each side of the diaphragm surround E118*b*. This is to help prevent an air flow route from areas of positive sound pressure on one side of the diaphragm to areas of negative sound pressure on the other side of the diaphragm. The stopper rings E207 and the plugs E204 made be connected to the diaphragm surround body E201 and each other via and adhering agent such as epoxy.

3. Preferred Transducer Base Structure Design

In each of the audio transducer embodiments described in this specification, in order for them to provide relatively low-energy-storage performance the transducer base structure, being the component or assembly from which the diaphragm assembly is supported and excited, preferably itself has few resonance modes, or more preferably no-resonance modes, within the transducer's FRO.

The transducer base structure is preferably constructed from rigid materials that have a relatively squat and compact geometry, meaning that no dimension is significantly larger than any other dimension of the structure. Slender geometries are more compact, however they are also more prone to resonance so they are not preferred for the embodiments of this invention, although not excluded from the scope of the invention.

If the transducer base structure is rigidly attached to other components, for example a baffle, enclosure, housing or any other surround, then preferably the entire structure (herein referred to as the "transducer base structure assembly") should also be constructed from rigid materials and have a squat and compact geometry.

It is also preferable that, so far as is possible, the base structure assembly does not obstruct the air flow on either side of the diaphragm and does not contribute to containment of an air volume which may in turn result in an air resonance mode.

The transducer base structure preferably also has a high mass compared to the diaphragm assembly, so that diaphragm displacement is large compared to that of the transducer base structure. Preferably the mass of the transducer base structure is greater than 10 times, or more preferably greater than 20 times the mass of the diaphragm assembly.

Preferably, at least one key structural component of the base structure assembly, other than any magnets, is made from a material having high specific modulus, for example from a metal such as, but not limited to, aluminium or magnesium, or from a ceramic such as glass, in order to minimise susceptibility to resonance.

The components of which the base structure assembly is comprised may be connected together by an adhering agent such as epoxy, or by welding, or by clamping using fasteners, or by a number of other methods. Welding and soldering provides a strong and rigid connection over a wide area and hence is preferable, particularly if the geometries are more slender and therefore prone to resonance.

FIGS. 1A-F for example shows an audio transducer embodiment, herein referred to as embodiment A, having a rigid and relatively light weight composite diaphragm assembly A101 rotatably coupled to a rigid transducer base structure A115.

The transducer base structure A115 comprises a permanent magnet A102, pole pieces A103 and A104, a contact bar A105 and decoupling pins A107 and A108. All parts of the transducer base structure A115 may be connected using an adhesive agent, for example epoxy adhesive, or alternatively via any rigid coupling mechanism such as via welding, clamping and/or fasteners.

The transducer base structure A115 is designed to be rigid so that any resonant modes that it has preferably occur outside of the transducer's FRO. The thick, squat and compact geometry of the transducer base structure A115 provides this embodiment with an advantage over conventional transducers having a transducer base structure consisting of a basket attached to a magnet and pole pieces.

Figure 15A:
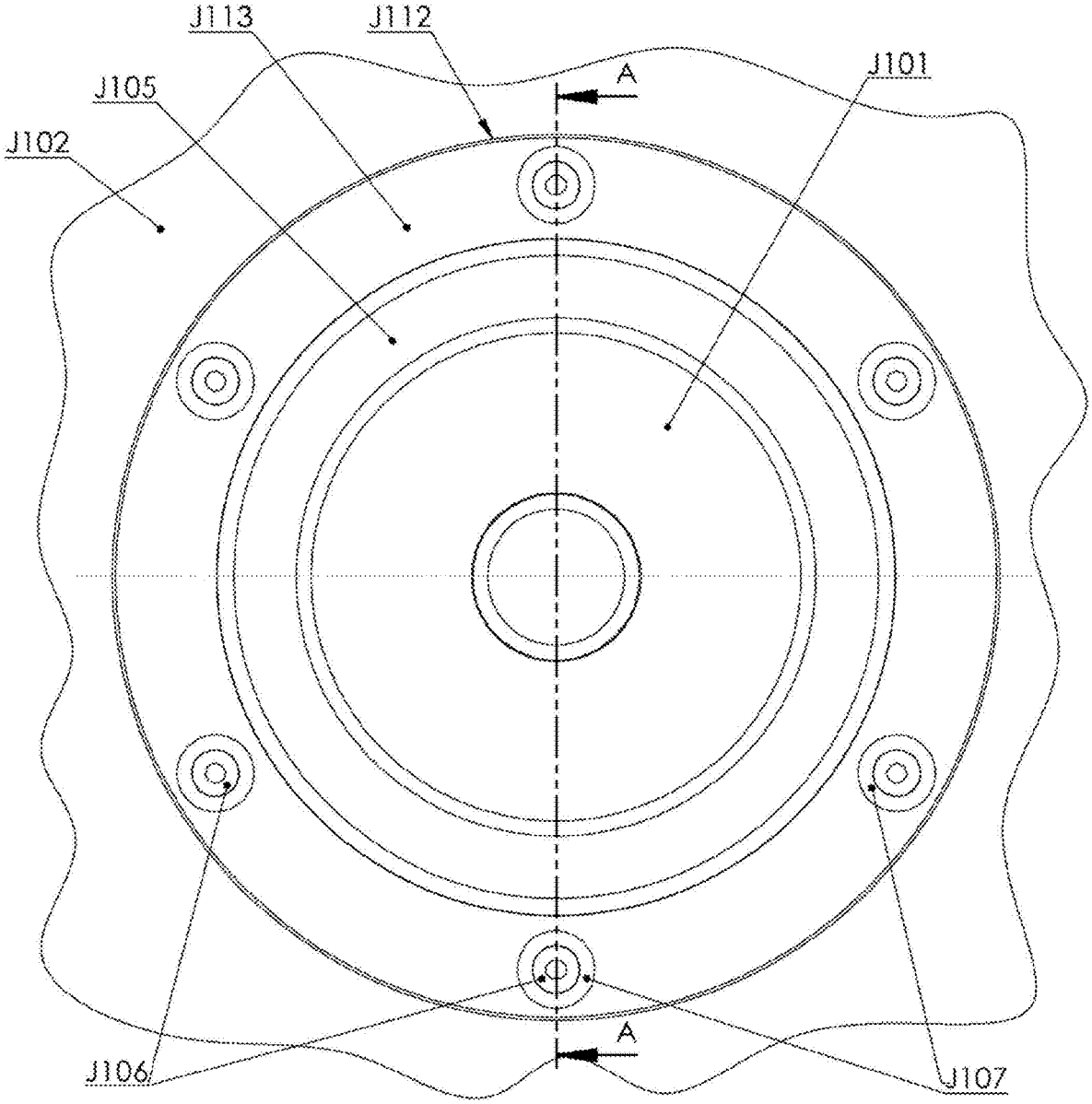
Figure 15B:
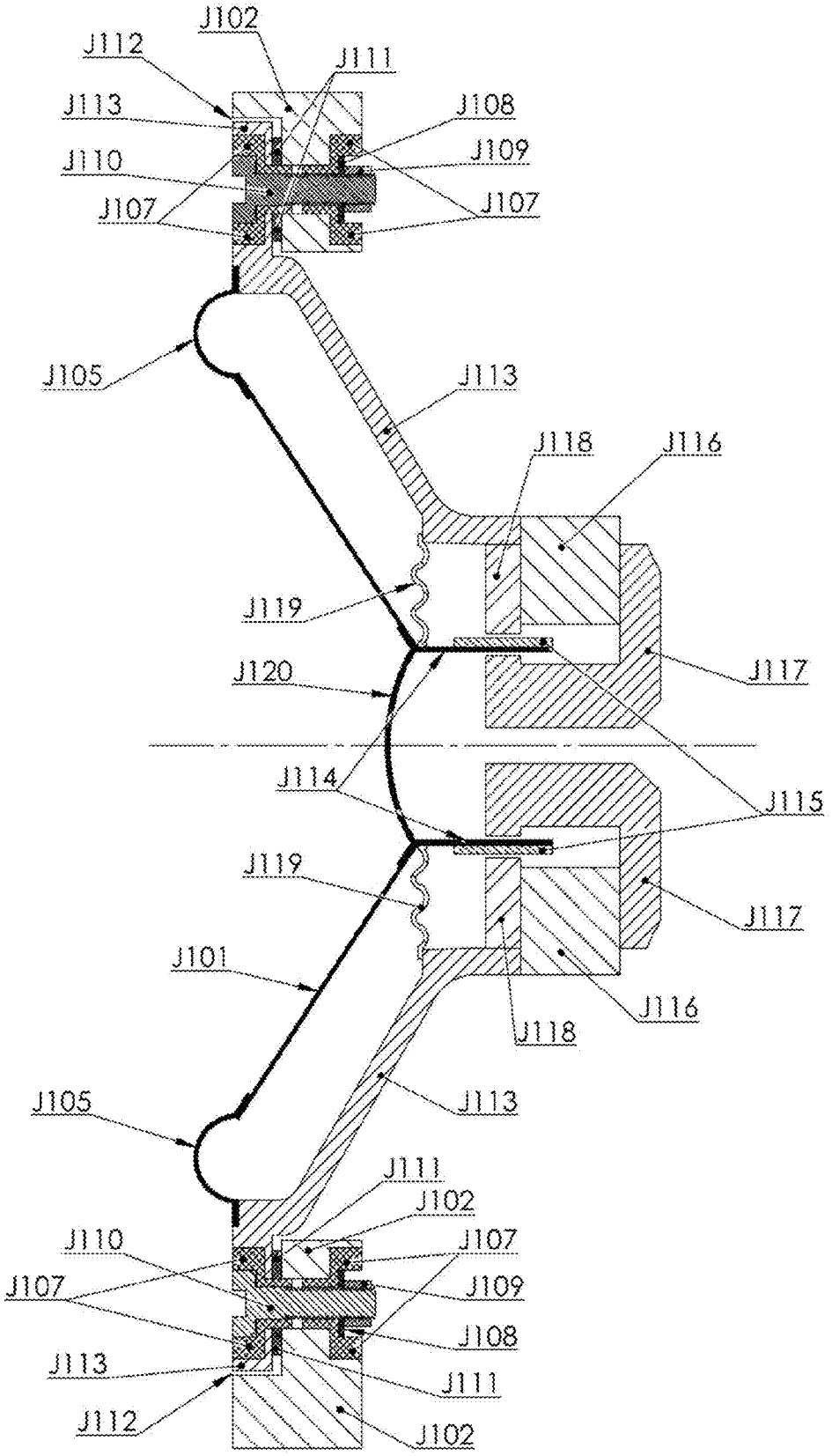

In a conventional audio transducer, such as the one shown in FIGS. 15A and 15B, the basket J113 has to link the relatively heavy mass of the magnet J116, top pole piece J118 and T-yoke J117 to the part of the basket that supports the flexible diaphragm suspension—the surround J105. The geometry of the transducer is restricted by the fact that the surround must be located a significant distance away from the magnet J116 and spider J119. This makes it difficult to provide a compact and squat geometry of transducer base structure, for a given size of the diaphragm cone J101. The thin, non-compact, non-squat geometry and location of conventional basket designs makes them prone to resonance.

Conventional surrounds often also contain one or more air pockets between the diaphragm and the enclosure or baffle thereby creating air resonance modes.

The same or similar transducer base structures or base structure assemblies are utilised in the other audio transducer embodiments of this invention.

4. Transducing Mechanism

In each of the audio transducer embodiments described in this specification, the audio transducer incorporates a transducing mechanism. In the case of the preferred electroacoustic implementation (e.g. loudspeaker), the associated transducing mechanism of each embodiment is configured to receive an electrical audio signal and by action of a force transferring component applies an excitation action force on the diaphragm assembly in response to the signal. During operation, an associated reaction force is typically also exhibited by the associated transducer base structure. In the case of the alternative acoustoelectric implementation (e.g. microphone) the transducing mechanism of each embodiment is configured to receive a force generated by the diaphragm assembly moving in response to sound waves, and by action of the force transferring component the movement is converted into an electrical audio signal.

The transducing mechanism thus comprises a force transferring component. Most preferably this part of the transducer is rigidly connected to the diaphragm structure or assembly, since this configuration tends to be more optimal for creation of a more accurately single-degree-of-freedom system thereby minimising unwanted resonance modes.

Alternatively the force transferring component is rigidly connected to the diaphragm via one or more intermediate components, and the force transferring component is in close proximity to the diaphragm body or structure in order to improve the rigidity of the combined structure and so that adverse resonance modes associated with those couplings are pushed higher in frequency. Preferably the distance between the force transferring component and the diaphragm structure or body in any one of the above embodiments is less than 75% of the maximum dimension of a major face (such as the length, but could alternatively be the width) of the diaphragm structure or body. More preferably the distance is less than 50%, even more preferably less than 35% or yet more preferably less than 25% of the maximum dimension of the diaphragm body or structure.

Preferably the connecting structure has a Young's modulus of greater than 8 GPa, or more preferably higher than approximately 20 GPa, again, to help ensure rigidity of the structure.

Electromagnetic excitation mechanisms comprising a magnetic field generating structure and an electrically conductive coil or element are highly linear. They are therefore a preferred form of transducing/excitation mechanism to be used with each of the above described embodiments of the present invention. They provide an advantage when used in combination with resonance-control features of the present invention, being that the quality of audio reproduction is maximised via a linear motor combined with a substantially resonance-free structure. Preferably the coil is fixed on the diaphragm side, since coils can be made to be lightweight and hence can less detrimental to diaphragm break-up resonances. Coil and magnet-based motors also provide high power handling, and they can be made to be robust.

Other excitation mechanisms may work well, depending upon the application, for example, a piezoelectric or a magnetostrictive transducing mechanism and these could alternatively be incorporated in any one of the embodiments of the present invention. Piezoelectric motors can be effective when used in combination with pure hinge systems and/or rigid diaphragm features according to the present invention, for example. In rotational action transducers, such as those described in relation to embodiments A, E, K, S and T such transducing mechanisms can be located close to the axis of rotation where the usual low excursion disadvantage of piezoelectric devices is mitigated by the fact that a small excursion near the base causes a large excursion towards the diaphragm distal periphery or tip. Additionally, piezoelectric motors may be inherently resonance-free to a high degree, and lightweight, which means that there is reduced load on the diaphragm which might otherwise accentuate diaphragm resonance modes.

5. Audio Transducer Applications

The audio transducer embodiments described in this specification may be configured for implementation in a large variety of audio devices. An example have been given in relation to embodiment K. Whilst this may be a preferred implementation in relation to that embodiment, it is not the only implementation and many others are also applicable.

Each of the audio transducer embodiments can be scaled to a size that performs the desired function. For example, the audio transducer embodiments of the invention may be incorporated in any one of the following audio devices, without departing from the scope of the invention:

- Personal audio devices including headphones, earphones, hearing aids, mobile phones, personal digital assistants and the like;
- Computing devices including personal desktop computers, laptop computers, tablets and the like;
- Computer interface devices including computer monitors, speakers and the like;
- Home audio devices, including floor-standing speakers, television speakers and the like;
- Car audio systems; and
- Other specialty audio devices.

Furthermore, the frequency range of the audio transducer can be manipulated in accordance with a given design to achieve the desired results. For example, an audio transducer of any one of the above embodiments may be used as a bass driver, a mid-range-treble driver, a tweeter or a full-range driver depending on the desired application.

An brief example of how the embodiment A audio transducer embodiment may be configured for various applications will be give below, however, as will be understood by those skilled in the art this is not intended to be limiting and many other possible configurations, applications and implementations are envisaged for this embodiment as well as every other embodiment described herein.

In one implementation, the audio transducer of embodiment A, for instance, may have a diaphragm body length of approximately 15 mm, for example, and designed to reproduce mid-range and treble frequencies, from 300 Hz to 20 kHz, in the two way headphone illustrated FIG. 10B (loudspeaker audio transducer H301). The same transducer could also be deployed as a mid-range-treble loudspeaker audio transducer for a home audio floor-standing speaker, for example reproducing the band of frequencies between 700 Hz and above, or, it could also be optimised to act as a full-range driver in a 1-way headphone.

The audio transducer of embodiment A can be scaled in size to fit a variety of applications. For example, FIG. 10B shows a bass loudspeaker audio transducer H302, which is an enlarged embodiment A audio transducer (in all dimensions) with respect to the mid-range and treble driver H301. The enlarged audio transducer may have a diaphragm length of about 32 mm, for example. In such a case, the transducer H302 may be capable of moving more air with a lower fundamental frequency of around 40 Hz. The transducer H302 may be suitable for reproducing frequencies up to around 4000 Hz. This driver would also be suitable for a mid-range driver of a home audio floor standing speaker, for example reproducing the band of frequencies between 100 Hz and 4000 Hz. Further approximate scaling (of all dimensions) to a diaphragm length of approximately 200 mm, for example, could result in a driver having substantially resonance-free bandwidth from 20 Hz to around 1000 Hz, or higher in some cases, with high volume excursion capability. This configuration would be suitable for a subwoofer for a home audio floor-stander for example.

Figure 11A:
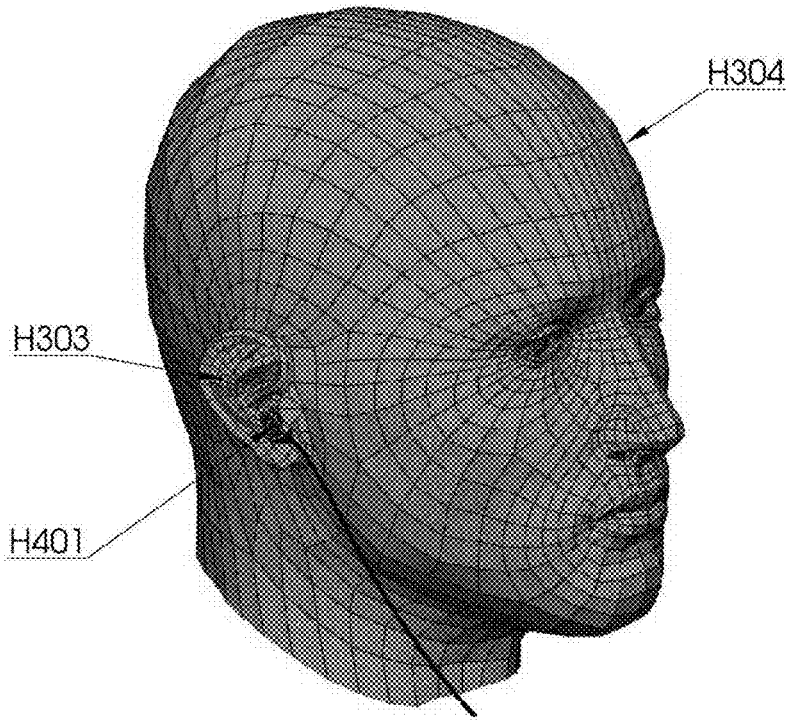
FIG. 11A shows a 3D view of a human head wearing a bud earphone one full range driver on the right ear. The loudspeaker driver used is similar to the one shown in FIGS. 5A-M.
Figure 11B:
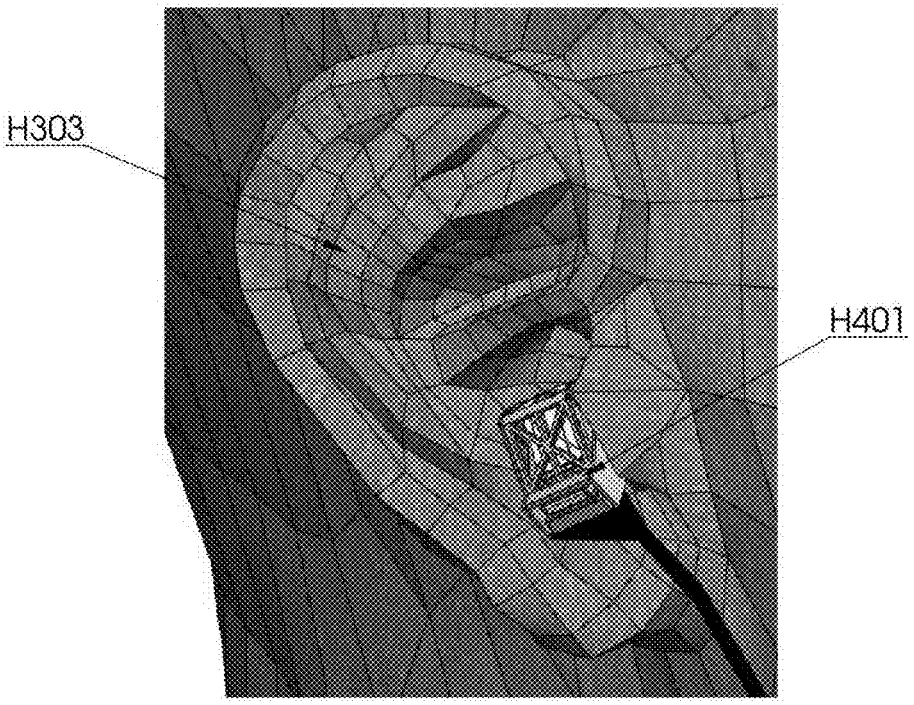
FIG. 11B shows the same image as in FIG. 11A, except it is a close-up view of the ear with the loudspeaker driver inside it.

If driver dimensions were scaled down such that the diaphragm length of the embodiment A audio transducer was about 8 mm, for example, the transducer may be deployed in a 1-way bud earphone similar to that illustrated in FIGS. 11A and 11B.

Referring to FIGS. 30A-D, yet another implementation of the embodiment A audio transducer, may be a loudspeaker system Z100 which may be a personal computer speaker unit, for example. In this audio device embodiment two or more audio transducer are incorporated in the same enclosure Z104. A first relatively smaller version of the embodiment A transducer Z101 is provided as a treble driver and a second relatively larger audio transducer Z102 is provided as a bass-midrange driver. Both units may be decoupled from the enclosure via a decoupling system as described under section 2.2.4 of this specification. The enclosure Z104 may comprise a plurality of rubber or other substantially soft feet Z105 distributed about the base of the enclosure to further decouple the enclosure from the supporting surface Z106.

The above provides examples of the versatility of the embodiments of the invention, and it would be readily apparent to those skilled in the art that other implementations are possible for embodiment A, or any other audio transducer embodiment either described in this specification or derivable from the description provided herewith.

The foregoing description of the invention includes preferred embodiments audio transducer and audio device embodiments. The description also includes various embodiments, examples and principles of design and construction of other systems, assemblies, structures, devices, methods and mechanisms relating to audio transducers. Many modifications to the audio transducer embodiments and to the other related systems, assemblies, structures, devices, methods and mechanisms disclosed herein may be made, as would be apparent to those skilled in the relevant art, without departing from the spirit and scope of the invention as defined by the accompanying claims.

That which is claimed:

1. An audio device comprising:

a housing;

an audio transducer mounted within the housing and having: a diaphragm, a hinge coupled to the diaphragm for enabling rotational oscillation of the diaphragm about an axis of rotation during operation and having a resilient member, and a transducing mechanism operatively coupled to the diaphragm;

a structure closely associated with and surrounding the diaphragm; and the diaphragm having an outer periphery that is at least partially free from physical connection with the surrounding structure; and a pair of complementary stopper surfaces including a first stopper surface coupled to or integrally formed with the diaphragm at or proximal to the axis of rotation and a second stopper surface coupled to or integrally formed with the surrounding structure, and wherein:

in a neutral position of the diaphragm, the first and second stopper surfaces are spaced, and a shortest distance between the first and second stopper surfaces along a first axis is substantially equal to or smaller than a shortest distance between a terminal end of the diaphragm opposing the axis of rotation and the surrounding structure along a second axis, the first axis is substantially aligned with or substantially parallel to the second axis, and the second axis is substantially perpendicular to the axis of rotation, and extends through the terminal end of the diaphragm and through the axis of rotation.

2. An audio device as claimed in claim 1 wherein the diaphragm comprises one or more peripheral regions that are free from physical connection with the surrounding structure and the outer periphery is significantly free from physical connection such that the one or more peripheral regions constitute at least 20% of a length or perimeter of the periphery.

3. An audio device as claimed in claim 1 wherein all regions of the outer periphery of the diaphragm that move a significant distance during normal operation are approximately entirely free from physical connection with the surrounding structure.

4. An audio device as claimed in claim 1 wherein all regions of the outer periphery of the diaphragm that are distal from the axis of rotation of the diaphragm are approximately entirely free from physical connection with the surrounding structure.

5. An audio device as claimed in claim 1 wherein a relatively small air gap separates the surrounding structure and the one or more peripheral regions of the diaphragm, such that a width of the air gap defined by the distance between each peripheral region and the surrounding structure is less than approximately 1.5 mm.

6. An audio device as claimed in claim 1 wherein the diaphragm comprises a relatively lower mass, per unit area of a radiating surface of the diaphragm, at one or more regions of the diaphragm distal to a centre of mass location of the diaphragm, relative to a mass per unit area at a region of the diaphragm adjacent the centre of mass location.

7. An audio device as claimed in claim 1 wherein the diaphragm comprises a relatively lower mass relative to a mass at or adjacent a region of the diaphragm directly acted upon by the transducing mechanism.

8. An audio device as claimed in claim 1 wherein the diaphragm comprises a diaphragm body formed from a foam material.

9. An audio device as claimed in claim 1 wherein the diaphragm comprises a diaphragm body having a maximum thickness that is greater than 11% of a greatest dimension of the diaphragm body.

10. An audio device as claimed in claim 1 wherein the diaphragm remains substantially rigid in use.

11. An audio device as claimed in claim 10 wherein the diaphragm comprises:

a diaphragm body having one or more major faces, and normal stress reinforcement coupled to the body, the normal stress reinforcement being coupled adjacent at least one of said major faces for resisting compression-tension stresses experienced at or adjacent the face of the body during operation.

12. An audio device as claimed in claim 11 wherein the diaphragm further comprises at least one inner reinforcement member embedded within the body and oriented at an angle relative to at least one of said major faces for resisting and/or substantially mitigating shear deformation experienced by the body during operation.

13. An audio device as claimed in claim 11 wherein the normal stress reinforcement comprises one or more elongate struts.

14. A personal audio device as claimed in claim 11 wherein the normal stress reinforcement comprises a plurality of elongate struts.

15. An audio device as claimed in claim 11 wherein a distribution of mass of the diaphragm body or a distribution of mass of the normal stress reinforcement, or both, is such that the diaphragm comprises a relatively lower mass, per unit area, at one or more low mass regions of the diaphragm most distal from a centre of mass location of the diaphragm relative to a mass, per unit area, at one or more relatively high mass regions of the diaphragm at or proximal to the centre of mass location.

16. An audio device as claimed in claim 15 wherein the normal stress reinforcement comprises a recess in the lower mass region.

17. An audio device as claimed in claim 1 wherein the transducing mechanism comprises at least one electrically conductive coil operatively coupled to at least one magnet.

18. An audio device as claimed in claim 1 wherein the transducing mechanism is located at or adjacent a centre of mass location of the associated diaphragm.

19. An audio device as claimed in claim 1 wherein the audio transducer comprises a transducer base structure to which the diaphragm is moveably coupled, and wherein the transducer base structure comprises a thick and/or squat geometry relative to the diaphragm.

20. An audio device as claimed in claim 1 wherein the comprises an enclosure or baffle.

21. An audio device as claimed in claim 1 wherein the diaphragm comprises a substantially rigid diaphragm base frame and a diaphragm body rigidly coupled to the diaphragm base frame at one end of the body.

22. An audio device as claimed in claim 21 wherein the diaphragm comprises a plurality of diaphragm bodies rigidly coupled to and extending radially from the diaphragm base frame.

23. An audio device as claimed in claim 22 wherein the hinge is coupled to the diaphragm base frame.

24. An audio device as claimed in claim 21 wherein the first stopper surface is integrally formed with or rigidly coupled to the diaphragm base frame.

25. An audio device as claimed in claim 24 wherein the first stopper surface is a substantially curved surface extending about the axis of rotation.

26. An audio device as claimed in claim 24 wherein the second stopper surface is a substantially curved surface extending about the axis of rotation.

27. An audio device as claimed in claim 21 wherein the first stopper surface extends outwardly from a side of the diaphragm that is between a pair of opposing major radiating faces of the diaphragm body.

28. An audio device as claimed in claim 21 wherein the transducing mechanism is rigidly coupled to the diaphragm base frame.

29. An audio device as claimed in claim 28 wherein the transducing mechanism comprises an electromagnetic mechanism including one or more force transferring components moveable using a magnetic field.

30. An audio device as claimed in claim 29 wherein the diaphragm is rigidly attached to the force transferring component of the transducing mechanism and the force transferring component(s) remain(s) substantially rigid in use.

31. An audio device as claimed in claim 30 wherein the force transferring component comprises a magnet.

32. An audio device as claimed in claim 29 wherein the one or more force transferring components comprises one or more conductive coil(s) curved about the axis of rotation.

33. An audio device as claimed in claim 1 comprising a second pair of complementary stopper surfaces and wherein each pair of stopper surfaces is located at one of two opposing sides of the diaphragm.

34. An audio device as claimed in claim 1 wherein the first and second stopper surfaces limit a degree of movement of the diaphragm along a third axis that is substantially perpendicular to the axis of rotation and to the second axis.

35. An audio device as claimed in claim 1 wherein the resilient member is configured to resiliently bias the diaphragm in a neutral position with respect to translational movement at least along the second axis.

36. An audio device as claimed in claim 1 wherein the first and second stopper surfaces are substantially concentric and have a common axis that is substantially aligned with the axis of rotation.

* * * * *